US006604973B2

(12) United States Patent
Nishida et al.

(10) Patent No.: US 6,604,973 B2
(45) Date of Patent: Aug. 12, 2003

(54) FLASH DISCHARGE TUBE AND METHOD FOR PRODUCING THE SAME

(75) Inventors: Shouji Nishida, Minamiashigara (JP); Hideaki Takeuchi, Minamiashigara (JP); Tsutomu Tobita, Minamiashigara (JP); Tatuya Isomura, Minamiashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 265 days.

(21) Appl. No.: 09/846,194

(22) Filed: May 2, 2001

(65) Prior Publication Data

US 2001/0041491 A1 Nov. 15, 2001

Related U.S. Application Data

(62) Division of application No. 09/210,667, filed on Dec. 14, 1998, now Pat. No. 6,268,697.

(30) Foreign Application Priority Data

Dec. 16, 1997 (JP) ..... 9-346422
Feb. 13, 1998 (JP) ..... 10-30893

(51) Int. Cl.[7] ..... H01J 9/00; H05B 33/10; B05D 5/12

(52) U.S. Cl. ..... 445/26; 445/28; 427/126.3; 427/126.2; 427/271

(58) Field of Search ..... 445/26, 28, 58; 427/106, 271, 126.3, 126.2

(56) References Cited

U.S. PATENT DOCUMENTS

| | | | | |
|---|---|---|---|---|
| 3,727,089 A | | 4/1973 | Chow | 313/176 |
| 4,303,554 A | * | 12/1981 | Sudo et al. | 252/519.3 |
| 4,369,208 A | * | 1/1983 | Okunaka et al. | 427/558 |
| 4,941,070 A | | 7/1990 | Ogawa et al. | 313/594 |
| 5,169,672 A | * | 12/1992 | Harima et al. | 427/458 |

FOREIGN PATENT DOCUMENTS

| | | | |
|---|---|---|---|
| JP | 357138772 | 6/1982 | 313/610 |
| JP | 60-141065 | 9/1985 | H01J/61/35 |

* cited by examiner

*Primary Examiner*—Sandra O'Shea
*Assistant Examiner*—Peter Macchiarolo
(74) *Attorney, Agent, or Firm*—Sughrue Mion, PLLC

(57) ABSTRACT

In an anode-side assembling process, a first end of a glass tube is fused to a rearward end of an electrode bar secured to an anode-side lead to produce a primary sealed product. In a cathode-side assembling process, a ring-shaped cathode is secured by caulking to a forward end portion of an electrode bar secured to a forward end of a cathode-side lead to produce a cathode member. In an assembling process, a second end of the glass tube of the primary sealed product is fused to a rearward end of the electrode bar secured to the cathode-side lead of the cathode member to produce a xenon discharge tube. A trigger electrode, which is composed of a transparent conductive film, is formed on a surface of the glass tube so that the light-transmissive sealed tube-coating ratio specified by the transparent conductive film is within a range of 5 to 30%.

12 Claims, 73 Drawing Sheets

10
16
12
14
34a
36
W
34b
38

Lia
Lic
ΔAC
18
20
22
24
26
28
30
32
40
42
44
58
60
62
64

FIG. 46

PRODUCTION HISTORY TABLE

| | | |
|---|---|---|
| 0 RECORD | 1/0 | LEAD WIRE LENGTH |
| | 1/0 | TUBE DIAMETER |
| | 1/0 | PRESENCE OR ABSENCE OF LIGHT EMISSION OR LIGHT EMISSION INTENSITY (VOLTAGE VALUE) |
| 1 RECORD | 1/0 | LEAD WIRE LENGTH |
| | 1/0 | TUBE DIAMETER |
| | 1/0 | PRESENCE OR ABSENCE OF LIGHT EMISSION OR LIGHT EMISSION INTENSITY (VOLTAGE VALUE) |
| 2 RECORD | 1/0 | LEAD WIRE LENGTH |
| | 1/0 | TUBE DIAMETER |
| | 1/0 | PRESENCE OR ABSENCE OF LIGHT EMISSION OR LIGHT EMISSION INTENSITY (VOLTAGE VALUE) |
| | | ⋮ |

FLASH DISCHARGE TUBE AND METHOD FOR PRODUCING THE SAME

This is a divisional of application Ser. No. 09/210,667 filed Dec. 14, 1998, now U.S. Pat. No. 6,268,697 the disclosure of which is incorporated herein by reference.

BACKGROUND OF THE INVENTION

1. Field of the Invention

The present invention relates to a flash discharge tube to be used, for example, to take a photograph, wherein the flash discharge tube comprises a trigger electrode composed of a transparent conductive film formed on a surface of a light-transmissive sealed tube made of a material such as glass. The present invention also relates to a method for producing the flash discharge tube.

2. Description of the Related Art

A flash discharge tube, which has been hitherto used, for example, to take a photograph, comprises a noble gas such as xenon enclosed in a columnar glass tube provided with a cathode electrode and an anode electrode disposed at both ends of the glass tube. The flash discharge tube further comprises a trigger electrode composed of a transparent conductive film containing a major component of tin oxide or the like formed on an outer circumferential surface of the glass tube.

In order to provide a means for improving the light emission efficiency of such a flash discharge tube, the present applicant has previously proposed a technique in which all or almost all of an area of the flash discharge tube for directly irradiating a photographic subject is formed with a portion in which no transparent conductive material is applied (see Japanese Laid-Open Utility Model Publication No. 60-141065). It has been demonstrated for the flash discharge tube concerning the proposed technique described above that the amount of light, which is obtained, for example, when only a back surface of the discharge tube is coated with the transparent conductive material, is increased by about 7% as compared with the amount of light which is obtained when the entire surface of the discharge tube is coated.

The flash discharge tube itself is extremely minute, and it is necessary to enclose the cathode and the anode in the glass tube together with the xenon gas. For this reason, in the conventional technique, when the flash discharge tube is produced, the entire production step is subdivided into a number of steps. Operations in the respective subdivided steps have been manually performed. Therefore, a problem arises in that the improvement in production efficiency of the flash discharge tube involves a limit as a matter of course.

SUMMARY OF THE INVENTION

The present invention has been made as a result of diligent investigations performed by the present applicant to follow the proposed technique, concerning the relationship between the light emission efficiency and the coating condition of the transparent conductive material. An object of the present invention is to provide a flash discharge tube and a method for producing the same excellent in light emission reliability so that a sufficient amount of light is obtained.

Another object of the present invention is to provide a method for producing the flash discharge tube, which makes it possible to realize fully automatic steps of producing the flash discharge tube, and achieve improvement in production efficiency of the flash discharge tube.

The above and other objects, features, and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 46 illustrates contents of a production history table;

DESCRIPTION OF THE PREFERRED EMBODIMENTS

Figure 1:
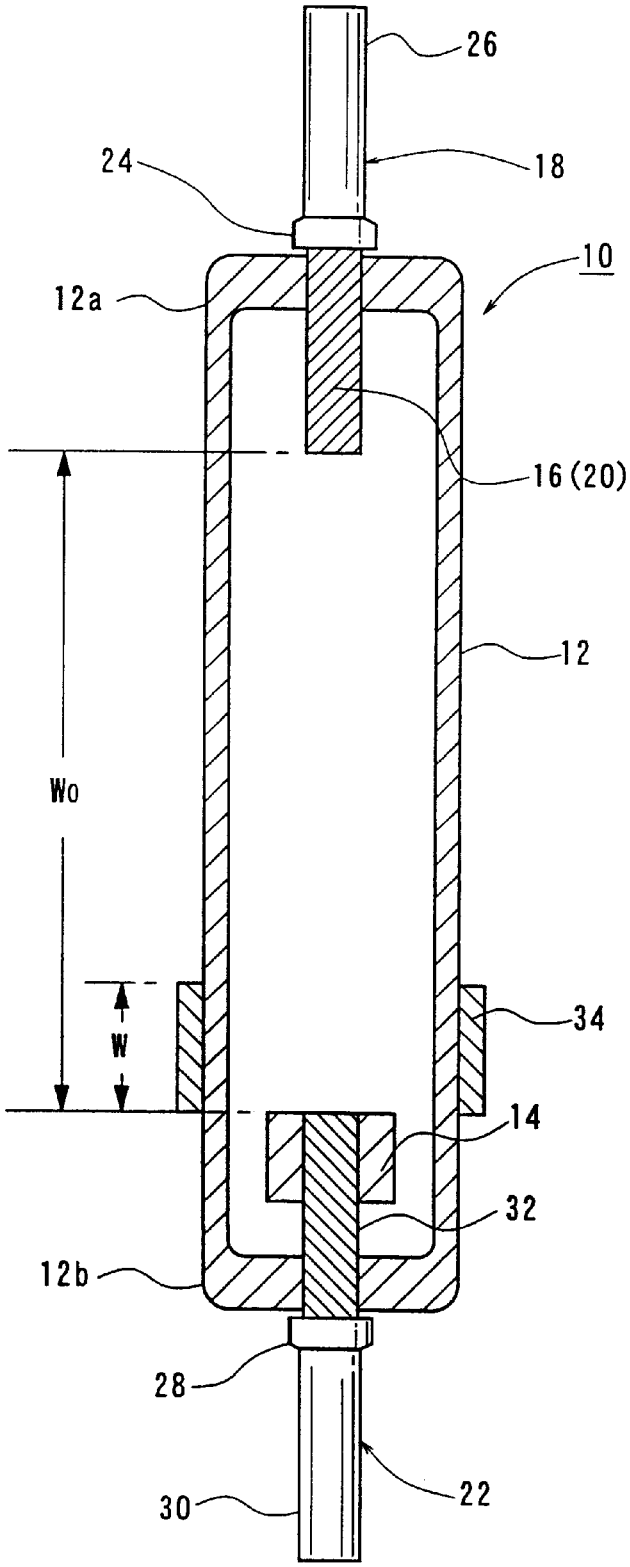
FIG. 1 shows a schematic sectional view illustrating a xenon discharge tube according to an embodiment of the present invention.

Before everything, the flash discharge tube according to the present invention lies in a flash discharge tube comprising a trigger electrode composed of a transparent conductive film formed on a surface of a light-transmissive sealed tube, wherein a light-transmissive sealed tube-coating ratio specified by the transparent conductive film is within a range of 5 to 30%.

The light-transmissive sealed tube-coating ratio herein refers to a value which is represented, in percentage, by a ratio between a coating area of the light-transmissive sealed tube coated with the transparent conductive film, and a surface area of the light-transmissive sealed tube defined between surface positions on the light-transmissive sealed tube located on cross sections identically perpendicular in the axial direction to respective forward ends of both electrodes of a cathode electrode and an anode electrode provided at both ends coaxially with the central axis of the light-transmissive sealed tube.

The light-transmissive sealed tube is composed of a material which is preferably glass. However, there is no limitation thereto. The transparent conductive film is made of a material which is preferably a solution of an organic metal compound containing a major component of indium or tin. The material is heat-treated to form the transparent conductive film containing a major component of oxide of indium ($In_2O_3$+$SnO_2$) or a major component of oxide of tin ($SnO_2$+$Sb_2O_3$). The coating film containing a major component of oxide of indium is called "ITO film". It is noted that the present invention is not especially limited to the use of the materials described above.

Accordingly, it is possible to obtain the flash discharge tube having high light emission reliability in which the amount of light is increased as compared with the conventional flash discharge tube, the minimum light emission voltage, at which continuous light emission can be effected under a certain condition, is not increased, and the acceptance ratio is excellent in the continuous light emission test under a certain condition. The contents of the method or the like for testing the light emission reliability will be described later on.

It is preferable for the flash discharge tube according to the present invention that the light-transmissive sealed tube is coated with the transparent conductive film in a band-shaped configuration so that the light-transmissive sealed tube-coating ratio is not less than 5% toward a center in an axial direction starting from a portion near to a surface position on the light-transmissive sealed tube on an identical cross section perpendicular in the axial direction to a forward end of a cathode electrode provided coaxially with a central axis of the light-transmissive sealed tube at one end of the light-transmissive sealed tube. In other words, the transparent conductive film is formed in the area in the vicinity of the forward end of the cathode electrode, in the band-shaped configuration, corresponding to at least the amount of 5% of the light-transmissive sealed tube-coating ratio. Thus, it is possible to obtain the effect of the present invention as described above.

The method for producing the flash discharge tube according to the present invention lies in a method for producing a flash discharge tube comprising a trigger electrode composed of a transparent conductive film formed on a surface of a light-transmissive sealed tube, the method comprising the steps of coating the surface of the light-transmissive sealed tube in accordance with an immersion method with a solution of an organic metal compound containing a major component metal of indium or tin as a transparent conductive material, drying the surface followed by allowing hot air to blow against only a portion for forming the transparent conductive film, of a coating layer of the transparent conductive material to perform local calcination by oxidizing indium or tin contained in the transparent conductive material, and then removing a non-calcinated portion of the transparent conductive material by means of etching with an acidic solution to form the transparent conductive film in a band-shaped configuration on the surface of the light-transmissive sealed tube. The type of the hot air is not specifically limited provided that the hot air is an oxygen-containing gas. However, it is convenient and preferable to use air.

Accordingly, it is possible to easily form the band-shaped transparent conductive film on the surface of the light-transmissive sealed tube, and it is possible to preferably obtain the flash discharge tube according to the present invention. In the method described above, the hot air is allowed to locally blow against only the portion to be calcinated of the coating layer of the transparent conductive material formed on the surface of the light-transmissive sealed tube. Therefore, it is possible to avoid oxidation of the lead terminal of the flash discharge tube, and it is possible to avoid heating loss of the cesium component in the cathode electrode.

In the method for producing the flash discharge tube according to the present invention, when the anode electrode or the cathode electrode is provided at one of both ends of the light-transmissive sealed tube by means of a sealing treatment prior to the formation of the band-shaped transparent conductive film on the surface of the light-transmissive sealed tube, an annealing treatment is performed in vacuum or in an inert gas atmosphere after the formation of the transparent conductive film. Thus, it is possible to further increase the conductivity of the transparent conductive film, which is preferred.

On the other hand, when the anode electrode or the cathode electrode is provided at one of both ends of the light-transmissive sealed tube by means of a sealing treatment after the formation of the band-shaped transparent conductive film on the surface of the light-transmissive sealed tube, the application of the sealing treatment simultaneously causes the application of the annealing treatment for the transparent conductive film. Accordingly, it is possible to obtain an effect that the conductivity of the transparent conductive film is improved without specially performing the annealing treatment for the transparent conductive film.

Explanation will be made below with reference to FIGS. 1 to 75 for an illustrative embodiment in which the flash discharge tube according to the present invention is applied to a xenon discharge tube (hereinafter referred to as "xenon discharge tube according to the embodiment") and for an illustrative embodiment in which the method for producing the flash discharge tube according to the present invention is applied to the xenon discharge tube (hereinafter referred to as "production method according to the embodiment").

As shown in FIG. 1, the xenon discharge tube 10 produced by the production method according to the embodiment of the present invention comprises a cathode 14 and an anode 16 arranged mutually oppositely in a glass tube 12 enclosed with xenon gas.

The anode 16 is constructed by a forward end portion of anode-side lead 18 made of metal, or it is constructed by another metal member, i.e., an anode bar (electrode bar) 20 secured to the forward end of the anode-side lead 18. The cathode 14 has a ring-shaped configuration, and it is secured by caulking to a forward end portion of a cathode-side lead 22.

Especially, in this embodiment, both of the anode-side lead 18 and the cathode-side lead 22 are composed of nickel. An inner end 24 (welded section) of the anode-side lead 18 has its diameter which is set to be slightly larger than a diameter of an outer lead 26 of the anode-side lead 18. The anode bar 20 made of metal (for example, made of tungsten), which constructs the anode 16, is secured to an end surface thereof.

An inner end 28 (welded section) of the cathode-side lead 22 has its diameter which is also set to be slightly larger than a diameter of an outer lead 30 of the cathode-side lead 22. An electrode bar (cathode bar) 32 made of, for example, tungsten for supporting the cathode 14 is secured to an end surface thereof. The ring-shaped cathode 14 is secured, for example, by caulking to the forward end portion of the cathode bar 32.

A first end 12*a* of the glass tube 12 is fused to a rearward end portion of the anode bar 20 secured to the anode-side lead 18. A second end 12*b* of the glass tube 12 is fused to a rearward end portion of cathode bar 32 secured to the cathode-side lead 22.

The surface of the glass tube 12 is coated with a transparent conductive film 34 in a band-shaped configuration from a position on the surface of the glass tube 12 corresponding to the forward end of the cathode 14 to a predetermined surface position. Thus, the xenon discharge tube 10 according to the embodiment of the present invention is constructed.

Figures 2A, 2B, 2C, 2D, 2E:
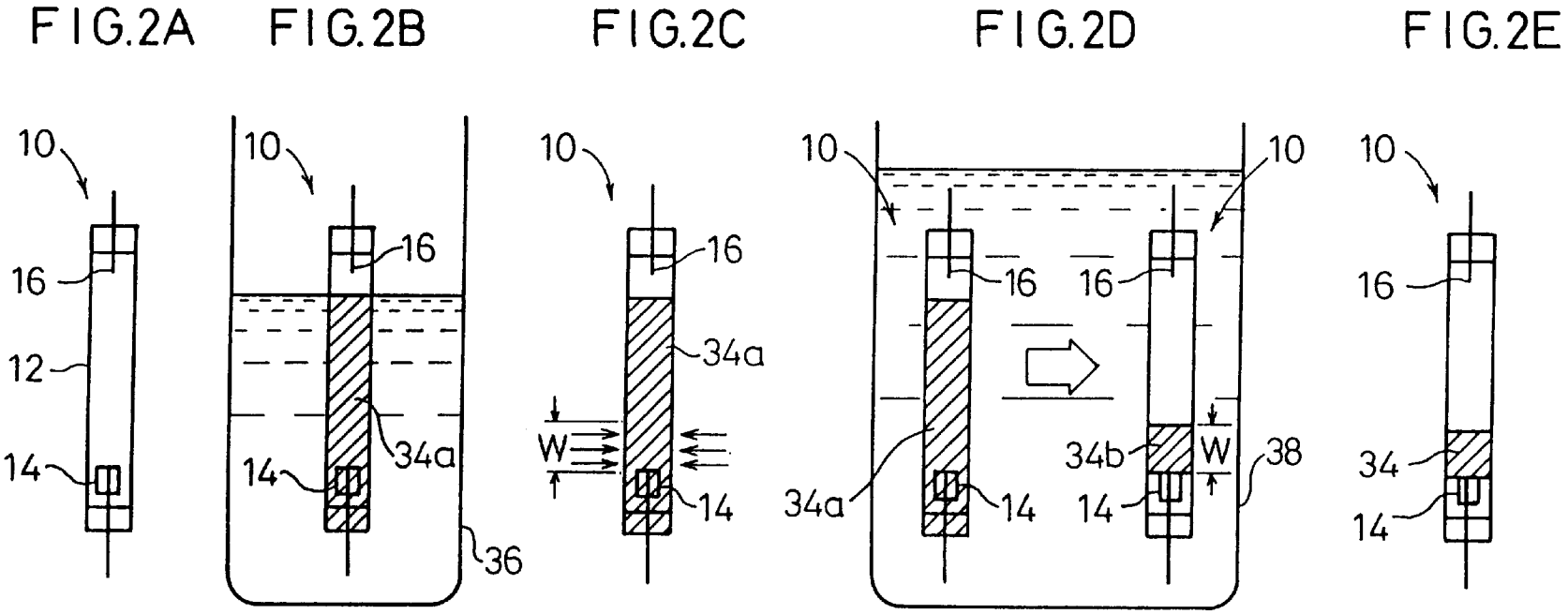
FIG. 2A shows a schematic profile of the xenon discharge tube comprising a cathode and an anode formed by a sealing process at both ends of a glass tube.
FIG. 2B illustrates a step of immersing the xenon discharge tube shown in FIG. 2A in a solution of a transparent conductive material to perform application therewith.
FIG. 2C illustrates a step of allowing hot air to blow against a portion of the xenon discharge tube shown in FIG. 2B on which a transparent conductive film is intended to be formed.
FIG. 2D illustrates a step of etching-processing the xenon discharge tube shown in FIG. 2C by using an acidic solution, in which the left half depicts a state before the treatment, and the right half depicts a state after the treatment.
FIG. 2E illustrates a step of annealing-processing the transparent conductive film formed on the xenon discharge tube shown in FIG. 2D.

A method for forming the transparent conductive film 34 will be explained with reference to FIGS. 2A to 2E. At first, as shown in FIG. 2A, the xenon discharge tube 10 is prepared, in which the cathode 14 and the anode 16 are provided at the both ends of the glass tube 12 by means of the sealing treatment. Details of a specified method for producing the xenon discharge tube will be described later on.

Subsequently, as shown in FIG. 2B, a bath 36 is prepared, which is filled with a solution of an organic metal compound containing a major component metal of indium. The xenon discharge tube 10 is immersed in the bath 36 with the cathode 14 disposed downward up to a position at which the anode 16 is not immersed. The xenon discharge tube 10 is pulled up at a pull up speed of about 10 mm/s. Thus, a coating film 34*a* of the solution is applied to the xenon discharge tube 10. The coating film 34*a* is dried, for example, for about 5 minutes in an atmosphere at a temperature of about 60° C. in an unillustrated drying step. After that, as indicated by arrows in FIG. 2C, for example, the air at a temperature of about 500° C. is allowed to locally blow for about 20 seconds in an amount of about 2 liters-air/$cm^2$-transparent conductive material/sec against only the coating film 34*a* existing in a range from the upper end of the cathode 14 of the xenon discharge tube 10 to a predetermined height (W). Thus, the indium in the solution is oxidized and calcinated.

As shown in FIG. 2D, a bath 38 is prepared, which is filled with 1 normal hydrochloric acid aqueous solution. The entire xenon discharge tube 10 is immersed in the bath 38 for about 30 seconds. Accordingly, the coating film 34*a* on the xenon discharge tube 10 is dissolved in the hydrochloric acid aqueous solution in the bath 38, and it is removed. However, only a part of the coating film 34*b* remains, which corresponds to the oxidized portion in the vicinity of the cathode 14 previously heated by the high temperature air. After that, the xenon discharge tube 10 is washed with water in an unillustrated washing step with water, followed by drying. Thus, the band-shaped transparent conductive film 34 having a predetermined width (W) is completely formed on the surface of the xenon discharge tube 10.

Preferably, as shown in FIG. 2E, the xenon discharge tube 10 is subsequently heated to apply an annealing treatment, for example, at a temperature of about 200° C. for about 20 minutes in vacuum or in an inert gas atmosphere. Thus, it is possible to improve the conductivity of the transparent conductive film 34.

The following process may be available in place of the method for forming the transparent conductive film described above. That is, an operation is performed to seal the cathode 14 and the anode 16 at the both ends of the glass tube 12 in the final step after the formation of the transparent conductive film 34. In this process, the sealing operation also effects the annealing treatment for the transparent conductive film 34.

Alternatively, when the xenon discharge tube 10 is immersed in the bath 36 shown in FIG. 2B, the following procedure may be adopted. That is, the xenon discharge tube 10 is immersed in the bath 36 up to a position corresponding to the first position for forming the film of the transparent conductive film 34, and then the xenon discharge tube 10 is pulled up therefrom. Thus, the first end of the coating film 34*a* of the solution is decided at the position corresponding to the first position for forming the film of the transparent conductive film 34. In other words, the first position for forming the film of the transparent conductive film 34 is decided during the immersing process.

After that, the following procedure may be adopted. That is, the unillustrated drying process is carried out, and then the hot air is allowed to locally blow against the coating film 34*a*. Further, the xenon discharge tube 10 is immersed in the bath 38 filled with the 1 normal hydrochloric acid aqueous solution, up to a position corresponding to the second position for forming the film of the transparent conductive film 34, and then the xenon discharge tube 10 is pulled up therefrom. Thus, the band-shaped transparent conductive film 34 having the predetermined width (W) is formed on the surface of the xenon discharge tube 10.

Next, explanation will be made below with reference to FIGS. 3 to 6 for an evaluation method and evaluation results for the light emission characteristic of the xenon discharge tube 10 according to the embodiment of the present invention.

Figure 3:
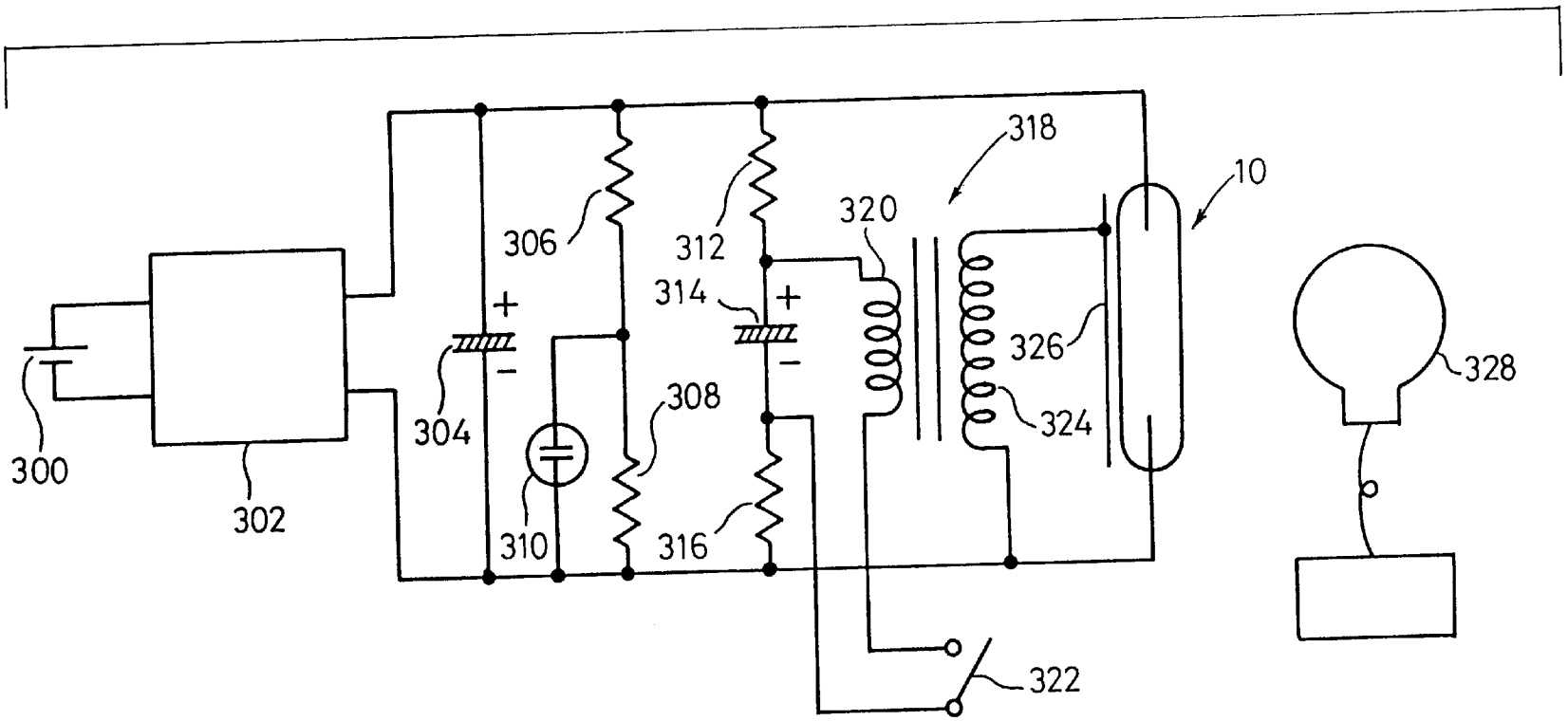
FIG. 3 shows a basic circuit diagram to be used to evaluate the light emission characteristic of the xenon discharge tube according to an embodiment of the present invention.

The light emission characteristic of the xenon discharge tube 10 is evaluated by constructing a basic circuit shown in FIG. 3. That is, the basic circuit 3 comprises a dry cell or battery 300 as a power source and a DC-DC converter 302 for raising the voltage of the battery 300. A main capacitor 304 is connected to the DC-DC converter 302. The main capacitor 304 is further connected in parallel with a voltage divider circuit comprising a resistor 306 and a resistor 308. A pilot lamp 310 is connected between a voltage division point and the ground line. The main capacitor 304 is further connected in parallel with a series circuit comprising a trigger capacitor 314 and a resistor 316, and it is connected with the pair of electrodes of the xenon discharge tube 10. One end of a primary winding 320 of a trigger coil 318 is connected to one end of the trigger capacitor 314. The other end of the trigger capacitor 314 and the other end of the primary winding 320 are connected to a switch 322. A secondary winding 324 of the trigger coil 318 is connected to a trigger electrode 326 composed of the transparent conductive film.

When an unillustrated power source switch is turned on, then the voltage of the main capacitor 304 is raised to several hundreds V, and the system is ready for light emission. Subsequently, when the switch 322 is turned on, a pulse of several kV is generated on the secondary winding 324 of the trigger coil 318. The pulse is applied to the trigger electrode 326 to induce electric discharge, and the xenon discharge tube 10 emits light. The light emission is continuously repeated when the switch 322 is turned on and off. In order to measure the amount of light emission, an integrating sphere 328 as a light-receiving element is provided so that it is opposed to the xenon discharge tube 10.

The light emission characteristic was evaluated for the following three items. As for the amount of light, the main capacitor 304 having a capacitance of 100 $\mu$F, which was included in the basic circuit for the xenon discharge tube 10, was charged with 230 V to cause light emission. The amount of light was measured by using the integrating sphere 328. An obtained result was converted into a guide number (light amount). The evaluation was made by using an average value obtained from ten xenon discharge tubes 10.

As for the minimum light emission voltage, the voltage was raised by every 5 V starting from a voltage of 140 V for the main capacitor 304 having a capacitance of 100 $\mu$F. In this procedure, a minimum voltage, which was obtained when light emission occurred continuously five times, was designated as the minimum light emission voltage. The evaluation was made by using an average value obtained from ten xenon discharge tubes 10 as well.

As for the acceptance ratio in the continuous light emission test, the main capacitor 304 having a capacitance of 170 $\mu$F, which was included in the basic circuit for the xenon discharge tube 10, was charged with 320 V to continuously cause light emission three hundreds times at intervals of 20 seconds. Those caused light emission all three hundreds times were accepted. Ten xenon discharge tubes 10 were subjected to the test at respective preset voltages to determine the ratio of an accepted number of them.

The xenon discharge tubes 10 used as the evaluation objectives had light-transmissive sealed tube-coating ratios ($(W/W_0)\times$circumferential length of glass tube$\times 100$ as shown in FIG. 1) of 100%, 54%, 23.0%, 15.4%, 7.7%, 3.8%, and 0%. Evaluation results for the respective evaluation items are shown in FIGS. 4 to 6.

Figure 4:
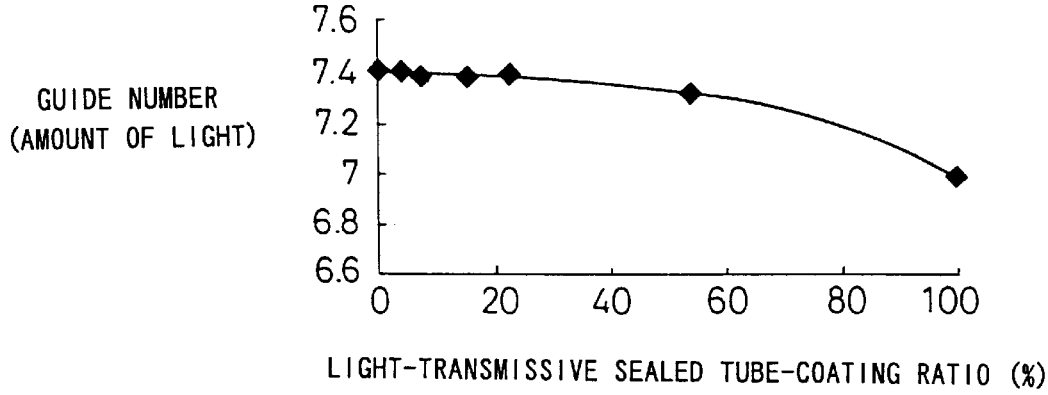
FIG. 4 shows a graph illustrating a relationship between the light-transmissive sealed tube-coating ratio and the amount of light of the xenon discharge tube according to the embodiment of the present invention.

The guide number (amount of light) shown in FIG. 4 was remarkably increased as the light-transmissive sealed tube-coating ratio was decreased. The result was equivalent to that obtained in the preceding knowledge, for example, in that the guide number was increased by about 5% in the xenon discharge tube 10 in which the light-transmissive sealed tube-coating ratio was 50% as compared with the xenon discharge tube 10 in which the light-transmissive sealed tube-coating ratio was 100%. However, according to the present result, it has been found that the gradually increasing tendency continues up to a point at which the light-transmissive sealed tube-coating ratio is less than 5%, in a range in which the light-transmissive sealed tube-coating ratio is further small as compared with those in the preceding proposal.

Figure 5:
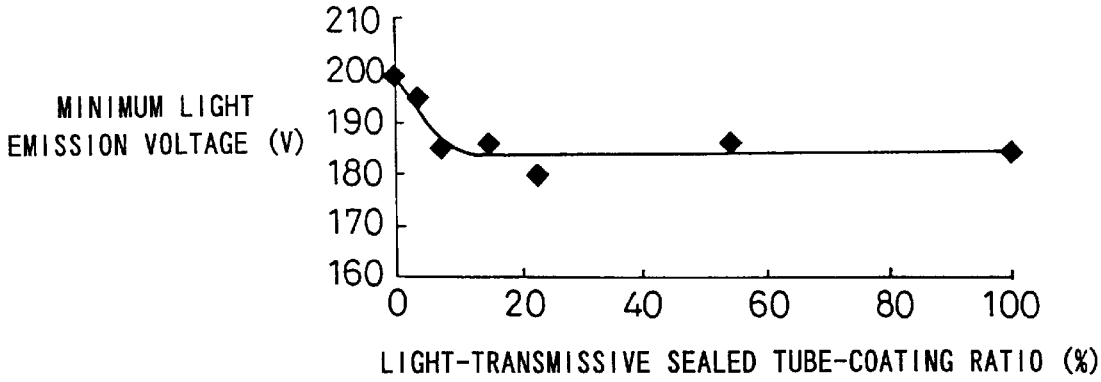
FIG. 5 shows a graph illustrating a relationship between the light-transmissive sealed tube-coating ratio and the minimum light emission voltage for the xenon discharge tube according to the embodiment of the present invention.

The minimum light emission voltage shown in FIG. 5 is maintained at an approximately equivalent level even when the light-transmissive sealed tube-coating ratio is decreased up to 5%. However, it has been found that the minimum light emission voltage suddenly increases when the light-transmissive sealed tube-coating ratio is further decreased below 5%.

Figure 6:
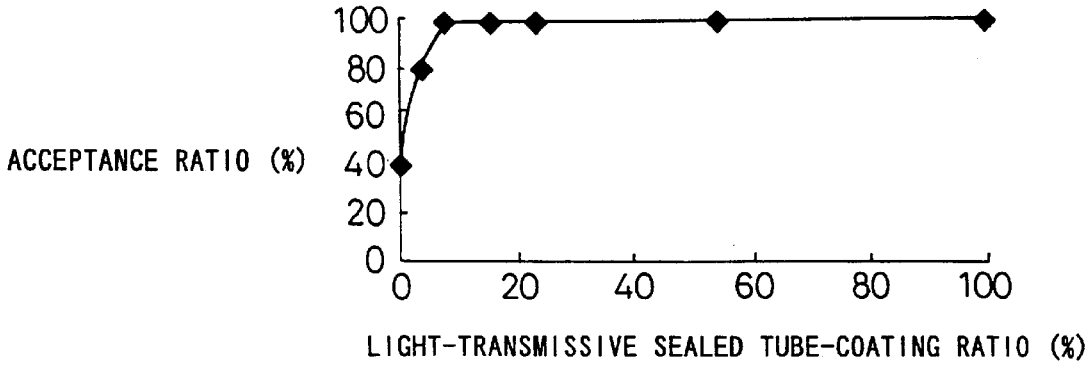
FIG. 6 shows a graph illustrating a relationship between the light-transmissive sealed tube-coating ratio and the acceptance ratio in the continuous light emission test performed for the xenon discharge tube according to the embodiment of the present invention.

The acceptance ratio in the continuous light emission test shown in FIG. 6 is maintained to be 100% even when the light-transmissive sealed tube-coating ratio is decreased up to 5%. However, it has been found that the acceptance ratio suddenly decreases when the light-transmissive sealed tube-coating ratio is further decreased below 5%.

When the respective evaluation results described above are comprehensively judged, it has been revealed that the light-transmissive sealed tube-coating ratio, which is defined by the transparent conductive film 34, is preferably within a range of 5 to 30% in order to ensure a sufficient amount of light and obtain a xenon discharge tube having high light emission reliability.

Next, a method for producing the xenon discharge tube according to the embodiment of the present invention will be explained with reference to a block diagram depicting steps shown in FIG. 7.

Figure 7:
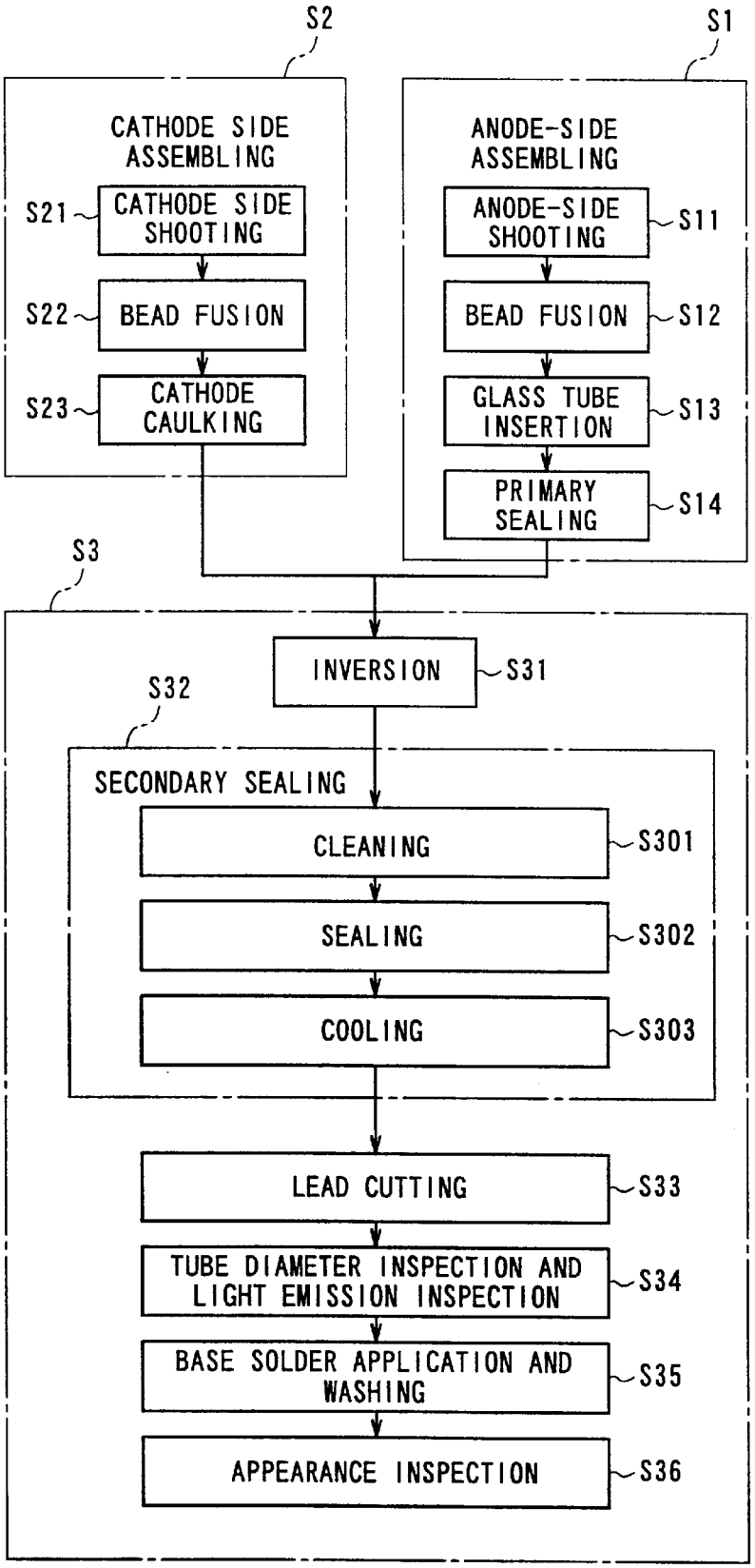
FIG. 7 shows a block diagram depicting steps of a method for producing the xenon discharge tube according to the embodiment of the present invention.

The production method according to the embodiment of the present invention is carried out as shown in FIG. 7. That is, in an anode-side assembling process S1, the first end 12*a* of the glass tube 12 is fused to the rearward end portion of the anode bar 20 which is secured to the anode-side lead 18 to produce a primary sealed product 72 (see FIG. 30B). In a cathode-side assembling process S2, the ring-shaped cathode 14 is secured by caulking to the forward end portion of the cathode bar 32 which is secured to the forward end of the cathode-side lead 22 to produce a cathode member 74 (see FIG. 27). In an assembling process S3, the second end 12*b* of the glass tube 12 of the primary sealed product 72 is fused to the rearward end portion of the cathode bar 32 which is secured to the cathode-side lead 22 of the cathode member 74 to produce a secondary sealed product 80. After that, the secondary sealed product 80 is subjected to various inspections to finally produce the xenon discharge tube 10.

Figure 8:
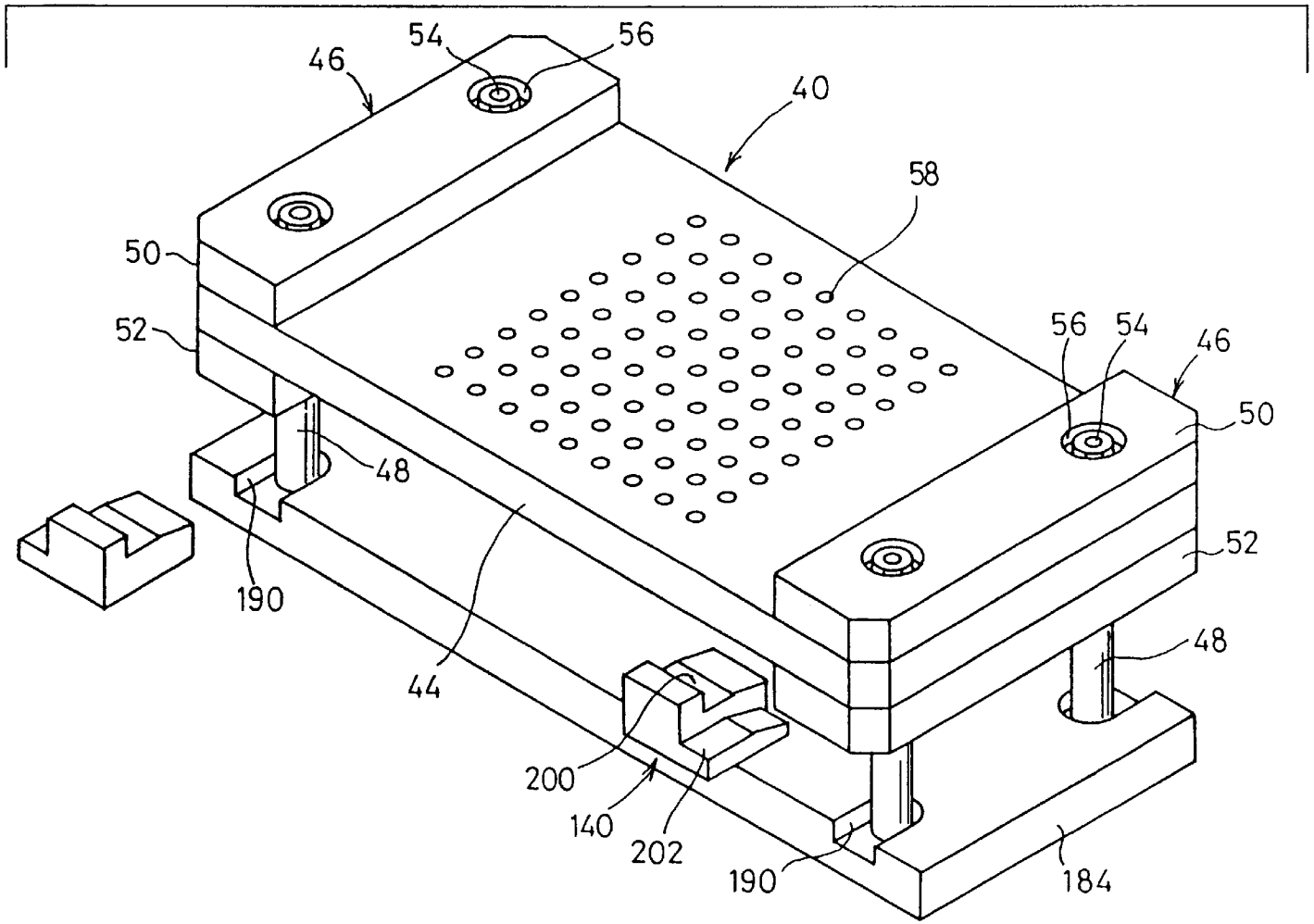
FIG. 8 shows a perspective view illustrating a structure of an anode-side sealing jig used in the production method according to the embodiment of the present invention.
Figure 9:
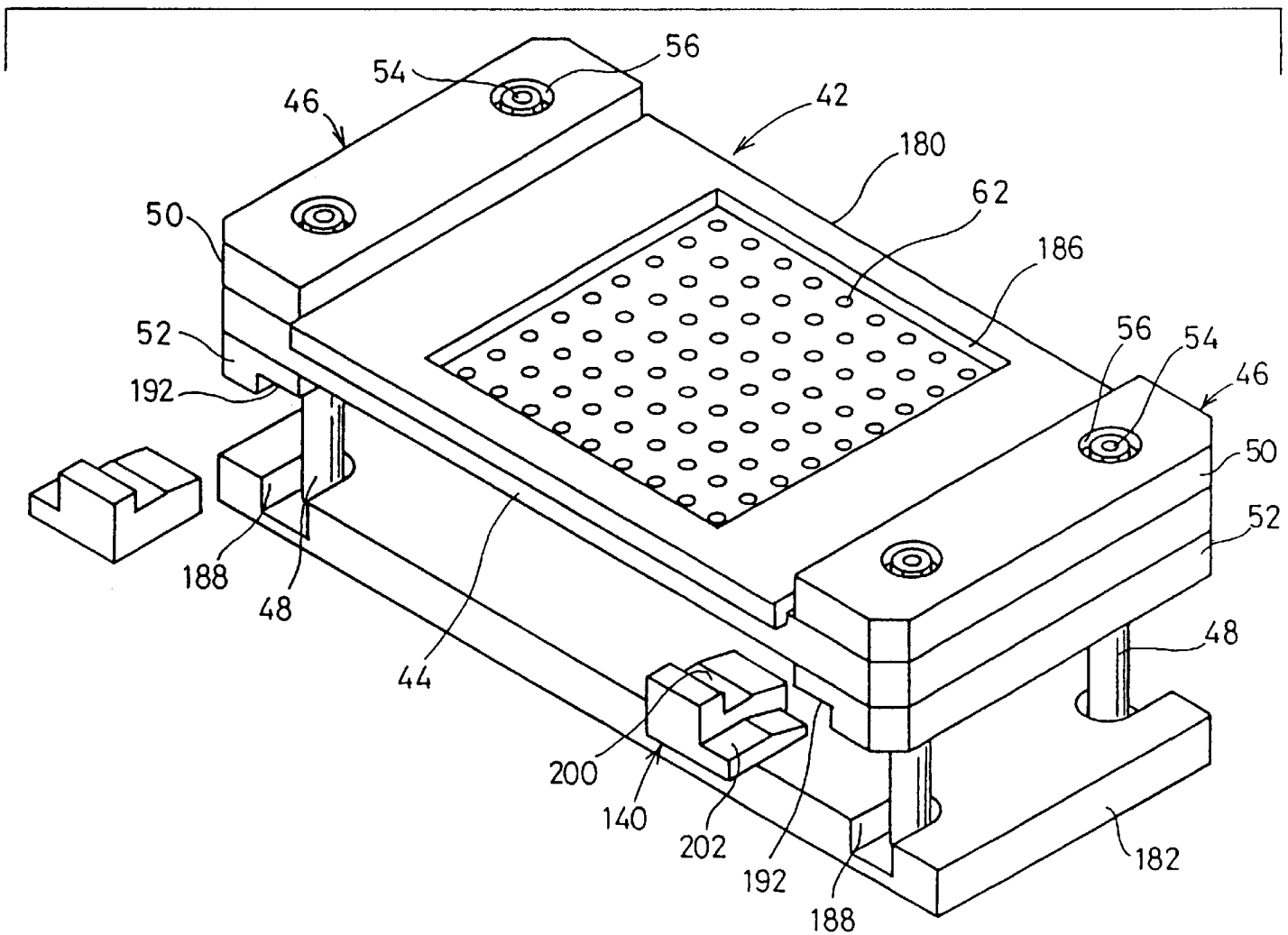
FIG. 9 shows a perspective view illustrating a structure of a cathode-side sealing jig used in the production method according to the embodiment of the present invention.

Especially, in the production method according to the embodiment of the present invention, an anode-side sealing jig 40 shown in FIG. 8 is used to produce the primary sealed product 72 in the anode-side assembling process S1. An cathode-side sealing jig 42 shown in FIG. 9 is used to produce the secondary sealed product 80 in the assembling process S3.

Each of the anode-side sealing jig 40 and the cathode-side sealing jig 42 comprises a plate-shaped main heater body 44, attachment members 46 for positioning and installing the main heater body 44, for example, in a station of the production equipment, and a plurality of (for example, four of) legs 48 for supporting the main heater body 44. The attachment members 46 are provided at both ends of the main heater body 44, each of which has upper and lower support plates 50, 52 for interposing the end of the sealing jig 40, 42. Bolt insertion holes 56 are provided through the support plates 50, 52 and the main heater body 44 for vertically inserting bolts 54 therethrough. The bolts 54 are inserted into the bolt insertion holes 56, and they are screwed into the legs 48. Thus, the main heater body 44 is constructed into each of the sealing jigs 40, 42 supported by the four legs 48 respectively.

Figures 10A, 10B:
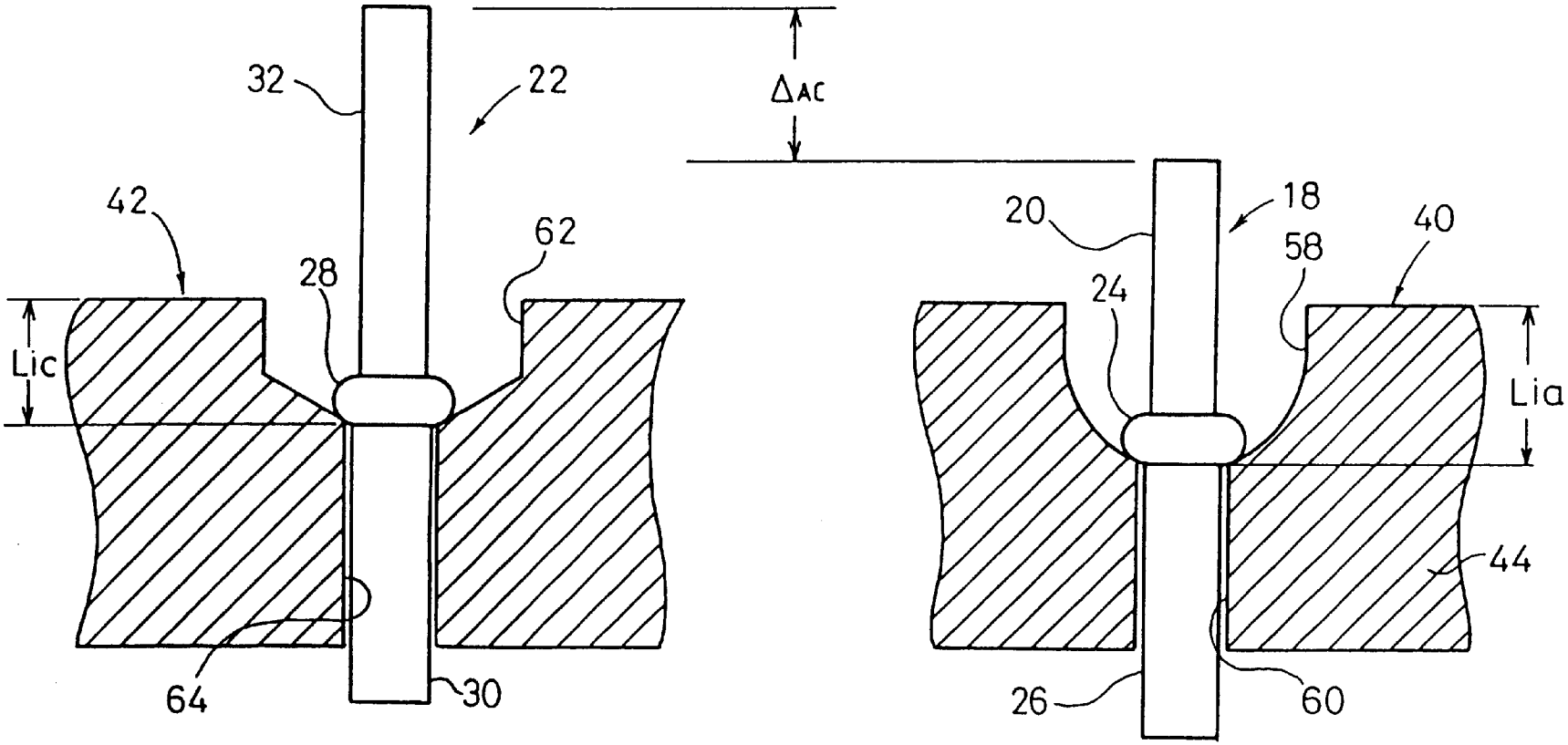
FIG. 10A shows a sectional view illustrating a state in which a cathode-side lead is shot into the cathode-side sealing jig.
FIG. 10B shows a sectional view illustrating a state in which an anode-side lead is shot into the anode-side sealing jig.

As also shown in FIG. 10B, the main heater body 44 of the anode-side sealing jig 40 is provided with a large number of (for example, 500 individuals of) recesses 58, for example, in a matrix form on its first principal surface so that the first ends 12*a* of the glass tubes 12 are insertable thereinto. A lead insertion hole 60, which penetrates through the main heater body 44 up to its second principal surface and into which the outer lead 26 of the anode-side lead 18 is insertable, is provided at a bottom central portion of each of the recesses 58.

Similarly, as also shown in FIG. 10A, the main heater body 44 of the cathode-side sealing jig 42 is provided with a large number of (for example, 500 individuals of) recesses 62, for example, in a matrix form on its first principal surface so that the second ends 12*b* of the glass tubes 12 are insertable thereinto. A lead insertion hole 64, which penetrates through the main heater body 44 up to its second principal surface and into which the outer lead 30 of the cathode-side lead 22 is insertable, is provided at a bottom central portion of each of the recesses 62.

Figure 11A:
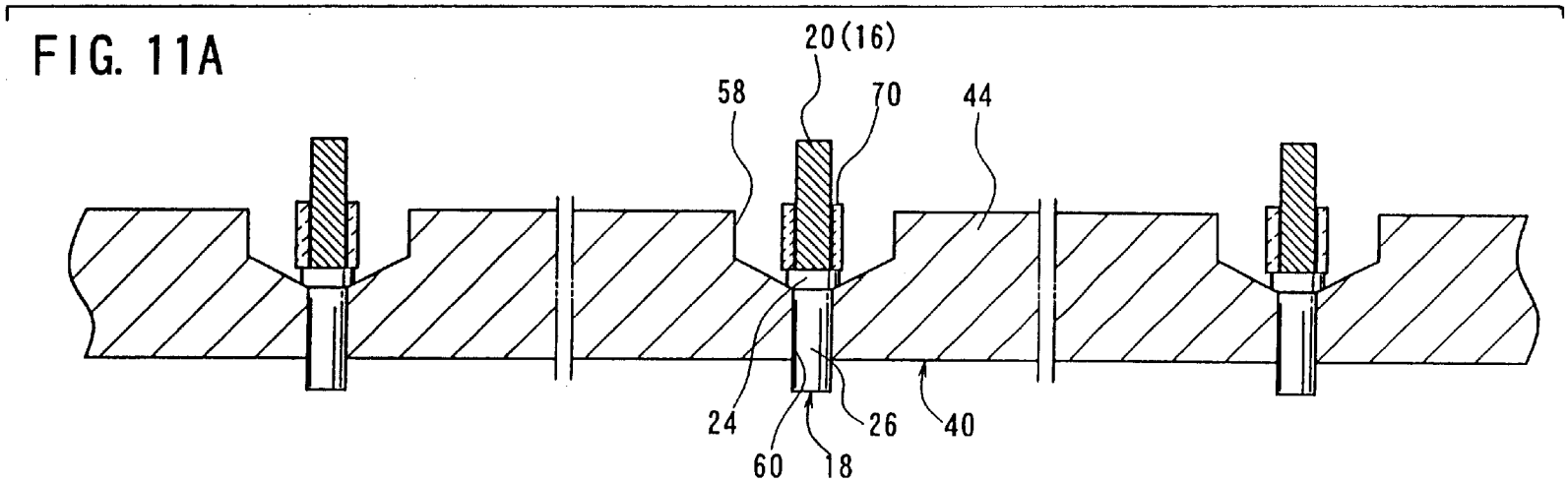
FIG. 11A shows a production step illustrating an anode-side shooting step in an anode-side assembling process.

The production method according to the embodiment of the present invention will now be specifically explained. At first, the anode-side assembling process S1 will be explained. In the first anode-side shooting step S11, a shooting system as described later on is used to insert the anode-side leads 18 into the respective lead insertion holes 60 of the anode-side sealing jig 40 respectively as shown in FIG. 11A.

In this procedure, the diameter of the welded section 24 of the anode-side lead 18 is processed to be larger than that of the outer lead 26 so that the diameter is larger than the diameter of the lead insertion hole 60. Therefore, the anode bar 20, which is secured to the forward end portion (welded section) 24 of the anode-side lead 18, is necessarily positioned within the recess 58. Further, each of the anode-side leads 18 is in a state in which its axial direction is aligned with the vertical direction.

The method for inserting the anode-side lead 18 includes, for example, two methods. One of the methods is based on, for example, the use of a part feeder so that a large number of anode-side leads 18 are aligned and supplied to the anode-side shooting step S11. The large number of aligned and supplied anode-side leads 18 are successively inserted into the respective lead insertion holes 60 of the anode-side sealing jig 40 by using an inserting mechanism. The other is a method in which a large number of anode-side leads 18, which are placed in a tray, are inserted into the respective lead insertion holes 60 of the anode-side sealing jig 40.

Any one of the foregoing methods is used to insert the large number of anode-side leads 18 into the respective lead insertion holes 60 of the anode-side sealing jig 40. After that, a ring-shaped glass bead 70 is inserted into the anode bar 20 of each of the anode-side leads 18 in a state in which the anode-side leads 18 are inserted into the respective lead insertion holes 60. The glass bead 70 has its diameter which is set to be larger than the diameter of the anode bar 20 and smaller than the diameter of the forward end portion 24 of the anode-side lead 18. Therefore, the glass bead 70 is placed on the forward end portion 24 of the anode-side lead 18 so that the proximal portion of the anode bar 20 is surrounded thereby. Those adoptable as the method for inserting the glass bead 70 into the anode bar 20 include the same methods as those used to insert the anode-side lead 18 into the lead insertion hole 60 of the anode-side sealing jig 40.

Next, explanation will be made with reference to FIGS. 12 to 14 for the shapes of the anode-side lead 18, the cathode-side lead 22, the glass bead 70, and the glass tube 12.

It is assumed that the diameter of the anode bar 20 and the cathode bar 32 of the anode-side lead 18 and the cathode-side lead 22 is dw, the diameter of the outer lead 26, 30 is dn, and the diameter of the welded section 24, 28 is dy. The following relationship is satisfied.

$$dw<dn<dy \text{ or } dw=dn<dy$$

For example, it is preferable to give (dw, dn, dy)=(0.6 mm, 0.8 mm, 1.1 mm).

Figure 12A:
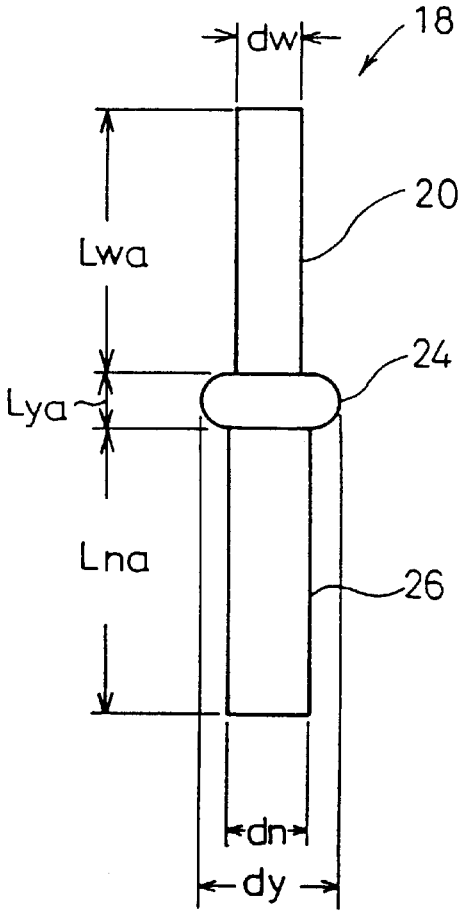
FIG. 12A shows a side view illustrating a shape of the anode-side lead.
Figure 12B:
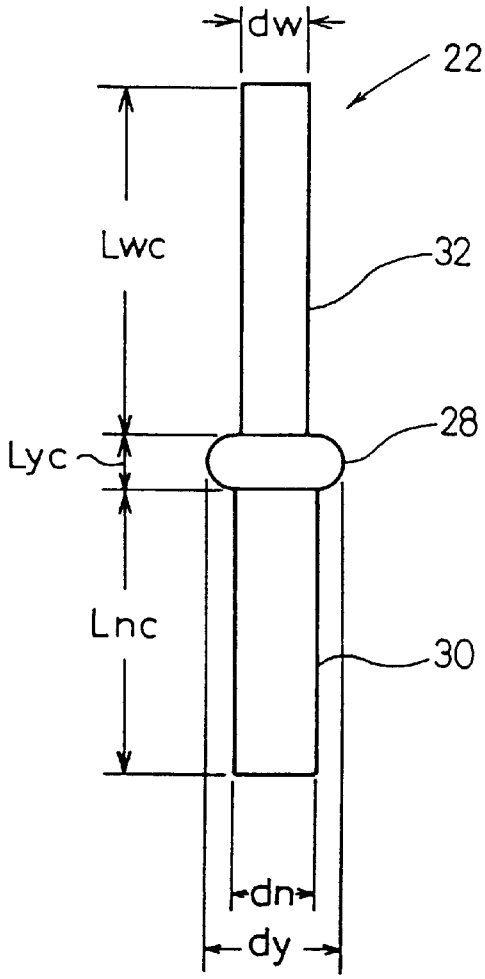
FIG. 12B shows a side view illustrating a shape of the cathode-side lead.
Figure 13B:
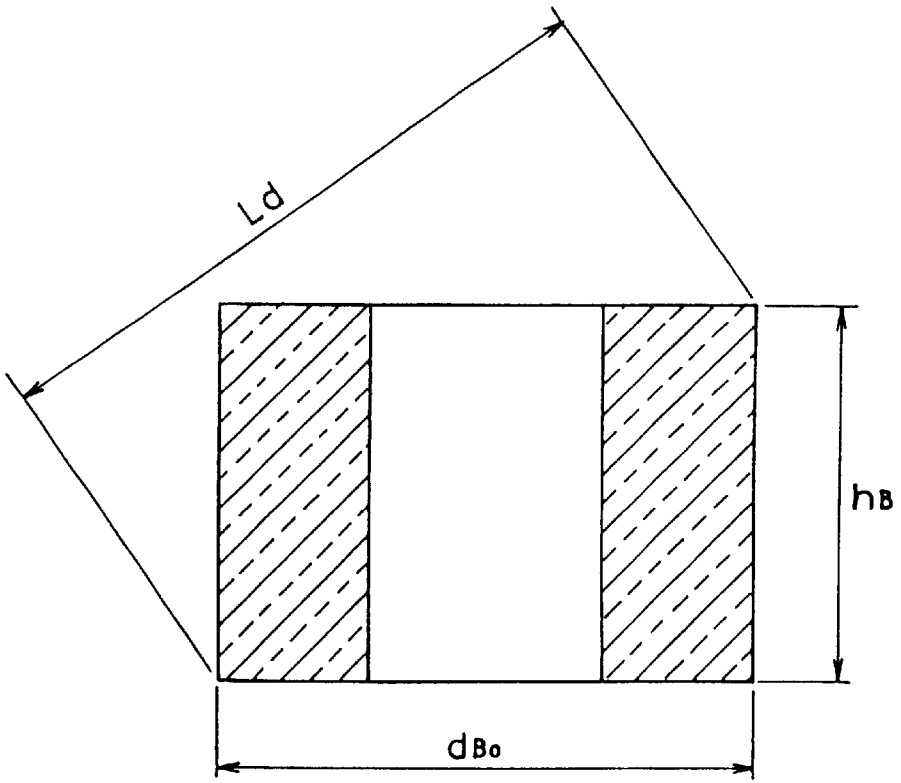
FIG. 13B shows a longitudinal sectional view illustrating the glass bead, taken along its axis as a center.

Since the cathode 14 is secured to the forward end portion of the cathode bar 32, the cathode bar 32 is generally formed to be longer than the anode bar 20 as shown in FIGS. 12A and 12B. In other words, assuming that the length of the anode bar 20 is Lwa and the length of the cathode bar 32 is Lwc, a relationship of Lwa<Lwc is satisfied. The lengths Lna, Lnc of the respective outer leads 26, 30 of the anode-side lead 18 and the cathode-side lead 22 are approximately the same length (Lna=Lnc). The lengths Lya, Lyc of the respective welded sections 24, 28 of the anode-side lead 18 and the cathode-side lead 22 are also approximately the same.

Figure 13A:
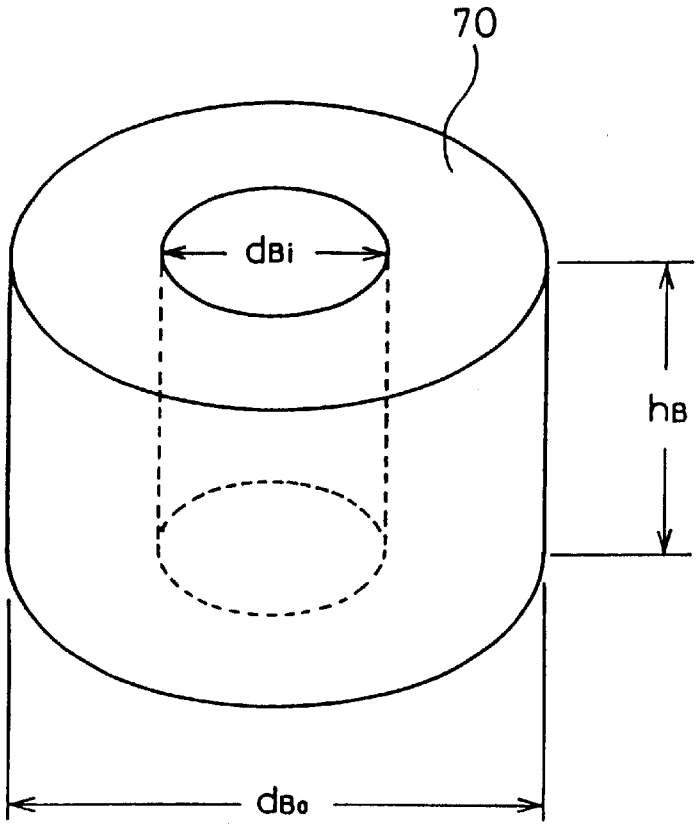
FIG. 13A shows a perspective view illustrating a shape of a glass bead.

As shown in FIG. 13A, the glass bead 70 is formed to have a ring-shaped configuration. The outer diameter $d_{Bo}$ of the glass bead 70 is set to have a dimension capable of inserting into the hollow portion of the glass tube 12, and the inner diameter $d_{Bi}$ thereof is set to have a dimension capable of insertion of the anode bar 20 and the cathode bar 32 thereinto. The height of the glass bead 70 is represented by $h_B$ as shown in FIG. 13A, and the length of the diagonal line of the longitudinal cross section taken along the axis as the center is represented by Ld.

Figure 14:
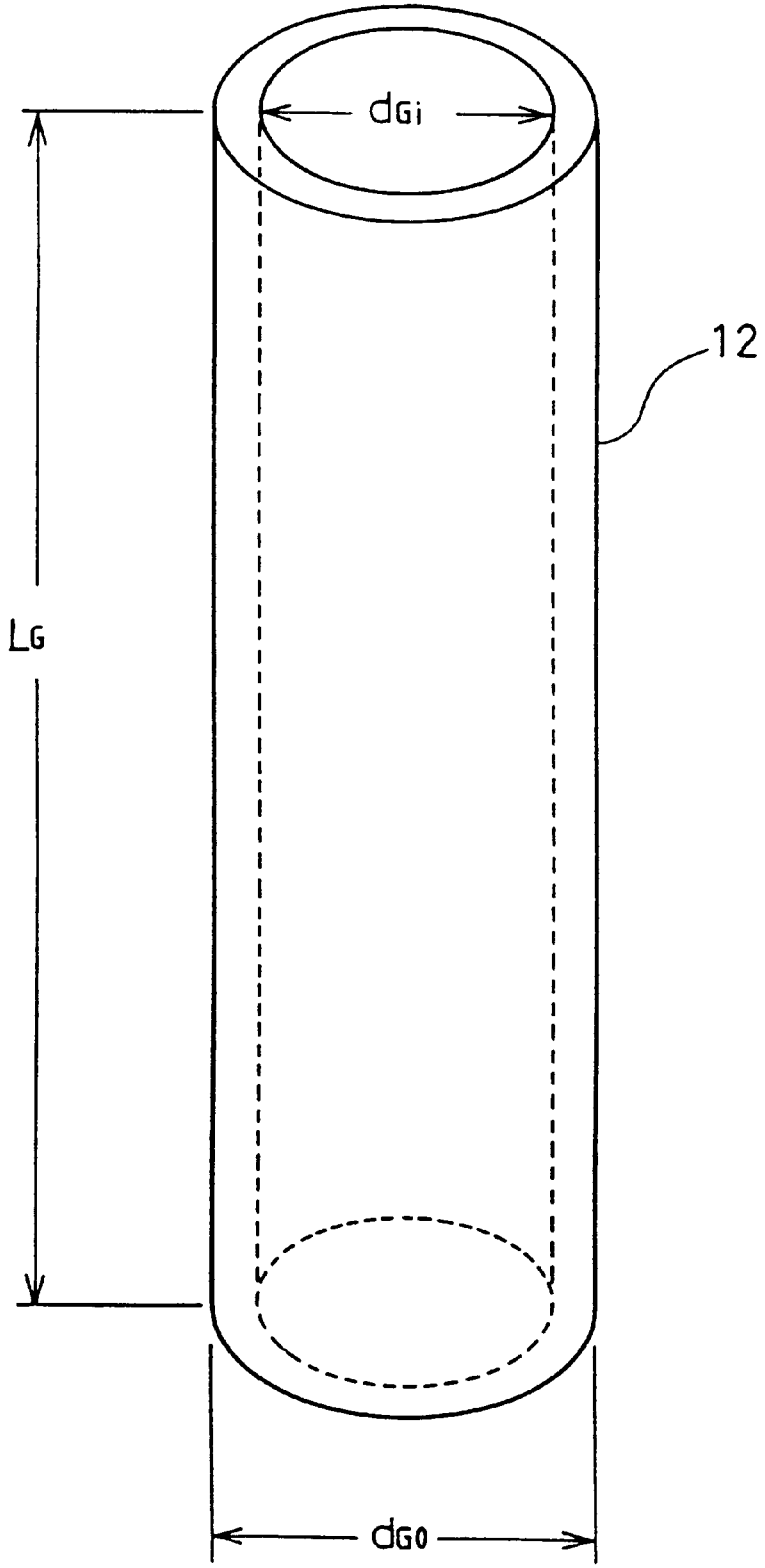
FIG. 14 shows a perspective view illustrating a shape of a glass tube.

As shown in FIG. 14, the glass tube 12 is formed to have a substantially cylindrical configuration. The length $L_G$ of the glass tube 12 is arbitrarily set depending on the purpose of use of the xenon discharge tube 10. The inner diameter $d_{Gi}$ of the glass tube 12 has a dimension capable of insertion of the glass bead 70 and the cathode 14 thereinto. The outer diameter of the glass tube 12 is represented by $d_{Go}$.

Next, explanation will be made for the shooting system to be used in the anode-side shooting step S11 (and the cathode-side shooting step S21 as described later on).

Those used for the shooting system include the anode-side sealing jig 40 and the cathode-side sealing jig 42 described above as well as a lead wire tray 90 (see FIG. 15) for storing a large number of anode-side leads 18 or a large number of cathode-side leads 22, a bead tray 92 (see FIG. 16) for storing a large number of glass beads 70, a lead wire-shooting jig 94 (see FIG. 17) for receiving a necessary number of anode-side leads 18 or cathode-side leads 22 from the lead wire tray 90 and shooting them into the anode-side sealing jig 40 or the cathode-side sealing jig 42, and a bead-shooting jig 96 (see FIG. 18) for receiving a necessary number of glass beads 70 from the bead tray 92 and shooting them into the anode-side sealing jig 40 or the cathode-side sealing jig 42.

Figure 15:
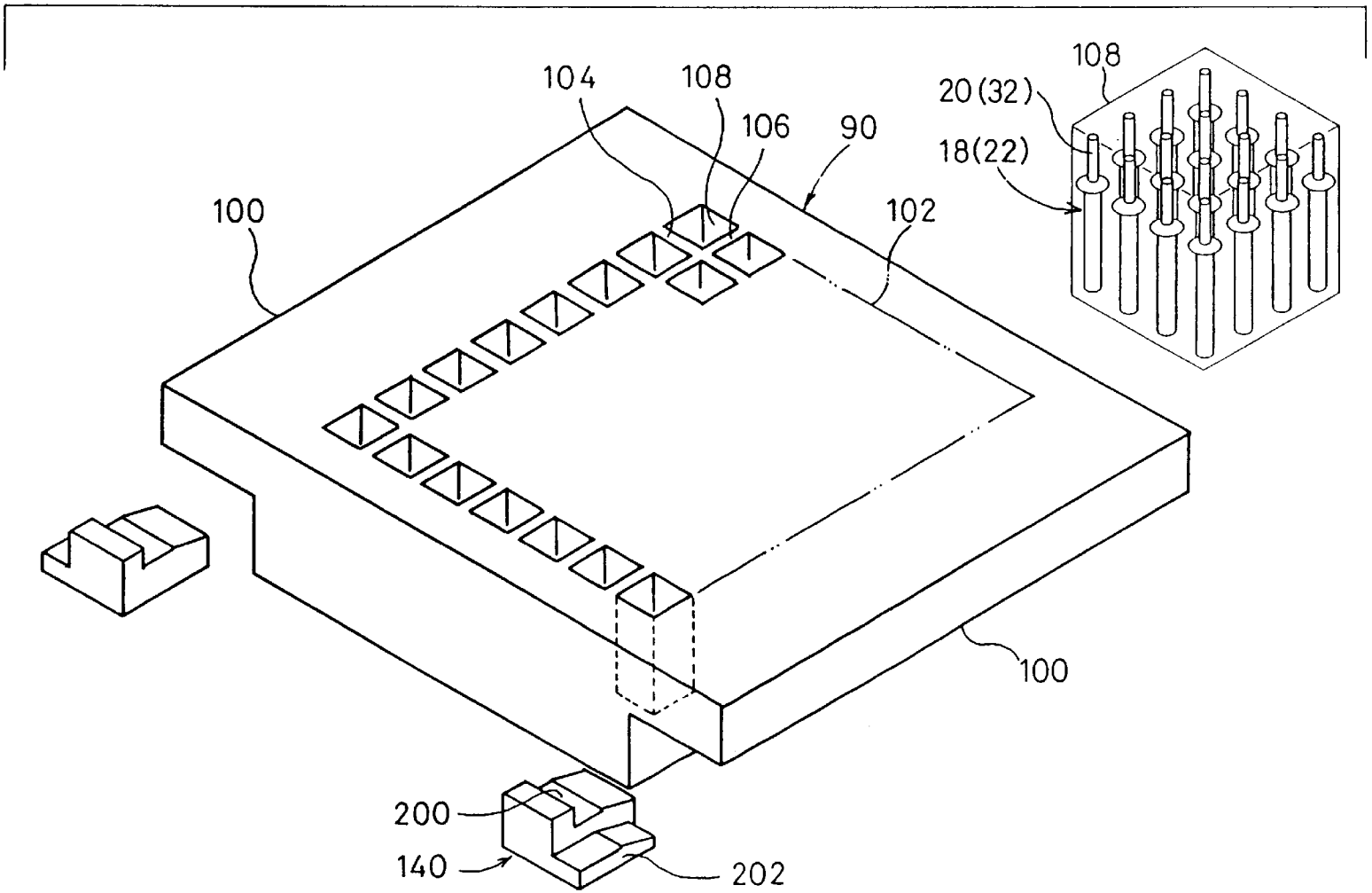
FIG. 15 shows a perspective view illustrating a structure of a lead wire tray to be used for the production method according to the embodiment of the present invention.

As shown in FIG. 15, the lead wire tray 90 is constructed to have a box-shaped configuration having flanges 100 on its both sides, including a lead wire-accommodating section 102 with its open top having a rectangular planar configuration formed therein. The lead wire-accommodating section 102 is shaped such that a large number of divisions 108 are arranged in a matrix form by means of a large number of partition plates 104, 106 arranged longitudinally and latitudinally. Each of the divisions 108 has a size of a degree corresponding to four of the recesses 58, 62 provided on each of the main heater bodies 44 of the anode-side sealing jig 40 and the cathode-side sealing jig 42. A plurality of (for example, twenty-five of) anode-side leads 18 or cathode-side leads 22 are inserted and accumulated in each of the divisions 108 with the anode bars 20 or the cathode bars 32 being disposed upward.

Figure 16:
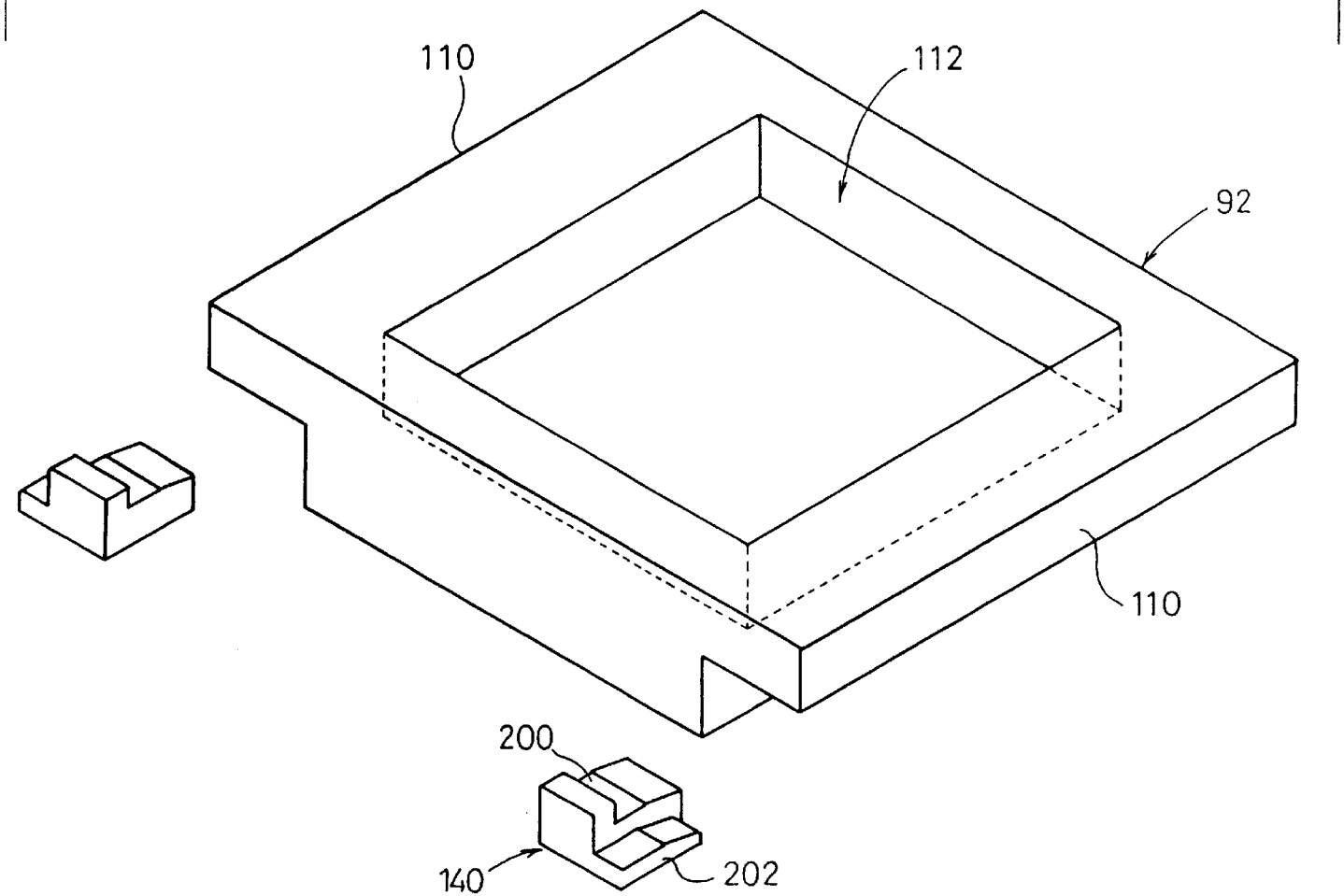
FIG. 16 shows a perspective view illustrating a structure of a bead tray to be used for the production method according to the embodiment of the present invention.

As shown in FIG. 16, the bead tray 92 is also constructed to have a box-shaped configuration having flanges 110 on its both sides, including a bead-accommodating section 112 with its open top having a rectangular planar configuration formed therein. The bead-accommodating section 112 is not formed with the partition plates 104, 106, unlike those arranged in the lead wire tray 90. The bead-accommodating section 112 is shaped to have one accommodating space extending thereover.

Figure 17:
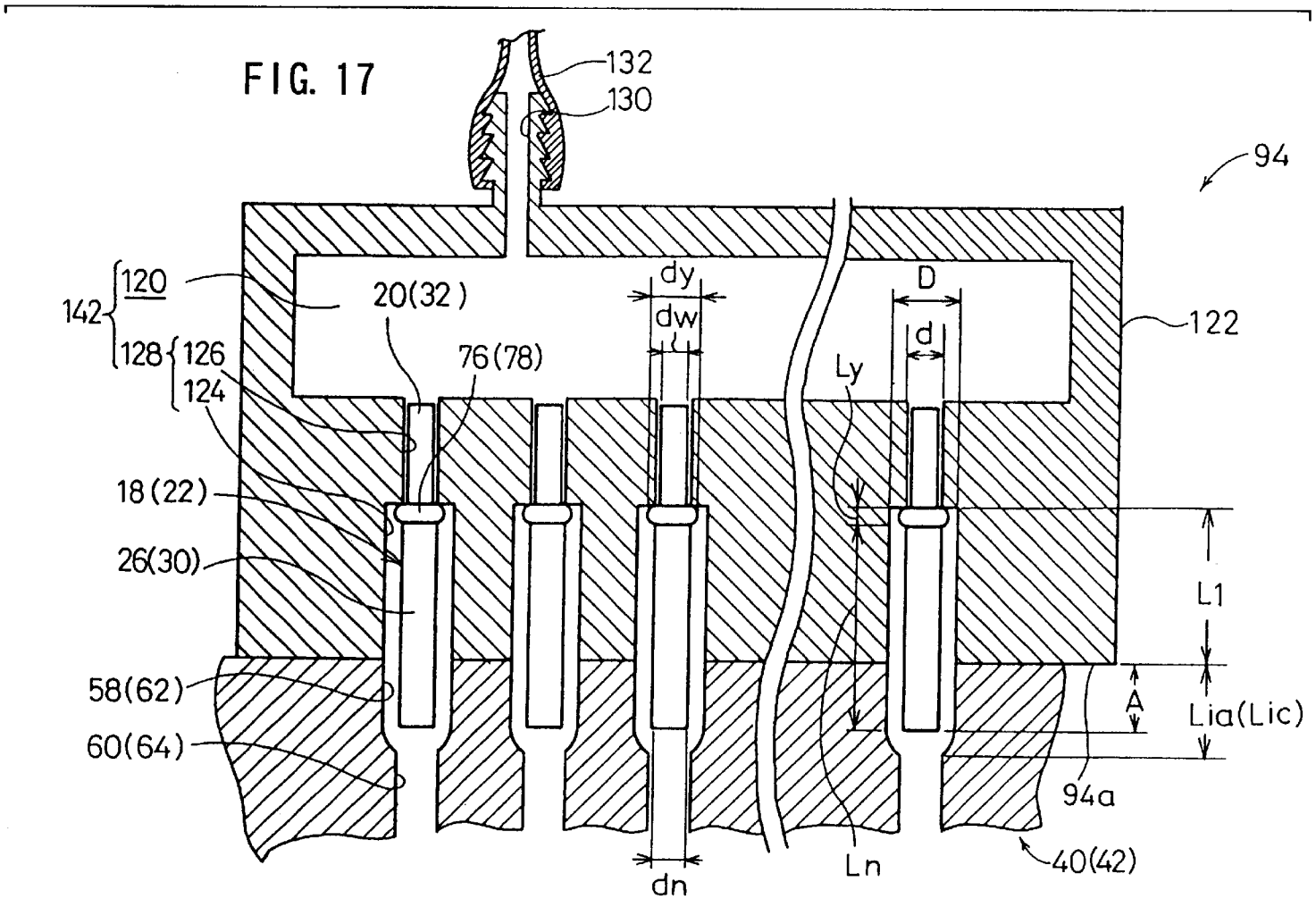
FIG. 17 shows a sectional view, with partial omission, illustrating a structure of a lead wire-shooting jig together with the sealing jig to be used for the production method according to the embodiment of the present invention.

As shown in FIG. 17, the lead wire-shooting jig 94 comprises a housing 122 with a hollow space 120 formed therein. Large holes 124, each of which has a substantially circular cross section, are formed through a lower surface of the housing 122 at positions corresponding to the lead insertion holes 60, 64 of the anode-side sealing jig 40 and the cathode-side sealing jig 42. Small hole 126, each of which has a substantially circular cross section, are formed at the bottoms of the large holes 124 to make communication with the hollow space 120. That is, the large hole 124 mutually communicates with the small hole 126 coaxially to form a communication hole 128 ranging from the lower surface of the housing 122 to the hollow space 120.

A hole 130, which communicates with the internal hollow space 120 for the purpose of vacuum suction, is formed through an upper portion of the housing 122. The hole 130 is connected to a hose 132 which is connected to a vacuum pump 2352 (see FIG. 26) via a first solenoid-operated valve 2354 (see FIG. 26).

As described later on, the lead wire-shooting jig 94 is provided with a chucking mechanism 2314 (see FIG. 26) for holding the lead wire tray 90, the anode-side sealing jig 40, or the cathode-side sealing jig 42 by using chucking pawls 140 (for example, see FIGS. 8, 9, and 15) to make tight contact with the lead wire-shooting jig 94. The large hole 124 and the small hole 126 are set to have respective sizes so that the following condition is satisfied. That is, the diameter of the small hole 126 has a size capable of inserting the anode bar 20 and the cathode bar 32 and incapable of inserting outer leads 26, 30. The diameter of the large hole 124 has a size of a degree incapable of inserting two or more anode-side leads 18 or cathode-side leads 22.

Specifically, assuming that the diameter of the large hole 124 is D and the diameter of the small hole 126 is d, the following relationships are given for the diameter dy of the welded section 24, 28 and the diameter dw of the anode bar 20 and the cathode bar 32 of the anode-side lead 18 and the cathode-side lead 22.

$$dw<d<dy$$

$$dy<D<2dw$$

A large number of anode-side leads 18 or cathode-side leads 22 accumulated in the lead wire tray 90 are inserted one by one into the respective communication holes 138 of the lead wire-shooting jig 94 as follows. That is, the flanges 100 of the lead wire tray 90 are hooked by the chucking pawls 140 (see FIG. 15) of the chucking mechanism 2314 (see FIG. 26) provided for the lead wire-shooting jig 94 to hold the lead wire tray 90. Accordingly, the lead wire tray 90 and the lead wire-shooting jig 94 are allowed to make tight contact with each other so that the lead wire-accommodating section 102 is opposed to the communication holes 128. After that, the lead wire tray 90 and the lead wire-shooting jig 94 are inverted upside down so that the lead wire-shooting jig 94 is disposed downward. The reliability of the operation is increased by shaking the both while allowing them to make tight contact with each other.

During this procedure, the large number of anode-side leads 18 or the cathode-side leads 22, which are accumulated in the lead wire-accommodating section 102 of the lead wire tray 90, freely fall toward the lead wire-shooting jig 94. Especially, the anode-side leads 18 or the cathode-side leads 22, which have been disposed at positions corresponding to the respective communication holes 128 of the lead wire-shooting jig 94, are exactly inserted into the communication holes 128. At this point of time, the hollow space 120 of the lead wire-shooting jig 94 is subjected to vacuum suction. Thus, the anode-side leads 18 or the cathode-side leads 22 having been inserted into the respective communication holes 128 are held in the communication holes 128. In other words, the respective communication holes 128 and the hollow space 120 function as a lead wire-holding section 142. The anode-side leads 18 or the cathode-side leads 22 having been inserted into the respective communication holes 128 of the lead wire-shooting jig 94 are inserted into the respective recesses 58 or 62 of the anode-side sealing jig 40 or the cathode-side sealing jig 42 as follows. That is, as shown in FIG. 17, the lead wire-shooting jig 94 is inverted upside down in the state in which the anode-side leads 18 or the cathode-side leads 22 are held in the respective communication holes 128 by the aid of the vacuum suction. Subsequently, the chucking pawls 140 (see FIGS. 8 and 9) of the chucking mechanism 2314 (see FIG. 26), which are provided for the lead wire-shooting jig 94, are used to hook the lower support plates 52 of the anode-side sealing jig 40 or the cathode-side sealing jig 42 so that the anode-side sealing jig 40 or the cathode-side sealing jig 42 is held thereby. Thus, the lead wire-shooting jig 94 and the anode-side sealing jig 40 or the cathode-side sealing jig 42 are allowed to make tight contact with each other so that the communication holes 128 are opposed to the recesses 58 or 62, followed by stopping the vacuum suction. Further, the reliability is increased by applying the shaking operation.

During this procedure, the anode-side leads 18 or the cathode-side leads 22, which have been inserted into the respective communication holes 128 of the lead wire-shooting jig 94, freely fall toward the recesses 58 or 62 of the anode-side sealing jig 40 or the cathode-side sealing jig 42. The outer leads 26 or 30 of the anode-side leads 18 or the cathode-side leads 22 are exactly inserted into the lead insertion holes 60 or 64 of the anode-side sealing jig 40 or the cathode-side sealing jig 42.

In this embodiment, it is assumed that the depth in the axial direction of the large hole 124 of the lead wire-shooting jig 94 is L1, the length of each of the outer leads 26, 30 of the anode-side leads 18 and the cathode-side leads 22 is Ln, the length of the welded section 24, 28 is Ly, the depths of the recesses 58, 62 of the anode-side sealing jig 40 and the cathode-side sealing jig 42 are Lia and Lic respectively, and there is given Ln+Ly−L1=A. On this condition, the dimension is set to satisfy the following relationships.

$$A<Lia$$

$$A<Lic$$

In other words, the depth L1 of the large hole 124 of the lead wire-shooting jig 94 is set so that the recess 58 or 62 of the anode-side sealing jig 40 or the cathode-side sealing jig 42 is not scraped by the forward end of the anode-side lead 18 or the cathode-side lead 22 when the lead wire-shooting jig 94 and the anode-side sealing jig 40 or the cathode-side sealing jig 42 are allowed to make tight contact with each other.

Figure 18:
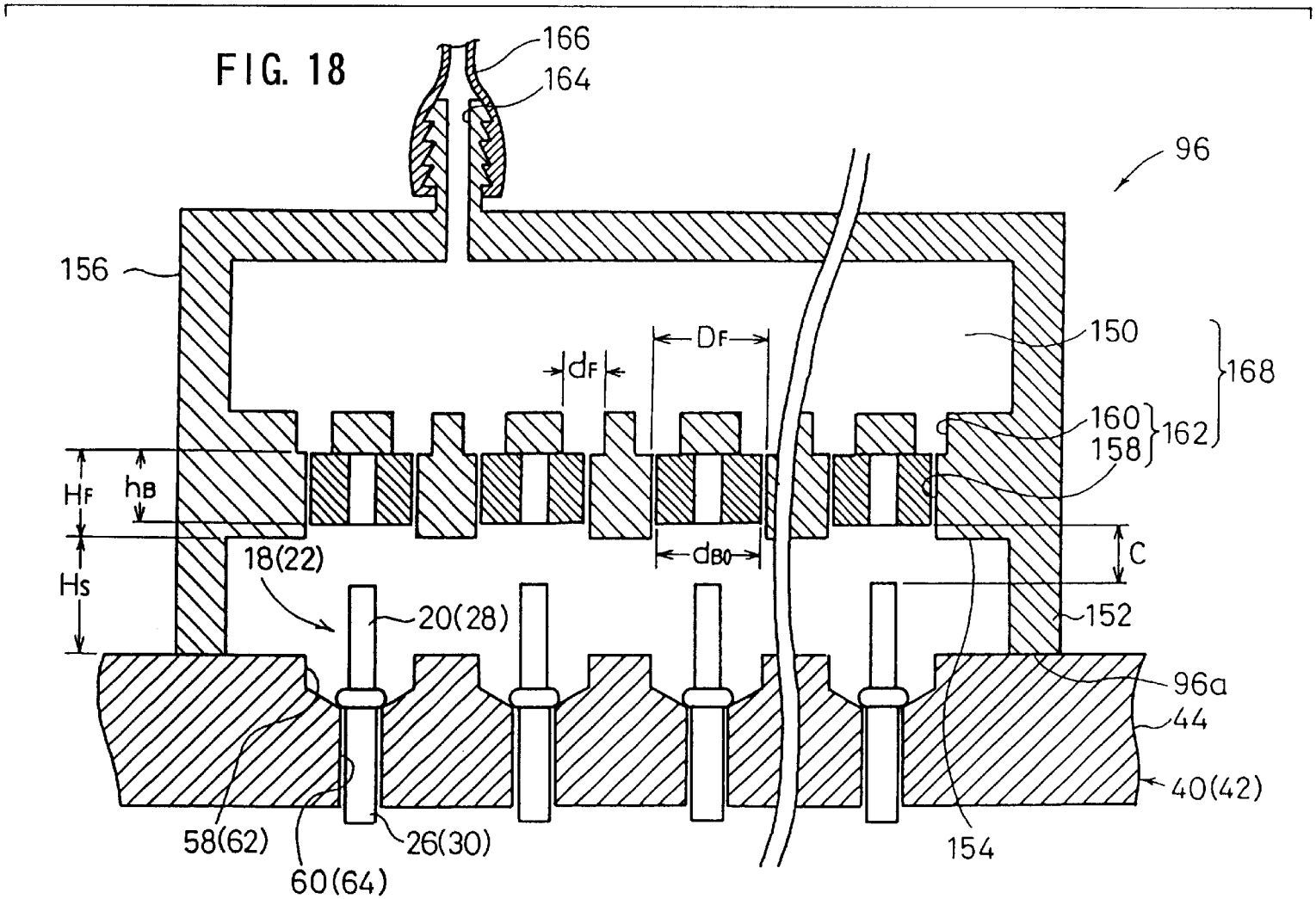
FIG. 18 shows a sectional view, with partial omission, illustrating a structure of a bead-shooting jig together with the sealing jig to be used for the production method according to the embodiment of the present invention.
Figure 19:
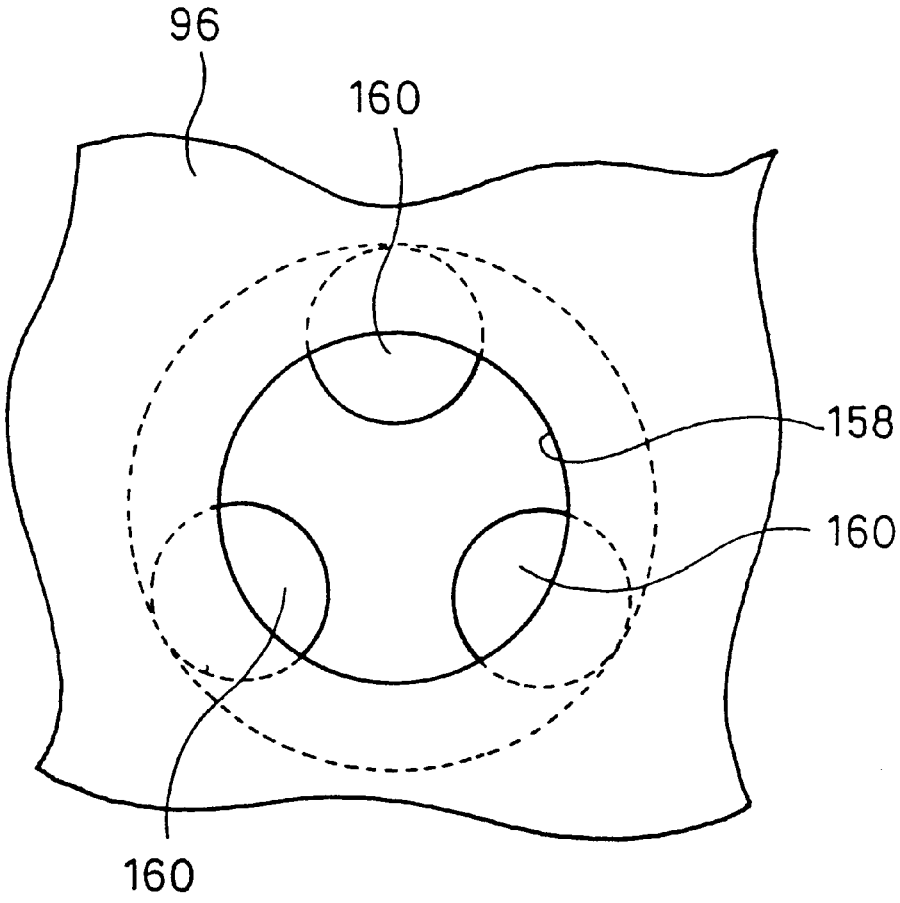
FIG. 19 shows shapes of a large hole and small holes of the bead-shooting jig.

On the other hand, as shown in FIG. 18, the bead-shooting jig 96 comprises a housing 156 including a hollow space 150 formed therein, a circumferential wall 152 formed on its lower surface, and a recess 154 having a large aperture area and having, for example, a rectangular configuration formed at the lower surface. Large holes 158, each of which has a substantially circular cross section, are formed at positions corresponding to the recesses 58, 62 of the anode-side sealing jig 40 and the cathode-side sealing jig 42 through the bottom of the recess 154. As also shown in FIG. 19, a plurality of (for example, three of) small holes 160, each of which has a substantially circular cross section and communicates with the hollow space 150, are formed at the bottom of the large hole 158. That is, the large hole 158 and the plurality of small holes 160 communicate with each other to form a communication hole 162 which ranges from the lower surface of the housing 156 to the hollow space 150.

A hole 164, which communicates with the internal hollow space 150 for the purpose of vacuum suction, is formed through an upper portion of the housing 156. The hole 164 is connected to a hose 166 which is connected to the vacuum pump 2352 (see FIG. 26) via a second solenoid-operated valve 2356 (see FIG. 26).

As described later on, the bead-shooting jig 96 is provided with a chucking mechanism 2338 (see FIG. 26) for holding the bead tray 92, the anode-side sealing jig 40, or the cathode-side sealing jig 42 by using chucking pawls 140 (see FIGS. 8, 9, and 16) to make tight contact with the bead-shooting jig 96.

The diameter of the large hole 158 is set to have a size so that the glass bead 70 is necessarily inserted thereinto in the vertical direction (the axis is directed in the vertical direction). Specifically, assuming that the diameter of the large hole 158 is $D_F$, the following relationship is given between the outer diameter $d_{Bo}$ of the glass bead 70 and the length Ld of the diagonal line of the vertical cross section of the glass bead 70 taken along its axis as the center (see FIG. 13B).

$$d_{Bo}<D_F<Ld$$

When the diameter $D_F$ of the large hole 158 is smaller than the length Ld of the diagonal line, the glass bead 70 is prevented from being inserted into the large hole 158 in the lateral direction (the axis is directed in the lateral direction). Assuming that the height of the glass bead 70 is $h_B$, the length Ld of the diagonal line satisfies $Ld^2=d_{Bo}^2+h_B^2$.

The diameter $d_F$ of the small hole 160 is set to have a size which is smaller than the outer diameter $d_{Bo}$ of the glass bead 70. The height of the circumferential wall 152 will be described later on.

A large number of glass beads 70 accumulated in the bead tray 92 are inserted one by one into the respective communication holes 162 of the bead-shooting jig 96 as follows. That is, the flanges 110 of the bead tray 92 are hooked by the chucking pawls 140 (see FIG. 16) of the chucking mechanism 2338 (see FIG. 26) provided for the bead-shooting jig 96 to hold the bead tray 92. Accordingly, the bead tray 92 and the bead-shooting jig 96 are allowed to make tight contact with each other so that the bead-accommodating section 112 is opposed to the communication holes 162. After that, the bead-shooting jig 96 is disposed downward. The reliability of the operation is increased by shaking the both while allowing them to make tight contact with each other.

During this procedure, the large number of glass beads 70, which are accumulated in the bead-accommodating section 112 of the bead tray 92, freely fall toward the bead-shooting jig 96. Especially, the glass beads 70, which have been disposed at positions corresponding to the respective communication holes 162 of the bead-shooting jig 96, are inserted into the communication holes 162 while directing the axis in the vertical direction. At this point of time, the hollow space 150 of the bead-shooting jig 96 is subjected to vacuum suction. Thus, the glass beads 70 having been inserted into the respective communication holes 162 are held in the communication holes 162. In other words, the respective communication holes 162 and the hollow space 150 function as a bead-holding section 168.

The glass beads 70 having been inserted into the respective communication holes 162 of the bead-shooting jig 96 are inserted into the anode bars 20 or the cathode bars 32 of the anode-side leads 18 or the cathode-side leads 22 inserted into the respective recesses 58 or 62 of the anode-side sealing jig 40 or the cathode-side sealing jig 42 as follows. That is, as shown in FIG. 18, the bead-shooting jig 96 is inverted upside down in the state in which the glass beads 70 are held in the respective communication holes 162 by the aid of the vacuum suction. Subsequently, the chucking pawls 140 (see FIGS. 8 and 9) of the chucking mechanism 2338 (see FIG. 26), which are provided for the bead-shooting jig 96, are used to hook the lower support plates 52 of the anode-side sealing jig 40 or the cathode-side sealing jig 42 so that the anode-side sealing jig 40 or the cathode-side sealing jig 42 is held thereby. Thus, the bead-shooting jig 96 and the anode-side sealing jig 40 or the cathode-side sealing jig 42 are allowed to make tight contact with each other so that the communication holes 162 are opposed to the recesses 58 or 62, followed by stopping the vacuum suction. Further, the reliability is increased by applying the shaking operation.

During this procedure, the glass beads 70, which have been inserted into the respective communication holes 162 of the bead-shooting jig 96, freely fall toward the recesses 58 or 62 of the anode-side sealing jig 40 or the cathode-side sealing jig 42. The glass beads 70 are exactly inserted into the anode bars 20 or the cathode bars 32 of the anode-side leads 18 or the cathode-side leads 22.

It is preferable that there is given the following dimensional relationship of the bead-shooting jig 96, especially the relationship concerning the height $h_B$ of the glass bead 70 provided that the depth of the large hole 158 is $H_F$, because of the following reason.

$$0.9h_B<H_F<1.2h_B$$

That is, the large hole 158 also functions as a guide for guiding the glass bead 70 so that its axis is directed substantially vertically when the inserted glass bead 70 is allowed to fall. Therefore, if the depth $H_F$ of the large hole 158 is shallow, it is feared that the guiding action is not performed sufficiently when the glass bead 70 is inserted into the anode bar 20 or the cathode bar 32 of the anode-side lead 18 or the cathode-side lead 22, and the ratio of insertion of the glass bead 70 is lowered. On the contrary, if the depth $H_F$ of the large hole 158 is deep, it is feared that a plurality of glass beads 70 enter one large hole 158, and they are attracted in an overlapped manner.

Therefore, when the foregoing relationship is maintained, no inconvenience occurs, i.e., the ratio of insertion of the glass bead 70 is prevented from deterioration, and the large hole 158 is prevented from invasion of a plurality of glass beads 70.

The height Hs of the circumferential wall 152 formed on the lower surface of the housing 156 of the bead-shooting jig 96 is set to satisfy the following relationship when the bead-shooting jig 96 and the anode-side sealing jig 40 or the cathode-side sealing jig 42 are allowed to make tight contact with each other so that the communication holes 162 are opposed to the recesses 58 or 62, provided that C represents a separation width between the lower end of the glass bead 70 held in the communication hole 162 and the forward end of the anode bar 20 or the cathode bar 32 of the anode-side lead 18 or the cathode-side lead 22 inserted into the recess 58 or 62 of the anode-side sealing jig 40 or the cathode-side sealing jig 42, and $h_B$ represents the height of the glass bead 70.

$$0<<C<h_B/2$$

If the dimension C is too small, the anode bar 20 or the cathode bar 32 interferes (for example, collides) with the glass bead 70, resulting in breakage of the glass bead 70. On the contrary, if the dimension C is too large, the hole of the glass bead 70 does not function as guide for insertion into the anode bar 20 or the cathode bar 32 during the falling process when the vacuum suction effected by the bead-shooting jig 96 is stopped. As a result, the ratio of insertion of the glass bead 70 into the anode bar 20 or the cathode bar 32 is deteriorated. Ideally, the dimension C approximate to zero as near as possible. For example, even when the part specifications and the production errors are considered, the dimension C is desirably a dimension at which the anode bar 20 or the cathode bar 32 does not interfere with the glass bead 70.

The length $L_G$ of the glass tube 12 is definitely determined depending on the type of apparatus for which the xenon discharge tube 10 is used. In order to guarantee the performance, for example, the durability of the xenon discharge tube 10, the arc length $W_0$ (see FIG. 1) is lengthened in some cases. A certain degree of length is required for the cathode bar 32 because it is necessary to secure the cathode 14 thereto. On the contrary, it is sufficient for the anode bar 20 that the anode bar 20 slightly protrudes from the upper end of the inserted glass bead 70, and hence it is possible to shorten the length of the anode bar 20 to such an extent.

The shape of the respective recesses 58, 62 differs between the anode-side sealing jig 40 and the cathode-side sealing jig 42. That is, as shown in FIG. 10A, the depth Lic of the recess 62 of the cathode-side sealing jig 42 is set to be shallow so that the heat required to seal the glass is not transmitted to the cathode 14 secured to the cathode bar 32 of the cathode-side lead 22 inserted into the recess 62 if possible. On the other hand, as shown in FIG. 10B, it is necessary and inevitable for the anode-side sealing jig 40 to increase the depth Lia of the recess 58 in order to allow the completed xenon discharge tube 10 to have a shape which facilitates the assembling operation carried out in the next step.

According to the fact described above, as shown in FIGS. 10A and 10B, when the anode-side sealing jig 40 and the cathode-side sealing jig 42 are placed, for example, on an unillustrated base stand while using the upper surface of each of the main heater bodies 44 as a reference, a large difference $\Delta_{AC}$ appears between the forward end position of the anode bar 20 and the forward end position of the cathode bar 32. If the difference $\Delta_{AC}$ is smaller than ½ ($=h_B/2$) of the height $h_B$ of the glass bead 70, the bead-shooting jig 96 can be commonly used for both of the anode-side sealing jig 40 and the cathode-side sealing jig 42 by setting the dimension C in view of the relationship of the dimension C, i.e., the relationship of $0<<C<h_B/2$. However, if the difference $\Delta_{AC}$ is large, especially if the difference $\Delta_{AC}$ is larger than the height $h_B$, then it is impossible to commonly use the bead-shooting jig 96, and it is inevitable to expand or extend the equipment.

In the embodiment of the present invention, in order to decrease the error $\Delta_{AC}$ as less as possible, there are provided an upper adapter 180 for covering the main heater body 44 of the cathode-side sealing jig 42, a cathode-side lower adopter 182 for placing the cathode-side sealing jig 42 thereon, and an anode-side lower adapter 184 for placing the anode-side sealing jig 40 thereon, as shown in FIGS. 20A, 20B, 8, and 9.

Figures 20A, 20B:
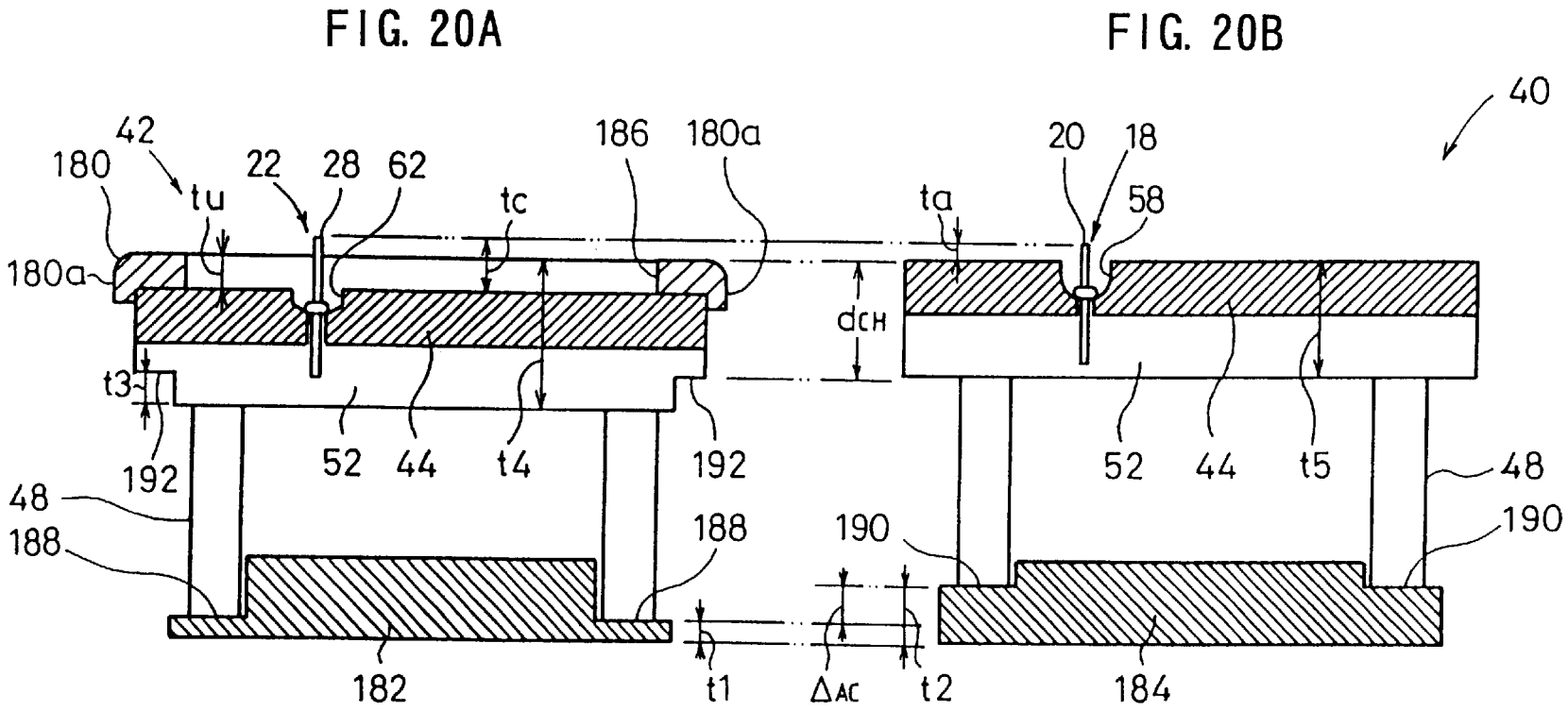
FIG. 20A shows a sectional view illustrating a state in which an upper adapter and a lower adapter are attached to the cathode-side sealing jig.
FIG. 20B shows a sectional view illustrating a state in which a lower adapter is attached to the anode-side sealing jig.

As shown in FIGS. 9 and 20A, the upper adapter 180 is made of metal or synthetic resin having a substantially rectangular planar configuration with its both ends bent downwardly and an opening 186 formed at its center. The upper adapter 180 is placed on the main heater body 44 so that bent sections 180*a* on both sides correspond to the long sides of the main heater body 44. In this embodiment, the distance between the both bent sections 180*a* is approximately the same as the short side of the main heater body 44. The size of the opening 186 is in such a degree that all of the recesses 62 formed in the main heater body 44 are faced upwardly.

As shown in FIGS. 9 and 20A, the cathode-side lower adapter 182 is made of metal or synthetic resin having a substantially rectangular parallelepiped-shaped configuration. Bottomed U-shaped cutouts 188 are formed at portions for placing the legs 48 of the cathode-side sealing jig 42. As shown in FIGS. 8 and 20B, the anode-side lower adapter 184 is also made of metal or synthetic resin having a substantially rectangular parallelepiped-shaped configuration. Bottomed U-shaped cutouts 190 are formed at portions for placing the legs 48 of the anode-side sealing jig 40.

The respective sizes of the upper adapter 180, the cathode-side lower adapter 182, and the anode-side lower adapter 184 are set to satisfy the following conditions.

(1) The forward end positions of the anode bars 20 and the cathode bars 32, which protrude upwardly from the plane (the upper surface of the upper adapter 180 or the upper surface of the main heater body 44) contacting with the reference plane 96*a* of the bead-shooting jig 96, are aligned depending on the presence or absence of the upper adapter 180 placed on the main heater body 44.

(2) The height of the plane (the upper surface of the upper adapter 180 or the upper surface of the main heater body 44) contacting with the reference plane 96*a* of the bead-shooting jig 96 is aligned depending on the depth of the cutout 188, 190 of the lower adapter 182, 184 for placing the legs 48 of the main heater body 44 thereon (i.e., the thickness t1, t2 of the bottom portion of the cutout 188, 190).

Specifically, as shown in FIG. 20A, the following relationship is satisfied provided that the thickness of the upper adapter 180 is tu, the length for protruding upwardly from the upper surface of the main heater body 44, of the cathode bar 32 of the cathode-side lead 22 inserted into each of the recesses 62 of the main heater body 44 of the cathode-side sealing jig 42 is tc, and the length for protruding upwardly from the upper surface of the main heater body 44, of the anode bar 20 of the anode-side lead 18 inserted into each of the recesses 58 of the main heater body 44 of the anode-side sealing jig 40 is ta as shown in FIG. 20B.

$$tc-tu=ta$$

As shown in FIG. 20A, the following relationship is satisfied provided that the thickness of the bottom portion of the cutout 188 of the cathode-side lower adapter 182 is t1, and the thickness of the bottom portion of the cutout 190 of the anode-side lower adapter 184 is t2.

$$t2-t1=\Delta_{AC}$$

As shown in FIGS. 9 and 20A, the cathode-side sealing jig 42 is formed with rectangular cutouts 192 on both sides of the mutually opposing surfaces of the respective lower support plates 52 disposed on the both sides of the main heater body 44. In this embodiment, the cutout 192 is formed to satisfy the following relationship provided that the depth of the cutout 193 is t3, the thickness from the upper surface of the upper adapter 180 to the lower surface of the lower support plate 52 is t4, and the thickness from the upper surface of the main heater body 44 of the anode-side sealing jig 40 to the lower surface of the lower support plate 52 is t5 as shown in FIG. 20B.

$$t4-t3=t5$$

In the embodiment of the present invention, as shown in FIGS. 8, 9, 15, and 16, each of the chucking pawls 140, which is provided for the lead wire-shooting jig 94 or the bead-shooting jig 96, comprises a main pawl body 200 for making contact with at least the lower surface of the flange 100 of the lead wire tray 90 and the lower surface of the flange 110 of the bead tray 92, and a protruding section 202 provided to protrude in an integrated manner in the lateral direction of the main pawl body 200, for making contact with the bottom portion of the cutout 192 provided on the lower support plate 52 of the cathode-side sealing jig 42 or the lower surface of the lower support plate 52 of the anode-side sealing jig 40.

Accordingly, when the lead wire-shooting jig 94 and the lead wire tray 90 or the bead-shooting jig 96 and the bead tray 92 are allowed to make tight contact with each other, the main pawl bodies 200 of the chucking pawls 140 are used to hook the flanges 100 of the lead wire tray 90 or the flanges 110 of the bead tray 92 so that the lead wire tray 90 or the bead tray 92 is held thereby. When the lead wire-shooting jig 94 or the bead-shooting jig 96 and the cathode-side sealing jig 42 are allowed to make tight contact with each other, the protruding sections 202 of the chucking pawls 140 are used to hook the bottom portions of the cutouts 192 so that the cathode-side sealing jig 42 is held thereby.

When the lead wire-shooting jig 94 or the bead-shooting jig 96 and the anode-side sealing jig 40 are allowed to make tight contact with each other, the protruding sections 202 of the chucking pawls 140 are used to hook the lower support plates 52 so that the anode-side sealing jig 40 is held thereby.

As described above, the cathode-side sealing jig 42 and the anode-side sealing jig 40 have the same distance $d_{CH}$ from the plane (the upper surface of the upper adapter 180 or the upper surface of the main heater body 44) contacting with the reference plane 94*a* of the lead wire-shooting jig 94 or the reference plane 96*a* of the bead-shooting jig 96 to the plane contacting with the chucking pawl 140. Further, they also have the same length of protrusion of the anode bar 20 and the cathode bar 32 from the plane contacting with the reference plane 96*a*. Therefore, it is unnecessary to change the structure of the housing 156 and the structure of the chucking mechanism 2338 (see FIG. 26) provided for the bead-shooting jig 96 depending on each of the sealing jigs 40, 42. Thus, the bead-shooting jig 96 can be commonly used for both of the sealing jigs 40, 42.

Next, explanation will be made with reference to FIGS. 21 to 26C for a lead wire-introducing system 1000 for introducing the anode-side leads 18 (or the cathode-side leads 22) into the lead wire tray 90.

Figure 21:
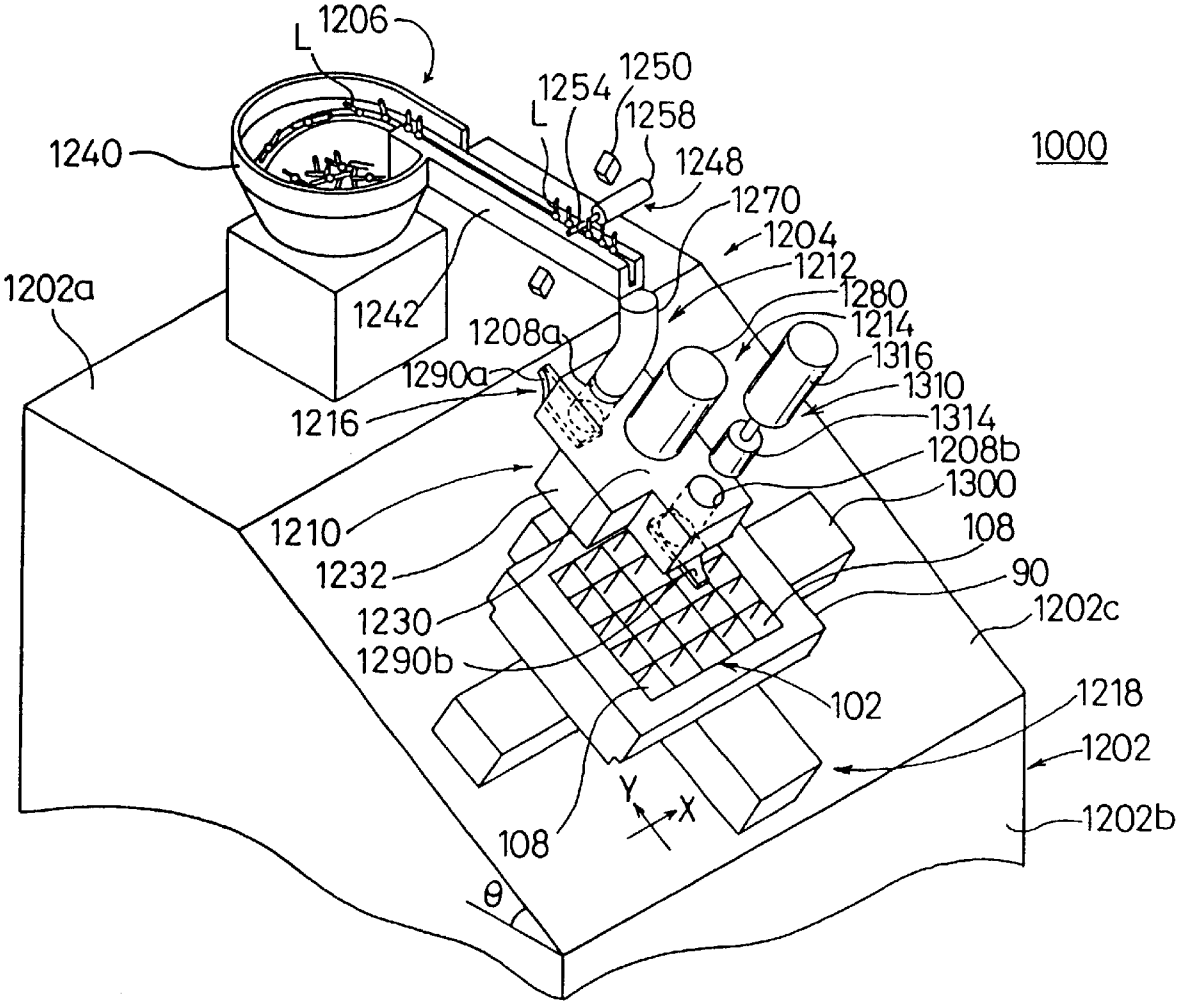
FIG. 21 shows a perspective view illustrating a structure of a lead wire-introducing system.

As shown in FIG. 21, the lead wire-introducing system 1000 comprises a lead wire-introducing apparatus 1204 which is installed on a base pedestal 1202, for introducing a large number of anode-side leads 18 or cathode-side leads 22 (hereinafter simply referred to as "lead wire L") in the longitudinal direction into the lead wire-accommodating section 102 of the lead wire tray 90.

The lead wire-introducing apparatus 1204 comprises a transport mechanism 1206 for successively transporting the lead wires L in the longitudinal direction, a stocker 1210 having a plurality of holes 1208*a*, 1208*b* each of which is capable of accommodating a predetermined number of lead wires L in the longitudinal direction, an introducing mechanism 1212 for introducing the lead wires L transported by the transport mechanism 1206 into one hole (1208*a* or 1208*b*) of the plurality of holes 1208*a*, 1208*b* of the stocker 1210, a positioning mechanism 1214 for selectively positioning one hole of the plurality of holes 1208*a*, 1208*b* of the stocker 1210 at an introducing position for the lead wire L for the introducing mechanism 1212, a shutter mechanism 1216 for selectively opening/shielding respective aperture planes opposing to the lead wire-accommodating section 102 of the lead wire tray 90, of the plurality of holes 1208*a*, 1208*b* provided for the stocker 1210, an XY table 1218 for moving the lead wire tray 90 in the XY directions so that an empty division 108 of the large number of divisions 108 of the lead wire-accommodating section 102 is positioned at the introducing position of the lead wire L for the stocker 1210, and a control unit 1220 (see FIG. 22) for controlling the respective mechanisms.

The base pedestal 1202 is formed with a tapered surface 1202*c* ranging from an upper surface 1202*a* which extends substantially horizontally to a front surface 1202*b* which extends substantially vertically. The tapered surface 1202*c* is formed to be inclined with respect to the horizontal direction by a predetermined angle θ, for example, θ=30°.

The lead wire-introducing system 1000 is constructed such that the transport mechanism 1206 is installed on the upper surface 1202*a* of the base pedestal 1202, the XY table 1218 is installed on the tapered surface 1202*c* of the base pedestal 1202, and the lead wire tray 90 is placed on the XY table 1218. Therefore, the lead wire tray 90 is installed in a state in which the aperture plane of the lead wire-accommodating section 102 is inclined by the predetermined angle θ (=30°) with respect to the horizontal direction.

The stocker 1210 is made of, for example, synthetic resin, and it is formed to have a substantially rectangular configuration. In the embodiment illustrated in the drawing, a rectangular projection 1232 is integrally formed on a side surface of a main stocker body 1230 having a rectangular parallelepiped-shaped configuration to give a substantially T-shaped planar configuration. The stocker 1210 is installed so that its upper surface is inclined by the predetermined angle θ with respect to the horizontal direction. The stocker 1210 is arranged so that its lower surface is parallel to the aperture plane of the lead wire tray 90 fixed on the XY table 1218, and it is disposed closely near to the aperture plane. The two circular holes 1208*a*, 1208*b* described above, which penetrate from the upper surface to the lower surface, are formed on both sides through the main stocker body 1230 of the stocker 1210.

On the other hand, the transport mechanism 1206 comprises a part feeder 1240 for aligning the supplied large number of lead wires L in one line in the longitudinal direction respectively, an aligning transport mechanism 1242 for successively transporting the lead wires L aligned by the part feeder 1240 in a state of being directed in the longitudinal direction respectively, and a controller 1244 (see FIG. 22) for controlling the part feeder 1240 and the aligning transport mechanism 1242 on the basis of commands given from the control unit 1220.

The transport mechanism 1206 further comprises, on the downstream side from the aligning transport mechanism 1242, a counting means 1246 for counting the number of lead wires L in the transport process, and a stop mechanism 1248 for temporarily stopping the transport of the lead wires L disposed on the upstream side after arrival at a predetermined number, of the large number of lead wires L in the transport process when the counting result obtained by the counting means 1246 indicates the predetermined number.

Figure 22:
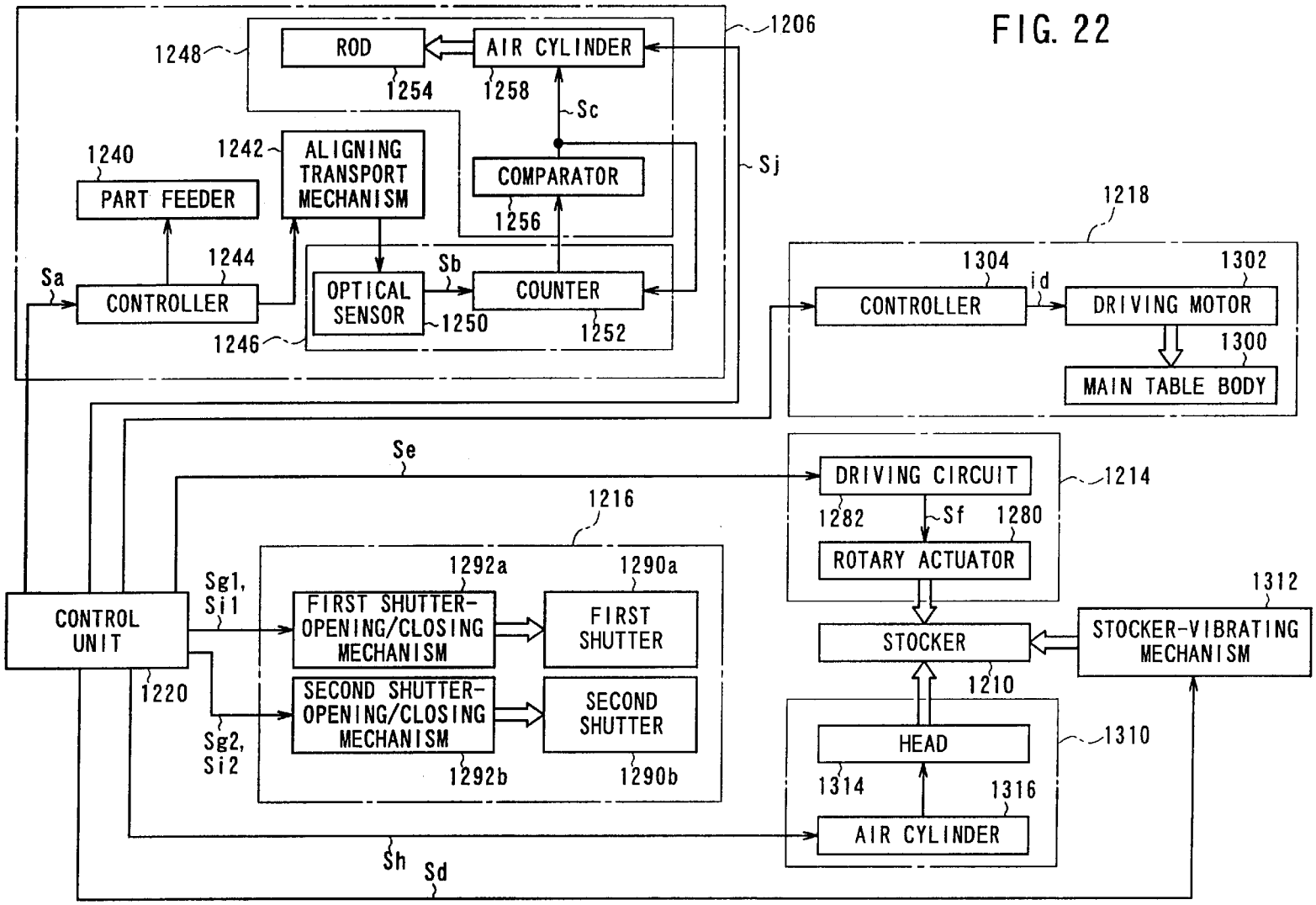
FIG. 22 shows a block diagram illustrating an arrangement of the lead wire-introducing system, especially depicting a control system.

As shown in FIG. 22, the counting means 1246 comprises, for example, an optical sensor 1250 for detecting the lead wire L in the transport process, and a counter 1252 for counting a detection pulse (pulse to indicate the detection of the lead wire L) contained in a detection signal from the optical sensor 1250.

The stop mechanism 1248 comprises a rod 1254 for making frontward/backward movement with respect to the transport passage for the lead wires L, a comparator 1256 for comparing a counted value obtained by the counter 1252 with a predetermined value (the value corresponding to the predetermined number), and an air cylinder 1258 for driving the rod 1254 to make frontward/backward movement with respect to the transport passage for the lead wires L.

The air cylinder 1258 drives the rod 1254 to make frontward movement with respect to the transport passage for the lead wires L on the basis of a coincidence signal (the signal to indicate that the counted value obtained by the counter 1252 arrives at the predetermined number) supplied from the comparator 1256. Accordingly, the transport is temporarily stopped for the lead wires L disposed on the upstream side after arrival at the predetermined number. The air cylinder 1258 drives the rod 1254 to make backward movement with respect to the transport passage for the lead wires L, for example, on the basis of a cancel command supplied from the control unit 1220. Accordingly, the transport of the lead wires L after arrival at the predetermined number, which has been in a stopped state, is started again.

The counter 1252 is subjected to wiring arrangement so that the coincidence signal outputted from the comparator 1256 is inputted into a reset terminal. The counted value is reset to be an initial value="0" on the basis of the output of the coincidence signal.

The downstream end of the aligning transport mechanism 1242 of the transport mechanism 1206 is a free end. Accordingly, the lead wire L, which has been successively transported in one line by the aid of the aligning transport mechanism 1242, freely falls from the downstream end, and it is accommodated in any one of the holes 1208*a* or 1208*b* of the stocker 1210 by the aid of the introducing mechanism 1212.

In this embodiment, the introducing mechanism 1212 comprises a cylindrical guide member 1270 having its hollow interior with its upper surface aperture arranged close to the downstream end of the aligning transport mechanism 1242. At least the lower end of the guide member 1270 is inclined by a predetermined angle (for example 30°) with respect to the vertical direction. The lower surface aperture of the guide member 1270 is positioned to oppose to one hole 1208*a* or 1208*b* of the stocker 1201 in a state in which the stocker 1210 is positioned by the aid of the positioning mechanism 1214.

Therefore, the predetermined number of lead wires L, which have been transported by the aligning transport mechanism 1242 of the transport mechanism 1206, freely fall from the downstream end of the aligning transport mechanism 1242 in the state of being directed in the longitudinal direction respectively. The falling direction is corrected for each of them by the intervening guide member 1270. Thus, each of the lead wires L is accommodated in one hole 1208*a* or 1208*b* of the stocker 1210.

The positioning mechanism 1214 comprises a rotary actuator 1280 for rotating and driving the stocker 1210, and a driving circuit 1282 for supplying a driving signal to the rotary actuator 1280 on the basis of a start signal supplied from the control unit 1220. The rotary actuator 1280 has its outer housing which is fixed, for example, to an unillustrated arm extending from the base pedestal 1202 so that the stocker 1210 may be arranged at the positions as described above. The rotary actuator 1280 has its rotary shaft which is attached to the center of the main stocker body 1230. Accordingly, when the rotary actuator 1280 is driven on the basis of the driving signal supplied from the driving circuit 1282, the stocker 1210 is rotated by 180° about its central axis. One hole 1208*a* or 1208*b*, which has been positioned just under the guide member 1270 of the introducing mechanism 1212, is disposed over one division 108 of the lead wire-accommodating section 102 of the lead wire tray 90. The other hole 1208*b* or 1208*a*, which has been positioned over one division 108, is in turn disposed just under the guide member 1270.

The shutter mechanism 1216 comprises two shutters (first and second shutters 1290*a*, 1290*b*) for selectively shielding/opening the respective lower surface apertures of the two holes 1208*a*, 1208*b* provided for the stocker 1210, and two shutter-opening/closing mechanisms (first and second shutter-opening/closing mechanisms 1292*a*, 1292*b*) for individually opening/closing and driving the first and second shutters 1290*a*, 1290*b*. The respective shutter-opening/closing mechanisms 1292*a*, 1292*b* operate and open the corresponding shutters 1290*a*, 1290*b* on the basis of the opening command signal supplied from the control unit 1220, and they operate and close the corresponding shutters 1290*a*, 1290*b* on the basis of the shielding command signal supplied from the control unit 1220.

The XY table 1218 comprises a main table body 1300 for placing and fixing the lead wire tray 90 thereon, a driving motor 1302 for driving and moving the main table body 1300, and a controller 1304 for decoding control codes (a start signal and an address code) supplied from the control unit 1220 to control a driving current to be supplied to the driving motor 1302. The controller 1304 functions as follows at the point of time to start the operation. That is, the lead wire tray 90 is moved in the X direction and in the Y direction indicated by the arrows to dispose the division 108 in the first row and first column of the lead wire-accommodating section 102, for example, at the position just under the hole 1208*b* located on the side of the lead wire-accommodating section 102 of the lead wire tray 90, of the two holes 1208*a*, 1208*b* of the stocker 1210.

After that, every time when the control code outputted from the control unit 1220 is inputted, the lead wire tray 90 is moved in the X direction and/or in the Y direction indicated by the arrows to dispose the division 108 having a coordinate (coordinate represented by the row and the column) specified by the address code contained in the supplied control code, at the position just under the hole (1208*a* or 1208*b*) located on the side of the lead wire-accommodating section 102 of the lead wire tray 90.

Figure 23:
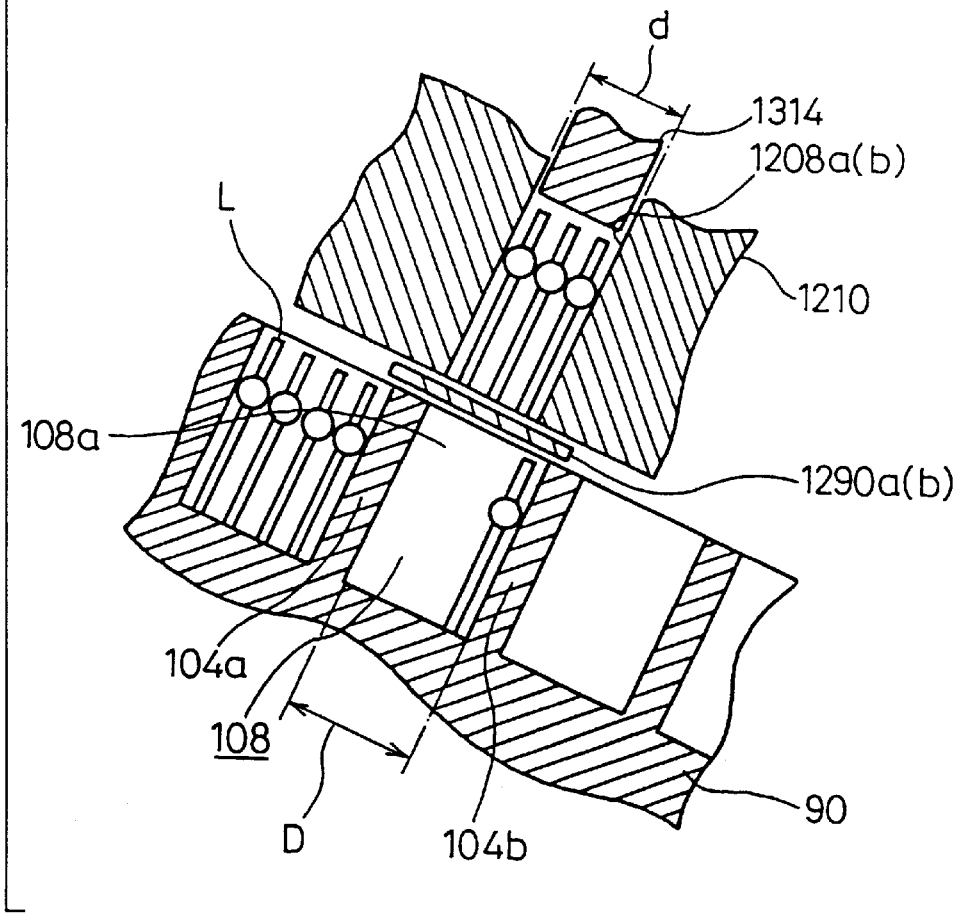
FIG. 23 shows a sectional view, with partial omission, illustrating a dimensional relationship between an aperture area of each division of a lead wire-accommodating section of the lead wire tray and an aperture area of a hole of a stocker.

Especially, in the embodiment of the present invention, the aperture area of each of the holes 1208*a*, 1208*b* of the stocker 1210 is set to be smaller than the aperture area of each of the divisions 108 of the lead wire-accommodating section 102 of the lead wire tray 90. Specifically, for example, as shown in FIG. 23, the diameter d of the hole 1208*a* or 1208*b* is set to be shorter than the projection length D in the side direction of the aperture of the division 108. When one division 108 is opposed to the hole 1208*a* or 1208*b* of the stocker 1210 by moving the XY table 1218, the hole 1208*a* or 1208*b* is located at a position deviated toward a part of the division 108, especially toward the partition plate 104*a* disposed upwardly, of the two partition plates 104*a*, 104*b* corresponding to the two latitudinal walls for constructing the division 108.

In addition to the various mechanisms described above, the lead wire-introducing system 1000 further comprises an extruding mechanism 1310 to act on the hole 1208*a* or 1208*b* with its lower aperture being in the open state by the aid of the shutter mechanism 1216, for extruding the predetermined number of lead wires L accommodated in the hole 1208*a* or 1208*b* toward the lead wire-accommodating section 102 of the lead wire tray 90, and a stocker-vibrating mechanism 1312 for vibrating the stocker 1210 in order to align the predetermined number of lead wires L introduced into the hole 1208*a* or 1208*b* by the aid of the introducing mechanism 1212, or in order to allow the predetermined number of lead wires L introduced into the hole 1208*a* or 1208*b* to fall into one division 108 of the lead wire tray 90.

The extruding mechanism 1310 comprises a head 1314 having a shape capable of insertion into the hole 1208*a* or 1208*b*, and an air cylinder 1316 for making frontward/backward movement of the head 1314 with respect to the hole 1208*a* or 1208*b*.

The lead wire-introducing system 1000 is basically constructed as described above. Next, its operation, function, and effect will be explained with reference to block diagrams depicting steps shown in FIGS. 24A to 25C as well.

At first, for example, when a start switch (not shown) of a control console (not shown) connected to the control unit 1220 is operated to input an operation start instruction into the control unit 1220, the control unit 1220 outputs a start signal Sa to the controller 1244 of the transport mechanism 1206. The controller 1244 drives the part feeder 1240 and the aligning transport mechanism 1242 of the transport mechanism 1206. The part feeder 1240 aligns the large number of supplied lead wires L in the longitudinal direction in one line respectively, and it successively feeds them one by one to the aligning transport mechanism 1242 disposed at the downstream stage (step S1 in FIG. 24A). The lead wires L, which are fed from the part feeder 1240 one by one, are transported in the state of being directed in the longitudinal direction, by the aligning transport mechanism 1242 (step S2 in FIG. 24A). At the point of time to start the operation, the respective shutters 1290*a*, 1290*b* of the shutter mechanism 1216 are at the positions to shield the lower apertures of the corresponding holes 1208*a*, 1208*b*. The holes 1208*a*, 1208*b* constitute spaces for accommodating the lead wires L respectively together with the shutters 1290*a*, 1290*b*.

At the point of time to start the operation, the control unit 1220 outputs a control code indicating the initial state to the controller 1304 for the XY table 1218. The controller 1304 decodes the inputted control code indicating the initial state to control the driving voltage id to be supplied to the driving motor 1302. Thus, the lead wire tray 90 is moved in the X direction and in the Y direction so that the division 108 in the first row and first column of the lead wire-accommodating section 102 is positioned just under the hole 1208*a* or 1208*b* located on the side of the lead wire-accommodating section 102 of the lead wire tray 90, of the two holes 1208*a*, 1208*b* of the stocker 1210. At this time, the other hole 1208*b* or 1208*a* of the stocker 1210 is positioned just under the guide member 1270 of the introducing mechanism 1212.

In the following description, the two holes 1208*a*, 1208*b* of the stocker 1210 are designated as follows. That is, the hole, which is positioned just under the guide member 1270 at the point of time to start the operation, is referred to as "first hole 1208*a*", and the hole, which is positioned over the division 108, is referred to as "second hole 1208*b*".

The large number of lead wires L, which are transported in an aligned manner on the transport passage of the aligning transport mechanism 1242, freely fall in the state of being directed in the longitudinal direction from the downstream end of the aligning transport mechanism 1242 respectively. The lead wires L pass through the intervening guide member 1270 of the introducing mechanism 1212. Thus, the lead wires L are corrected for their falling direction, and they are introduced into the first hole 1208*a* of the stocker 1210 (step S101 in FIG. 24B).

Figure 24A:
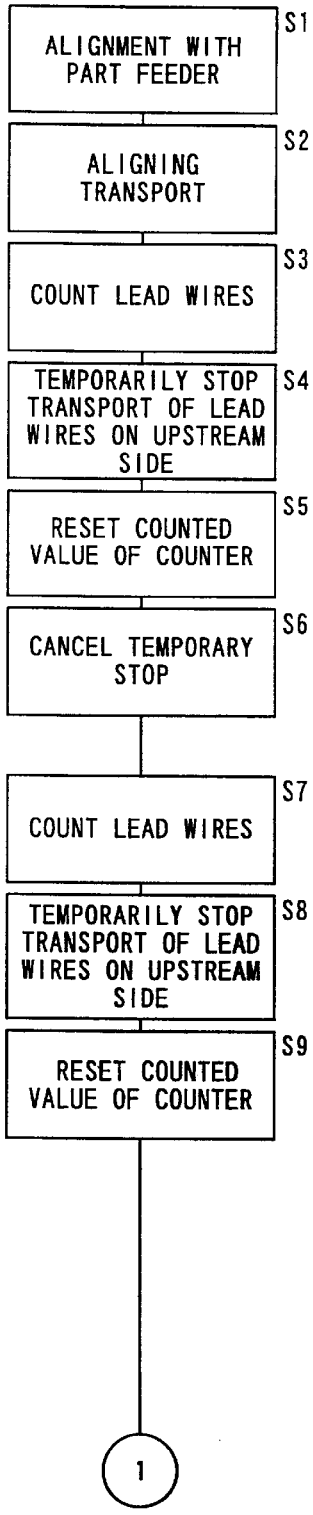
FIG. 24A shows a block diagram (No. 1) depicting steps of the processing action effected by a transport mechanism disposed in the lead wire-introducing system.
Figure 24B:
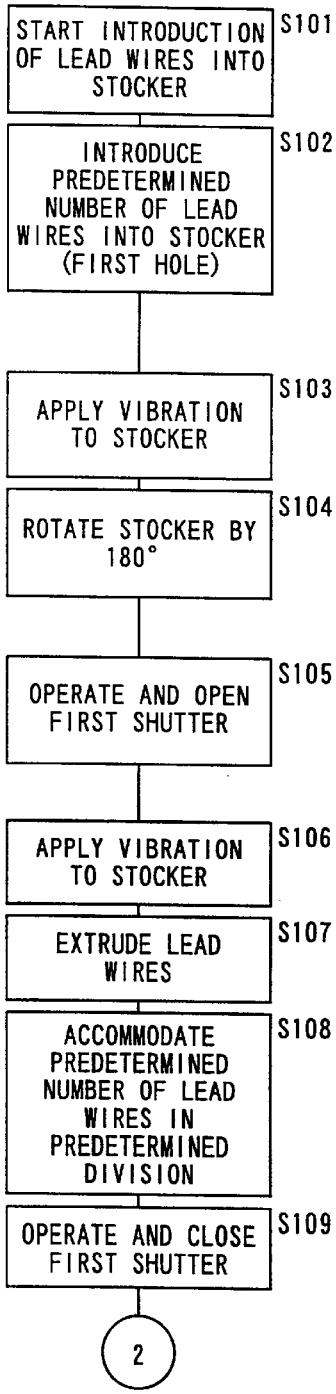
FIG. 24B shows a block diagram (No. 1) depicting steps of the processing action effected for a first hole of the stocker disposed in the lead wire-introducing system.

The lead wires L in the transport process are successively counted by the counting means 1246 installed on the downstream side of the aligning transport mechanism 1242 at the stage for introducing the lead wires L into the stocker 1210 (step S3 in FIG. 24A). The counting operation is performed by detecting the lead wire L in the transport process by using the optical sensor 1250, and counting, with the counter 1252, the detection pulse contained in a detection signal Sb outputted from the optical sensor 1250. The counted value obtained by the counter 1252 is compared with the predetermined value by the comparator 1256 of the stop mechanism 1248. A coincidence signal Sc is outputted from the comparator 1256 at the point of time at which the counted value obtained by the counter 1252 coincides with the predetermined value, and the signal is supplied to the air cylinder 1258 and the counter 1252 respectively.

The air cylinder 1258 is operated on the basis of the input of the coincidence signal Sc from the comparator 1256 so that the rod 1254 is driven to make frontward movement with respect to the transport passage for the lead wires L. Accordingly, the transport of the lead wires L is temporarily stopped on the upstream side after arrival at the predetermined number (step S4 in FIG. 24A). Only the predetermined number of lead wires L are introduced into the first hole 1208*a* of the stocker 1210 by the aid of the guide member 1270 (step S102 in FIG. 24B).

The counter 1252 sets the present counted value to be the initial value="0" on the basis of the input of the coincidence signal Sc. That is, the counted value is reset (step S5 in FIG. 24A).

The control unit 1220 output a driving signal Sd to the stocker-vibrating mechanism 1312 at the point of time at which the introduction of the predetermined number of lead wires L into the first hole 1208*a* of the stocker 1210 is completed. The stocker-vibrating mechanism 1312 applies vibration to the stocker 1210 for a predetermined period of time on the basis of the input of the driving signal Sd (step S103 in FIG. 24B). The application of vibration to the stocker 1210 allows the predetermined number of lead wires L introduced into the first hole 1208*a* to be aligned in the state of being directed in the longitudinal direction. The predetermined period of time is, for example, 3 to 5 seconds.

The control unit 1220 in turn outputs a start signal Se to the driving circuit 1282 of the positioning mechanism 1214 at the stage at which the application of vibration is completed. The driving circuit 1282 outputs a driving signal Sf to the rotary actuator 1280 on the basis of the input of the start signal Se to rotate the stocker 1210 by 180° about its central axis as the center (step S104 in FIG. 24B).

The stocker 1210 is rotated by 180°, and the first hole 1208*a*, which has been previously disposed just under the guide member 1270 of the introducing mechanism 1212 and in which the predetermined number of lead wires L are accommodated, is located over one division 108 of the lead wire-accommodating section 102 of the lead wire tray 90. At this stage, the control unit 1220 outputs an opening command signal Sg1 to the first shutter-opening/closing mechanism 1292*a* of the shutter mechanism 1216. The first shutter-opening/closing mechanism 1292*a* operates and opens the first shutter 1290*a* on the basis of the input of the opening command signal Sg1 (step S105 in FIG. 24B). Accordingly, the predetermined number of lead wires L, which have been accommodated in the first hole 1208*a*, fall toward the division 108 disposed just thereunder.

The control unit 1220 outputs the driving signal Sd to the stocker-vibrating mechanism 1312. The stocker-vibrating mechanism 1312 applies vibration to the stocker 1210 for a predetermined period of time on the basis of the input of the driving signal Sd (step S106 in FIG. 24B). The application of vibration to the stocker 1210 allows the lead wires L in the first hole 1208*a* to smoothly fall into the division 108 disposed just thereunder.

Further, the control unit 1220 outputs a control signal Sh to instruct the air cylinder 1316 of the extruding mechanism 1310 to perform the extruding operation. The air cylinder 1316 drives and moves the head 1314 in the positive direction on the basis of the input of the control signal Sh. Thus, the head 1314 is inserted into the first hole 1208*a* (step S107 in FIG. 24B). Accordingly, for example, the lead wires L, which have remained in the first hole 1208*a* without falling, are also extruded downwardly in accordance with the driving movement of the head 1314. At this stage, all of the predetermined number of lead wires L having been contained in the first hole 1208*a* are accommodated in the corresponding division 108 (step S108 in FIG. 24B). The air cylinder 1316 restores the head 1314 to the original position immediately after the movement of the head 1314 in the positive direction.

After that, the control unit 1220 outputs a shielding command signal Si1 to the first shutter-opening/closing mechanism 1292*a* of the shutter mechanism 1216. The first shutter-opening/closing mechanism 1292*a* operates and closes the first shutter 1290*a* on the basis of the input of the shielding command signal Si1 (step S109 in FIG. 24B). Accordingly, the lower surface aperture of the first hole 1208*a* is shielded, and the space for accommodating the lead wires L is formed (comparted) by the first hole 1208*a*.

Subsequently, the control unit 1220 outputs a control code (a start signal and an address code indicating the next division (for example, an address code indicating a division in the first row and second column)) to the controller 1304 of the XY table 1218. The controller 1304 moves the lead wire tray 90 on the basis of the input of the control code so that the division indicated by the address code (the division in the first row and second column in this embodiment) of the divisions of the lead wire tray 90 is positioned just under the hole (the first hole 1208*a* at this stage) of the stocker 1210 (step S110 in FIG. 25B).

Figure 24C:
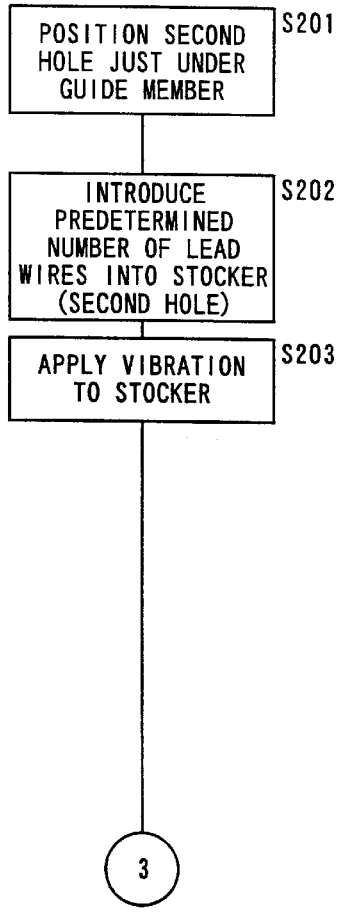
FIG. 24C shows a block diagram (No. 1) depicting steps of the processing action effected for a second hole of the stocker disposed in the lead wire-introducing system.

On the other hand, when the stocker 1210 is rotated by 180° in the step S104, the second hole 1208*b* is positioned just under the guide member 1270 of the introducing mechanism 1212 (step S201 in FIG. 24C). At this stage, the control unit 1220 outputs a cancel signal Sj to the air cylinder 1258 of the stop mechanism 1248. The air cylinder 1258 retracts the rod 1254 from the transport passage for the lead wires L on the basis of the input of the cancel signal Sj to cancel the temporary stop state of the aligning transport (step S6 in FIG. 24A). Accordingly, the aligning transport is started again for the lead wires L on the upstream side.

The large number of lead wires L, which are transported in the aligned manner on the transport passage of the aligning transport mechanism 1242, freely fall in the state of being directed in the longitudinal direction from the downstream end of the aligning transport mechanism 1242, and they pass through the intervening guide member 1270 of the introducing mechanism 1212. Thus, the lead wires L are corrected for their falling direction, and they are in turn introduced into the second hole 1208*b* of the stocker 1210.

Also in this procedure, the lead wires L, which are in the transport process, are counted by the counting means 1246 (step S7 in FIG. 24A), in the same manner as in the introduction of the lead wires L into the first hole 1208*a* described above. At the point of time at which the counted value obtained by the counter 1252 coincides with the predetermined value, the air cylinder 1258 drives the rod 1254 to make frontward movement with respect to the transport passage for the lead wires L to temporarily stop the transport of the lead wires L on the upstream side after arrival at the predetermined number (step S8 in FIG. 24A). The counter 1252 resets the present counted value (step S9 in FIG. 24A). Accordingly, only the predetermined number of lead wires L are introduced into the second hole 1208*b* of the stocker 1210 by the aid of the guide member 1270 (step S202 in FIG. 24C).

At the point of time at which the introduction of the predetermined number of lead wires L into the second hole 1208*b* of the stocker 1210 is completed, the stocker-vibrating mechanism 1312 is used to apply vibration to the stocker 1210 for a predetermined period of time, at the timing as used in the step S106 described above (step S203 in FIG. 24C). The application of vibration to the stocker 1210 allows the predetermined number of lead wires L introduced into the second hole 1208*b* to be aligned in the state of being directed in the longitudinal direction. At the stage at which the application of vibration is completed, the stocker 1210 is rotated by 180° about its central axis as the center by the aid of the positioning mechanism 1214 in the same manner as in the step S104 described above (step S204 in FIG. 25C).

The stocker 1210 is rotated by 180°, and the second hole 1208*b*, in which the predetermined number of lead wires L are accommodated, is located over one division 108 of the lead wire-accommodating section 102 of the lead wire tray 90. At this stage, the control unit 1220 outputs an opening command signal Sg2 to the second shutter-opening/closing mechanism 1292*b* of the shutter mechanism 1216. The second shutter-opening/closing mechanism 1292*b* operates and opens the second shutter 1290*b* on the basis of the input of the opening command signal Sg2 (step S205 in FIG. 25C). Accordingly, the predetermined number of lead wires L, which have been accommodated in the second hole 1208*b*, fall toward the division 108 disposed just thereunder.

At this time, the stocker-vibrating mechanism 1312 is used to apply vibration to the stocker 1210 for a predetermined period of time in the same manner as in the step S106 described above (step S206 in FIG. 25C). The application of vibration to the stocker 1210 allows the lead wires L in the second hole 1208*b* to smoothly fall into the division 108 disposed just thereunder.

Further, the head 1314 is inserted into the second hole 1208*b* by the aid of the extruding mechanism 1310 in the same manner as in the step S107 described above (step S207 in FIG. 25C). Accordingly, for example, the lead wires L, which have remained in the second hole 1208*b* without falling, are also extruded downwardly in accordance with the driving movement of the head 1314. At this stage, all of the predetermined number of lead wires L having been contained in the second hole 1208*b* are accommodated in the corresponding division 108 (step S208 in FIG. 25C).

After that, the control unit 1220 outputs a shielding command signal Si2 to the second shutter-opening/closing mechanism 1292*b* of the shutter mechanism 1216. The second shutter-opening/closing mechanism 1292*b* operates and closes the second shutter 1290*b* on the basis of the input of the shielding command signal Si2 (step S209 in FIG. 25C). Accordingly, the lower surface aperture of the second hole 1208*b* is shielded, and the space for accommodating the lead wires L is formed (comparted) by the second hole 1208*b*.

Figure 25A:
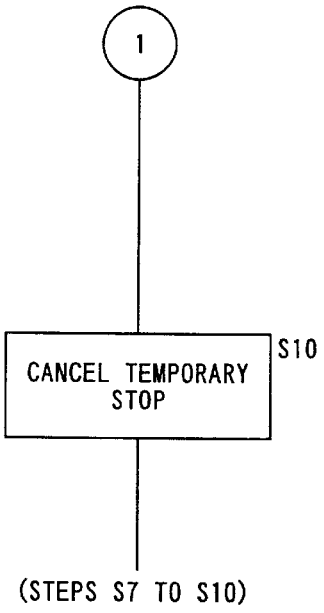
FIG. 25A shows a block diagram (No. 2) depicting steps of the processing action effected by the transport mechanism disposed in the lead wire-introducing system.
Figure 25B:
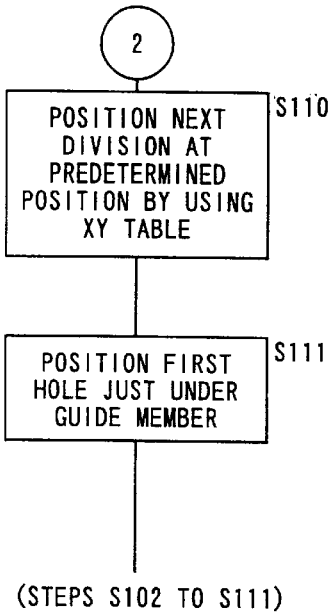
FIG. 25B shows a block diagram (No. 2) depicting steps of the processing action effected for the first hole of the stocker disposed in the lead wire-introducing system.
Figure 25C:
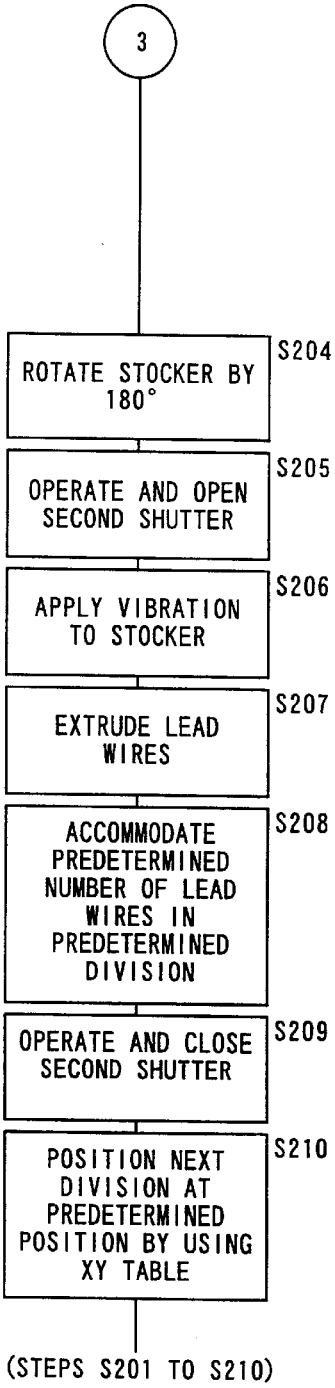
FIG. 25C shows a block diagram (No. 2) depicting steps of the processing action effected for the second hole of the stocker disposed in the lead wire-introducing system.

After that, the lead wire tray 90 is driven and moved by the XY table 1218 so that the division indicated by the address code supplied from the control unit 1220 (for example, a division in the first row and third column) of the divisions of the lead wire tray 90 is positioned just under the second hole 1208*b* of the stocker 1210 (step S210 in FIG. 25C).

The stocker 1210 is rotated by 180° by the aid of the positioning mechanism 1214, and then the steps S201 to S210 are successively repeated. Thus, the system performs, in a cyclic manner, the supply of the predetermined number of lead wires L to the second hole 1208*b* and the supply of the predetermined number of lead wires L to the division positioned by the XY table 1218.

When the stocker 1210 is rotated by 180° in the step S204 described above, the first hole 1208*a* is positioned just under the guide member 1270 of the introducing mechanism 1212 (step S111 in FIG. 25B). At this stage, the temporary stop state of the aligning transport is canceled by the aid of the air cylinder 1258 of the stop mechanism 1248 (step S10 in FIG. 25A).

After that, the successive repetition of the steps S102 to S111 allows the system to perform, in a cyclic manner, the supply of the predetermined number of lead wires L to the first hole 1208*a* and the supply of the predetermined number of lead wires L to the division positioned by the XY table 1218.

The transport mechanism 1206 repeats, in a cyclic manner, the processes of the steps S7 to S10.

When the predetermined number of lead wires L are introduced into all of the divisions of the lead wire tray 90 as described above, the lead wire tray 90 is transported to the next production step to be used for the automatic supply (automatic shooting) of the lead wires L to the lead wire-shooting jig 94.

The lead wires L may be automatically supplied to the lead wire-shooting jig 94 until all of the lead wires L accommodated in the respective divisions 108 of the lead wire tray 90 are exhausted. However, in some cases, the supply to the lead wire-shooting jig 94 is not performed well from a point of time at which about 10 individuals remain. In such a case, for example, when the number of lead wires L accommodated in each of the divisions 108 is about ten, the automatic supply of the lead wires L to the lead wire-shooting jig 94 is stopped. The lead wire tray 90 is set on the XY table 1218 again. The lead wire-introducing system 1000 described above is used to accommodate the predetermined number of lead wires L in the respective divisions 108 of the lead wire tray 90.

In such a situation, it is allowable to change the predetermined value used to perform the comparing process effected by the comparator 1256 of the stop mechanism 1248. Alternatively, when the predetermined number is allowed to have a certain degree of margin (the margin of about 10 individuals), the series of foregoing operations may be carried out without changing the predetermined value.

As described above, the lead wire-introducing system 1000 can be used to introduce the predetermined number of lead wires L (the anode-side leads 18 or the cathode-side leads 22) in the longitudinal direction respectively into the large number of divisions 108 formed in the lead wire-accommodating section 102 of the lead wire tray 90. Therefore, it is possible to facilitate automatization of the process in the downstream steps including, for example, the process for supplying the lead wires L to the lead wire-shooting jig 94 and the process for supplying the lead wires L to the respective recesses 58 of the anode-side sealing jig 40 by the aid of the lead wire-shooting jig 94. Thus, it is possible to achieve the improvement in production efficiency of the xenon discharge tube 10.

Especially, it is possible to automatically perform the operation for introducing the large number of lead wires L in the longitudinal direction into the lead wire-accommodating section 102 of the lead wire tray 90, for example, the operation for introducing the predetermined number of lead wires L into the respective divisions 108 of the lead wire-accommodating section 102 of the lead wire tray 90 respectively. Thus, it is possible to realize the efficient and quick operation for introducing the lead wires L into the lead wire tray 90.

Next, explanation will be made with reference to FIGS. 26 to 29B for a shooting system 2000 for shooting the anode-side leads 18 or the cathode-side leads 22 in the lead wire tray 90 and glass beads 70 in the bead tray 92 into the anode-side sealing jig 40 or the cathode-side sealing jig 42.

The shooting system 2000 comprises a transport mechanism 2302 for transporting the anode-side sealing jig 40 and the anode-side sealing jig 42 to a lead wire-inserting position P1 and a bead-inserting position P2, a lead wire tray-receiving unit 2306 comprising a plurality of racks 2304 arranged in the vertical direction for accommodating the lead wire trays 90, a first vertical movement mechanism 2310 for vertically moving the plurality of racks 2304 arranged in the lead wire tray-receiving unit 2306 to transport and position a designated rack 2304 at an introducing port 2308, a lead wire tray transport mechanism 2312 for transporting the lead wire tray 90 placed on the rack 2304 positioned at the introducing port 2308 to an installed position of the lead wire-shooting jig 94 or returning the lead wire tray 90 to the introducing port 2308, a chucking mechanism 2314 provided for the lead wire-shooting jig 94 for making tight contact between the lead wire-shooting jig 94 and the lead wire tray 90 or making tight contact between the lead wire-shooting jig 94 and the anode-side sealing jig 40 or the cathode-side sealing jig 42, a first inverting mechanism 2316 for supporting, in the initial state, the lead wire-shooting jig 94 with the respective communication holes 128 directed downwardly, and inverting the lead wire tray 90 and the lead wire-shooting jig 94 allowed to make tight contact with each other by the chucking mechanism 2314, or the lead wire-shooting jig 94 and the anode-side sealing jig 40 or the cathode-side sealing jig 42 allowed to make tight contact with each other, a first shaking mechanism 2318 for applying rotary shaking or linear shaking to the lead wire tray 90 and the lead wire-shooting jig 94 allowed to make tight contact with each other by the chucking mechanism 2314, or the lead wire-shooting jig 94 and the anode-side sealing jig 40 or the cathode-side sealing jig 42 allowed to make tight contact with each other, a first suction mechanism 2320 for vacuum-attracting the anode-side leads 18 or the cathode-side leads 22 inserted into the respective communication holes 128 of the lead wire-shooting jig 94, and a first frontward/backward transport mechanism 2322 for transporting the lead wire-shooting jig 94 with the anode-side leads 18 or the cathode-side leads 22 vacuum-attracted thereto, to the lead wire-inserting position P1 on the transport mechanism 2302.

The first vertical movement mechanism 2310 is controlled as follows. That is, when the anode-side sealing jig 40 is introduced into the shooting system 2000, then the first vertical movement mechanism 2310 selects the lead wire tray 90 containing the anode-side leads 18, of the lead wire trays 90 placed on the plurality of racks 2304, and it transports the lead wire tray 90 to the introducing port 2308. When the cathode-side sealing jig 42 is introduced, then the first vertical movement mechanism 2310 selects the lead wire tray 90 containing the cathode-side leads 22, of the lead wire trays 90 placed on the plurality of racks 2304, and it transports the lead wire tray 90 to the introducing port 2308.

The shooting system 2000 comprises the various mechanisms described above as well as a bead tray-receiving unit 2332 comprising a plurality of racks 2330 arranged in the vertical direction for accommodating the bead trays 92, a second vertical movement mechanism 2358 for vertically moving the plurality of racks 2330 arranged in the bead tray-receiving unit 2332 to transport and position a designated rack 2330 at an introducing port 2334, a bead tray transport mechanism 2336 for transporting the bead tray 92 placed on the rack 2330 positioned at the introducing port 2334 to an installed position of the bead-shooting jig 96 or returning the bead tray 92 to the introducing port 2334, a chucking mechanism 2338 provided for the bead-shooting jig 96 for making tight contact between the bead-shooting jig 96 and the bead tray 92 or making tight contact between the bead-shooting jig 96 and the anode-side sealing jig 40 or the cathode-side sealing jig 42, a second inverting mechanism 2340 for supporting, in the initial state, the bead-shooting jig 96 with the respective communication holes 162 directed downwardly, and inverting the bead tray 92 and the bead-shooting jig 96 allowed to make tight contact with each other by the chucking mechanism 2338, or the bead-shooting jig 96 and the anode-side sealing jig 40 or the cathode-side sealing jig 42 allowed to make tight contact with each other, a second shaking mechanism 2342 for applying rotary shaking or linear shaking to the bead tray 92 and the bead-shooting jig 96, or the bead-shooting jig 96 and the anode-side sealing jig 40 or the cathode-side sealing jig 42 allowed to make tight contact with each other by the chucking mechanism 2338, a second suction mechanism 2344 for vacuum-attracting the glass beads 70 inserted into the respective communication holes 162 of the bead-shooting jig 96, and a second frontward/backward transport mechanism 2346 for transporting the bead-shooting jig 96 with the glass beads 70 vacuum-attracted thereto, to the bead-inserting position P2 on the transport mechanism 2302.

The shooting system 2000 further comprises unillustrated various sensors and a control unit 2348 for controlling the various mechanisms on the basis of a previously set sequence in accordance with detection signals supplied from the various sensors and external operations, in order to adjust the operation timing for the various mechanisms.

Next, the processing operation of the shooting system 2000 will be explained with reference to block diagrams depicting steps shown in FIGS. 27A to 29B as well.

Figure 27A:
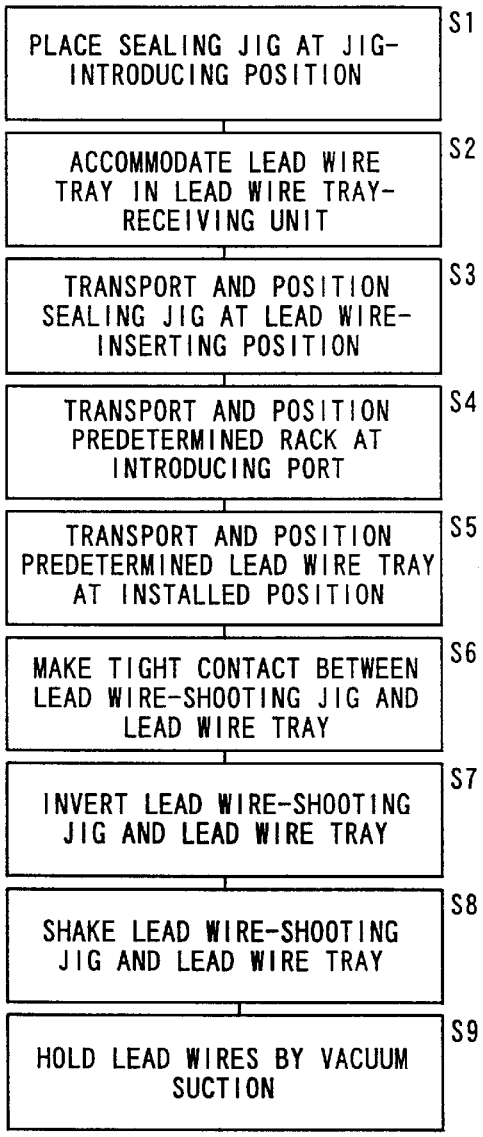
FIG. 27A shows a block diagram (No. 1) depicting steps of the processing action effected for the lead wire tray, the lead wire-shooting jig, and the sealing jig disposed in the shooting system.

At first, for example, the anode-side sealing jig 40 is placed at a jig-introducing position P0 on a transport belt 2350 of the transport mechanism 2302 in the stopped state (step S1 in FIG. 27A). A plurality of lead wire trays 90 are accommodated in the lead wire tray-receiving unit 2306 (step S2 in FIG. 27A). The anode-side leads 18 are accommodated in one lead wire tray 90 with the respective anode bars 20 directed upwardly respectively. For example, the cathode-side leads 22 are accommodated in another lead wire tray 90 with the cathode bars 32 directed upwardly respectively. On the other hand, a plurality of bead trays 92 are accommodated in the bead tray-receiving unit 2332 as well (step S101 in FIG. 27B). A large number of beads are accommodated in the respective bead trays 92.

When the anode-side sealing jig 40 is placed on the transport belt 2350, the anode-side lower adapter 184 is firstly placed on the transport belt 2350, and then the anode-side sealing jig 40 is placed on the lower adapter 184.

Subsequently, for example, when a shooting start switch (not shown) of a control console (not shown) connected to the control unit 2348 is operated to input a shooting start instruction into the control unit 2348, then the control unit 2348 outputs a start signal Sa to the transport mechanism 2302, and it simultaneously outputs start signals (Sb1, Sb2) and code data (Dt1, Dt2) indicating rack numbers to the first and second vertical movement mechanism 2310, 2358 respectively.

The transport mechanism 2302 drives the transport belt 2350 in a first direction on the basis of the input of a start signal Sa. Accordingly, the anode-side sealing jig 40, which is placed on the transport belt 2350, is transported toward the lead wire-inserting position P1. A detection signal is outputted from the unillustrated sensor at the point of time at which the anode-side sealing jig 40 arrives at the lead wire-inserting position P1 in accordance with the transport driving action effected by the transport mechanism 2302. The detection signal is inputted into the control unit 2348. The control unit 2348 outputs a stop signal to the transport mechanism 2302 on the basis of the input of the detection signal from the sensor to stop the transport of the anode-side sealing jig 40 having been performed by the transport mechanism 2302. Accordingly, the anode-side sealing jig 40 is positioned at the lead wire-inserting position P1 on the transport belt 2350 (step S3 in FIG. 27A). At this time, another anode-side sealing jig 40 is placed at the jig-introducing position P0 on the transport belt 2350. The another anode-side sealing jig 40 is transported in the next cycle to the lead-inserting position P1 so that the anode-side leads 18 are inserted thereinto.

The first vertical movement mechanism 2310 starts driving movement of the plurality of racks 2304 in the vertical direction on the basis of the input of a start signal Sb1 from the control unit 2348. The rack 2304, which corresponds to the rack number indicated by the inputted code data Dt1, is transported to the introducing port 2308, and it is positioned (step S4 in FIG. 27A).

On the other hand, the second vertical movement mechanism 2358 also starts driving movement of the plurality of racks 2330 in the vertical direction on the basis of the input of a start signal Sb2 from the control unit 2348. The rack 2330, which corresponds to the rack number indicated by the inputted code data Dt2, is transported to the introducing port 2334, and it is positioned (step S102 in FIG. 27B).

The control unit 2348 outputs a start signal Sc1 to the lead wire tray transport mechanism 2312 at the point of time at which the rack 2304 is completely positioned by the first vertical movement mechanism 2310. The control unit 2348 outputs a start signal Sc2 to the bead tray transport mechanism 2336 at the point of time at which the rack 2330 is completely positioned by the second vertical movement mechanism 2358.

The lead wire tray transport mechanism 2312 transports the lead wire tray 90 to the installed position of the lead wire-shooting jig 94 on the basis of the input of the start signal Sc1. The lead wire tray 90 is positioned at the installed position (step S5 in FIG. 27A). Accordingly, the lead wire tray 90 with the lead wire-accommodating section 102 directed upwardly is opposed just under the lead wire-shooting jig 94 installed with the communication holes 128 directed downwardly.

On the other hand, the bead tray transport mechanism 2336 transports the bead tray 92 to the installed position of the bead-shooting jig 96 on the basis of the input of the start signal Sc2. The bead tray 92 is positioned at the installed position (step S103 in FIG. 27B). Accordingly, the bead tray 92 with the bead-accommodating section 112 directed upwardly is opposed just under the bead-shooting jig 96 installed with the communication holes 162 directed downwardly.

Subsequently, the control unit 2348 output holding command signals Sd1, Sd2 to the chucking mechanism 2314 attached to the lead wire-shooting jig 94 and the chucking mechanism 2338 attached to the bead-shooting jig 96 respectively.

The chucking mechanism 2314 of the lead wire-shooting jig 94 drives the chucking pawls 140 (see FIG. 15) on the basis of the input of the holding command signal Sd1 to hook the flanges 100 of the lead wire tray 90 by using the chucking pawls 140 so that the lead wire tray 90 is held thereby. Thus, the lead wire tray 90 and the lead wire-shooting jig 94 are allowed to make tight contact with each other so that the lead wire-accommodating-section 102 is opposed to the communication holes 128 (step S6 in FIG. 27A).

On the other hand, the chucking mechanism 2338 of the bead-shooting jig 96 drives the chucking pawls 140 (see FIG. 16) on the basis of the input of the holding command signal Sd2 to hook the flanges 110 of the bead tray 92 by using the chucking pawls 140 so that the bead tray 92 is held thereby. Thus, the bead tray 92 and the bead-shooting jig 96 are allowed to make tight contact with each other so that the bead-accommodating section 112 is opposed to the communication holes 162 (step S104 in FIG. 27B).

Subsequently, the control unit 2348 outputs start signals Se1, Se2 to the first and second inverting mechanisms 2316, 2340 respectively. The first inverting mechanism 2316 inverts the lead wire tray 90 and the lead wire-shooting jig 94 allowed to make tight contact with each other by the aid of the chucking mechanism 2314 of the lead wire-shooting jig 94, on the basis of the input of the start signal Se1 so that the lead wire-shooting jig 94 is positioned downward (step S7 in FIG. 27A).

At this stage, the large number of anode-side leads 18, which are accumulated in the lead wire-accommodating section 102 of the lead wire tray 90, freely fall toward the lead wire-shooting jig 94. Among them, the anode-side leads 18, which have been disposed at the positions corresponding to the respective communication holes 128 of the lead wire-shooting jig 94, are exactly inserted into the communication holes 128.

In this embodiment, as shown in FIG. 17, the following relationships are satisfied on the side on which the anode-side leads 18 are inserted, concerning the diameter d of the small hole 126, the diameter D of the large hole 124, the diameter dw of the anode bar 20 of the anode-side lead 18, and the diameter dy of the welded section 76.

$$dw<d<dy$$

$$dy<D<2dw$$

Therefore, the anode bar 20 can be inserted into the small hole 126, but the outer lead 26 cannot be inserted thereinto. Further, two or more anode-side leads 18 cannot be inserted into the large hole 124. That is, the anode-side leads 18 are inserted into the respective communication holes 128 one by one with the outer leads 26 located in the large holes 124 respectively.

Figure 27B:
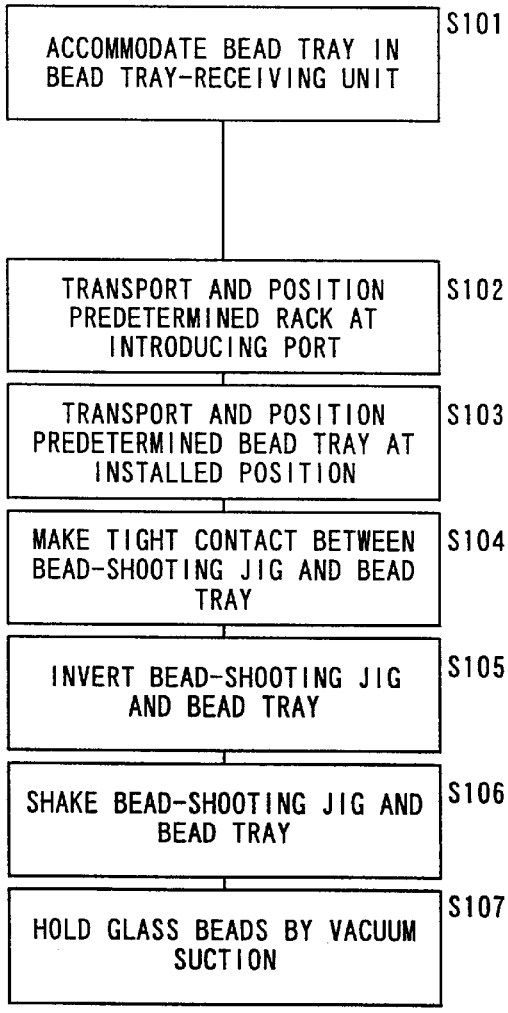
FIG. 27B shows a block diagram (No. 1) depicting steps of the processing action effected for the bead tray, the bead-shooting jig, and the sealing jig disposed in the shooting system.

On the other hand, the second inverting mechanism 2340 inverts the bead tray 92 and the bead-shooting jig 96 allowed to make tight contact with each other by the aid of the chucking mechanism 2338 of the bead-shooting jig 96, on the basis of the input of the start signal Se2 so that the bead-shooting jig 96 is positioned downward (step S105 in FIG. 27B).

At this stage, the large number of glass beads 70, which are accumulated in the bead-accommodating section 112 of the bead tray 92, freely fall toward the bead-shooting jig 96. Among them, the glass beads 70, which have been disposed at the positions corresponding to the respective communication holes 162 of the bead-shooting jig 96, are inserted into the communication holes 162 with their axes being directed in the vertical direction.

In this embodiment, the depth $H_F$ of the large hole 158 of the bead-shooting jig 96 is approximately the same as the height $h_B$ of the glass bead 70 while satisfying the following relationship.

$$0.9h_B<H_F<1.2h_B$$

Therefore, any inconvenience does not occur, which would be otherwise caused such that two or more glass beads 70 are inserted into one large hole 158.

Further, in this embodiment, in order to reliably insert the anode-side leads 18 into the communication holes 128 and reliably insert the glass beads 70 into the communication holes 162, the shaking action is applied to the lead wire tray 90 and the lead wire-shooting jig 94 allowed to make tight contact with each other by the aid of the chucking mechanism 2314 of the lead wire-shooting jig 94, and the bead tray 92 and the bead-shooting jig 96 allowed to make tight contact with each other by the aid of the chucking mechanism 2338 of the bead-shooting jig 96 respectively.

That is, the control unit 2348 outputs start signals Sf1, Sf2 to the first and second shaking mechanisms 2318, 2342 respectively at the point of time at which the inverting processes are completed by the first and second inverting mechanisms 2316, 2340. The first shaking mechanism 2318 applies rotary shaking and linear shaking to the lead wire tray 90 and the lead wire-shooting jig 94 allowed to make tight contact with each other, on the basis of the input of the start signal Sf1 (step S8 in FIG. 27A). Accordingly, the anode-side leads 18 are reliably inserted one by one into the respective communication holes 128 of the lead wire-shooting jig 94.

On the other hand, the second shaking mechanism 2342 applies rotary shaking and linear shaking to the bead tray 92 and the bead-shooting jig 96 allowed to make tight contact with each other by the aid of the chucking mechanism 2338 of the bead-shooting jig 96, on the basis of the input of the start signal Sf2 (step S106 in FIG. 27B). Accordingly, the glass beads 70 are reliably inserted one by one into the respective communication holes 162 of the bead-shooting jig 96.

After that, the control unit 2348 outputs suction command signals Sg1, Sg2 to the first and second suction mechanisms 2320, 2344 respectively. The first suction mechanism 2320 is subjected to the opening operation for the first solenoid-operated valve 2354 installed between the vacuum pump 2352 and the lead wire-shooting jig 94, on the basis of the input of the suction command signal Sg1 so that the vacuum is applied to the hollow space 120 of the lead wire-shooting jig 94 to hold, in the communication holes 128, the anode-side leads 18 inserted into the respective communication holes 128. That is, the anode-side leads 18 are held by the lead wire-holding section 142 by means of the vacuum suction (step S9 in FIG. 27A).

On the other hand, the second suction mechanism 2344 is subjected to the opening operation for the second solenoid-operated valve 2356 installed between the vacuum pump 2352 and the bead-shooting jig 96, on the basis of the input of the suction command signal Sg2 so that the vacuum is applied to the hollow space 150 of the bead-shooting jig 96 to hold, in the communication holes 162, the glass beads 70 inserted into the respective communication holes 162. That is, the glass beads 70 are held by the bead-holding section 168 by means of the vacuum suction (step S107 in FIG. 27B).

Subsequently, the control unit 2348 outputs stop signals Sf3, Sf4 to the first and second shaking mechanisms 2318, 2342 respectively, and it simultaneously outputs inversion signals Se3, Se4 to the first and second inverting mechanisms 2316, 2340 respectively. The first shaking mechanism 2318 stops the shaking operation for the lead wire tray 90 and the lead wire-shooting jig 94 in the tight contact state, on the basis of the input of the stop signal Sf3 (step S10 in FIG. 28A). The first inverting mechanism 2316 inverts the lead wire tray 90 and the lead wire-shooting jig 94 in the tight contact state, on the basis of the input of the inversion signal Se3 so that the lead wire tray 90 is disposed downward (step S11 in FIG. 28A).

Figure 28A:
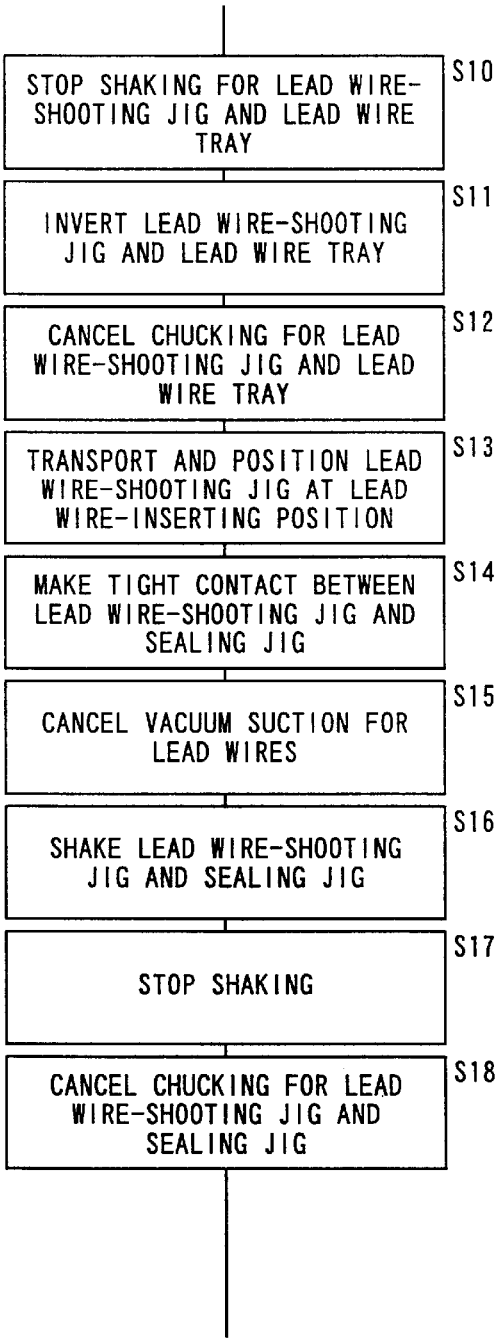
FIG. 28A shows a block diagram (No. 2) depicting steps of the processing action effected for the lead wire tray, the lead wire-shooting jig, and the sealing jig disposed in the shooting system.
Figure 28B:
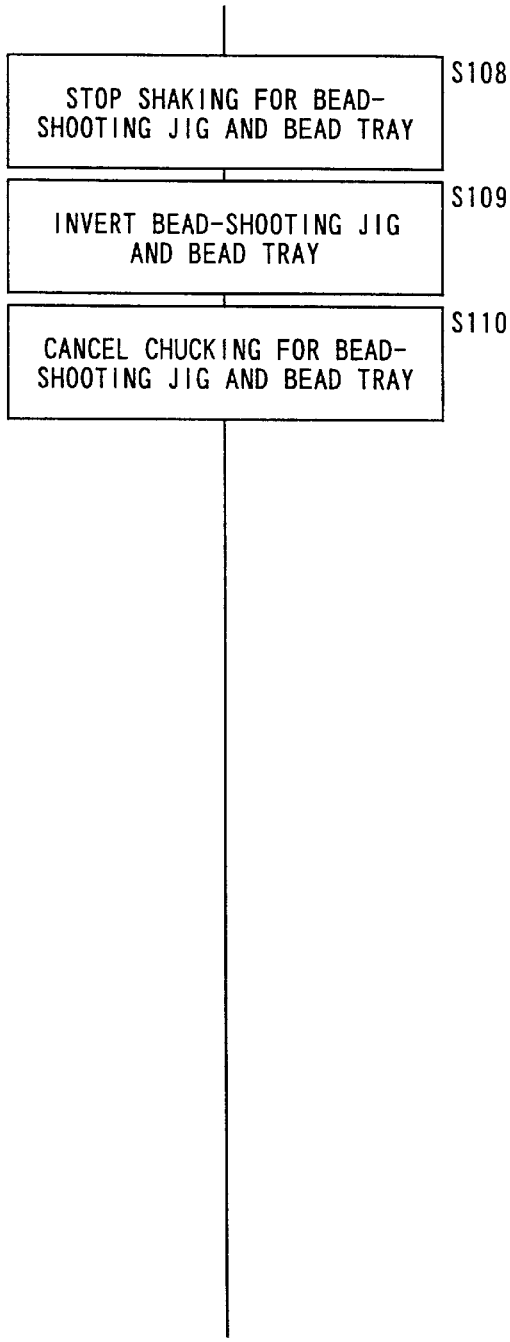
FIG. 28B shows a block diagram (No. 2) depicting steps of the processing action effected for the bead tray, the bead-shooting jig, and the sealing jig disposed in the shooting system.

On the other hand, the second shaking mechanism 2342 stops the shaking operation for the bead tray 92 and the bead-shooting jig 96 in the tight contact state, on the basis of the input of the stop signal Sf4 (step S108 in FIG. 28B). The second inverting mechanism 2340 inverts the bead tray 92 and the bead-shooting jig 96 in the tight contact state, on the basis of the input of the inversion signal Se4 so that the bead tray 92 is disposed downward (step S109 in FIG. 28B).

Subsequently, the control unit 2348 outputs cancel command signals Sd3, Sd4 to the respective chucking mechanisms 2314, 2338. The chucking mechanism 2314 of the lead wire-shooting jig 94 cancels the chucking action for the lead wire tray 90 effected by the chucking pawls 140, on the basis of the input of the cancel command signal Sd3 (step S12 in FIG. 28A). The lead wire tray 90 is placed on the transport passage of the lead wire tray transport mechanism 2312.

On the other hand, the chucking mechanism 2338 of the bead-shooting jig 96 cancels the chucking action for the bead tray 92 effected by the chucking pawls 140, on the basis of the input of the cancel command signal Sd4 (step S110 in FIG. 28B). The bead tray 92 is placed on the transport passage of the bead tray transport mechanism 2336. From this stage, the half of the system on the side for shooting the glass beads 70 is in a waiting state.

Subsequently, the control unit 2348 outputs a start signal Sh1 to the first frontward/backward transport mechanism 2322. The first frontward/backward transport mechanism 2322 transports the lead wire-shooting jig 94 with the anode-side leads 18 vacuum-attracted to the respective communication holes 128 to the lead wire-inserting position P1 on the transport belt 2350, on the basis of the input of the start signal Sh1, and it positions the lead wire-shooting jig 94 (step S13 in FIG. 28A). Accordingly, the respective communication holes 128 of the lead wire-shooting jig 94 are opposed to the respective recesses 58 of the anode-side sealing jig 40.

Subsequently, the control unit 2348 outputs the holding command signal Sd1 to the chucking mechanism 2314. The chucking mechanism 2314 drives the chucking pawls 140 on the basis of the input of the holding command signal Sd1 to hook the lower support plates 52 of the anode-side sealing jig 40 by using the chucking pawls 140 so that the anode-side sealing jig 40 is held thereby. Thus, the lead wire-shooting jig 94 and the anode-side sealing jig 40 are allowed to make tight contact with each other so that the respective communication holes 128 are opposed to the respective recesses 58 (step S14 in FIG. 28A).

After that, the control unit 2348 outputs a suction cancel signal Sg3 to the first suction mechanism 2320. The first suction mechanism 2320 operates and closes the first solenoid-operated valve 2354 on the basis of the input of the suction cancel signal Sg3. Thus, the hollow space 120 of the lead wire-shooting jig 94 is restored to have the atmospheric pressure (step S15 in FIG. 28A).

Accordingly, the anode-side leads 18, which have been inserted into the respective communication holes 128 of the lead wire-shooting jig 94, freely fall toward the recesses 58 of the anode-side sealing jig 40. The outer leads 26 of the anode-side leads 18 are exactly inserted into the lead insertion holes 60 of the anode-side sealing jig 40.

Further, in this embodiment, in order to reliably insert the anode-side leads 18, the shaking action is applied to the lead wire-shooting jig 94 and the anode-side sealing jig 40 allowed to make tight contact with each other by the aid of the chucking mechanism 2314. That is, the control unit 2348 outputs the start signal Sf1 to the first shaking mechanism 2318 at the point of time at which the closing operation is completed for the first solenoid-operated valve 2354 by the first suction mechanism 2320. The first shaking mechanism 2318 applies rotary shaking and linear shaking to the lead wire-shooting jig 94 and the anode-side sealing jig 40 allowed to make tight contact with each other, on the basis of the input of the start signal Sf1 (step S16 in FIG. 28A). Accordingly, the anode-side leads 18 are reliably inserted one by one into the respective recesses 58 of the anode-side sealing jig 40.

Subsequently, the control unit 2348 outputs the stop signal Sf3 to the first shaking mechanism 2318, and then it outputs the cancel command signal Sd3 to the chucking mechanism 2314. The first shaking mechanism 2318 stops the shaking operation for the lead wire-shooting jig 94 and the anode-side sealing jig 40 in the tight contact state, on the basis of the input of the stop signal Sf3 (step S17 in FIG. 28A). The chucking mechanism 2314 cancels the chucking operation for the anode-side sealing jig 40 effected by the chucking pawls 140, on the basis of the input of the cancel command signal Sd3 (step S18 in FIG. 28A). The anode-side sealing jig 40 is placed on the transport belt 2350 of the transport mechanism 2302.

After that, the control unit 2348 outputs a restoration signal Sh3 to the first frontward/backward transport mechanism 2322, and it simultaneously outputs a transport restart signal Sa to the transport mechanism 2302. The first frontward/backward transport mechanism 2322 restores the lead wire-shooting jig 94 to the original position on the basis of the input of the restoration signal Sh3 (step S19 in FIG. 29A).

The transport mechanism 2302 restarts the transport of the anode-side sealing jig 40 on the basis of the input of the transport restart signal Sa. Accordingly, the anode-side sealing jig 40, which is placed on the transport belt 2350, is in turn transported to the bead-inserting position P2, and it is positioned at the bead-inserting position P2 (step S20 in FIG. 29A).

Figure 29A:
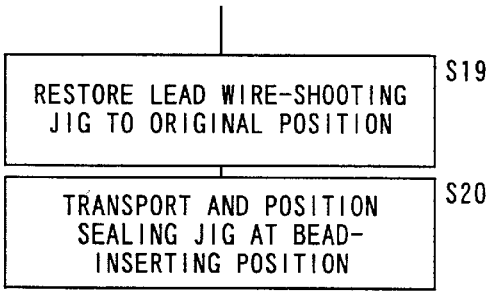
FIG. 29A shows a block diagram (No. 3) depicting steps of the processing action effected for the lead wire tray, the lead wire-shooting jig, and the sealing jig disposed in the shooting system.

At this time, another anode-side sealing jig 40, which has been placed at the jig-introducing position P0 on the transport belt 2350, is positioned at the lead wire-inserting position P1 to repeat the series of processes described above (the processes ranging from the step S6 in FIG. 27A to the step S20 in FIG. 29A). Thus, the anode-side leads 18 are inserted into the respective recesses 58 of the another anode-side sealing jig 40 with the anode bars 20 being directed upwardly.

At the point of time at which the anode-side sealing jig 40 is positioned at the bead-inserting position P2, the control unit 2348 in turn outputs a start signal Sh2 to the second frontward/backward transport mechanism 2346. The second frontward/backward transport mechanism 2346 transports the bead-shooting jig 96 with the glass beads 70 vacuum-attracted to the respective communication holes 162 to the bead-inserting position P2 on the transport belt 2350, on the basis of the input of the start signal Sh2, and it positions the bead-shooting jig 96 (step S111 in FIG. 29B). Accordingly, the respective communication holes 162 of the bead-shooting jig 96 are opposed to the respective recesses 58 of the anode-side sealing jig 40.

Subsequently, the control unit 2348 outputs the holding command signal Sd2 to the chucking mechanism 2338. The chucking mechanism 2338 drives the chucking pawls 140 on the basis of the input of the holding command signal Sd2 to hook the lower support plates 52 of the anode-side sealing jig 40 by using the chucking pawls 140 so that the anode-side sealing jig 40 is held thereby. Thus, the bead-shooting jig 96 and the anode-side sealing jig 40 are allowed to make tight contact with each other so that the respective communication holes 162 are opposed to the respective recesses 58 (step S112 in FIG. 29B).

After that, the control unit 2348 outputs a suction cancel signal Sg4 to the second suction mechanism 2344. The second suction mechanism 2344 operates and closes the second solenoid-operated valve 2356 on the basis of the input of the suction cancel signal Sg4. Thus, the hollow space 150 of the bead-shooting jig 96 is restored to have the atmospheric pressure (step S113 in FIG. 29B).

Accordingly, the glass beads 70, which have been inserted into the respective communication holes 162 of the bead-shooting jig 96, freely fall toward the recesses 58 of the anode-side sealing jig 40. The glass beads 70 are exactly inserted into the anode bars 20 of the anode-side leads 18.

Further, in this embodiment, in order to reliably insert the glass beads 70, the shaking action is applied to the bead-shooting jig 96 and the anode-side sealing jig 40 allowed to make tight contact with each other by the aid of the chucking mechanism 2338 of the bead-shooting jig 96. That is, the control unit 2348 outputs the start signal Sf2 to the second shaking mechanism 2342 at the point of time at which the closing operation is completed for the second solenoid-operated valve 2356 by the second suction mechanism 2344.

Figure 29B:
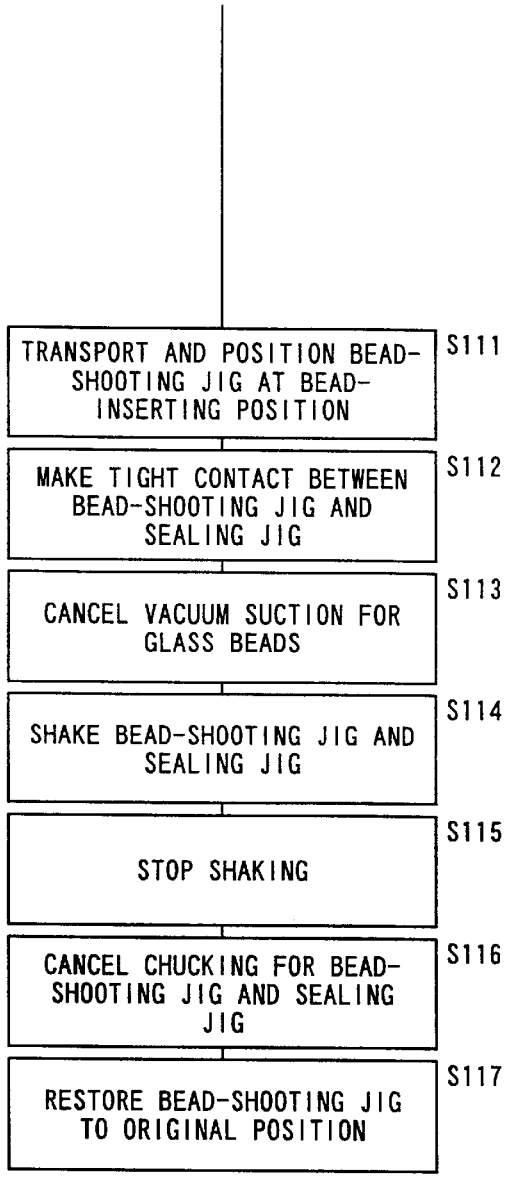
FIG. 29B shows a block diagram (No. 3) depicting steps of the processing action effected for the bead tray, the bead-shooting jig, and the sealing jig disposed in the shooting system.

The second shaking mechanism 2342 applies rotary shaking and linear shaking to the bead-shooting jig 96 and the anode-side sealing jig 40 allowed to make tight contact with each other, on the basis of the input of the start signal Sf2 (step S114 in FIG. 29B). Accordingly, the glass beads 70 are reliably inserted respectively into the anode bars 20 of the anode-side leads 18 inserted into the respective recesses 58 of the anode-side sealing jig 40.

Subsequently, the control unit 2348 outputs the stop signal Sf4 to the second shaking mechanism 2342, and then it outputs the cancel command signal Sd4 to the chucking mechanism 2338. The second shaking mechanism 2342 stops the shaking operation for the bead-shooting jig 96 and the anode-side sealing jig 40 in the tight contact state, on the basis of the input of the stop signal Sf4 (step S115 in FIG. 29B). The chucking mechanism 2338 cancels the chucking operation for the anode-side sealing jig 40 effected by the chucking pawls 140, on the basis of the input of the cancel command signal Sd4 (step S116 in FIG. 29B). The anode-side sealing jig 40 is placed on the transport belt 2350 of the transport mechanism 2302.

After that, the control unit 2348 outputs a restoration signal Sh4 to the second frontward/backward transport mechanism 2346, and it simultaneously outputs the transport restart signal Sa to the transport mechanism 2302. The second frontward/backward transport mechanism 2346 restores the bead-shooting jig 96 to the original position on the basis of the input of the restoration signal Sh4 (step S117 in FIG. 29B).

The transport mechanism 2302 restarts the transport of the anode-side sealing jig 40 on the basis of the input of the transport restart signal Sa. Accordingly, the anode-side sealing jig 40, which is placed on the transport belt 2350, is in turn transported to the next step. At this time, another anode-side sealing jig 40, which has been positioned at the lead wire-inserting position P1, is transported to the bead-inserting position P2 to repeat the series of processes described above (the processes ranging from the step S111 to the step S117 in FIG. 29B). Thus, the glass beads 70 are respectively inserted into the anode bars 20 of the anode-side leads 18 inserted into the respective recesses 58 of the another anode-side sealing jig 40.

The series of processes described above (ranging from the step S6 in FIG. 27A to the step S20 in FIG. 29A and from the step S101 in FIG. 27B to the step S117 in FIG. 29B) are carried out, for example, over several cycles. After that, the cathode-side sealing jig 42 is in turn placed at the jig-introducing position P0 on the transport belt 2350 of the transport mechanism 2302 to perform the process for inserting the cathode-side leads 22 into the cathode-side sealing jig 42. In this process, the cathode-side lower adapter 182 is placed on the transport belt 2350, the cathode-side sealing jig 42 is successively placed on the lower adapter 182, and the upper adapter 180 is placed on the main heater body 44 of the cathode-side sealing jig 42.

The lead wire tray 90, in which the large number of anode-side leads 18 are accommodated, is returned to the introducing port 2308 by the aid of the lead wire tray transport mechanism 2312. The lead wire tray 90, in which a large number of cathode-side leads 22 are accommodated, is in turn positioned at the introducing port 2308 by the aid of the first vertical movement mechanism 2310. The lead wire tray transport mechanism 2312 is used to transport the lead wire tray 90 to the installed position of the lead wire-shooting jig 94.

After that, the processes ranging from the step S6 in FIG. 27A to the step S20 in FIG. 29A are carried out, and thus the cathode-side leads 22 are inserted one by one into the respective recesses 62 of the cathode-side sealing jig 42. The processes ranging from the step S111 to the step S117 in FIG. 29B are carried out, and thus the glass beads 70 are inserted into the cathode bars 32 of the cathode-side leads 22 inserted into the respective recesses 62 of the cathode-side sealing jig 42.

As described above, the shooting system 2000 makes it possible to realize the fully automatic steps of producing the xenon discharge tube 10, especially the automatic step of aligning the lead wires (the anode-side leads 18 and the cathode-side leads 22) performed at the stage prior to the step of sealing the glass tube, and the automatic step of inserting the glass beads 70 into the aligned lead wires. Thus, it is possible to achieve the improvement in production efficiency of the xenon discharge tube 10.

Figure 11B:
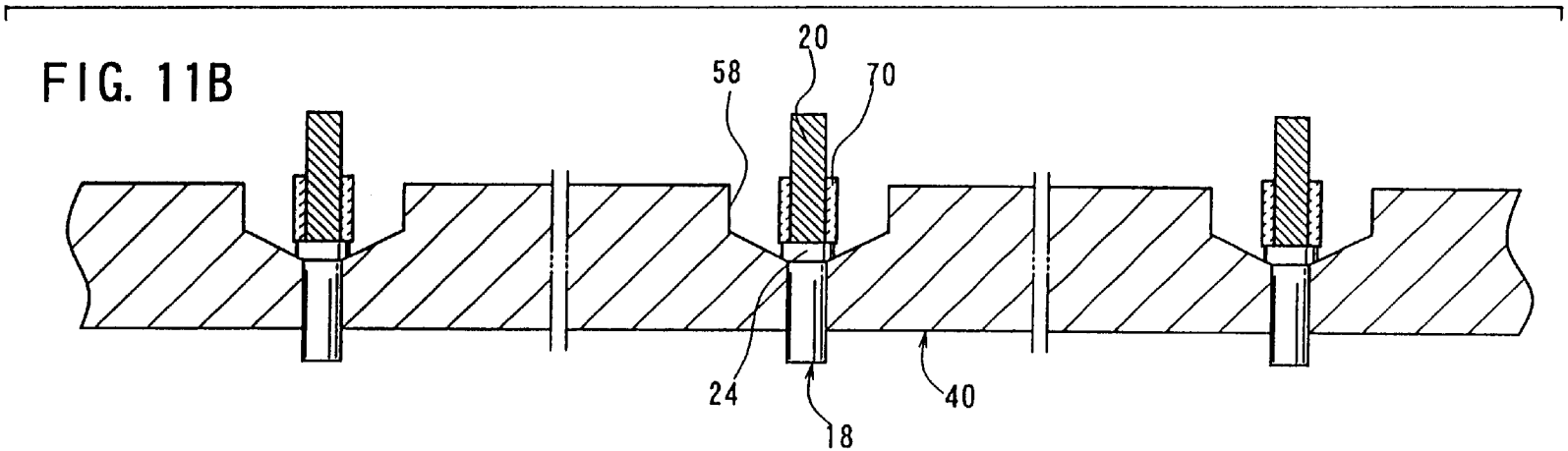
FIG. 11B shows a production step illustrating a bead-fusing step.

Next, the bead-fusing step S12 shown in FIG. 7 is carried out as follows. That is, a bead-fusing machine is used to apply electric power as shown in FIG. 11B so that the anode-side sealing jig 40, into which the anode-side leads 18 are inserted, is heated in an inert gas atmosphere to thermally fuse the glass beads 70 to the electrode bars 20.

Figure 30A:
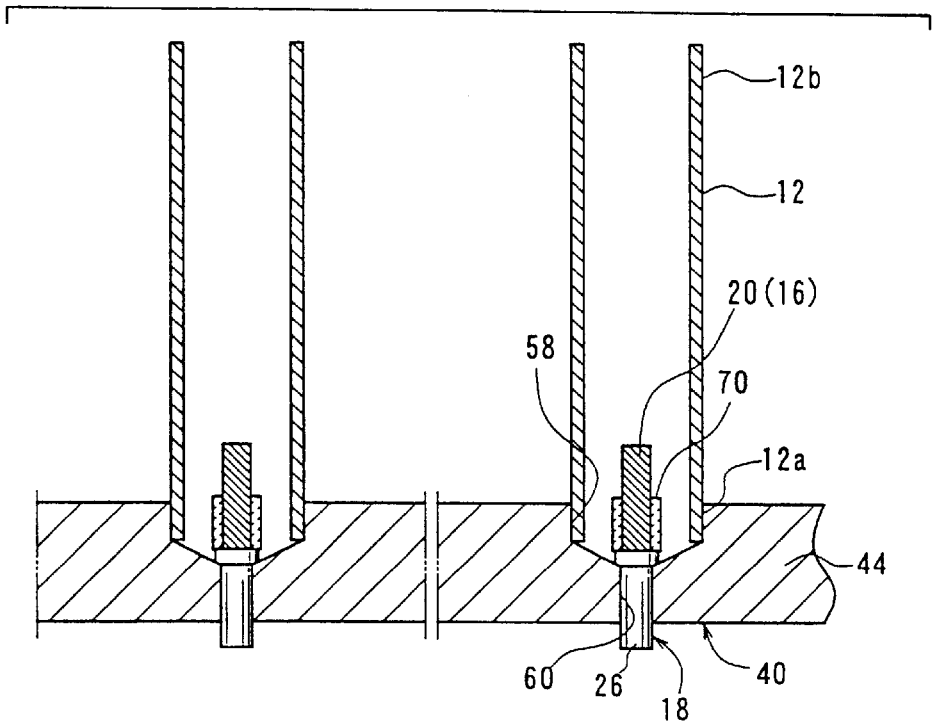
FIG. 30A shows a production step illustrating a glass tube-inserting step in the anode-side assembling process.

Next, the glass tube-inserting step S13 is carried out as follows. That is, as shown in FIG. 30A, a glass tube-inserting machine is used to insert the first ends 12*a* of the glass tubes 12 into the respective recesses 48 of the anode-side sealing jig 40 respectively. During this process, the first end 12*a* of the glass tube 12 is inserted and fixed in the recess 58 in a state in which the first end 12*a* of the glass tube 12 approximately coincides with the forward end surface of the anode-side lead 18 in the height direction.

The following methods are adoptable as the method for inserting the glass tubes 12. In one method, for example, a large number of glass tubes 12 are aligned on a tray, and then the glass tubes 12 are taken out of the tray one by one to insert them into the respective recesses 58 of the anode-side sealing jig 40. In another method, a large number of glass tubes 12 are accommodated in a container called hopper, and the glass tubes 12 are taken out of the bottom of the hopper one by one to insert them into the respective recesses 40 of the anode-side sealing jig 40.

Figure 30B:
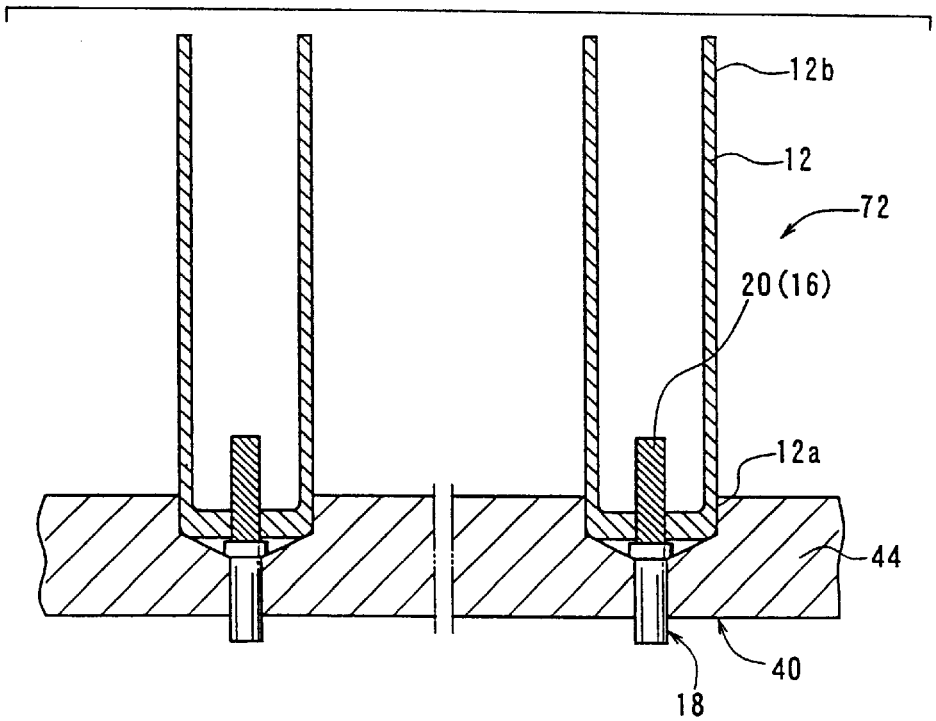
FIG. 30B shows a production step illustrating a primary sealing step.

Next, the primary sealing step S14 shown in FIG. 7 is carried out as follows. That is, as shown in FIG. 30B, a primary sealing machine is used to apply electric power so that the anode-side sealing jig 40, into which the first ends 12*a* of the glass tubes 12 are respectively inserted into the respective recesses 58, is heated in an inert gas atmosphere. The heating causes thermal fusion between the glass bead 70 and the first end 12*a* of the glass tube 12. The first end 12*a* of the glass tube 12 is sealed to the electrode bar 20 of the anode-side lead 18. At this stage, the primary sealed product 72 is produced, in which the first end 12*a* of the glass tube 12 is sealed, and the second end 12*b* of the glass tube 12 is open.

Figure 26:
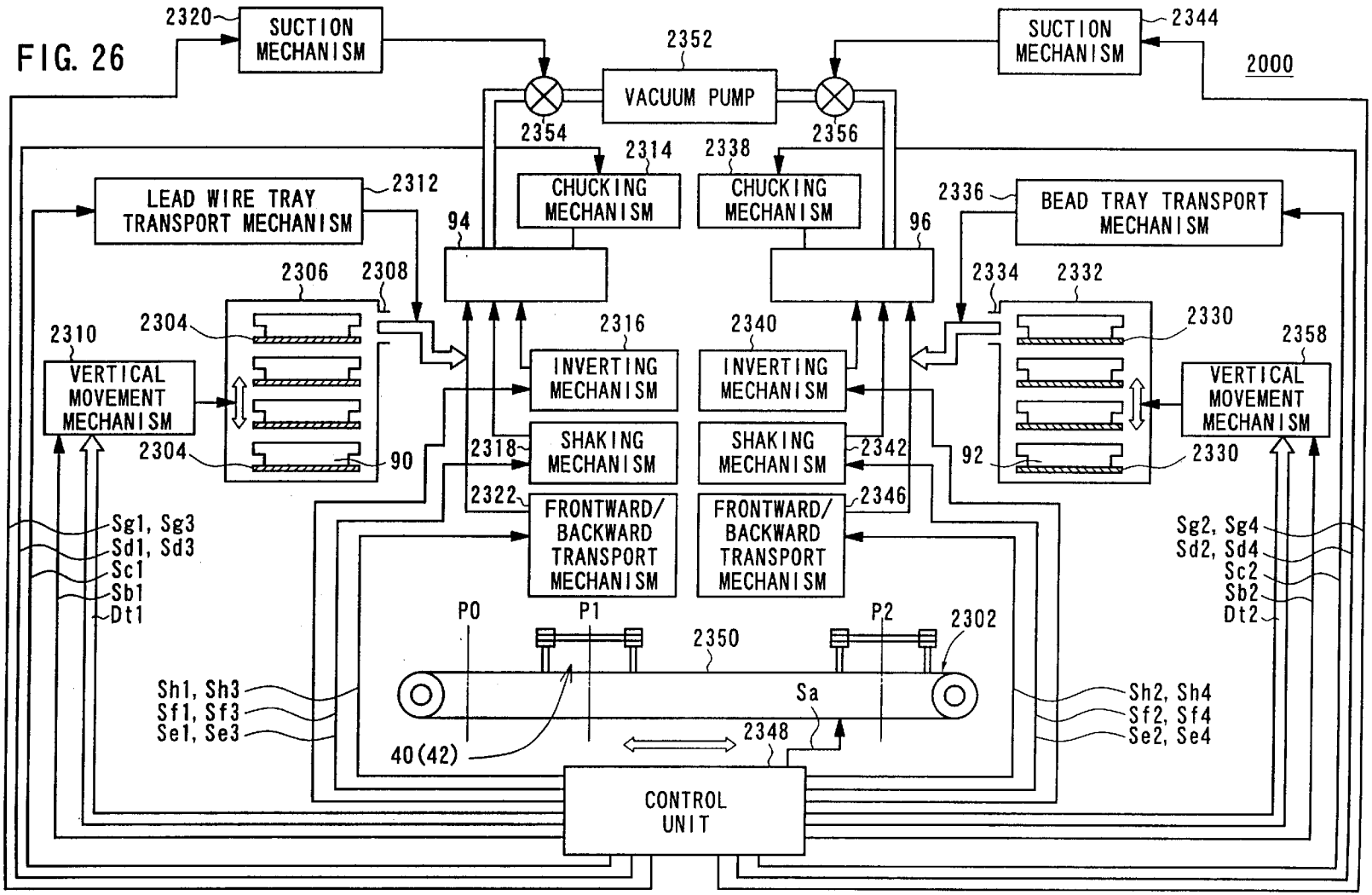
FIG. 26 shows an entire arrangement of a shooting system.
Figure 31A:
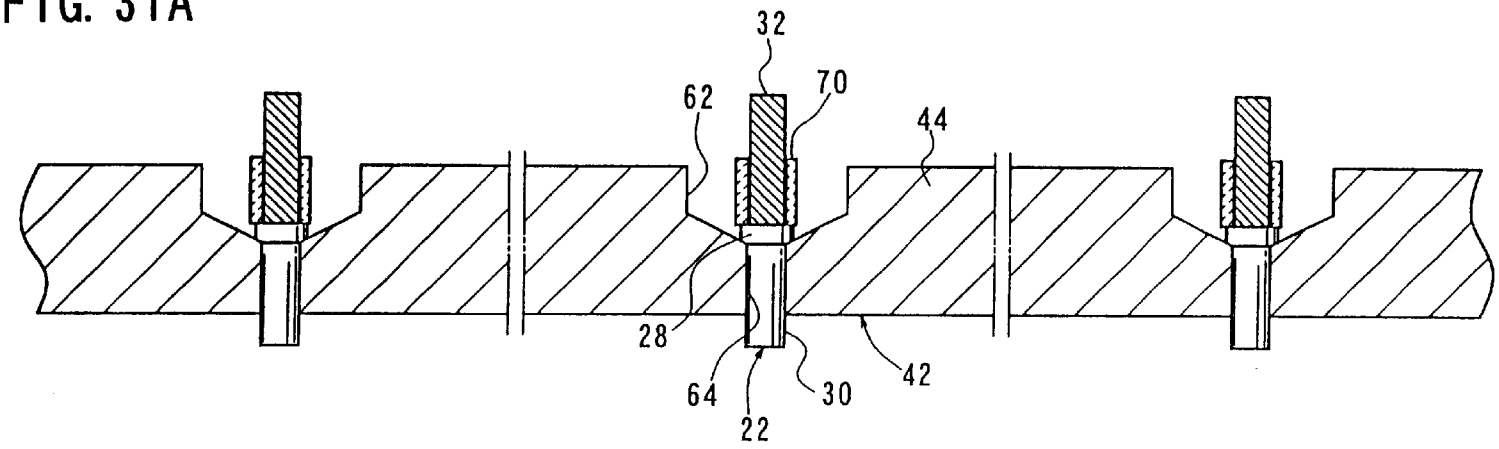
FIG. 31A shows a production step illustrating a cathode-side shooting step in a cathode-side assembling process.

On the other hand, the cathode-side assembling process S2 shown in FIG. 7 is carried out as follows. That is, in the first cathode-side shooting step S21, the shooting system 2000 shown in FIG. 26 is used to insert the cathode-side leads 22 into the respective lead insertion holes 56 of the cathode-side sealing jig 42 as shown in FIG. 31A.

Also in this process, the diameter of the forward end portion 28 of the cathode-side lead 22 (the portion to which the electrode bar 32 is secured) is processed to be larger than the outer lead 30 and larger than the diameter of the lead insertion hole 56, in the same manner as in the anode-side lead 18. Therefore, the electrode bar 32, which is secured to the forward end portion 28 of the cathode-side lead 22, is necessarily positioned in the recess 64. Further, each of the cathode-side leads 22 is in a state in which its axial direction is in the vertical direction.

The two methods for inserting the anode-side lead 18 described above may be adopted as the method for inserting the cathode-side lead 22.

A large number of cathode-side leads 22 are inserted into the respective lead insertion holes 64 of the cathode-side sealing jig 42 in accordance with any one of the foregoing methods. After that, the ring-shaped glass beads 70 are inserted into the electrode bars 32 of the respective cathode-side leads 22 in the state in which the cathode-side leads 22 have been inserted. The diameter of the glass bead 70 is set to be larger than the diameter of the electrode bar 32 and smaller than the diameter of the forward end portion 28 of the cathode-side lead 22. Therefore, the glass bead 70 is placed on the forward end portion 28 of the cathode-side lead 22 so that the proximal portion of the electrode bar 32 is surrounded thereby. Those adoptable as the method for inserting the glass beads 70 into the electrode bars 32 include the same method as those used to insert the anode-side leads 18 into the lead insertion holes 64 of the anode-side sealing jig 40.

That is, the lead wire-introducing system 1000 and the shooting system 2000 shown in FIGS. 21 and 26 may be used to shoot the cathode-side leads 22 into the respective insertion holes 64 of the cathode-side sealing jig 42 and insert the glass beads 70 into the cathode-side leads 22.

Figure 31B:
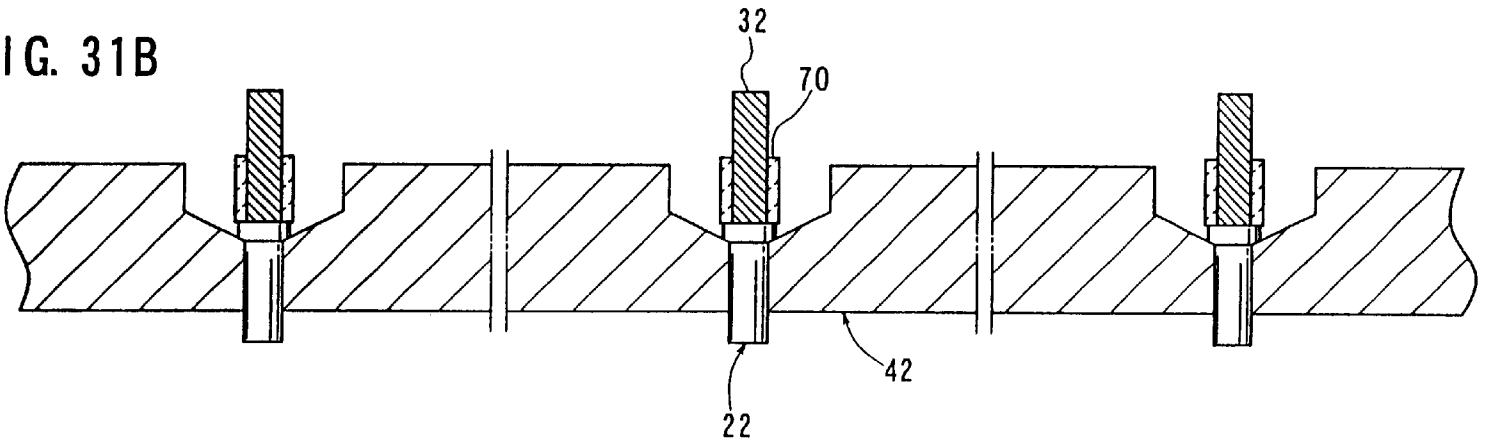
FIG. 31B shows a production step illustrating a bead-fusing step.
Figure 32:
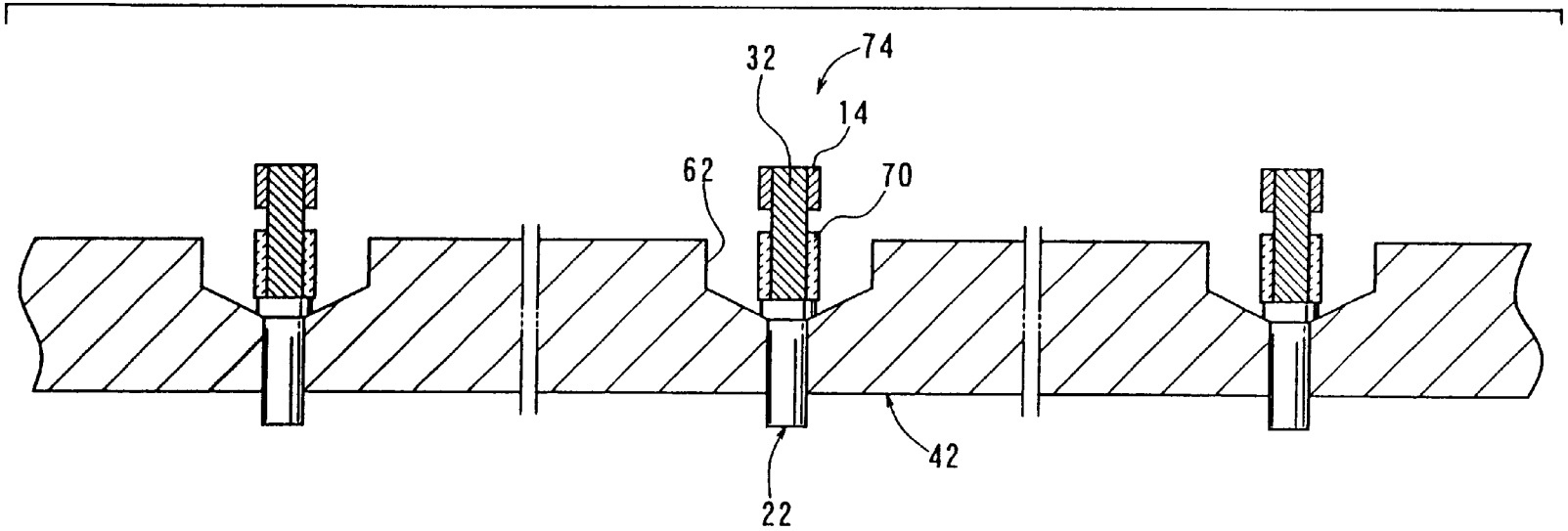
FIG. 32 shows a production step illustrating a cathode-caulking step.

Next, the bead-fusing step S22 shown in FIG. 7 is carried out as follows. That is, the bead-fusing machine is used to apply electric power as shown in FIG. 31B so that the cathode-side sealing jig 42, into which the cathode-side leads 22 are inserted, is heated in an inert gas atmosphere to thermally fuse the glass beads 70 to the electrode bars 32. Next, the cathode-caulking step S23 is carried out as follows. That is, an automatic caulking machine is used as shown in FIG. 32 so that the ring-shaped cathodes 14 are inserted into the electrode bars 32. After that, the cathode 14 is caulked to the forward end portion of the electrode bar 32 to secure the cathode 14 to the forward end portion of the electrode bar 32. Thus, the cathode member 74 is produced.

Figure 33A:
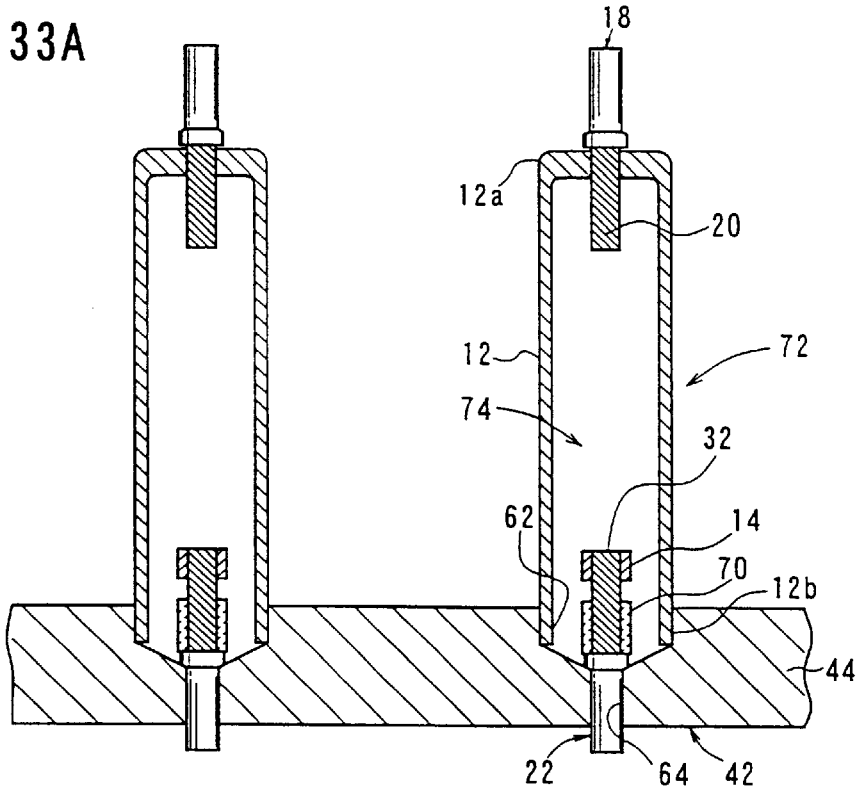
FIG. 33A shows a production step illustrating a state in which the glass bead is inserted into a cathode bar of the cathode-side lead inserted into the cathode-side sealing jig, the cathode is thereafter caulked to a forward end portion of the cathode bar to produce a cathode member, and a second end of the primary sealed product is inserted into a recess of the cathode-side sealing jig.

Next, the assembling process S3 shown in FIG. 7 is carried out as follows. That is, in the first inverting step S31, as shown in FIG. 33A, an inverting machine is used to invert the primary sealed products 72 (see FIG. 30B) produced in the primary sealing step S14 of the anode-side assembling process S1. The second ends 12*b* (open ends) of the glass tubes 12 of the respective primary sealed products 72 are disposed downward.

After that, the second ends 12*b* of the glass tubes 12 of the primary sealed products 72 are respectively inserted into the respective recesses 62 of the cathode-side sealing jig 42 into which the cathode members 74 have been inserted. During this process, the second end 12*b* of the glass tube 12 is inserted and fixed in the recess 62 in a state in which the second end 12*b* of the glass tube 12 approximately coincides with the forward end plane of the cathode-side lead 22 in the height direction.

Figure 33B:
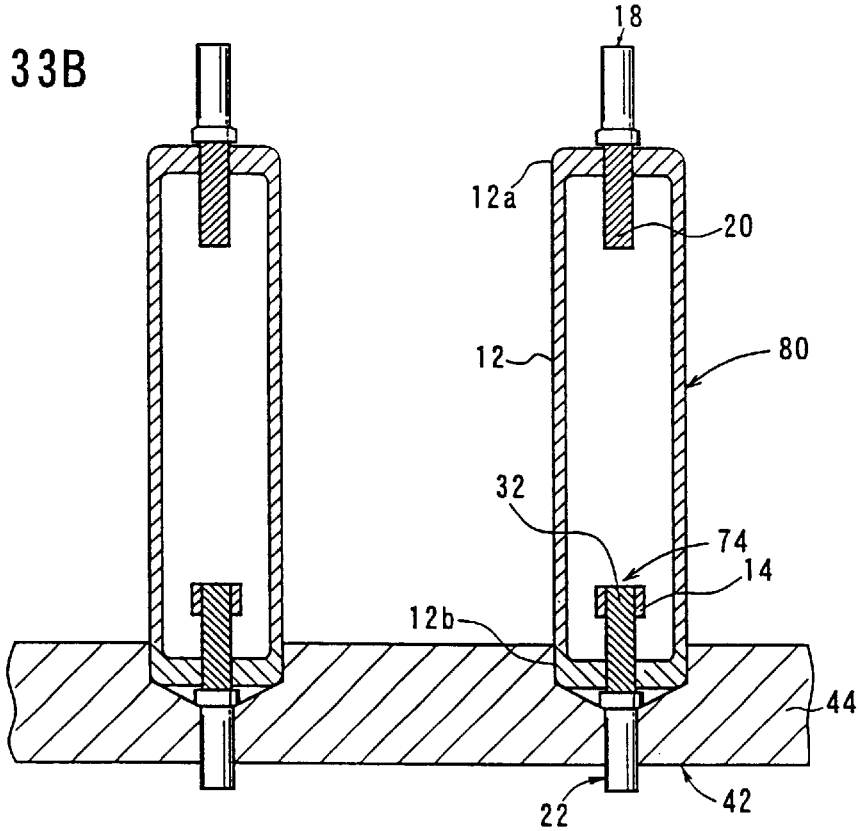
FIG. 33B shows a production step illustrating a state in which the second end of the primary sealed product is sealed to the cathode bar of the cathode-side lead to produce a secondary sealed product.

Next, the secondary sealing step S32 is carried out as follows. That is, as shown in FIG. 33B, a secondary sealing processing apparatus 3000 as described later on is used to apply electric power so that the cathode-side sealing jig 42, in which the second ends 12*b* of the glass tubes 12 are inserted into the respective recesses 62, is heated in a xenon gas atmosphere. Thus, the glass bead 70 is glass-fused to the second end 12*b* of the glass tube 12.

As shown in FIG. 7, the secondary sealing step S32 comprises at least three subdivided steps. Specifically, the secondary sealing step S32 comprises a cleaning step S301 for exposing the workpiece (the cathode-side sealing jig 42 in which the second ends 12*b* of the glass tubes 12 are respectively inserted into the respective recesses 62) to a negative pressure atmosphere prior to the electric power application and heating for the cathode-side sealing jig 42 so that impurities are removed from at least the inside of the glass tubes 12, a sealing step S302 for applying electric power and heating the cathode-side sealing jig 42 in a negative pressure atmosphere and in a xenon gas atmosphere, and a cooling step S303 for cooling at least the cathode-side sealing jig 42 in a negative pressure atmosphere.

Accordingly, at first, the cathode-side sealing jig 42, into which the glass tubes 12 as the primary sealed products 72 are inserted, is introduced into the cleaning step S301. In the cleaning step S301, the cathode-side sealing jig 42 is exposed to the negative pressure atmosphere prior to the application of electric power and heating for the cathode-side sealing jig 42. Therefore, the impurities, which exist in the interior of the glass tubes 12 inserted into the cathode-side sealing jig 42, are removed to the outside by means of the negative pressure.

After that, the cathode-side sealing jig 42, into which the glass tubes 12 are inserted, is introduced into the next sealing step S302. In the sealing step S302, the electric power is applied to heat the cathode-side sealing jig 42 in the negative pressure atmosphere and in the xenon gas atmosphere. The heating causes thermal fusion between the glass bead 70 and the first end 12*a* of the glass tube 12. The second end 12*b* of the glass tube 12 is sealed to the electrode bar 32 of the cathode member 74. At this stage, the second ends 12*b* of the glass tubes 12 of the primary sealed products 72 are fused to the respective corresponding cathode-side leads 22 to produce the secondary sealed products 80 in which xenon gas is enclosed in the glass tubes 12. The secondary sealed products 80, which are discharged from the sealing step S302, are cooled in the negative pressure atmosphere in the next cooling step S303. The xenon gas, which remains in the sealing tank, is recovered and reused.

The arrangement of the secondary sealing processing apparatus 3000 will be explained with reference to FIGS. 34 to 50.

Figure 34:
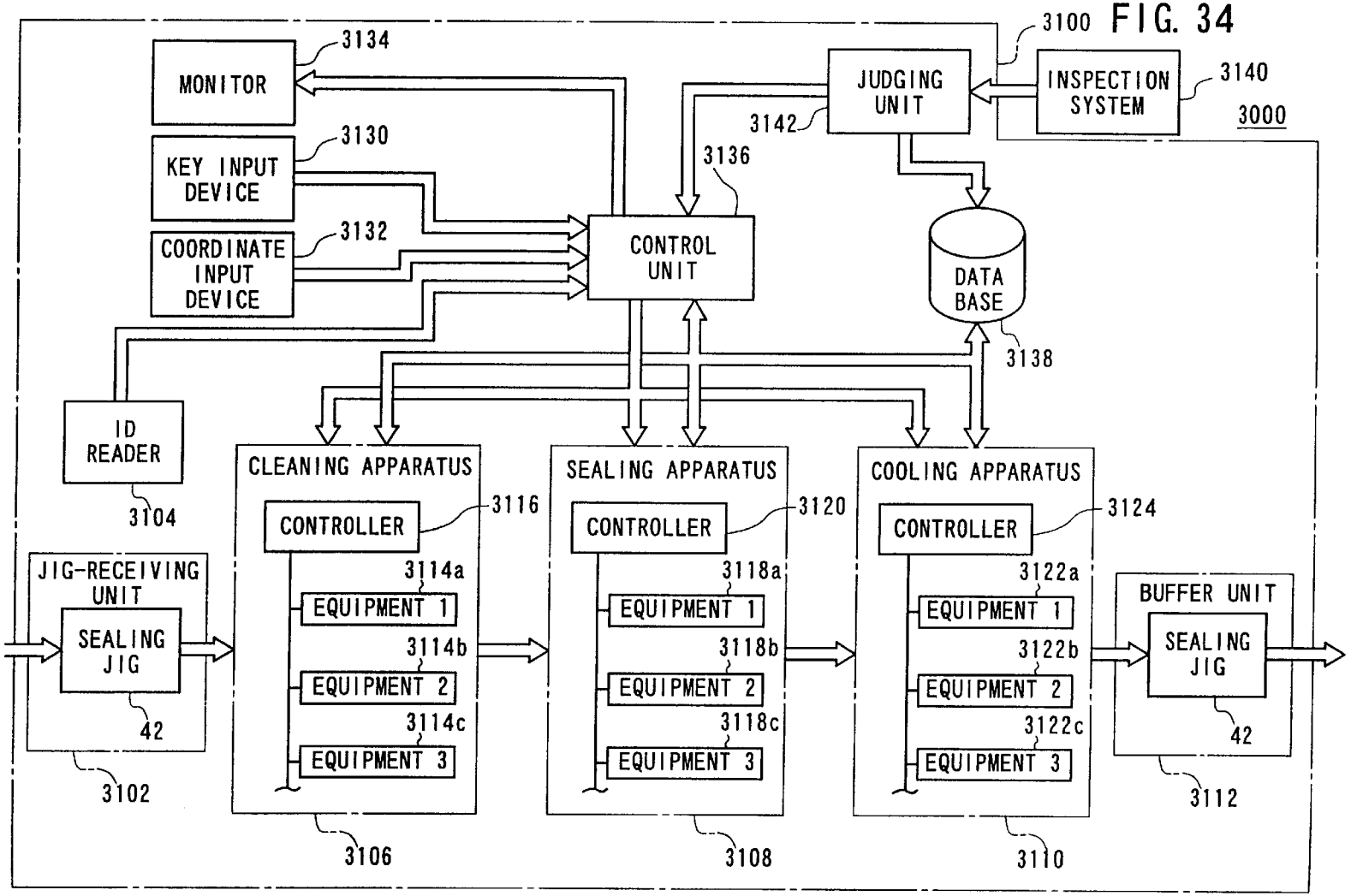
FIG. 34 shows a block diagram illustrating an arrangement of a secondary sealing processing apparatus.

As shown in FIG. 34, the secondary sealing processing apparatus 3000 comprises a jig-receiving unit 3102 for introducing and placing the cathode-side sealing jig 42, an ID reader 3104 for reading the jig number and ID of the cathode-side sealing jig 42 introduced into the jig-receiving unit 3102, a cleaning apparatus 3106 for removing impurities from at least the inside of the glass tubes 12 by exposing, to the negative pressure atmosphere, the workpiece in which the second end 12*b* of the glass tube 12 is inserted into each recess 64 of the cathode-side sealing jig 42 prior to the electric power application and heating for the cathode-side sealing jig 42, a sealing apparatus 3108 for applying the electric power to heat the cathode-side sealing jig 42 in the negative pressure atmosphere and in the xenon gas atmosphere, a cooling apparatus 3110 for cooling at least the cathode-side sealing jig 42 in the negative pressure atmosphere, and a buffer unit 3112 for temporarily accommodating the cathode-side sealing jig 42 after completion of the secondary sealing step S32 shown in FIG. 7.

The cleaning apparatus 3106 comprises a first controller 3116 for analyzing the contents of record data supplied from a control unit 3136 described later on to prepare and output sequence data for driving and controlling various types of equipment 3114*a*, 3114*b*, 3114*c* . . . included in the cleaning apparatus 3106.

The sealing apparatus 3108 comprises a second controller 3120 for analyzing the contents of record data supplied from the control unit 3136 to prepare and output sequence data for driving and controlling various types of equipment 3118*a*, 3118*b*, 3118*c* . . . included in the sealing apparatus 3108.

The cooling apparatus 3110 comprises a third controller 3124 for analyzing the contents of record data supplied from the control unit 3136 to prepare and output sequence data for driving and controlling various types of equipment 3122*a*, 3122*b*, 3122*c* . . . included in the cooling apparatus 3110.

In addition to the various apparatuses and units described above, the secondary sealing processing apparatus 3000 further comprises the control unit 3136 for controlling the first to third controllers 3116, 3120, 3134 in an adaptive manner corresponding to the cleaning process, the sealing process, and the cooling process on the basis of pattern information set by using, for example, a key input device 3130, a coordinate input device 3132, and a monitor 3134 to optimally perform the secondary sealing process, a data base 3138 for storing, for example, various tables and pattern information prepared in the control unit 3136, and a judging unit 3142 for making judgment on applicability of the cathode-side sealing jig 42 on the basis of an inspection result (production history table) supplied from an inspection system 3140 as described later on.

In the secondary sealing step S32 shown in FIG. 7, the time-dependent change of the cathode-side sealing jig 42, especially the change of the contact plane between the main heater body 44 and the upper and lower support plates 50, 52 (steel plates) as shown in FIG. 9 causes the change in temperature distribution of the main heater body 44. Therefore, it is difficult to produce the xenon discharge tube 10 having a constant quality under a constant sealing condition.

Accordingly, the jig number is previously affixed to the cathode-side sealing jig 42. When the cathode-side sealing jig 42 is introduced into the secondary sealing processing apparatus 3000, the affixed jig number is read by using the ID reader 3104 to automatically set a sealing condition which is optimum for the sealing jig 42 specified by the jig number.

The cathode-side sealing jig 42 undergoes the time-dependent change as described above. Therefore, a problem arises in that the non-defective ratio is extremely deteriorated unless the sealing condition is changed. In this context, a method is conceived, in which the finished secondary sealed product 80 is self-observed by an operator to judge the sufficient or insufficient degree of sealing so that the sealing condition is set again. However, in order to observe the secondary sealed product 80, it is necessary to forcibly withdraw the secondary sealed product 80 from the cathode-side sealing jig 42. In such a procedure, when the secondary sealed product 80 is returned to the cathode-side sealing jig 42 after the observation, it is feared that the lead wires of the neighboring secondary sealed products 80 are bent, and the neighboring secondary sealed products 80 become defective.

Accordingly, the secondary sealing processing apparatus 3000 is used as follows. That is, as shown in FIG. 7, each of the outer leads 26, 30 of the anode-side leads 18 and the cathode-side leads 22, which is led from the both ends of the glass tube 12 as the secondary sealed product 80, is cut into a predetermined length in the lead-cutting step S33. After that, in the tube diameter inspection and light emission inspection step S34, the tube diameter of the secondary sealed product 80 is measured, and the inspection is performed to confirm whether or not the secondary sealed product 80 emits light.

Figure 35A:
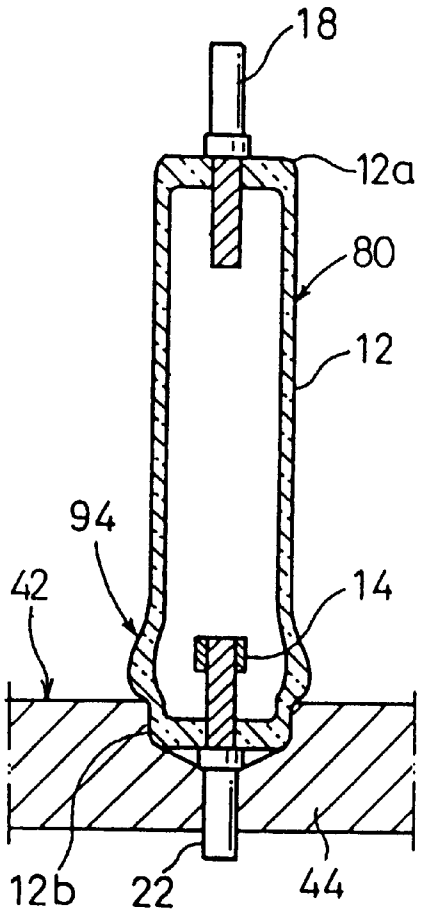
FIG. 35A illustrates a glass tube subjected to excessive glass sealing.
Figure 35B:
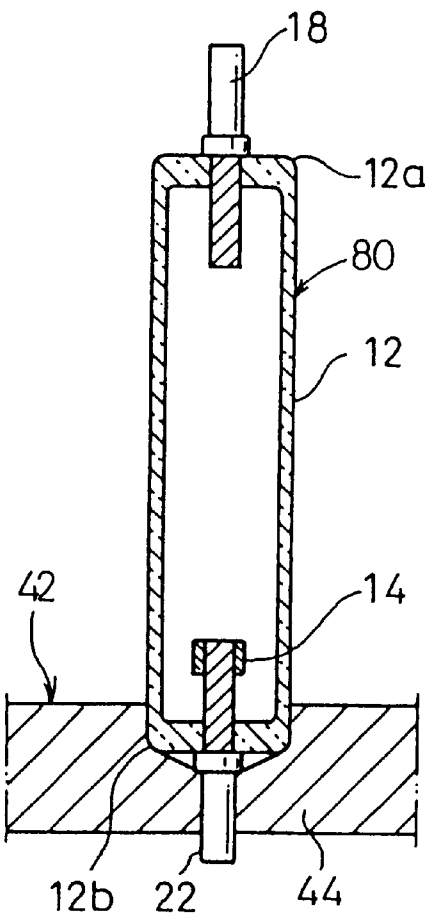
FIG. 35B illustrates a glass tube subjected to normal glass sealing.
Figure 35C:
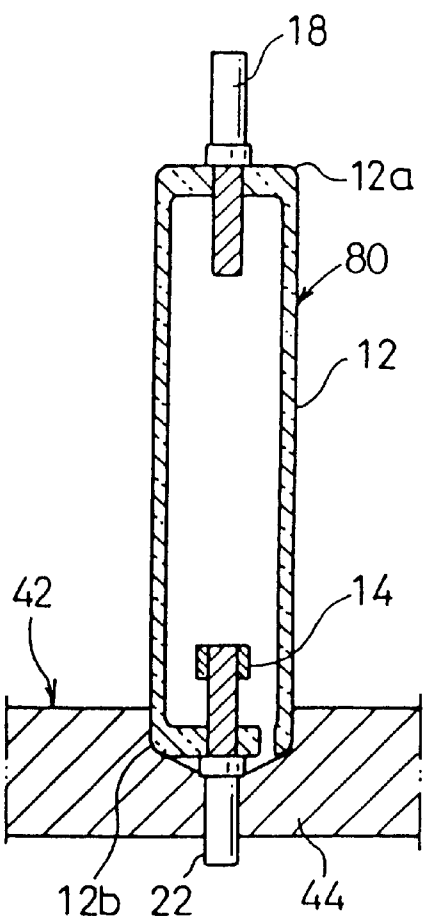
FIG. 35C illustrates a glass tube subjected to insufficient glass sealing.

The quality data for the xenon discharge tube 10 especially includes important data concerning whether or not the sealed portion is adequately fused. If the sealing is excessive, the temperature is high in the vicinity of the glass fused portions (the first end 12*a* and the second end 12*b* of the glass tube) as shown in FIG. 35A. In this case, the glass is softened at portions other than the fused portions (12*a*, 12*b*), and the bulge 94 is produced due to the own weight as compared with the normal secondary sealed product 80 shown in FIG. 35B. If the sealing is insufficient, the fused portions (12*a*, 12*b*) are not completely fused. As a result, the xenon gas leaks, and no light emission occurs.

Therefore, it is possible to inspect whether or not the sealing is excessive by measuring the diameter (tube diameter) of the glass sealed portion (for example, the second end 12*b*) of the glass tube 12 of the secondary sealed product 80. It is possible to inspect whether or not the sealing is insufficient by measuring the presence or absence of light emission caused by the secondary sealed product 80.

The secondary sealing processing apparatus 3000 is designed to previously store, as pattern numbers, the ordinary secondary sealing condition, the secondary sealing condition concerning the defective light emission, and the secondary sealing condition concerning the defective tube diameter for every cathode-side sealing jig 42 to execute a feedback process in which the secondary sealing condition is changed on the basis of the inspection result supplied from the inspection system 3140.

Next, explanation will be made with reference to FIGS. 36 to 48 for the inspection system 3140 for cutting the lead wires of the secondary sealed product 80, inspecting the tube diameter, and inspecting the light emission. The secondary sealed product 80, which is processed by using the inspection system 3140, is referred to as "workpiece 80". The anode-side lead 18 and the cathode-side lead 22 are collectively referred to as "lead wire 18, 22".

Figure 37:
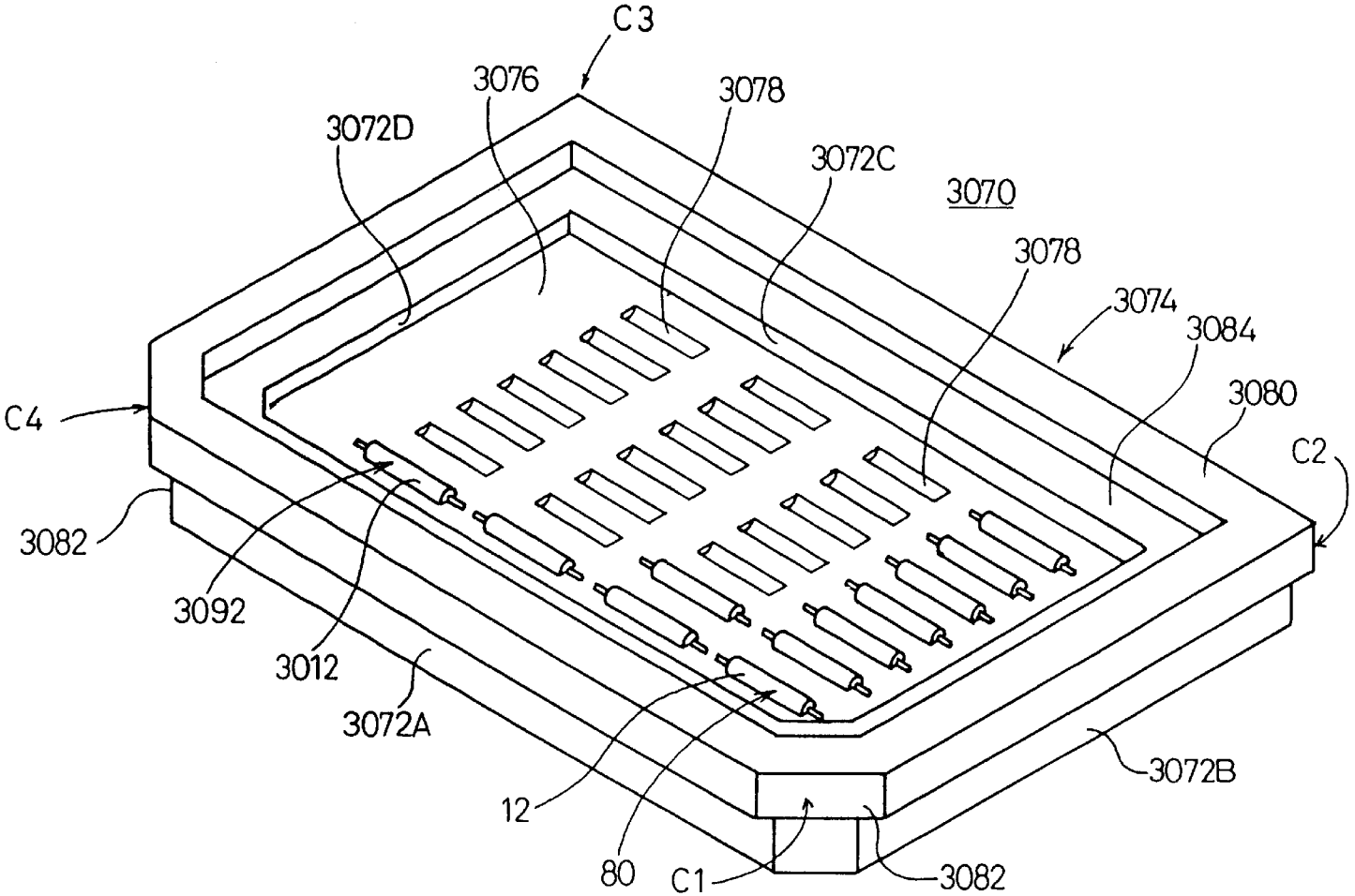
FIG. 37 shows a structure of a tray to be used for the inspection system.

The inspection system 3140 uses a tray 3070 shown in FIG. 37 in addition to the cathode-side sealing jig 42 described above. As shown in FIG. 37, the tray 3070 is composed of a housing 3074 having a bottomed box-shaped configuration and having a substantially rectangular planar configuration with side walls 3072A to 3072D on its four sides. A large number of recesses 3078 are formed in a matrix form on a bottom 3076 of the housing 3074 in a state in which their longitudinal direction is coincident with the longitudinal direction of the housing 3074. Each of the recesses 3078 has a size capable of placing the secondary sealed product 80 of the xenon discharge tube 10 respectively laterally and independently as described later on. Specifically, the recess 3078 has a curvature which is slightly larger than that of the glass tube 12 as the secondary sealed product 80, and it has approximately the same length as that of the glass tube 12.

The housing 3074 is integrally formed with a flange 3080 disposed at its upper portion. Two corners C2, C3 of respective corners C1 to C4 of the flange 3080, which are located at both ends of an identical side, are formed to have a slightly curved configuration having the same curvature respectively. The remaining two corners C1, C4 are chamfered in oblique directions respectively to form tapered surfaces 3082. The tapered surfaces 3082 formed by the chamfering make it possible to specify the direction of the tray 3070, making it possible to have a function of so-called home position setting in the automatic transport of the tray 3070. Thus, it is possible to further facilitate realization of the automatic transport step.

The flange 3080 has a rectangular and annular step 3084 which is formed at the inside thereof. The shape, which is comparted and formed by the step 3084, is approximately the same as or slightly larger than the bottom profile of the housing 3074. Accordingly, when another tray 3070 is placed on one tray 3070, the plurality of trays 3070 can be stably stacked by inserting the bottom 3076 of the tray 3070 disposed upward into the step 3084 of the flange 3080 of the tray 3070 disposed downward.

Figure 36:
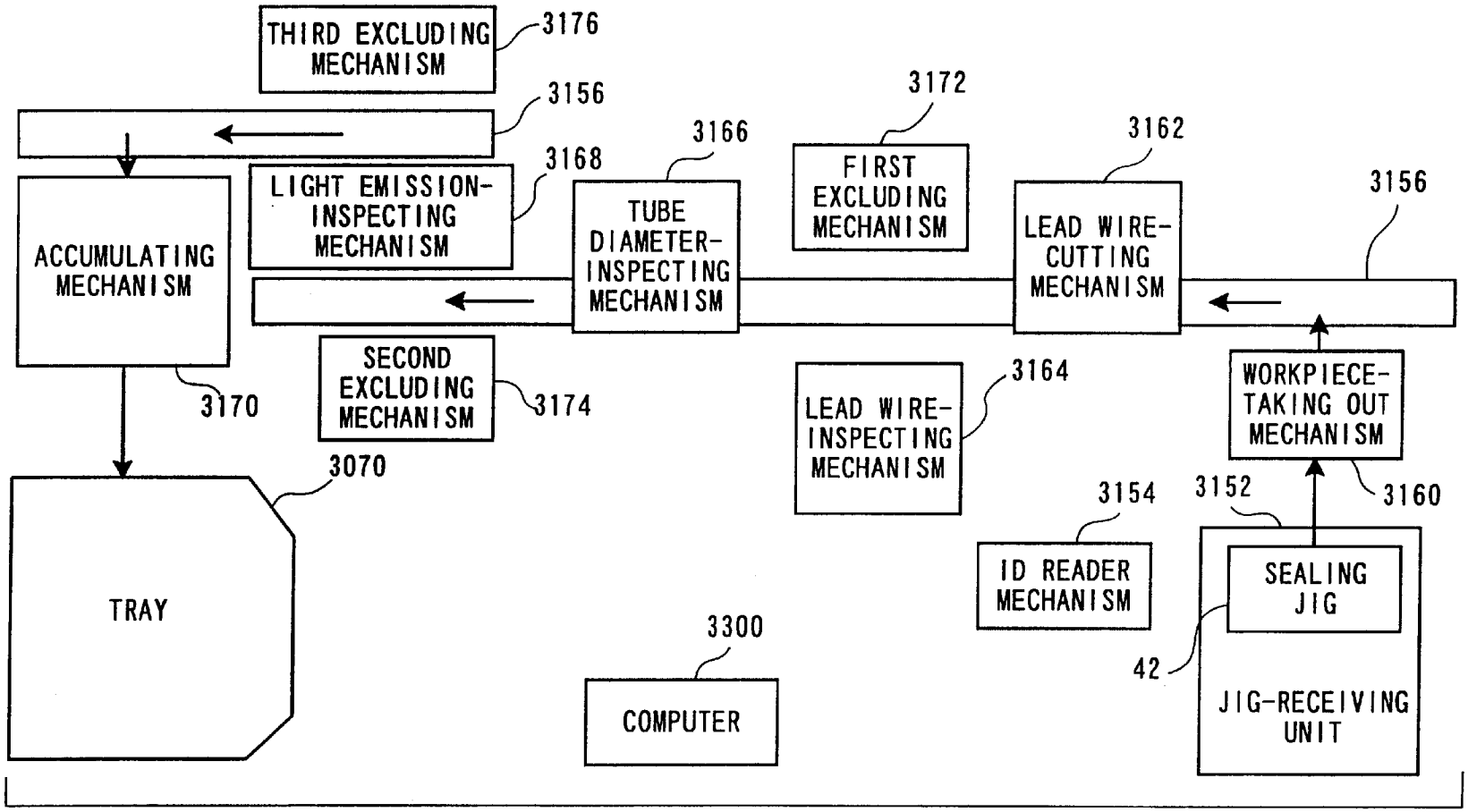
FIG. 36 shows an arrangement of an inspection system.

As shown in FIG. 36, the inspection system 3140 makes it possible to collect quality data for the workpieces 80 for every cathode-side sealing jig 42 and manage the quality data for the unit of cathode-side sealing jig 42. The inspection system 3140 comprises a jig-receiving unit 3152 for introducing and placing the cathode-side sealing jig 42, an ID reader mechanism 3154 for reading ID of the cathode-side sealing jig 42 placed on the jig-receiving unit 3152, a workpiece-taking out mechanism 3160 for simultaneously taking a plurality of workpieces 80 out of the cathode-side sealing jig 42 to transport the workpieces 80 to a transport mechanism 3156 so that the plurality of workpieces 80 are placed laterally on a transport stand 3158 (see FIG. 39) of the transport mechanism 3156, the transport mechanism 3156 for successively transporting, in a first direction, the plurality of workpieces 80 transported by the workpiece-taking out mechanism 3160 in a state of being placed laterally respectively, a lead wire-cutting mechanism 3162 for cutting the lead wire 18, 22 to have a predetermined length for each of the workpieces 80, a lead wire-inspecting mechanism 3164 for inspecting whether or not the length of the lead wire 18, 22 after the cutting is within a predetermined length range, a tube diameter-inspecting mechanism 3166 for inspecting the diameter of the glass tube 12 at the glass sealed portion (in the vicinity of the second end 12*b*) of the workpiece 80, a light emission-inspecting mechanism 3168 for inspecting the light emission state of the workpiece 80, and an accumulating mechanism 3170 for accumulating, on the tray 3070, the workpieces 80 acknowledged to be adequate, of the workpieces 80 for which the light emission inspection has been finished.

The phrase that the lead wire 18, 22 is cut to have the predetermined length by using the lead wire-cutting mechanism 3162 means that extra portions on both sides are cut and removed so that the lead wire 18, 22 after the cutting has the predetermined length.

The lead wire-inspecting mechanism 3164 measures the length of the lead wire 18, 22 after the cutting to output a measured value as a lead wire length. The lead wire-inspecting mechanism 3164 judges whether or not the lead wire length is within a predetermined length range. An obtained judgement result is outputted as bit information (1/0=adequate/defective).

The tube diameter-inspecting mechanism 3166 measures the diameter of the glass tube 12 at the glass sealed portion (in the vicinity of the second end 12*b*) of the workpiece 80 to output a measured value as a tube diameter. The tube diameter-inspecting mechanism 3166 judges whether or not the tube diameter is within a predetermined diameter range. An obtained judgement result is outputted as bit information (1/0=adequate/defective).

The light emission-inspecting mechanism 3168 measures the presence or absence of light emission of the workpiece 80, for example, by using the voltage. The light emission-inspecting mechanism 3168 judges whether or not the number of times of light emission is not less than a predetermined number of times. An obtained judgement result is outputted as bit information (1/0=adequate/defective). Alternatively, the light emission-inspecting mechanism 3168 measures the light emission intensity of the workpiece 80, for example, by using a photoelectric tube. The light emission-inspecting mechanism 3168 outputs a measured value as a light emission intensity, and it judges whether or not the light emission intensity is within a predetermined range. An obtained judgement result is outputted as bit information (1/0=adequate/defective).

In addition to the various mechanisms described above, the inspection system 3140 comprises a first excluding mechanism 3172 for excluding, from the transport passage of the transport mechanism 3156, the workpiece 80 judged to be NG by the lead wire-inspecting mechanism 3164, a second excluding mechanism 3174 for excluding, from the transport passage of the transport mechanism 3156, the workpiece 80 judged to be NG by the tube diameter-inspecting mechanism 3166, and a third excluding mechanism 3176 for excluding, from the transport passage of the transport mechanism 3156, the workpiece 80 judged to be NG by the light emission-inspecting mechanism 3168. Defective workpieces 80, which are excluded by any excluding mechanism of the first to third excluding mechanisms 3172 to 3176, are transported to a separately installed station.

Figure 38:
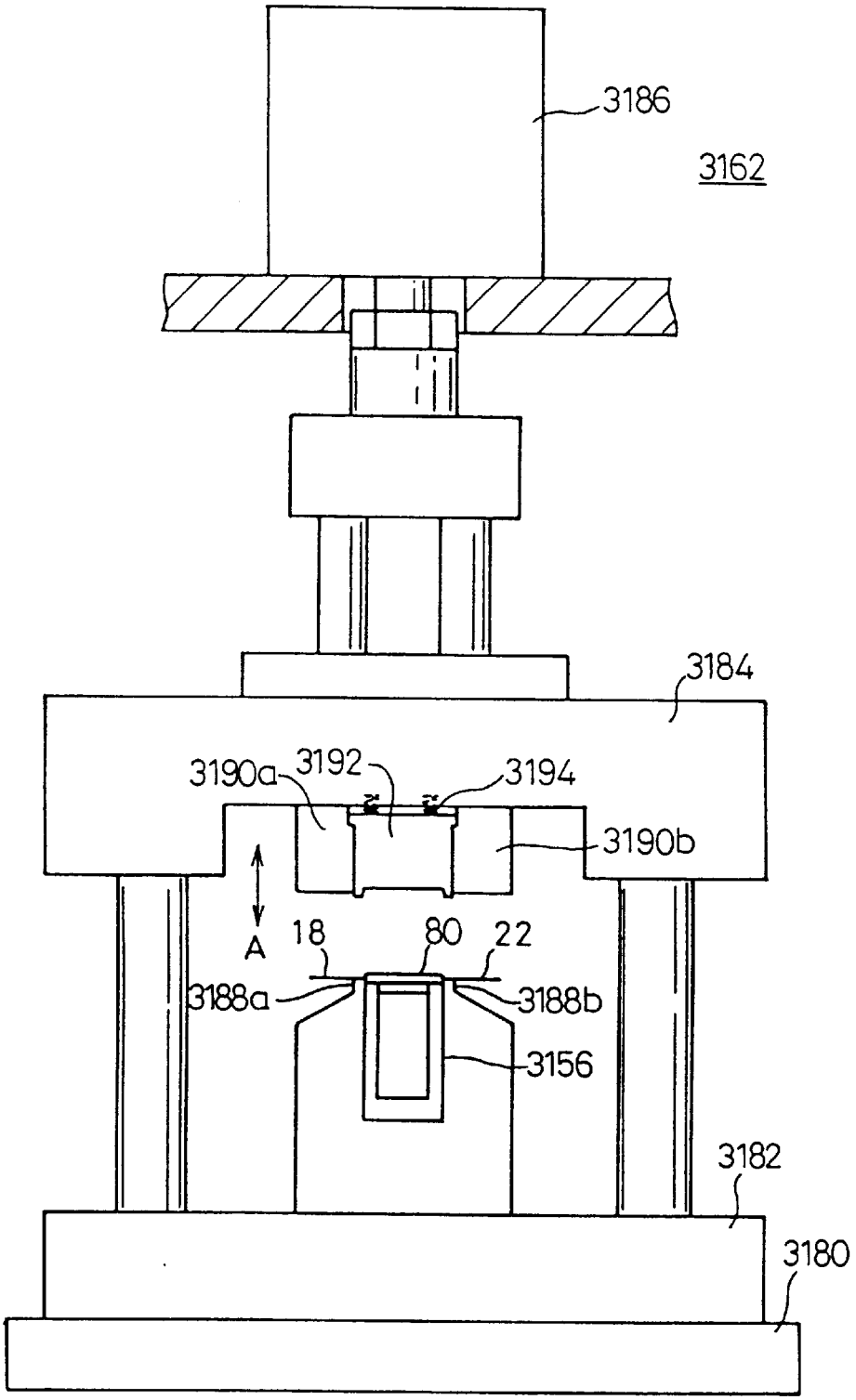
FIG. 38 shows an arrangement of a lead wire-cutting mechanism.

Of the various mechanisms for constructing the inspecting mechanism 3140, the lead wire-cutting mechanism 3162 is specifically constructed, for example, as shown in FIG. 38. In this illustrative embodiment, the lead wire-cutting mechanism 3162 comprises a lower blade block 3182 installed and fixed on a base pedestal 3180, an upper blade block 3183 which is vertically movable (in the direction indicated by the arrow A) with respect to the lower blade block 3182, and a driving source such as an air cylinder 3186 for vertically moving the upper blade block 3184.

Two lower blades 3188*a*, 3188*b*, which are installed vertically upwardly, are attached to an upper portion of the lower blade block 3182. The upper blade block 3184 is attached with two upper blades 3190*a*, 3190*b* which are installed vertically downwardly. The transport mechanism 3156 is installed between the two lower blades 3188*a*, 3188*b*. The workpiece 80 is successively transported by the transport mechanism 3156, and the respective lead wires 18, 22 are placed on the lower blades 3188*a*, 3188*b* respectively.

On the other hand, a holding member 3192 is provided between the two upper blades 3190*a*, 3190*b*. The holding member 3192 is always urged downwardly by an elastic member 3194 such as a compressive coil spring provided in the upper blade block 3184.

Next, the operation of the lead wire-cutting mechanism 3162 will be explained. At first, when the workpiece 80, which is transported from the front side of the drawing (FIG. 38) by the aid of the transport mechanism 3156, is introduced into the lead wire-cutting mechanism 3162, the lead wires 18, 22 of the workpiece 80 are in a state of being placed on the lower blades 3188*a*, 3188*b* respectively. Starting from this state, the upper blade block 3184 is moved downwardly in accordance with the driving action of the air cylinder 3186. At first, the holding member 3192 holds the lead wires 18, 22 placed on the lower blades 3188*a*, 3188*b*. The upper blade block 3184 is further moved downwardly in accordance with the driving action of the air cylinder 3186. However, the holding member 3192 is merely pressed downwardly by the elastic member 3194. Therefore, the holding member 3192 is moved relatively upwardly with respect to the downward movement of the upper blades 3190*a*, 3190*b*. That is, the holding member 3192 escapes relatively upwardly while holding the lead wires 18, 22.

The downward movement of the upper blades 3190*a*, 3190*b* allows the upper blades (3190*a*, 3190*b*) and the lower blades (3188*a*, 3188*b*) to be meshed with each other. At this point of time, the lead wires 18, 22 are cut, and unnecessary portions on the both sides are removed. At the stage at which the lead wires 18, 22 are completely cut, the upper blade block 3184 is in turn moved upwardly in accordance with the upward driving action effected by the air cylinder 3186. The upper blades 3190*a*, 3190*b* are separated from the lower blades 3188*a*, 3188*b*, and they are moved upwardly by a predetermined distance, during which the lead wires 18, 22 are in a state of being pressed against the lower blades 3188*a*, 3188*b* by means of the holding member 3192.

When the upper blade block 3184 is further moved upwardly in accordance with the driving action of the air cylinder 3186, the pressing action on the lead wires 18, 22 effected by the holding member 3192 is released from the stage at which the upper blades 3190*a*, 3190*b* are separated from the lower blades 3188*a*, 3188*b* by not less than a predetermined distance. The holding member 3192 is moved upwardly together with the upper blades 3190*a*, 3190*b*, and the mechanism is finally restored to the initial state.

The lead wire-cutting mechanism 3162 functions such that the lead wires 18, 22 are cut by meshing the upper blades (3190*a*, 3190*b*) and the lower blades (3188*a*, 3188*b*) while pressing the lead wires 18, 22 against the lower blades 3188*a*, 3188*b* by using the holding member 3192. Therefore, it is possible to cut the lead wires 18, 22 reliably into the desired length.

Figure 39:
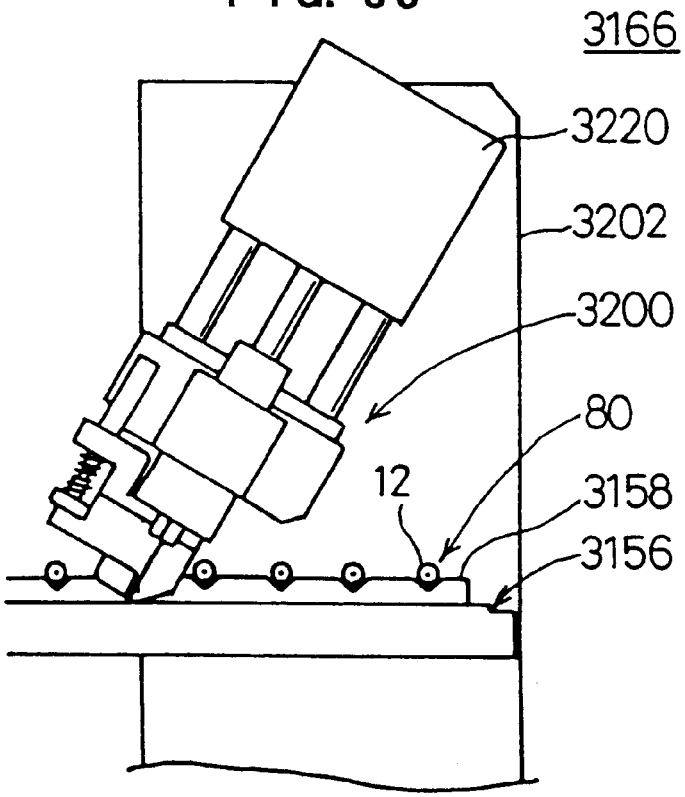
FIG. 39 shows an arrangement of a tube diameter-inspecting mechanism.

Next, the tube diameter-inspecting mechanism 3166 will be explained with reference to FIGS. 39 to 40B. As shown in FIG. 39, the tube diameter-inspecting mechanism 3166 comprises a support member 3202 for supporting a main tube diameter-inspecting mechanism body 3200 while being inclined by a predetermined angle with respect to the vertical direction.

Figure 40A:
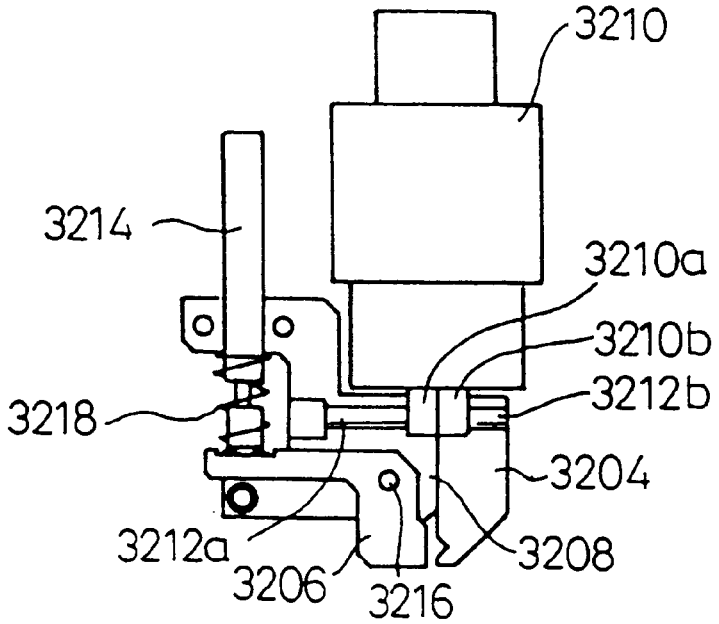
FIG. 40A shows an arrangement of a main tube diameter-inspecting mechanism body, especially depicting a state in which a reference pawl approaches a measuring pawl.
Figure 40B:
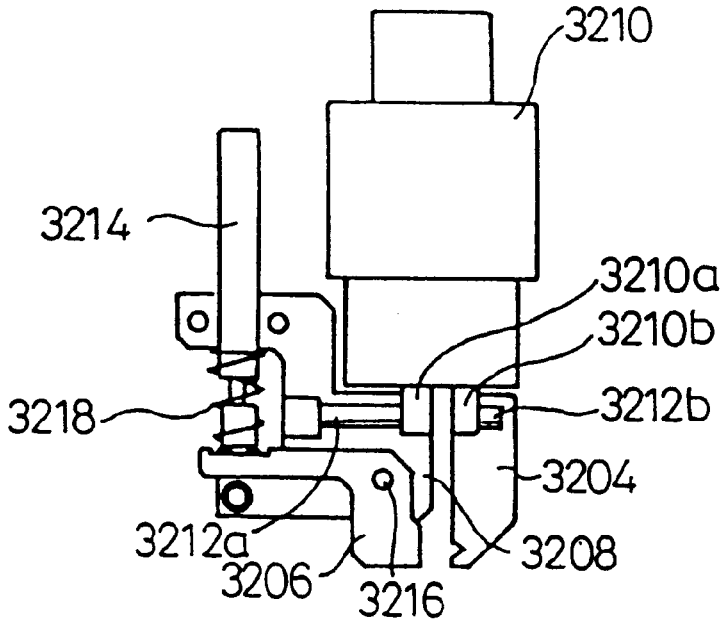
FIG. 40B shows an arrangement depicting a state in which the reference pawl is separated from the measuring pawl.

As shown in FIGS. 40A and 40B, the main tube diameter-inspecting mechanism body 3200 comprises a reference pawl 3204 and a measuring pawl 3206 which act to interpose the glass tube 12 of the workpiece 80 during the transport effected by the transport mechanism 3156 (see FIG. 39), a positioning plate 3208 for positioning the reference pawl 3204 at a predetermined reference position, an air chucking mechanism 3210 for moving the reference pawl 3204 in a direction to make approach and in a direction to make separation with respect to the measuring pawl 3206, a bolt member 3212*a* for fixing the positioning plate 3208 to a first pawl 3210*a* of the air chucking mechanism 3210, a bolt member 3212*b* for fixing the reference pawl 3204 to a second pawl 3210*b* of the air chucking mechanism 3210, and a cylindrical sensor 3214 for converting rotational displacement of the measuring pawl 3206 into linear displacement to measure the displacement amount of the measuring pawl 3206.

The measuring pawl 3206, which has a substantially L-shaped configuration, has its first end which is opposed to the reference pawl 3204 and its second end which is opposed to the sensor 3214, comprising a support point 3216 which is provided at its bent portion. The measuring pawl 3206 has the first end which is always urged to oppose to the reference pawl 3204 by a compressive coil spring 3218 attached to surround the cylindrical sensor 3214.

As shown in FIG. 39, the main tube diameter-inspecting mechanism body 3200 is movable in a direction to make approach and in a direction to make separation with respect to the transport mechanism 3156 by the aid of an air cylinder 3220 provided on the support member 3202.

Next, the operation of the tube diameter-inspecting mechanism 3166 will be explained. At first, when the workpiece 80 is transported by the transport mechanism 3156 to a position in the vicinity of the main tube diameter-inspecting mechanism body 3200, the main tube diameter-inspecting mechanism body 3200 is moved obliquely downwardly in accordance with the driving action of the air cylinder 3220. Simultaneously, the reference pawl 3204 is moved in parallel in the direction to make separation from the measuring pawl 3206 in accordance with the driving action of the air chucking mechanism 3210. Accordingly, as shown in FIG. 40B, a space, which is sufficient to interpose the glass tube 12 of the workpiece 80, is formed between the reference pawl 3154 and the measuring pawl 3156.

The main tube diameter-inspecting mechanism body 3200 is further moved downwardly in accordance with the driving action of the air cylinder 3220, and the glass tube 12 of the workpiece 80 enters the space between the reference pawl 3204 and the measuring pawl 3206. At this stage, the reference pawl 3204 is in turn moved in a direction opposite to the direction described above, in accordance with the driving action of the air chucking mechanism 3210, and the reference pawl 3204 is positioned at a predetermined reference position by the aid of the positioning plate 3208. In this state, the measuring pawl 3206 makes rotational displacement about the center of the support point 3216 depending on the size of the diameter of the glass tube 12 of the workpiece 80 in opposition to the urging force exerted by the compressive coil spring 3218. The rotational displacement is converted into linear displacement by the sensor 3214 to be measured thereby.

In the tube diameter-inspecting mechanism 3166, the glass tube 12 of the workpiece 80 is interposed by the reference pawl 3204 and the measuring pawl 3206. The rotational displacement of the measuring pawl 3206, which is brought about during this process depending on the diameter of the glass tube 12, is converted into the linear displacement by the sensor to measure the diameter of the glass tube 12. Accordingly, it is possible to easily measure the diameter of the glass tube 12 of the workpiece 80 during the transport process effected in one station of the transport mechanism 3156.

Figure 41:
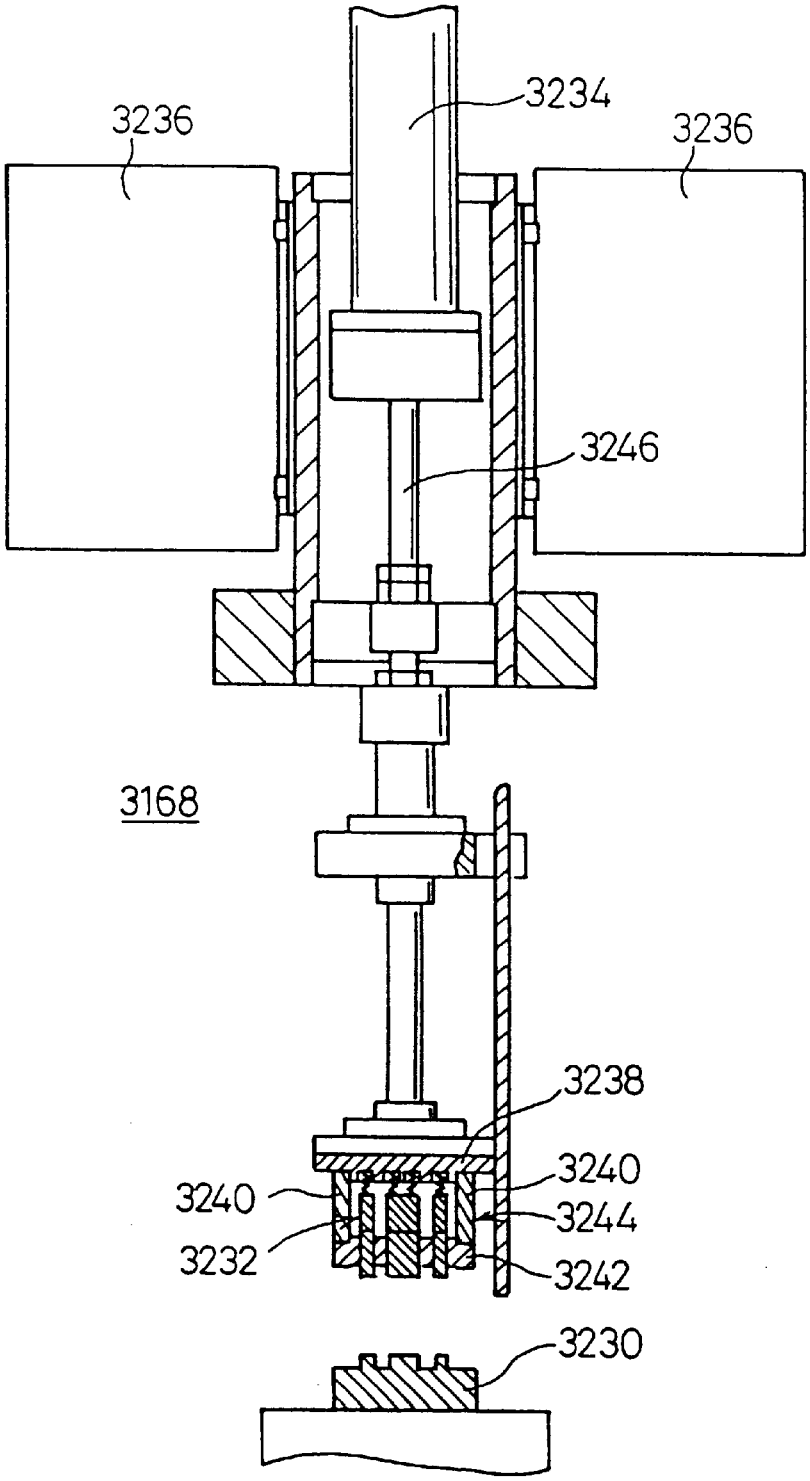
FIG. 41 shows an arrangement illustrating a light emission-inspecting mechanism.
Figure 42:
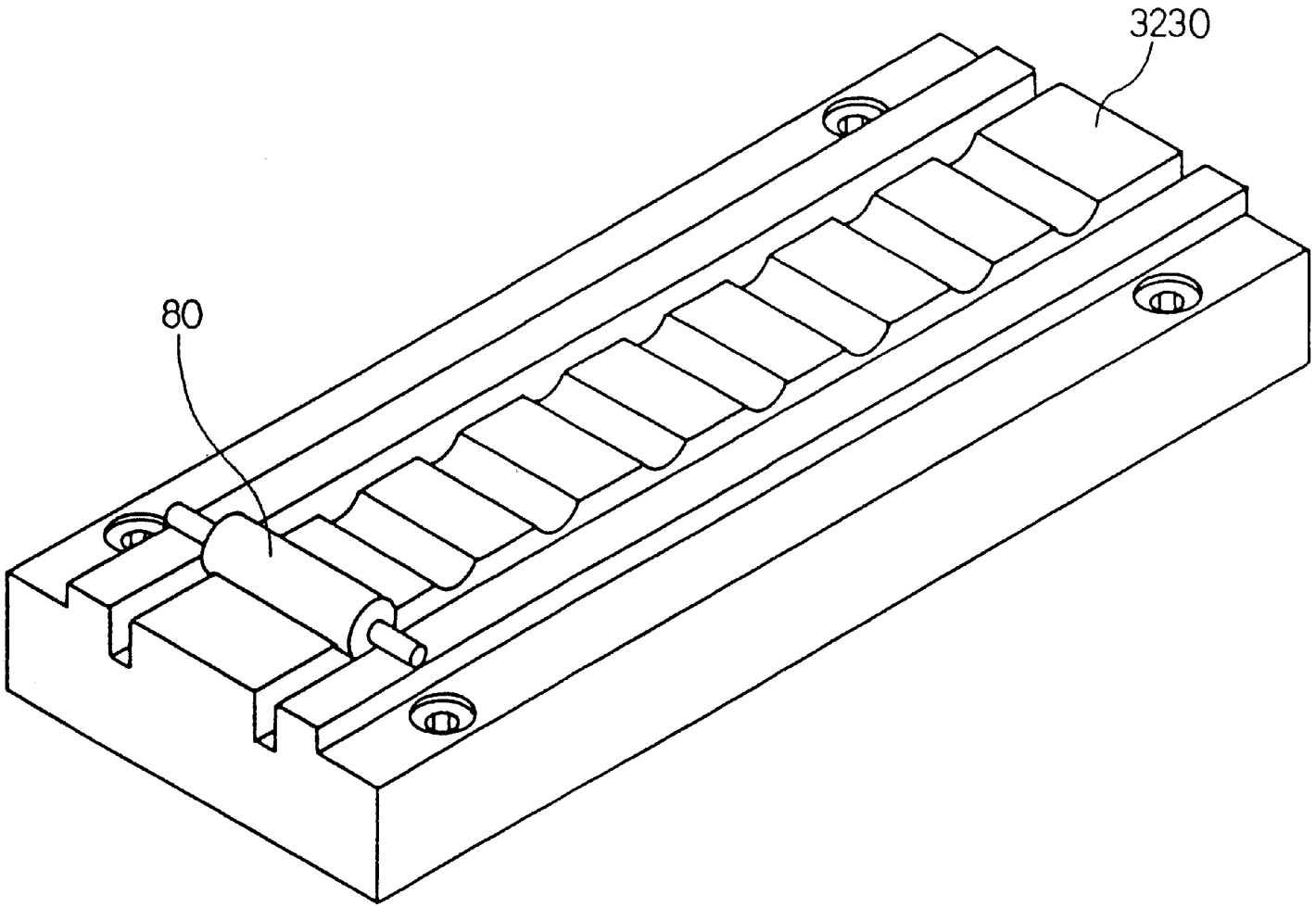
FIG. 42 shows a perspective view illustrating a setting tray.

Next, the light emission-inspecting mechanism 3168 will be explained with reference to FIGS. 41 to 45. As shown in FIG. 41, the light emission-inspecting mechanism 3168 comprises a setting tray 3230 (see FIG. 42) capable of simultaneously placing eight workpieces 80 transported by the transport mechanism 3156, inspecting heads 3232 for allowing the workpieces 80 placed on the setting tray 3230 to cause light emission, an air cylinder 3234 for moving the inspecting heads 3232 in a direction to make approach and in a direction to make separation with respect to the workpieces 80 placed on the setting tray 3230, and an accommodating box 3236 installed with a circuit board for driving and controlling the inspecting heads 3232.

The inspecting heads 3232 are prepared to correspond to eight channels in conformity with the number of workpieces 80 to be placed on the setting tray 3230. The inspecting heads 3232 corresponding to the eight channels are accommodated in a housing 3244 which is constructed by a support plate 3238, side plates 3240, and a lower plate 3242. A piston rod 3246 of the air cylinder 3234 is connected via various link mechanisms to an upper central portion of the support plate 3238 of the housing 3244.

Figure 43:
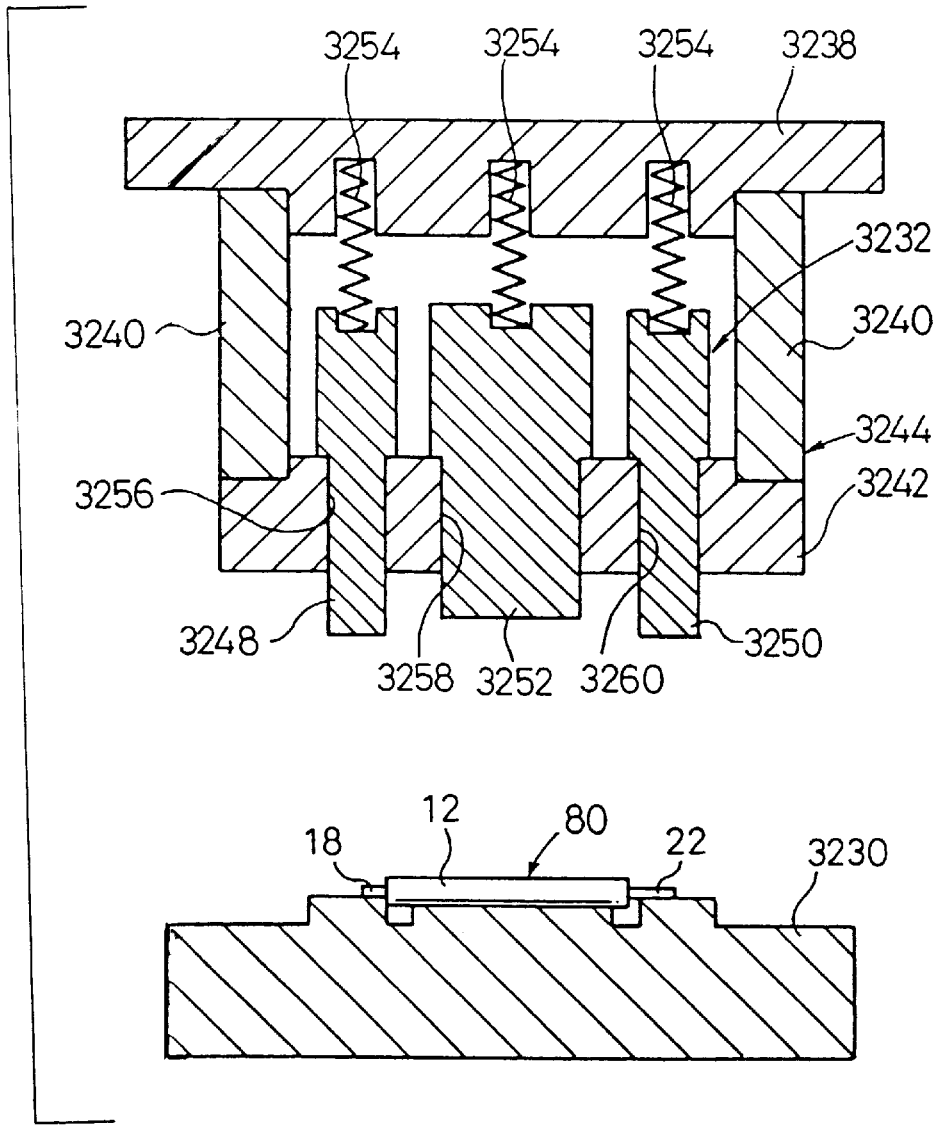
FIG. 43 shows a sectional view illustrating a state in which an inspection head is separated from the setting tray in the light emission-inspecting mechanism.

As shown in FIG. 43, the inspecting head 3232 corresponding to one channel comprises a positive electrode 3248 for making contact with the anode-side lead 18 of the workpiece 80, a negative electrode 3250 for making contact with the cathode-side lead 22, and a trigger electrode 3252 for making contact with the glass tube 12 of the workpiece 80. The electrodes 3248, 3250, 3252 are joined to the inner wall surface of the support plate 3238, for example, via compressive coil springs 3254 respectively, and they are always urged downwardly by the compressive coil springs 3254.

The lower plate 3242, which is one of the constitutive members of the housing 3244, has openings 3256, 3258, 3260 for inserting the positive electrode 3248, the negative electrode 3250, and the trigger electrode 3252 therethrough respectively. Electrode surfaces of the respective electrodes 3248, 3250, 3252 are exposed downwardly from the lower plate 3242.

Figure 44:
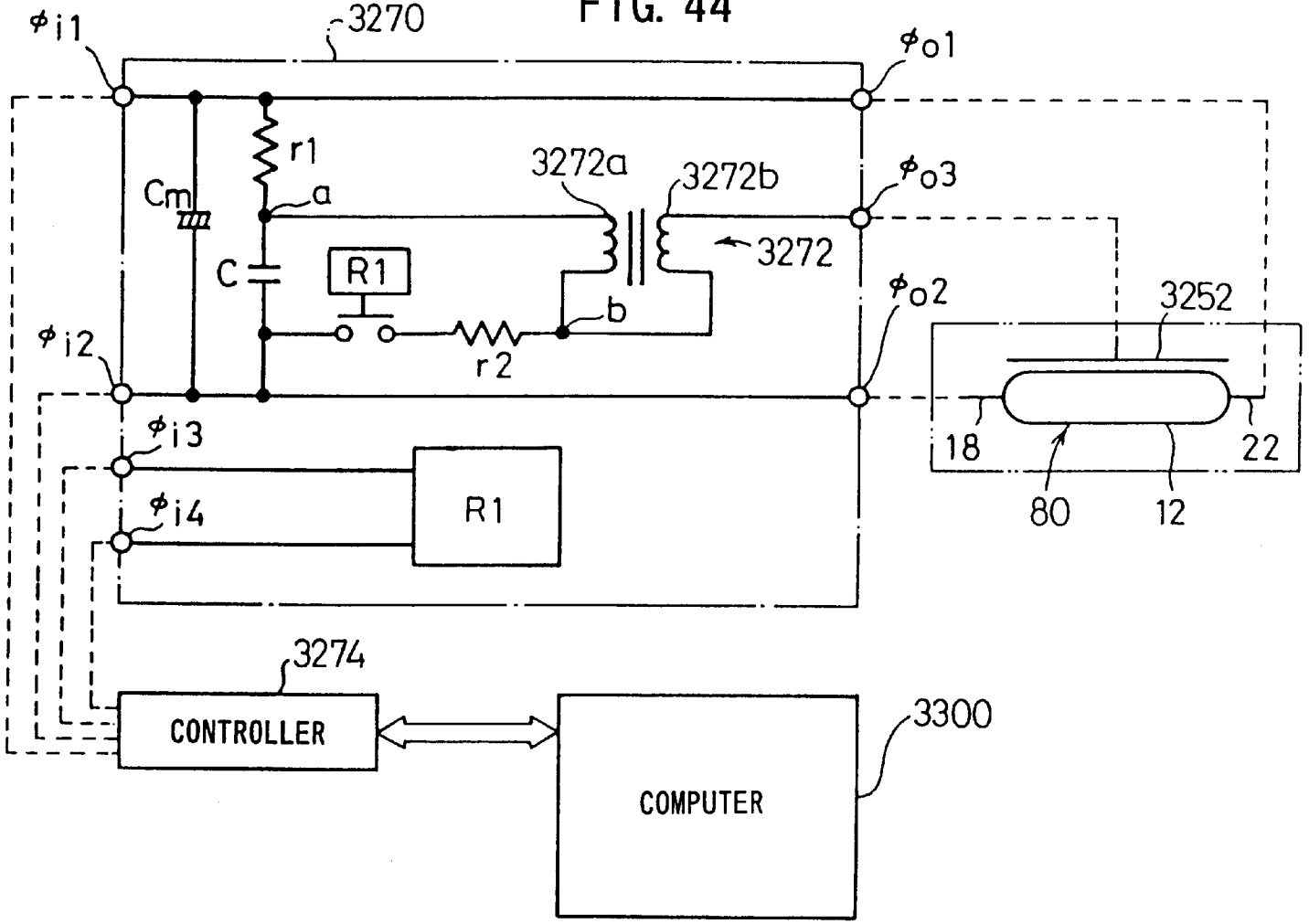
FIG. 44 shows a circuit diagram depicting a circuit system for driving and controlling the inspection head.

As shown in FIG. 44, for example, a circuit 3270, which is used to drive and control the inspecting head 3232 corresponding to one channel, comprises four input terminals (a negative input terminal $\phi$i1, a positive input terminal $\phi$i2, and two relay switch terminals $\phi$i3, $\phi$i4) and three output terminals (a negative output terminal $\phi$o1, a positive output terminal $\phi$o2, and a trigger output terminal $\phi$o3). A main capacitor Cm is connected at a first stage between the negative input terminal $\phi$i1 and the positive input terminal $\phi$i2. A series circuit comprising a resistor r1 and a capacitor C is connected at a second stage. A primary trigger coil 3272*a*, a resistor r2, and a relay switch R1 are connected in series between the positive output terminal $\phi$o2 and a contact a between the resistor r1 and the capacitor C. A secondary trigger coil 3272*b* is connected between the trigger output terminal $\phi$o3 and a positive terminal (common contact b) of the primary trigger coil 3272*a*. A transformer 3272 for raising the primary voltage is constructed by the primary trigger coil 3272*a* and the secondary trigger coil 3272*b*.

The four input terminals $\phi$i1 to $\phi$i4 are connected to a controller 3274. A predetermined voltage is supplied from the controller 3274 for a predetermined period of time between the negative input terminal $\phi$i1 and the positive input terminal $\phi$i2. At a point of time after passage of the predetermined period of time, a switching signal is supplied from the controller 3274 to the two relay switch terminals $\phi$i3, $\phi$i4.

Figure 45:
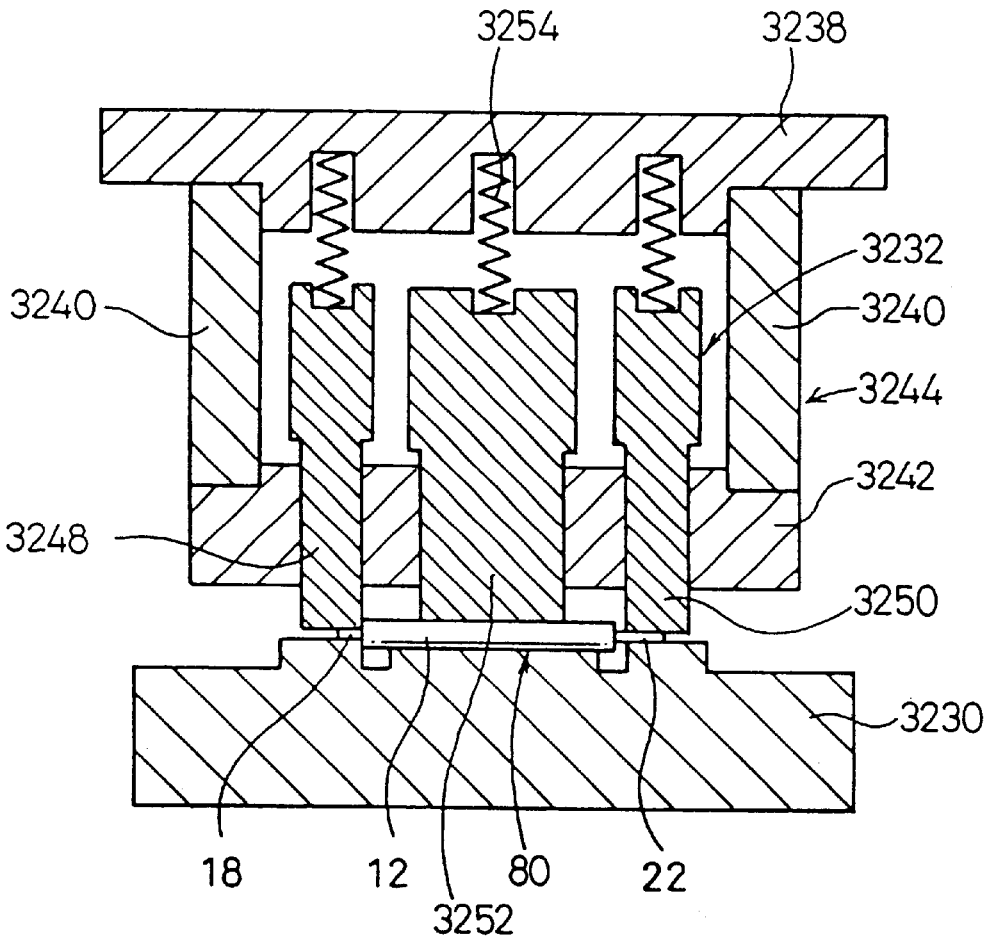
FIG. 45 shows a sectional view illustrating a state in which the inspection head is allowed to contact with a workpiece in the light emission-inspecting mechanism.

Next, the operation of the light emission-inspecting mechanism 3168 will be explained. At first, the eight workpieces 80 are transported by the aid of the transport mechanism 3156, and the eight workpieces 80 are simultaneously placed on the setting tray 3230. At this point of time, the housing 3244 is moved downwardly in accordance with the driving action of the air cylinder 3234. Accordingly, as shown in FIG. 45, the positive electrode 3248 contacts with the anode-side lead 18 of the workpiece 80, the negative electrode 3250 contacts with the cathode-side lead 22 of the workpiece 80, and the trigger electrode 3252 contacts with the glass tube 12 of the workpiece 80. At a stage at which the electrodes 3248, 3250, 3252 are separated from the upper surface of the lower plate 3242, the downward movement of the housing 3244 effected by the air cylinder 3234 is stopped.

After that, the predetermined voltage is applied for the predetermined period of time from the controller 3274 between the negative input terminal $\phi$i1 and the positive input terminal $\phi$i2. Accordingly, the main capacitor Cm is charged. After completion of the charging, the switching signal is supplied from the controller 3274 to the two relay switch terminals $\phi$i3, $\phi$i4 to turn on the relay switch R1. By doing so, an extremely high voltage is applied for a short period of time to the trigger electrode 3252 via the trigger output terminal $\phi$o3.

The workpiece 80 is excited by the high voltage applied to the glass tube 12 by the trigger electrode 3252. The electric charge, which has been accumulated in the main capacitor Cm is instantaneously discharged. As a result, the workpiece 80 causes light emission. Once the workpiece 80 causes light emission, the voltage of the main capacitor Cm is suddenly decreased. Therefore, it is possible to know the presence or absence of light emission by measuring the terminal voltage of the main capacitor Cm by using the controller 3274.

The inspection system 3140 comprises, as shown in FIG. 36, a computer 3300 for outputting inspection results obtained for the workpieces 80 by the respective inspecting mechanisms, to the judging unit 3142 (see FIG. 34), the results being processed in a unit of workpieces 80 contained in each of the cathode-side sealing jigs 42. The production history table, in which the inspection results for the workpieces 80 are registered in the unit of workpieces 80 contained in the cathode-side sealing jig 42 as described above, is outputted to the judging unit 3142.

For example, as shown in FIG. 46, the production history table has a number of records corresponding to the number of workpieces 80 accommodated in the cathode-side sealing jig 42. Those stored in each of the records include the lead wire length, the judgment bit for the effectiveness/ineffectiveness of the lead wire length, the tube diameter, the judgment bit for the effectiveness/ineffectiveness of the tube diameter, the presence or absence of light emission or the light emission intensity (voltage value), and the judgment bit for the effectiveness/ineffectiveness of the light emission. The record address relates to the workpiece 80 such that the record index for the access is updated in accordance with the order of the workpieces 80 transported by the transport mechanism 3106.

Next, the method for inspecting the workpiece 80 by using the inspection system 3140 will be explained with reference to a block diagram depicting steps shown in FIG.

Figure 47:
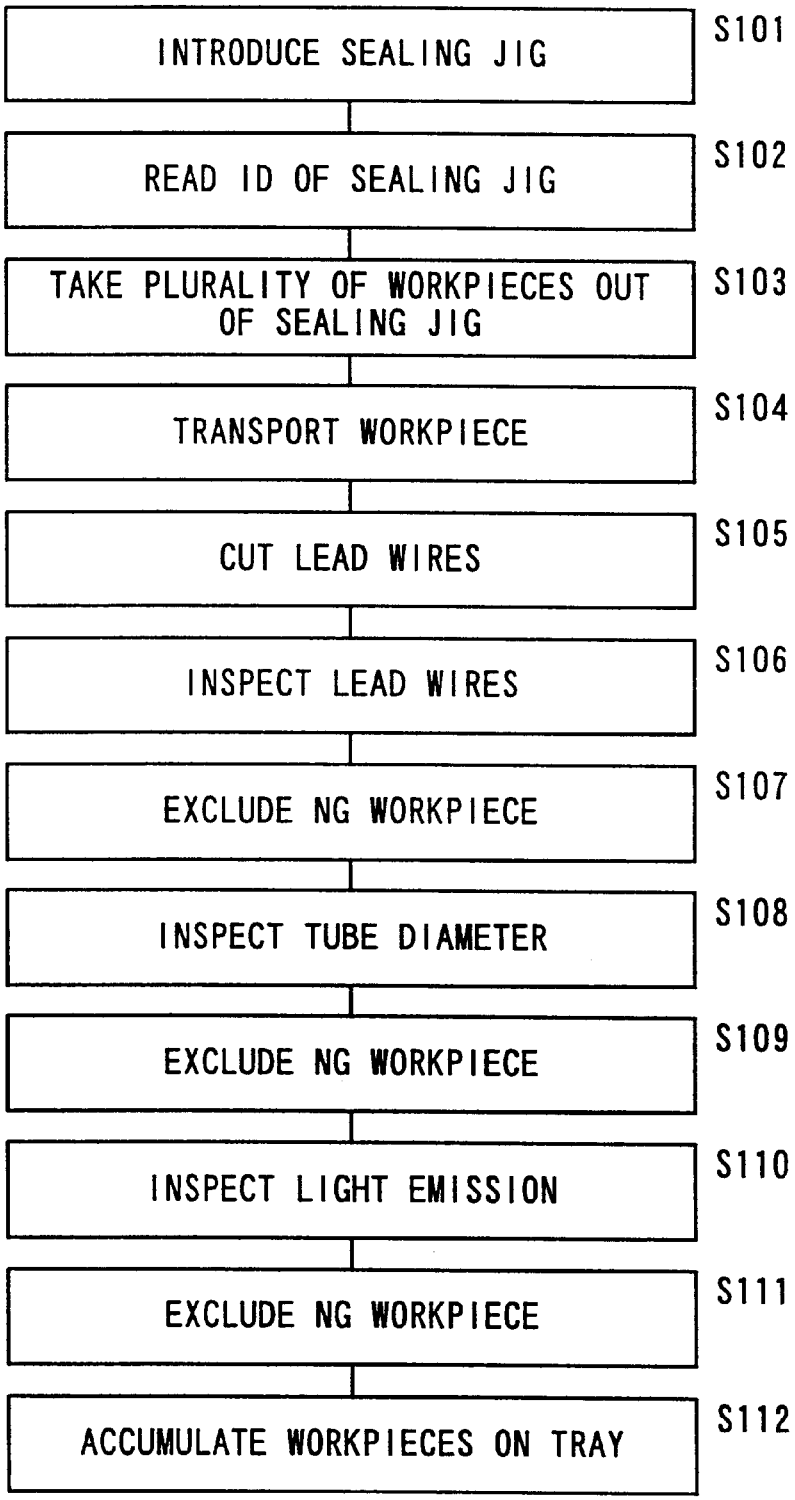
FIG. 47 shows a block diagram depicting steps of an inspection procedure performed in the inspection system.
Figure 48:
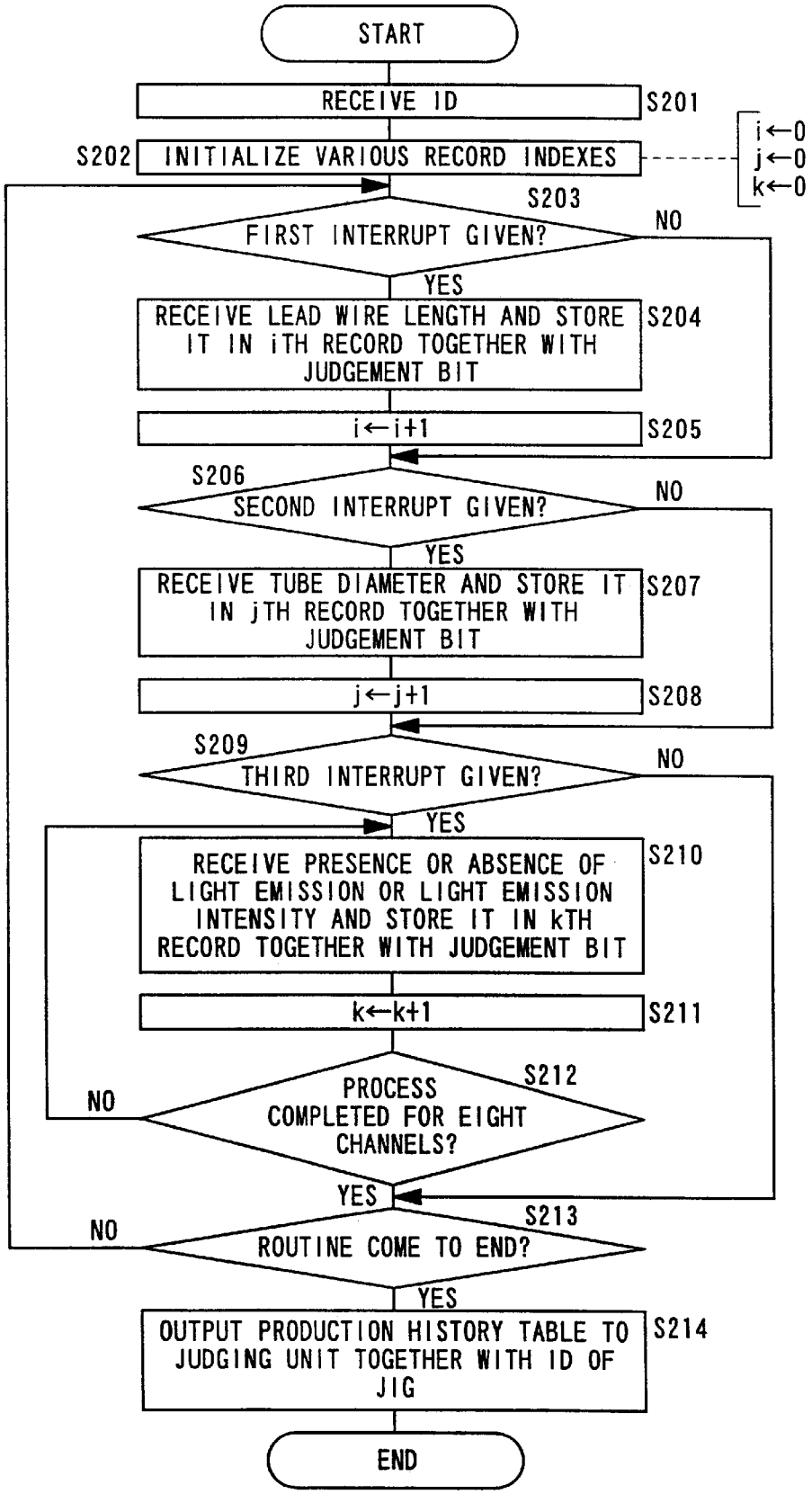
FIG. 48 shows a flow chart-illustrating a processing operation effected by a computer.

47 and a flow chart shown in FIG. 48. At first, when the cathode-side sealing jig 42 accommodated with the large number of workpieces 80 is introduced into the inspection system 3140 to be placed in the jig-receiving unit 3152 (step S101 in FIG. 47), the ID reader mechanism 3154 is used to read ID of the cathode-side sealing jig 42 (step S102 in FIG. 47).

The read ID is received by the computer 3300 (step S201 in FIG. 48). Simultaneously with the receipt of ID, various record indexes i, j, k of the production history table are initialized (step S202 in FIG. 48).

After that, in a step S203 in FIG. 48, it is judged whether or not any data input interrupt is given from the lead wire-inspecting mechanism 3164. If there is any input interrupt, the routine proceeds to the next step S204. If there is no input interrupt, the routine proceeds to a step S206.

In the step S206, it is in turn judged whether or not any data input interrupt is given from the tube diameter-inspecting mechanism 3166. If there is any input interrupt, the routine proceeds to the next step S207. If there is no input interrupt, the routine proceeds to a step S209.

In the step S209, it is judged whether or not any data input interrupt is given from the light emission-inspecting mechanism 3168. If there is any input interrupt, the routine proceeds to the next step S210. If there is no input interrupt, the routine proceeds to a step S213 to in turn judge whether or not the process is completed for all of the workpieces 80 having been accommodated in the cathode-side sealing jig 42. If the process is not completed, the routine returns to the step S203 to repeat the process in the step S203 and the followings. If the process is completed, the routine proceeds to the next step S214 to output the production history table to the judging unit 3142 together with ID (the ID number and the jig number) of the cathode-side sealing jig 42. Thus, a series of processes are completed.

When the reading process for ID is completed in the step S102, the workpiece-taking out mechanism 3160 is subsequently used to simultaneously take the plurality of workpieces 80 out of the cathode-side sealing jig 42 to be transported to the transport mechanism 3156. The plurality of workpieces 80 are placed laterally on the transport stand 3158 of the transport mechanism 3156 (step S103 in FIG. 47). The plurality of workpieces 80 are taken out of the cathode-side sealing jig 42 at predetermined intervals. Specifically, when the process for the plurality of workpieces 80 effected by the lead wire-cutting mechanism 3162 disposed at the downstream stage is completed, the plurality of workpieces 80 are taken out of the cathode-side sealing jig 42 to be introduced into the transport mechanism 3156.

The plurality of workpieces 80, which are introduced into the transport mechanism 3156 by the aid of the workpiece-taking out mechanism 3160, are successively transported in the first direction while being placed laterally respectively (step S104 in FIG. 47).

At first, the workpieces 80 are introduced into the lead wire-cutting mechanism 3162 one by one. The lead wires 18, 22, which are led on the both sides of the workpiece 80 introduced into the lead wire-cutting mechanism 3162, are cut to have the predetermined length (step S105 in FIG. 47).

The workpiece 80, for which the lead wires 18, 22 have been cut, is introduced into the next lead wire-inspecting mechanism 3164 to inspect whether or not the length of the lead wires 18, 22 after the cutting is within the predetermined length (step S106 in FIG. 47). During this process, the lengths of the lead wires 18, 22 after the cutting are measured, and obtained results are outputted as lead wire lengths. Further, it is judged whether or not the lead wire length is within the predetermined length, and an obtained judgement result is outputted as bit information (1/0= adequate/defective).

The outputted lead wire length and the judgement bit are received by the computer 3300, and they are stored in a record (ith record) indicated by the first record index i of the production history table (step S204 in FIG. 48). After that, in a step S205 in FIG. 48, the first record index i is updated by +1.

The judgement bit is also supplied to the first excluding mechanism 3172. The workpiece 80, which is judged to be defective, is removed from the transport passage of the transport mechanism 3156 (step S107 in FIG. 47).

The workpiece 80, which has been completed for the processes in the lead wire-cutting mechanism 3162 and the lead wire-inspecting mechanism 3164 and which has been judged to be adequate, is transported by the transport mechanism 3156, and it is introduced into the next tube diameter-inspecting mechanism 3166 to inspect the diameter of the glass tube 12 in the vicinity of the glass sealed portion (in the vicinity of the second end 12*b*) (step S108 in FIG. 47). During this process, the diameter of the glass tube 12 at the glass sealed portion of the workpiece 80 is measured, and an obtained result is outputted as a tube diameter. It is judged whether or not the tube diameter is within the predetermined diameter range. An obtained judgement result is outputted as bit information (1/0=adequate/defective).

The outputted tube diameter and the judgement bit are received by the computer 3300, and they are stored in a record (jth record) indicated by the second record index j of the production history table (step S207 in FIG. 48). After that, in a step S208, the second record index j is updated by +1.

The judgement bit is also supplied to the second excluding mechanism 3174. The workpiece 80, which is judged to be defective, is removed from the transport passage of the transport mechanism 3156 (step S109 in FIG. 47).

The workpiece 80, which has been completed for the process in the tube diameter-inspecting mechanism 3166 and which has been judged to be adequate, is transported by the transport mechanism 3156, and it is introduced into the next light emission-inspecting mechanism 3168. The number of workpieces 80 to be introduced into the light emission-inspecting mechanism 3168 at one time is, for example, eight. The light emission inspection is performed a plurality of times (for example, eight times) for the eight workpieces 80 (step S110 in FIG. 47).

In this process, the presence or absence of eight times of light emission for the eight workpieces 80 is read in a unit of the channel by the aid of the controller 3274 (the light emission is present if the terminal voltage of the main capacitor Cm shown in FIG. 44 is greatly decreased from the charged voltage, while the light emission is absent if the terminal voltage is not changed so much from the charged voltage). The number of light emission times is outputted for each of the channels. Further, it is judged whether or not the workpiece 80 is adequate or defective depending on whether or not the light emission is caused not less than a preset number of times. Respective judgement results are outputted as bit information (1/0=adequate/defective) respectively. In this embodiment, the presence or absence of light emission is judged by using the voltage of the main capacitor Cm. Alternatively, it is allowable that the light emission of the workpiece 80 is detected by using a photoelectric tube or the like to directly measure its light emission intensity.

The outputted presence or absence of light emission or the light emission intensity and the judgement bit for the eight workpieces 80 are received by the computer 3300 in the unit of the channel, and they are stored in a record (kth record) indicated by the third record index k of the production history table (step S210 in FIG. 48). After that, in a step S211, the third record index k is updated by +1. Subsequently, in a step S212, it is judged whether or not the process is completed for the eight channels. If the process is not completed, the routine returns to the step S210 to perform the process for receiving the presence or absence of light emission or the light emission intensity for the next channel and the process for updating the third record index k. The routine is repeated until the process is completed for the eight channels.

The judgement bit is also supplied to the third excluding mechanism 3176. The workpiece 80, which is judged to be defective, is removed from the transport passage of the transport mechanism 3156 (step S111 in FIG. 47).

The workpiece 80, which has been completed for the process in the light emission-inspecting mechanism 3168 and which has been judged to be adequate, is successively accommodated while being directed laterally in an empty place on the tray 3070 by the aid of the accumulating mechanism 3170 disposed at the next stage. At the state at which the tray 3070 is filled with the workpieces 80, the tray 3070 is discharged from the inspection system 3140, and it is transported to the next step.

Next, explanation will be made for the pattern registration of the optimum condition concerning the secondary sealing process effected by the secondary sealing processing apparatus 3000 and the relationship concerning the jig number and the registered pattern. At first, the pattern registration will be explained. Those set as the data for controlling the secondary sealing process include the operation states of the various types of equipment (for example, pumps, valves, and heaters) included in the respective apparatuses, the control amounts (for example, the degree of vacuum, the gas pressure, and the heater temperature), and the time, in accordance with the control steps executed by the control unit 3136.

A series of control operation data required for the secondary sealing process is usually called sequence data. It is advantageous to register the sequence data as one pattern data (including a pattern number), in view of, for example, the storage capacity, the operation speed of the program (especially, the retrieving process), and the transfer speed.

The pattern data and the pattern number can be set by using a graphic screen of the monitor 3134 connected to the control unit 3136. In this embodiment, this operation may be performed as follows. That is, the point is instructed by using a keyboard or a pointing device such as a mouse. If the monitor is equipped with a touch panel function, the operator may directly touch the monitor screen by hand to instruct the point, i.e., the input position is specified by means of GUI (graphical user interface).

Figure 49:
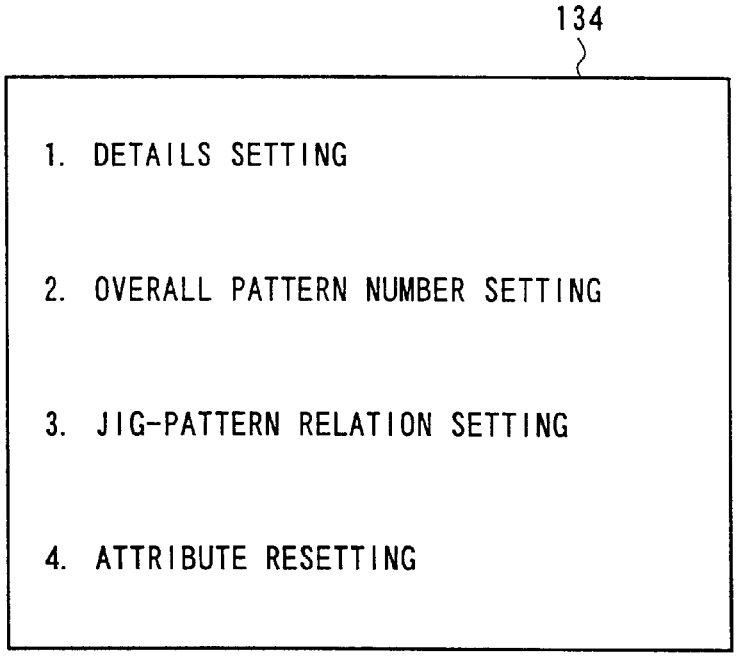
FIG. 49 illustrates an example of a menu screen displayed on a monitor of the secondary sealing processing apparatus.

An example of such an operation will be explained. At first, for example, as shown in FIG. 49, a menu screen is displayed on the screen of the monitor 3134. The menu screen includes, for example, the setting to prepare the pattern data which serves as a base for the sequence data (1. Details setting), the setting to allot a large number of prepared pattern data to the various apparatuses (the cleaning apparatus 3106, the sealing apparatus 3108, and the cooling apparatus 3110) and combine the data into various patterns to set an overall pattern (2. Overall pattern number setting), the setting to set the corresponding relationship between the sealing jig and the overall pattern number (3. Jig-pattern relation setting), and the setting to make reset to the ordinary overall pattern number (4. Attribute resetting).

Figure 50:
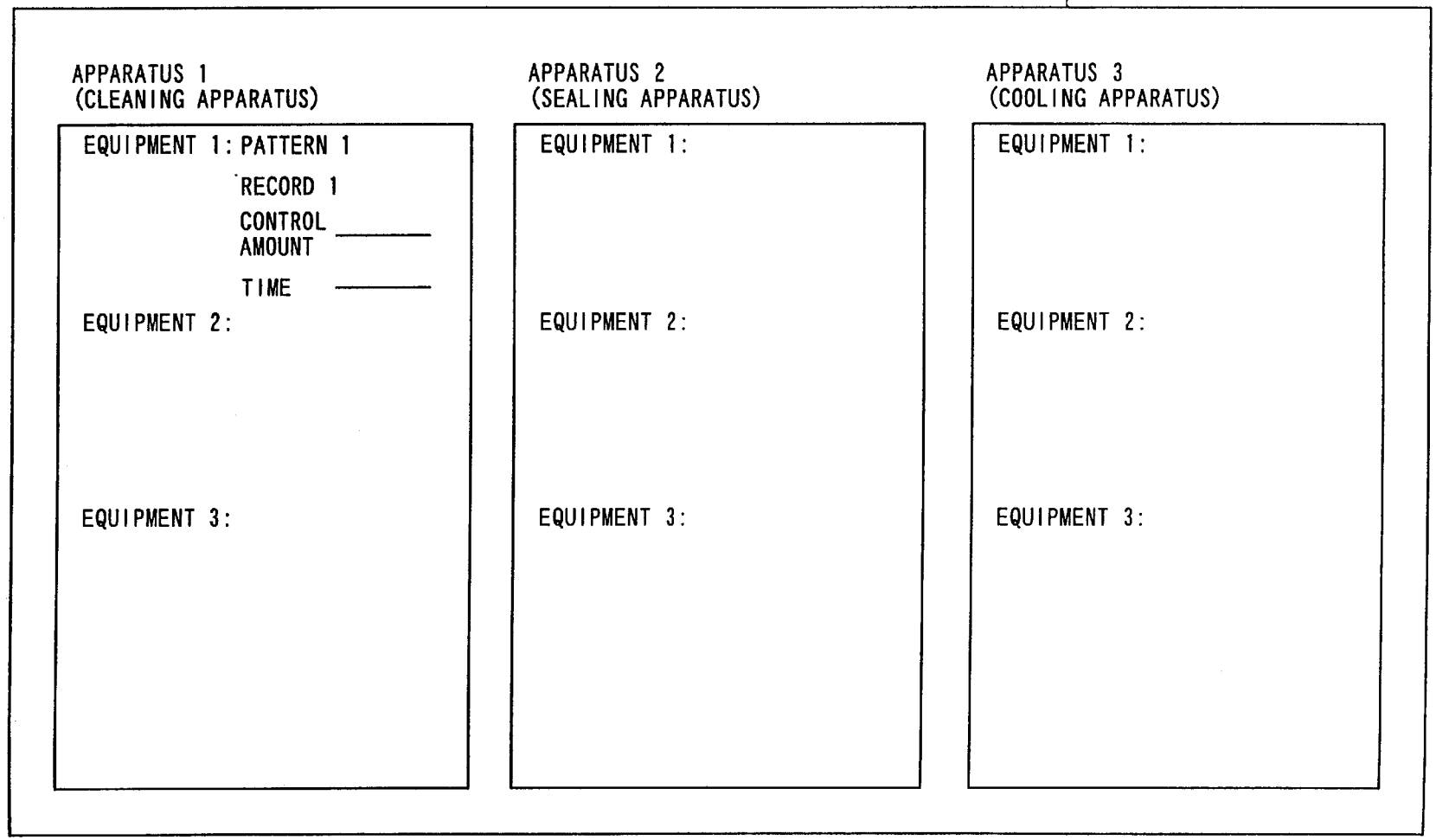
FIG. 50 illustrates an example of the system architecture displayed on the monitor of the secondary sealing processing apparatus.

For example, if "1. Details setting" is selected, then the screen is switched, and a schematic drawing is displayed, depicting the system of the secondary sealing processing apparatus 3000 as shown in FIG. 50. If any one of the equipment of the cleaning apparatus 3106, the sealing apparatus 3108, and the cooling apparatus 3110 is selected, items necessary to set the pattern data are automatically displayed. FIG. 50 illustrates, for example, the display of input columns for inputting the pattern number, the record number, the control amount, and the time, when the equipment 1 of the apparatus 1 (the cleaning apparatus 3106) is selected.

When the pattern registration is performed, the confirming function acts to judge whether or not the input data is adequate. In other words, it is judged whether or not the input data is within a range capable of setting. If the input data is within the range capable of setting, the input data is displayed on the input column, and it is simultaneously registered in the necessary table. If the input data is without the range capable of setting, the input data is not displayed on the input column, and it is not registered in the necessary table. Those functionable in the pattern registration includes the editing function (correcting function) for inserting or deleting any intervening control step and the editing function (copying function) for copying the pattern data.

In the pattern registration described above, a plurality of sequence data can be registered for one equipment, i.e., a plurality of pattern data can be registered for one equipment. The pattern data are set with pattern numbers respectively, and they can be easily distinguished.

Therefore, the pattern registration makes it possible to perform setting in a visual manner without any input error. It is easy to perform the maintenance, for example, for the pattern registration and the setting without any special knowledge.

On the other hand, the jig number is related to the registered pattern data by using the overall pattern number setting (the overall pattern number registered in the table of pattern correspondence).

The jig number, which is read by the ID reader 3104, is initially distinguished for whether the number is "0" or "other than it". If the jig number is "0", the overall pattern number is not automatically set. A set number is used, which is determined by using an unillustrated selection switch for selecting the overall pattern number, installed on the operation panel, because of the following reason. That is, it is intended to prevent the contents of the table of pattern correspondence used in the practical production stage, from being easily changed by the automatic setting performed in the test. Such a procedure is extremely effective to avoid any restoration failure (the failure in restoration of the contents of the table of pattern correspondence after the test).

Therefore, when the test is carried out, the procedure can be easily executed by forcibly making the jig number to be "0" by using the cathode-side sealing jig 42 on which no jig number is formed, or by using the cathode-side sealing jig 42 on which the portion of formation of the jig number is masked.

The operation of the overall pattern number setting is the registration in the table of pattern correspondence of the fact that the procedure of what overall pattern number is carried out for the cathode-side sealing jig 42 introduced into the secondary sealing processing apparatus 3000. Also in this case, the registration may be performed as follows. That is, the point is instructed by using a keyboard or a pointing device such as a mouse. If the monitor is equipped with a touch panel function, the operator may directly touch the monitor screen by hand to instruct the point. When the overall pattern number setting is executed, the confirming function acts to judge whether or not the input data is adequate.

In order to mass-produce the xenon discharge tube 10, the cathode-side sealing jig 42 is moved in the secondary sealing processing apparatus 3000 in the direction of the cleaning apparatus 3106→the sealing apparatus 3108→the cooling apparatus 3110. Therefore, the contents of the overall pattern number have a form which contains a plurality of pattern numbers (pattern numbers for each of the equipment types) each indicating the pattern data for the equipment of each of the apparatuses 3106, 3108, 3110. The pattern number table is incorporated as a conversion table therefor.

Accordingly, the overall pattern number corresponding to the jig number of the cathode-side sealing jig 42 introduced into the secondary sealing processing apparatus 3000 is retrieved. Further, the pattern number for each of the equipment types corresponding to the retrieved overall pattern number is retrieved. The pattern data corresponding to the pattern numbers of the respective equipment types are outputted to the respective controllers 3116, 3120, 3124. Thus, the secondary sealing process is performed under the process condition corresponding to the concerning cathode-side sealing jig 42.

As described above, the secondary sealing processing apparatus 3000 is constructed by providing the cathode-side sealing jig 42 comprising the main heater body 44 formed with the plurality of holes into which the plurality of workpieces 80 are individually inserted respectively, for being used to seal the glass tubes 12 of the workpieces 80, the secondary sealing processing apparatus 3000 for performing the secondary sealing process for the cathode-side sealing jig 42 on the basis of the secondary sealing process condition corresponding to the cathode-side sealing jig 42 to be used so that the plurality of glass tubes 12 introduced into the cathode-side sealing jig 42 are sealed, the inspection system 3140 for inspecting the sealed states of the glass tubes 12 of the workpieces 80, and the judging unit 3142 for judging whether or not the secondary sealing process condition in the secondary sealing processing apparatus 3000 is adequate on the basis of the result of inspection supplied from the inspection system 3140.

Accordingly, at first, the secondary sealing processing apparatus 3000 is used to process (for example, apply the electric power and heat) the cathode-side sealing jig 42 on the basis of the secondary sealing process condition corresponding to the cathode-side sealing jig 42 to be used. Thus, the plurality of glass tubes 12, which are introduced into the cathode-side sealing jig 42, are sealed. After that, the inspection system 3140 is used to inspect the sealed states of the individual glass tubes 12.

In the next judging unit 3142, it is judged whether the secondary sealing process condition in the secondary sealing processing apparatus 3000 is adequate or defective for the unit of the jig on the basis of the result of inspection supplied from the inspection system 3140. The adequate/defective judgement may be made for the unit of workpiece.

In the secondary sealing processing apparatus 3000, it is possible to optimize the secondary sealing process condition in the secondary sealing step S32 (see FIG. 7) for the workpiece 80 by utilizing the result of judgement. Thus, it is possible to achieve the improvement in production efficiency of the xenon discharge tube 10.

Especially, in this embodiment, the secondary sealing process condition corresponding to the cathode-side sealing jig 42 as the judgement objective is changed (updated) on the basis of the result of judgement supplied from the judging unit 3142.

Accordingly, if the result of judgement in the judging unit 3142 is inadequate ("defective light emission" or "defective tube diameter"), the secondary sealing process condition is automatically updated to set a secondary sealing process condition which is most suitable for the present defect. Therefore, it is possible to effectively simplify the operation for setting the condition. Thus, it is possible to realize the reduction of the number of steps and the reduction of the production cost.

Next, the base solder-applying and washing step S35 shown in FIG. 7 is carried out as follows. That is, a base solder-applying and washing machine 4000 (see FIG. 51) is used to apply solder plating as a base to the anode-side lead 18 and the cathode-side lead 22 having been cut to have the predetermined length respectively. The base solder plating is applied in order to facilitate application of solder when the anode-side lead 18 and the cathode-side lead 22 are soldered to wiring of a circuit board after the xenon discharge tube 10 is incorporated, for example, into a strobe unit of a camera set. Flux is applied during the base soldering treatment. Therefore, any dirt caused by the flux is removed by washing.

Figure 51:
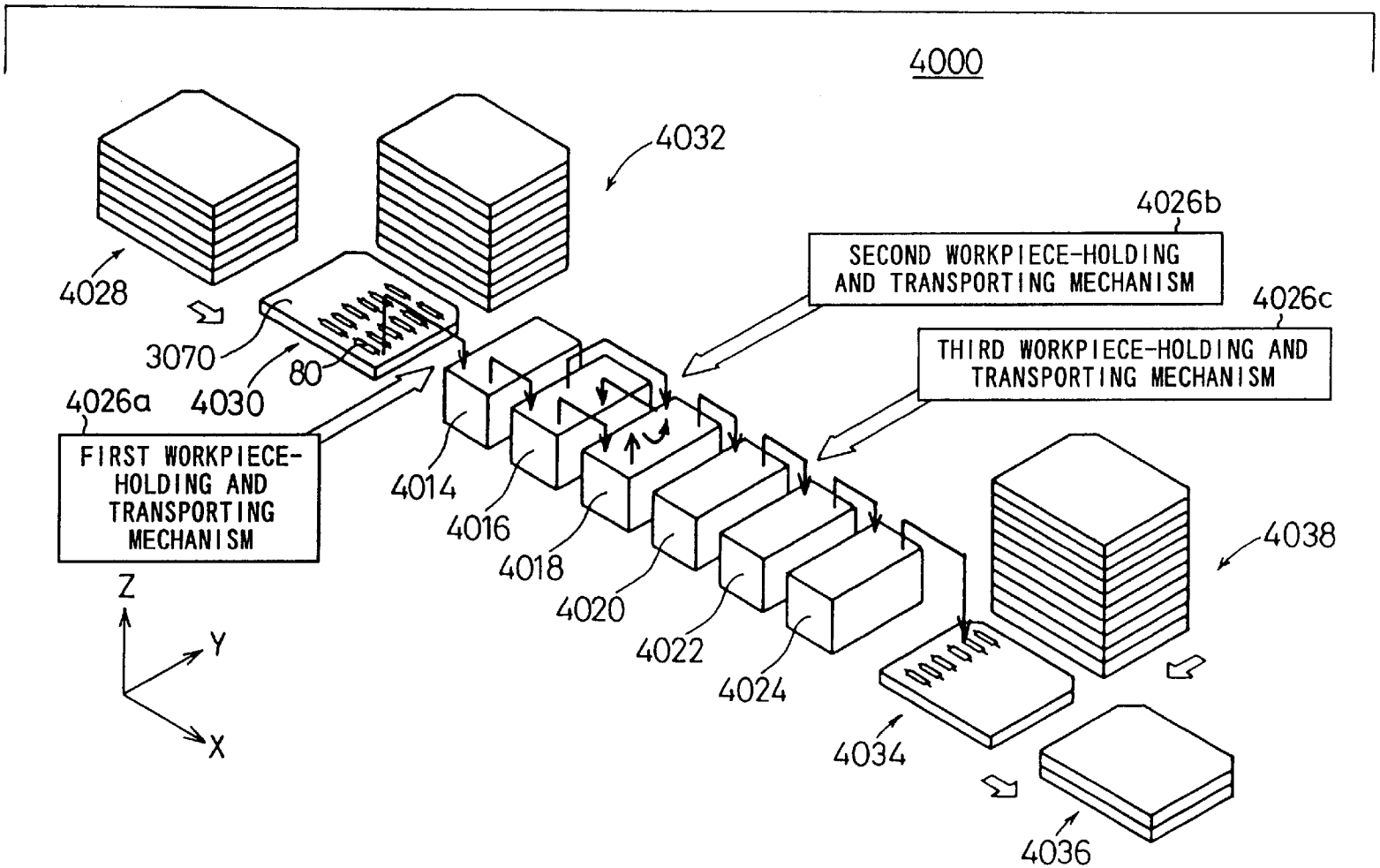
FIG. 51 shows a schematic arrangement illustrating a system of a base solder-applying and washing machine.

The base solder-applying and washing machine 4000 will now be explained with reference to FIGS. 51 to 59. As shown in FIG. 51, the base solder-applying and washing machine 4000 comprises an end-aligning mechanism 4014 for aligning the ends of the anode-side lead 18 and the cathode-side lead 22 of the secondary sealed product 80, a flux-applying mechanism 4016, a soldering mechanism 4018, a washing mechanism 4020, a water-draining mechanism 4022, and a drying mechanism 4024. The base solder-applying and washing machine 4000 further comprises first to third workpiece-holding and transporting mechanisms 4026*a* to 4026*c* for transporting the secondary sealed product 80 between the respective mechanisms.

In addition to the various mechanisms described above, the base solder-applying and washing machine 4000 comprises a non-soldered workpiece tray supply station 4028 for previously stacking and preparing the trays 3070 accommodating a plurality of non-soldered secondary sealed products 80 in order to supply the non-soldered (hereinafter referred to as "non-soldered") secondary sealed products 80 to the end-aligning mechanism 4014, a non-soldered workpiece-taking out station 4030 for taking one tray 3070 out of the non-soldered workpiece tray supply station 4028 to supply the tray 3070 to the end-aligning mechanism 4014, and an empty tray-stacking station for stacking trays 3070 which are empty after all of the non-soldered secondary sealed products 80 are supplied to the end-aligning mechanism 4014.

In addition to the various mechanisms described above, the base solder-applying and washing machine 4000 comprises a soldered workpiece-accommodating station 4034 arranged with one empty tray for receiving and accommodating the soldered (hereinafter referred to as "soldered") secondary sealed products 80 from the drying mechanism 4024, a soldered workpiece-stacking station 4036 for stacking the trays 3070 filled with the soldered secondary sealed products 80, and an empty tray supply station 4038 for preparing the empty trays 3070 in order to arrange a new empty tray 3070 in the soldered workpiece-accommodating station 4034.

In this embodiment, parts of a commercially available soldering apparatus based on the immersion method can be used for the flux-applying mechanism 4016, the soldering mechanism 4018, the washing mechanism 4020, and the drying mechanism 4024. Each of these mechanisms comprises certain associated equipment and certain tanks for being filled with the flux or the like to immerse the anode-side lead 18 and the cathode-side lead 22 of the secondary sealed product 80 therein. In the base solder-applying and washing machine 4000, when the water-draining mechanism 4022 described later on has a drying function, it is possible to omit the drying mechanism 4024.

Next, the principal components of the base solder-applying and washing machine 4000 will be explained in further detail below. At first, the end-aligning mechanism 4014 for the anode-side lead 18 and the cathode-side lead 22 of the secondary sealed product 80 shown in FIG. 52 comprises a receiving section 4040 for the secondary sealed product 80 formed with U-shaped grooves having enlarged opening ends to regulate movement of the secondary sealed product 80 in the widthwise direction, a pair of pushers 4042*a*, 4042*b* to serve as a pressing means 4043, and driving means 4044*a*, 4044*b* such as pneumatic cylinders. The workpiece-holding and transporting mechanisms 4026*a* to 4026*c* described above (see FIG. 51) are used as means for arranging the secondary sealed products 80 on the receiving section 4040.

A limiter 4046 is provided for the driving means 4044*a*, 4044*b* in order to regulate the pressing limit for the pushers 4042*a*, 4042*b*. The pushers 4042*a*, 4042*b* are moved in directions to interpose the secondary sealed products 80 by energizing the driving means 4044*a*, 4044*b*. The movement of the pushers 4042*a*, 4042*b* is stopped at the point of time at which the distance between the pushers 4042*a*, 4042*b* arrives at a predetermined value which is set to be slightly larger than the entire length of the secondary sealed products 80.

Therefore, for example, when the secondary sealed products 80 are merely arranged on the tray 3070, a dispersion of about 2 mm is involved in the positions of the ends of the secondary sealed products 80 in ordinary cases. However, the dispersion is decreased to be about 0.2 mm owing to the end-aligning mechanism 4014. Thus, it is possible to appropriately perform the soldering operation in the next step.

Figure 52:
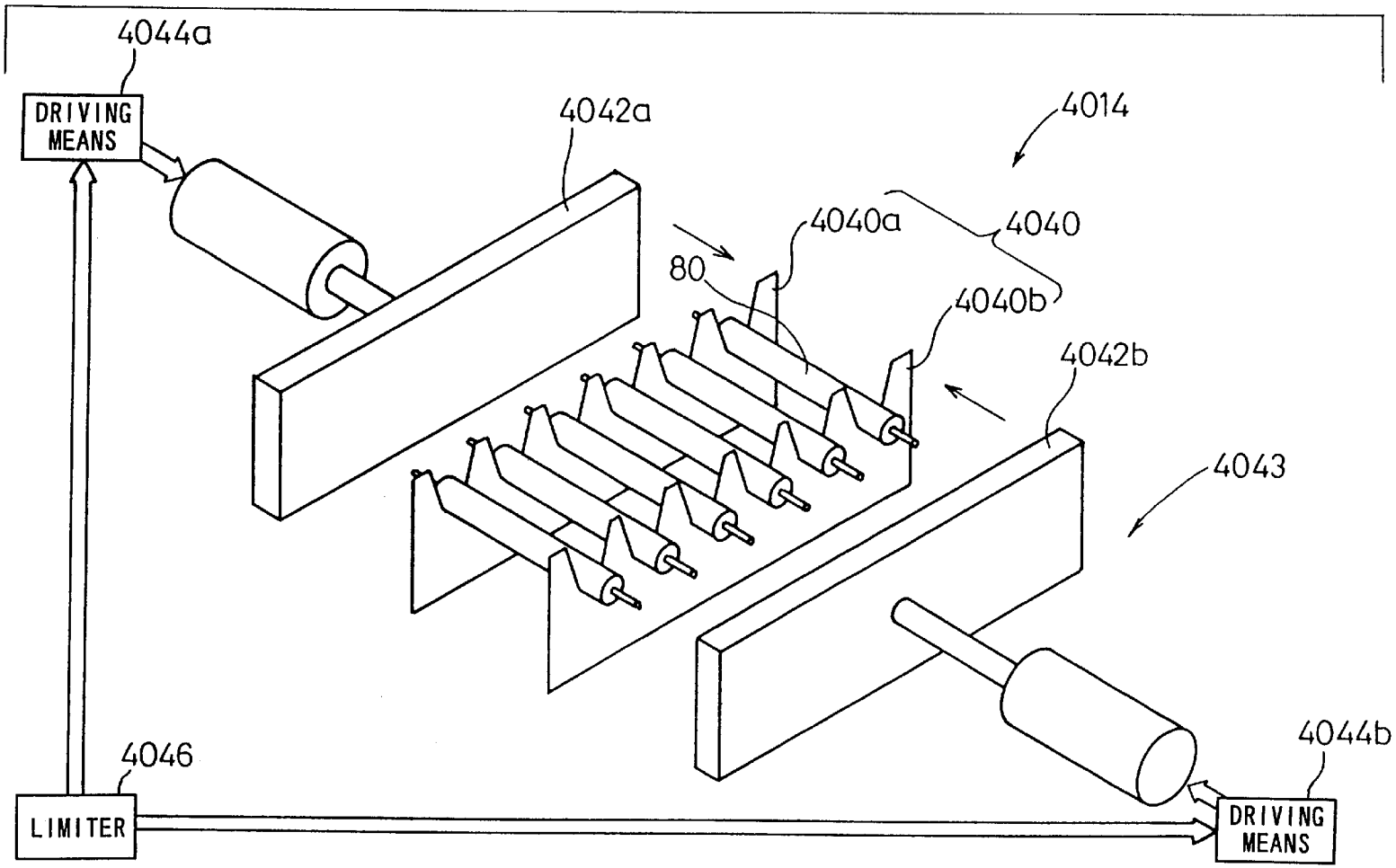
FIG. 52 shows a schematic perspective view illustrating an end-aligning mechanism for the anode-side lead and the cathode-side lead.

With reference to FIG. 52, the receiving section 4040 for the secondary sealed products 80 is made of a material such as synthetic resin, comprising two plate-shaped members 4040*a*, 4040*b* provided in an upstanding manner on both sides of a bottom plate member while being separated from each other. The both ends of the secondary sealed products 80 are held on the U-shaped grooves of the plate-shaped members 4040*a*, 4040*b*. Each of the pushers 4042*a*, 4042*b* has a smooth pressing surface without including any irregularity having a sufficient area to press the six secondary sealed products 80 held by the receiving section 4040.

Alternatively, in place of one of the pair of pushers 4042*a*, 4042*b*, it is allowable to provide a support section for receiving the secondary sealed products 80 pressed and moved by the pusher 4042*a*. Further alternatively, the receiving section 4040 is structured so that the secondary sealed products are arranged longitudinally. In this arrangement, the pusher may be omitted.

Figure 53:
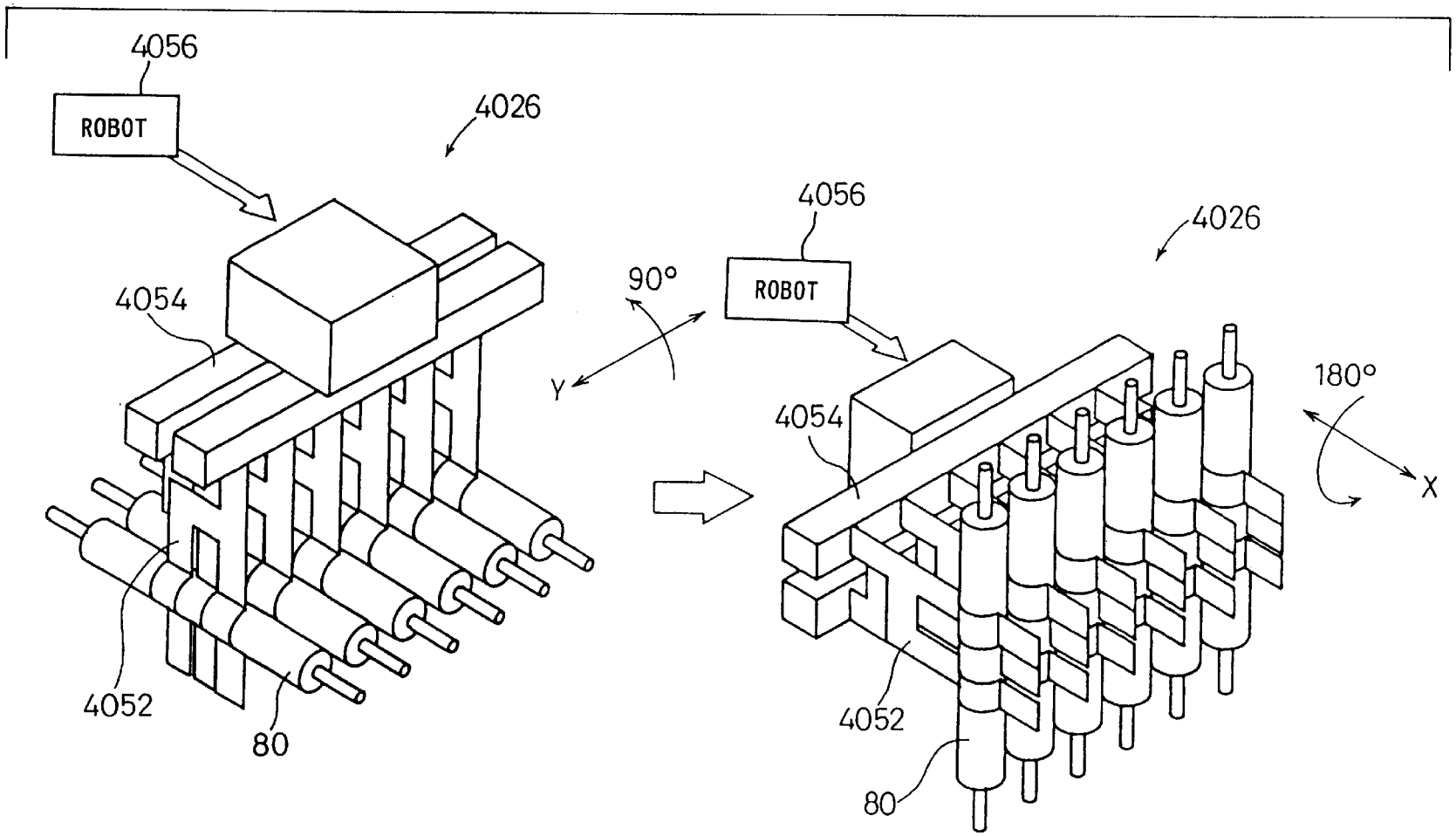
FIG. 53 shows a schematic perspective view illustrating the operation of a workpiece-holding and transporting mechanism.

As shown in FIG. 53, the workpiece-holding and transporting mechanism 4026 for transporting the secondary sealed products 80 comprises a plurality of chucks 4052 for holding the secondary sealed products 80, secured to a support member 4054. The support member 5054 is connected to a driving means 4056 such as a robot for arbitrarily rotating the direction for the chucks 4052 to hold the secondary sealed products 80 by 90° about a center of the Y axis and by 180° about a center of the X axis as shown in FIG. 53.

With reference to FIG. 53, the state of the workpiece-holding and transporting mechanism 4026 disposed on the left side represents a posture of action directed to the transport operation or a posture of holding at a predetermined position in the soldering apparatus while holding the six secondary sealed products 80 corresponding to one array on the tray 3070 disposed horizontally, by using the six chucks 4052. Specifically, the state shown on the left side in FIG. 53 represents, for example, a posture in which the first workpiece-holding and transporting mechanism 4026*a* grips the secondary sealed products 80 so that the non-soldered secondary sealed products 80 corresponding to one array on one tray 3070 of the non-soldered workpiece-taking out station 4030 are taken out to supply them to the end-aligning mechanism 4014, a posture in which the third workpiece-holding and transporting mechanism 4026*c* arranges the soldered secondary sealed products 80 to be immersed in a washing liquid in the washing mechanism 4020, and a posture in which the third workpiece-holding and transporting mechanism 4026*c* accommodates the soldered secondary sealed products 80 in the empty tray 3070 on the soldered workpiece-accommodating station 4034 as well.

On the other hand, the transition state of the workpiece-holding and transporting mechanism 4026 from the left side to the right side in FIG. 53 represents an operation posture in which the secondary sealed products 80 gripped horizontally by the chucks 4052 are rotated by 90° about the center of the Y axis so that the secondary sealed products 80 are allowed to stand in the vertical direction. Specifically, this state represents, for example, a posture in which the second workpiece-holding and transporting mechanism 4026*b* grips the horizontally arranged secondary sealed products 80 to allow them to stand in the vertical direction while being held so that the anode-side leads 18 or the cathode-side leads 22 of the secondary sealed products 80 disposed downward in FIG. 53 are immersed, for example, in the flux in the flux-applying mechanism 4016 or in the soldering mechanism 4018.

The workpiece-holding and transporting mechanism 4026 disposed on the right side in FIG. 53 represents an operation posture in which the vertically standing secondary sealed products 80 are rotated by 180° about the center of the X axis as shown in FIG. 53 to invert the secondary sealed products 80 upside down. Specifically, this posture represents a posture in which the inverting action is performed after the second workpiece-holding and transporting mechanism 4026*b* is used to solder one of the electrode leads (for example, the anode-side lead 18) of the secondary sealed product 80, and then the other electrode lead (for example, the cathode-side lead 22) is successively soldered.

Basically, the workpiece-holding and transporting mechanism 4026 is movable in the respective directions of X and Z as shown in FIG. 51. In order to increase the production efficiency, the three mechanisms are provided, i.e., the first workpiece-holding and transporting mechanism 4026*a* which takes charge of the operation for making movement between the non-soldered workpiece-taking out station 4030 and the end-aligning mechanism 4014 to transport the secondary sealed products 80, the second workpiece-holding and transporting mechanism 4026*b* which takes charge of the operation for applying flux and solder to the first electrode leads (for example, the anode-side leads 18) of the secondary sealed products 80 and then successively inverting the longitudinal direction of the secondary sealed products 80 to apply flux and solder to the second electrode leads (for example, the cathode-side leads 22) of the secondary sealed products 80, and the third workpiece-holding and transporting mechanism 4026*c* which takes charge of the transport operation at the stage of the washing mechanism 4020 and the followings. In this embodiment, the mechanism for rotating the secondary sealed products 80 by 90° about the center of the Y axis and the mechanism for inverting the secondary sealed products 80 by 180° about the center of the X axis are not provided for the first and third workpiece-holding and transporting mechanism 4026*a*, 4026*c*, because these mechanisms are not especially necessary (see FIG. 53).

An alternative embodiment is available in order to increase the production efficiency. That is, the number of mechanisms is increased at critical path portions in the respective processing steps to deliver the secondary sealed products 80 between the respective steps. In another embodiment, the operation may be performed in an overlapped manner in an identical step. On the contrary, the range of charge of one workpiece-holding and transporting mechanism 4026 is widened for portions in which any problem scarcely occurs in view of the capacity of the step, so that the number of installed mechanisms of the workpiece-holding and transporting mechanisms 4026 may be decreased.

Figure 54:
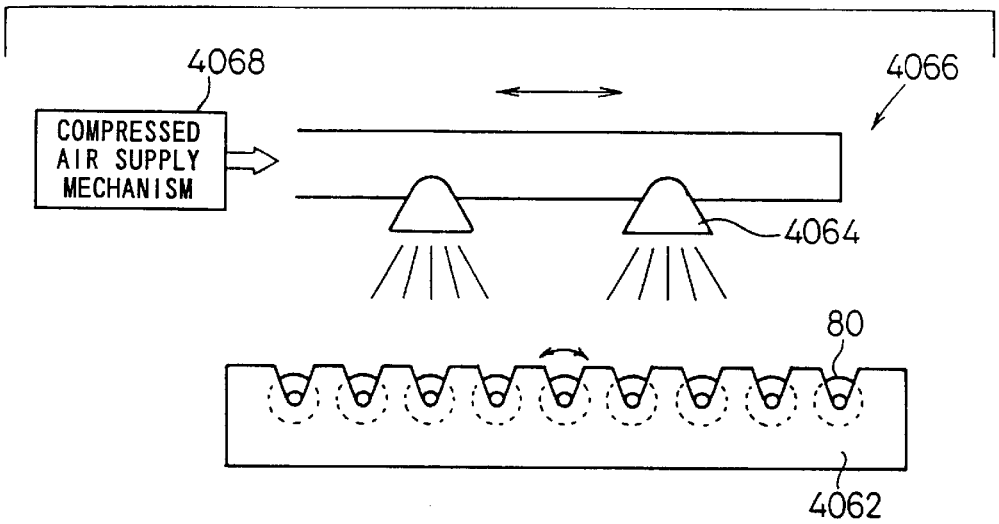
FIG. 54 shows a schematic elevational view illustrating a water-draining mechanism.

Next, the water-draining mechanism 4022 is shown in FIG. 54. The water-draining mechanism 4022 comprises a receiving section 4062 having the same structure as that of the receiving section 4040 described above, and a spray apparatus 4066 provided with a plurality of spray nozzles 4064 movable in the direction indicated by the arrow in FIG. 54. The spray apparatus 4066 is preferably connected to a compressed fluid supply mechanism 4068 based on the use of compressed air. The receiving section 4062 is provided with an unillustrated pressing member which presses the secondary sealed products 80 while leaving a gap of a degree to allow rotation so that the secondary sealed products 80 on the receiving section 4062 are prevented from being jumped out by the pressure of the compressed air.

In another embodiment, a spray nozzle 4064 having an oscillating or swinging function may be provided in place of the spray apparatus 4066 which is movable itself. Alternatively, it is allowable to provide a receiving section 4062 having a swinging function.

Explanation will be made with reference to block diagrams illustrating the system arrangement shown in FIGS. 55 to 59 for a method for base-soldering and washing-processing the secondary sealed products 80 by using the base solder-applying and washing machine 4000 described above.

Figure 55:
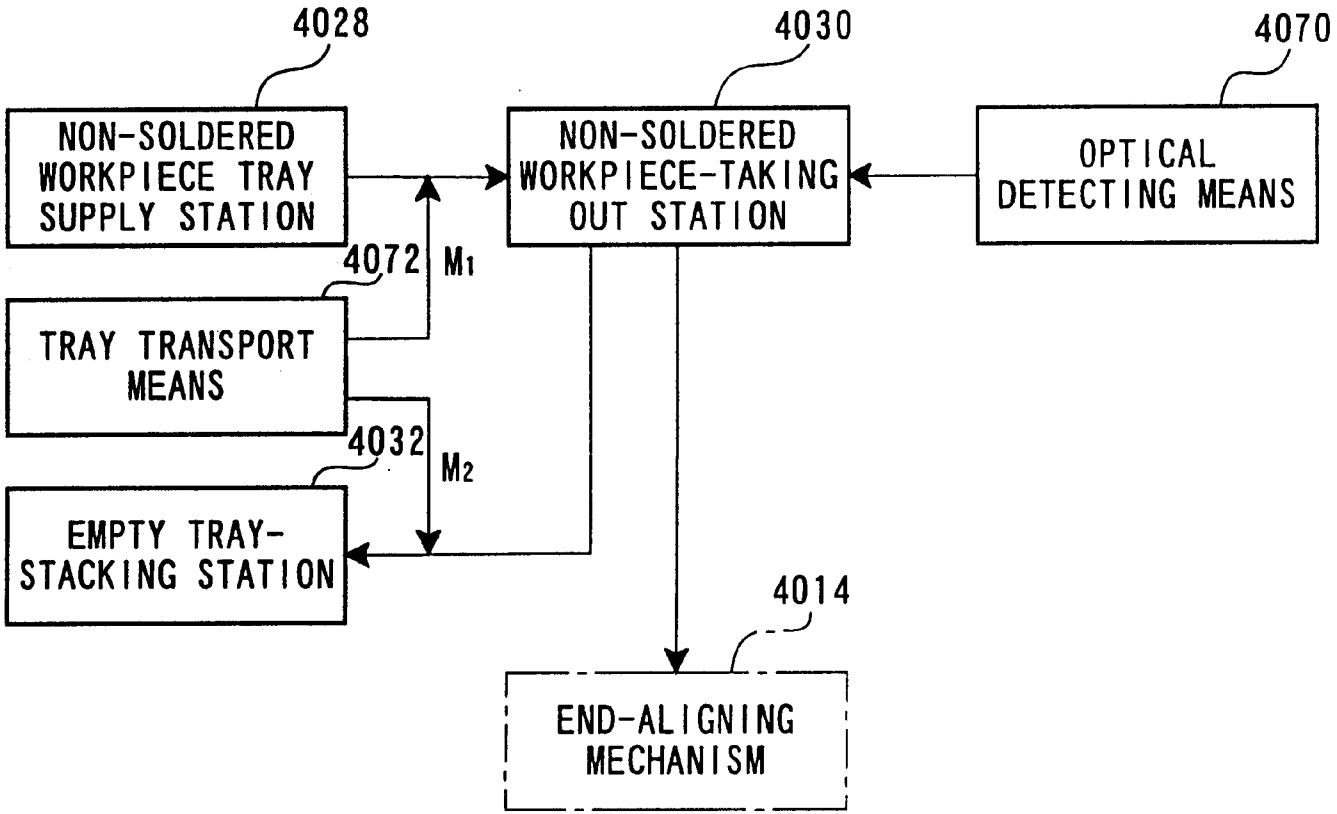
FIG. 55 shows a block diagram illustrating a system arrangement of a non-soldered workpiece tray station.

At first, reference is made to the block diagram illustrating the non-soldered workpiece tray station shown in FIG. 55. An optical detecting means 4070 is used to confirm that there is no tray 3070 in the non-soldered workpiece-taking out station 4030. After that, one of the trays 3070 stacked in the non-soldered workpiece tray supply station 4028 is transported to the non-soldered workpiece-taking out station 4030 by means of the tray transport means 4072 ($M_1$).

Subsequently, an amount of the non-soldered secondary sealed products 80 corresponding to one array arranged horizontally in four arrays x six individuals on the tray 3070 in the non-soldered workpiece-taking out station 4030 are transported to the end-aligning mechanism 4014. This operation is repeated to deal with those arranged in the four arrays. When the empty array of the secondary sealed products 80 disappears on the tray 3070, an unillustrated control means such as a sequencer is operated to count and confirm that the number of arrays of the taken out secondary sealed products 80 arrives at a predetermined number of arrangements (four arrays) on the tray 3070. The empty tray 3070 in the non-soldered workpiece-taking out station 4030 is transported to the empty tray-stacking station 4032 by means of the tray transport means 4072 ($M_2$). After that, the operations of ($M_1$) to ($M_2$) are repeated.

Figure 56:
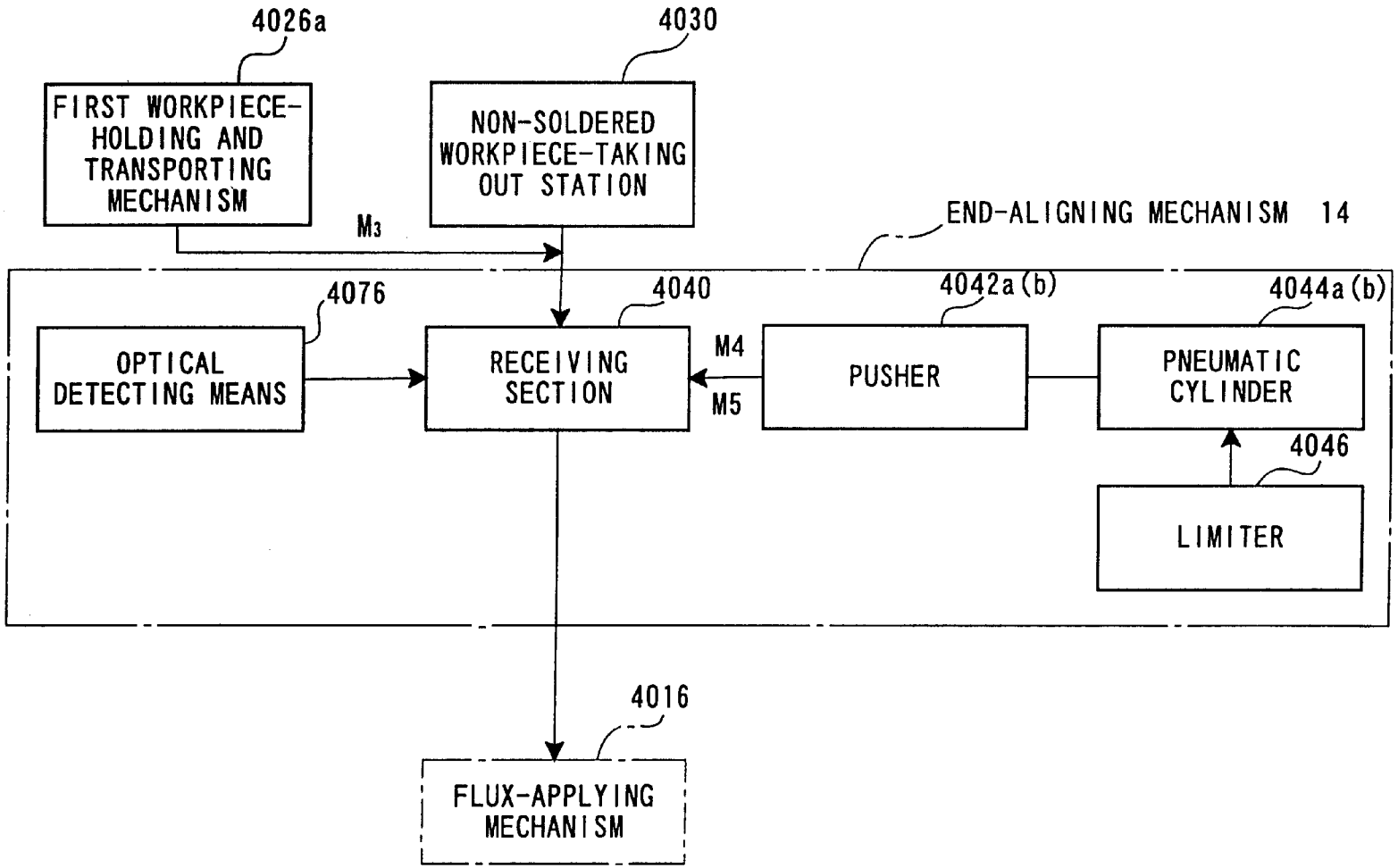
FIG. 56 shows a block diagram illustrating a system arrangement of the end-aligning mechanism.

On the other hand, as shown in FIG. 56, the six secondary sealed products 80 accommodated in one array are gripped by the first workpiece-holding and transporting mechanism 4026*a*, and they are transported to the end-aligning mechanism 4014. The secondary sealed products 80 are arranged on the receiving section 4040 ($M_3$). Subsequently, the action of ($M_3$) is repeated to successively transport the secondary sealed products 80 accommodated in the other arrays one by one.

Subsequently, with reference to the block diagram illustrating the end-aligning mechanism 4014 shown in FIG. 56, an optical detecting means 4076 is used to confirm the presence of the secondary sealed products 80 on the receiving section 4040. After that, the secondary sealed products 80 arranged on the receiving section 4040 are pressed in the length direction (the direction indicated by the arrow in FIG. 52) by means of the pushers 4042*a*, 4042*b* urged by the pneumatic cylinders as the driving means 4044*a*, 4044*b* ($M_4$).

Subsequently, when the pushers 4042*a*, 4042*b* are moved to the predetermined positions, the limiter 4046 for the driving means 4044*a*, 4044*b* is operated to stop the movement of the pushers 4042*a*, 4042*b*. Thus, the ends of the secondary sealed products 80 are aligned. After that, the pushers 4042*a*, 4042*b* are restored to the original positions, and they wait ($M_5$).

Figure 57:
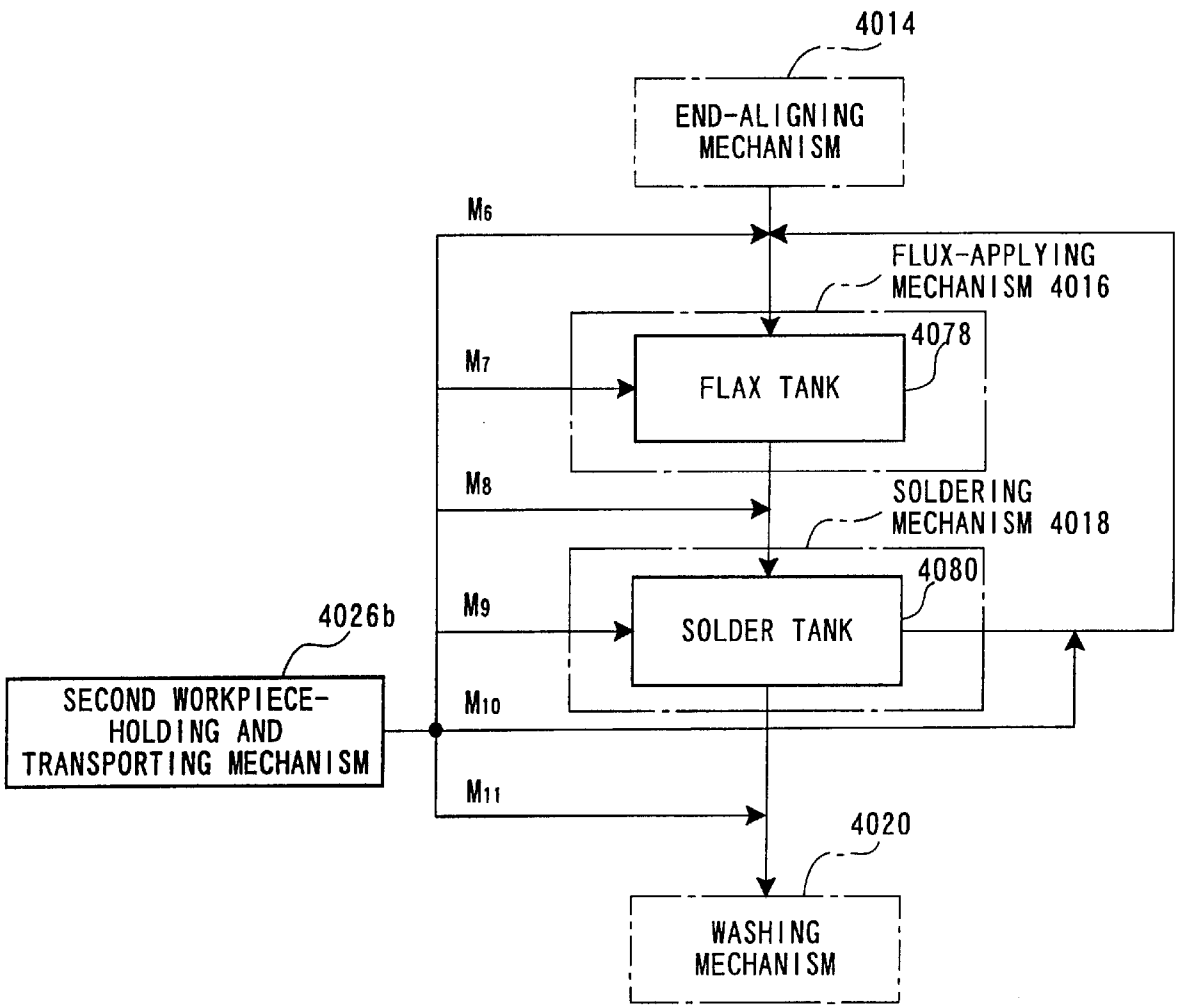
FIG. 57 shows a block diagram illustrating a system arrangement of a flux-applying mechanism and a soldering mechanism.

Next, reference is made to a block diagram in FIG. 57 illustrating the flux-applying mechanism 4016 and the soldering mechanism 4018. The secondary sealed products 80, for which the ends have been aligned, are gripped by the second workpiece-holding and transporting mechanism 4026*b* which receives another signal from the limiter 4046. The secondary sealed products 80 are rotated by 90° by the aid of the chucks 4052 so that they stand in the vertical direction. In this state, the secondary sealed products 80 are transported to the flux-applying mechanism 4016 ($M_6$).

Subsequently, the secondary sealed products 80 are transported by the second workpiece-holding and transporting mechanism 4026*b* to a flux tank 4078 of the flux-applying mechanism 4016, and they are positioned. After that, the secondary sealed products 80 are finely moved into the flux in the flux tank 4078 ($M_7$). The downward electrode leads (for example, the anode-side leads 18) of the secondary sealed products 80 are immersed for a predetermined period of time to apply the flux.

Subsequently, the secondary sealed products 80, which are gripped by the second workpiece-holding and transporting mechanism 4026*b*, are successively transported to a solder tank 4080 of the soldering mechanism 4018 while maintaining the posture of standing in the vertical direction ($M_8$). The secondary sealed products 80 are successively moved finely into the solder in the solder tank 4080 ($M_9$). The first electrode leads (for example, the anode-side leads 18) of the secondary sealed products 80 are immersed and processed therein. Thus, the soldering operation is completed.

Subsequently, the chucks 4052 of the second workpiece-holding and transporting mechanism 4026*b* are operated to invert the secondary sealed products 80 upside down so that the secondary sealed products 80 are allowed to stand in the vertical direction with the non-soldered second electrode leads (for example, the cathode-side leads 22) being disposed downward. The secondary sealed products 80 are subjected to the flux application and the soldering again ($M_{10}$).

Subsequently, the soldered secondary sealed products 80, which have been completed for the base soldering for the both electrode leads (the anode-side leads 18 and the cathode-side leads 22), are subjected to rotation of the gripping direction by 90° by the aid of the second workpiece-holding and transporting mechanism 4026*b* so that they are laid in the horizontal direction. In this state, the secondary sealed products 80 are transported to a washing tank 4082 of the washing mechanism 4020. The secondary sealed products 80 are arranged on a receiving section (not shown) arranged in the washing tank 4082, the receiving section having the same structure as that of the receiving section 4040 of the end-aligning mechanism 4014 ($M_{11}$). The second workpiece-holding and transporting mechanism 4026*b* is restored to the original position to repeat the operations of ($M_6$) to ($M_{11}$).

Figure 58:
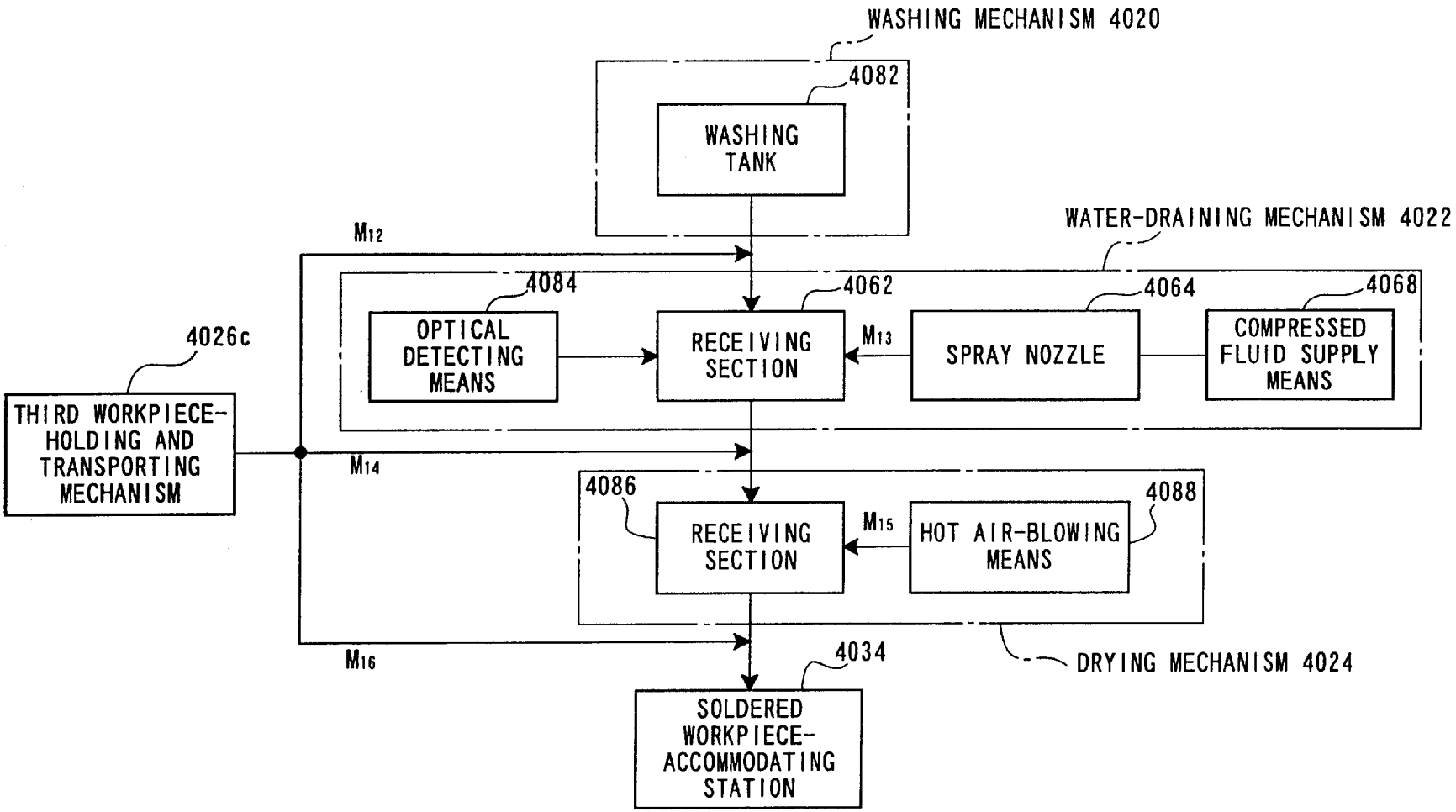
FIG. 58 shows a block diagram illustrating a system arrangement of a washing mechanism, a draining mechanism, and a drying mechanism.

Next, reference is made to FIG. 58 showing a block diagram illustrating the washing mechanism 4020, the water-draining mechanism 4022, and the drying mechanism 4024. After the passage of the predetermined period of time for completing the washing operation, the secondary sealed products 80 are gripped by the third workpiece-holding and transporting mechanism 4026*c* while maintaining the posture of the horizontal position, and they are transported to a receiving section 4062 of the water-draining mechanism 4022 to be arranged thereon ($M_{12}$).

Subsequently, an optical detecting means 4084 is used to confirm the presence of the secondary sealed products 80 on the receiving section 4062. After that, the compressed air is allowed to blow against the secondary sealed products 80 for a predetermined period of time by using the spray nozzle 4064 of the spray apparatus 4066 energized by the compressed fluid supply mechanism 4068 ($M_{13}$). The spray apparatus 4066 may be operated in a continuous state because the production efficiency is high. The spray apparatus 4066 undergoes reciprocating movement as shown in FIG. 54 by the aid of an unillustrated driving means such as a pneumatic cylinder. Thus, the compresses air is allowed to blow at different angles. Accordingly, the secondary sealed products 80 on the receiving section 4062 make swinging movement so that the entire surfaces thereof are sufficiently water-drained.

After performing the water-draining process for the predetermined period of time, the secondary sealed products 80 are gripped by the third workpiece-holding and transporting mechanism 4026*c* again, and they are transported to the drying mechanism 4024 ($M_{14}$). The secondary sealed products 80 are arranged on a receiving section 4086 of the drying mechanism 4024, and then they are dried by using a hot air-blowing means 4088 ($M_{15}$). The drying mechanism 4024 may be omitted, for example, by using a means in which the water-draining mechanism 4022 itself is placed in a high temperature atmosphere, or high temperature compressed air is allowed to blow by using the spray apparatus 4066.

Subsequently, the secondary sealed products 80, which have been dried and processed for the predetermined period of time, are transported to the soldered workpiece-accommodating station 4034 by the aid of the third workpiece-holding and transporting mechanism 4026*c*. The secondary sealed products 80 are arranged in a predetermined empty array on the tray 3070 in the soldered workpiece-accommodating station 4034 ($M_{16}$). The third workpiece-holding and transporting mechanism 4026*c* is restored to the original position to repeat the operations of ($M_{12}$) to ($M_{16}$).

Figure 59:
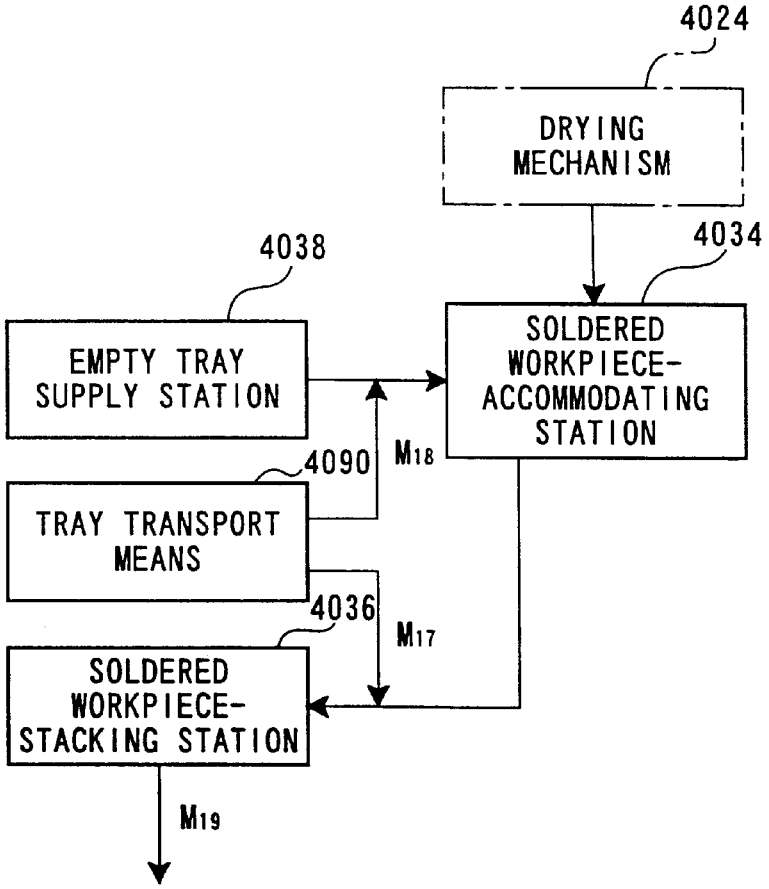
FIG. 59 shows a block diagram illustrating a system arrangement of a soldered tray station.

Next, reference is made to FIG. 59 showing a block diagram illustrating the soldered tray station. When the soldered secondary sealed products 80 are successively arranged, and consequently the tray 3070 in the soldered workpiece-accommodating station 4034 has no empty array, then an unillustrated control means such as a sequencer counts to confirm that the number of accommodating arrays arrives at the predetermined number (four arrays) of arrangements of the tray 3070. The tray transport means 4090 is operated to transfer the tray 3070 which accommodates the secondary sealed products 80 in all of the arrays, to the soldered workpiece-stacking station 4036 ($M_{17}$). A new empty tray 3070 is transported from the empty tray supply station 4038 to the soldered workpiece-accommodating station 4034 ($M_{18}$).

The respective trays 3070, in which the soldered secondary sealed products 80 are arranged in the soldered workpiece-stacking station 4036, are fed to the inspection step by using an appropriate means to inspect whether or not the soldering process for the secondary sealed product 80 is adequate ($M_{19}$).

The base solder-applying and washing machine 4000 is basically constructed as described above. Its function and effect are as follows.

At first, the ends of the electrode leads (the anode-side leads 18 or the cathode-side leads 22) having the short size of the secondary sealed products 80 are aligned, followed by soldering. Therefore, little dispersion occurs in the amount of soldering for each of the electrode leads of the secondary sealed products 80.

When the secondary sealed products 80, which have been subjected to the washing process after the soldering, are water-drained, the entire surfaces of the secondary sealed products 80 are water-drained. Therefore, there is no chance to be erroneously judged to be defective due to the presence of any water mark when the product is inspected after the soldering.

The both electrode leads (the anode-side leads 18 or the cathode-side leads 22) of the secondary sealed products 80 are continuously soldered by using the workpiece-holding and transporting mechanism 4026*a* to 4026*c* capable of gripping and inverting the secondary sealed products 80 upside down. Accordingly, the secondary sealed products 80 can be soldered and produced in one operation step. Thus, it is possible to improve the production efficiency of the secondary sealed products 80.

Next, the appearance inspection step S36 shown in FIG. 7 is carried out. In the step S36, an appearance inspection system 5000 is used to inspect the shape, the sealed state, and the appearance defect such as dirt and crack of the completed xenon discharge tube 10 by means of, for example, image processing to remove defective products.

The appearance inspection system 5000 will now be explained with reference to FIGS. 60 to 75. The xenon discharge tube 10 before the completion, which is inspected and processed by the appearance inspection system 5000, is called workpiece 10.

Figure 60:
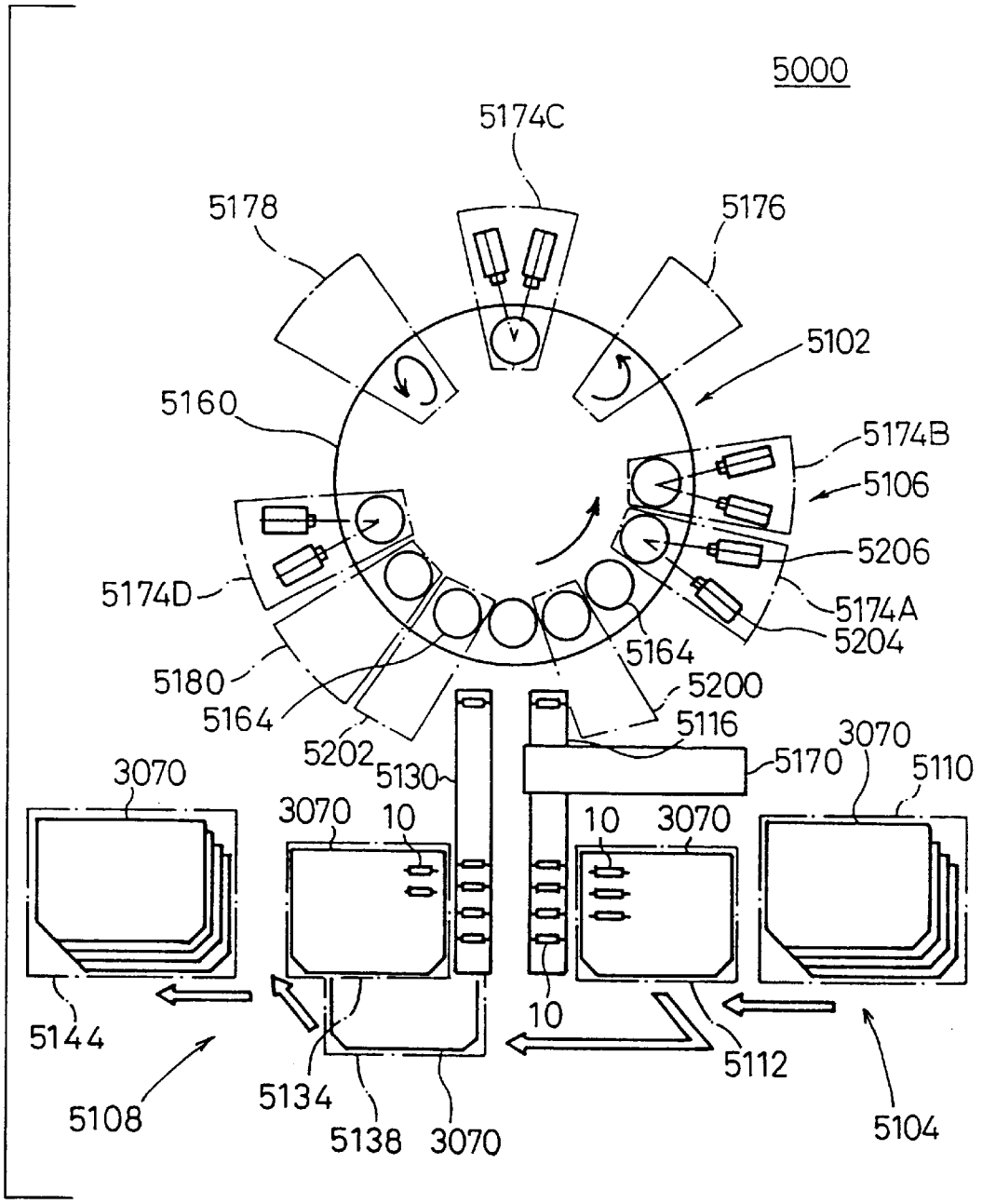
FIG. 60 shows an arrangement illustrating an appearance inspection system.

As shown in FIG. 60, the appearance inspection system 5000 comprises a workpiece-introducing unit 5104 for taking the workpiece 10 to be subjected to the appearance inspection out of the tray 3070 in which a large number of workpieces 10 are accommodated so that the workpiece 10 is introduced into a rotary transport unit 5102 as described later on, an appearance inspection unit 5106 for performing substantial appearance inspection for the workpiece 10 during the transport process effected by the rotary transport unit 5102, and a workpiece-accumulating unit 5108 for accumulating, in the tray 3070, the workpieces acknowledge to be adequate, of the workpieces 10 completed for the appearance inspection.

Figure 61:
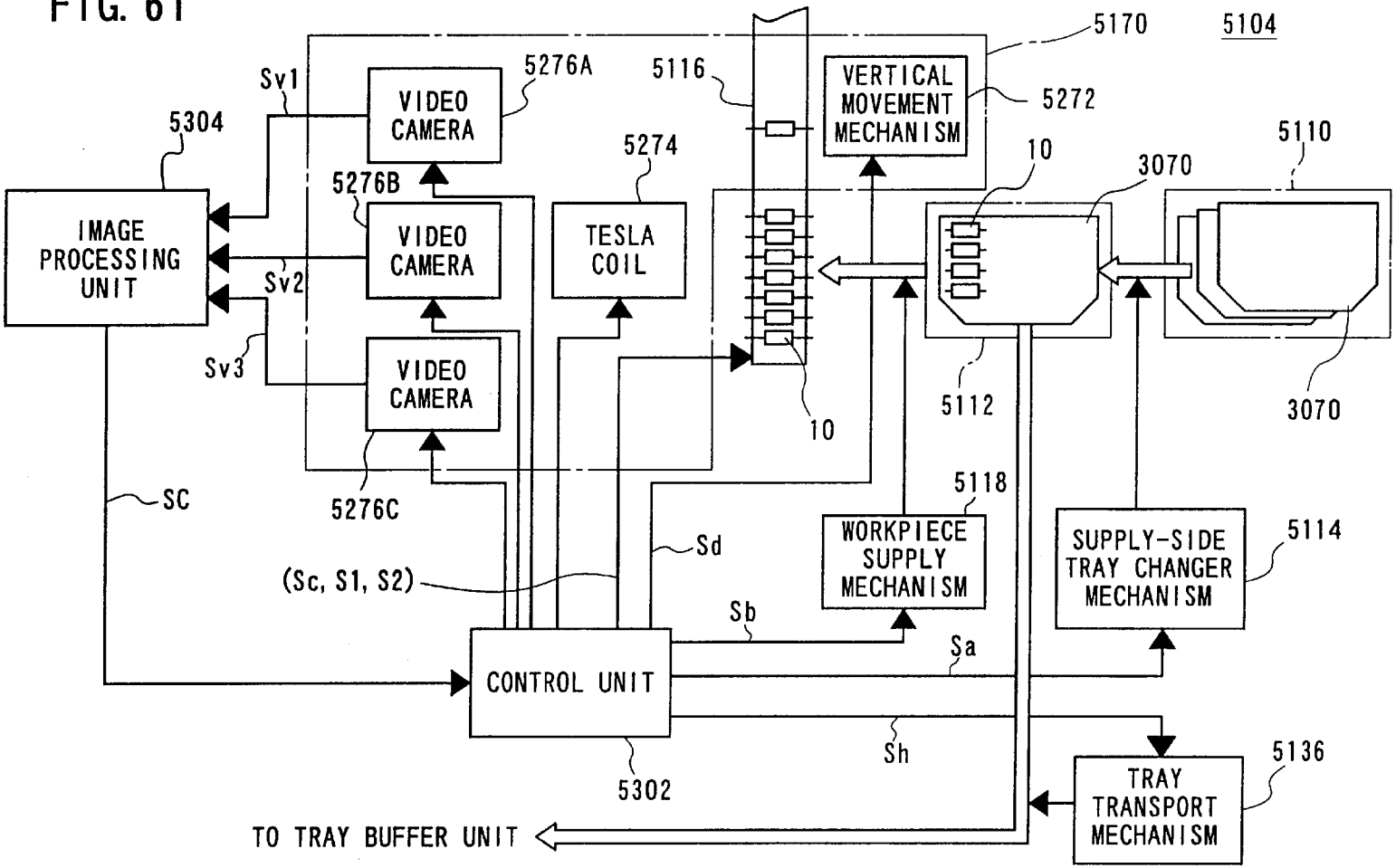
FIG. 61 shows an arrangement illustrating a tray supply unit, a workpiece supply unit, and a tesla inspection station of the appearance inspection system.

As shown in FIG. 61, the workpiece-introducing unit 5104 comprises a tray-receiving unit 5110 for accommodating, in a stacked state, a large number of trays 3070 which accommodate a large number of workpieces 10, a supply-side tray changer mechanism 5114 for separating, one by one, the large number of trays 3070 accommodated in the tray-receiving unit 5110 and positioning the trays 3070 in a supply unit 5112, a workpiece supply mechanism 5118 for taking a plurality of workpieces 10 at once out of one tray 3070 positioned in the supply unit and introducing the workpieces 10 into a supply-side linear transport mechanism 5116, the supply-side linear transport mechanism 5116 for successively transporting, in a first direction, the plurality of workpieces 10 introduced by the workpiece supply mechanism 5118 in a state of being placed laterally, and a workpiece-introducing mechanism 5120 (see FIG. 62) arranged in the vicinity of the terminal end of the supply-side linear transport mechanism 5116, for taking out, one by one, the workpieces 10 transported by the supply-side linear transport mechanism 5116 and introducing the workpieces 10 into a rotary transport unit 5102 (see FIG. 60).

Figure 63:
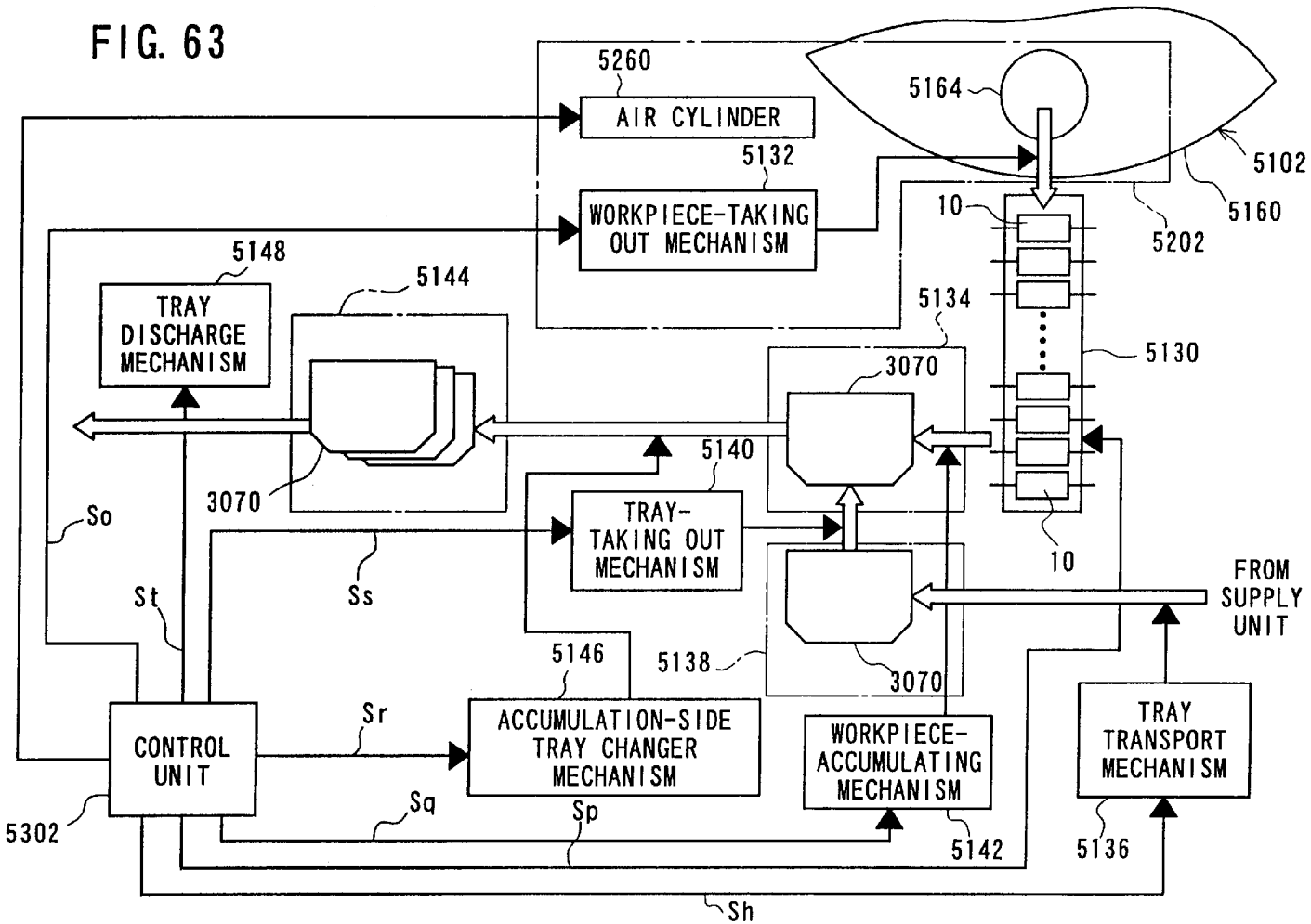
FIG. 63 shows a workpiece-taking out station, a workpiece-accumulating mechanism, and a tray discharge unit of the appearance inspection system.

As shown in FIG. 63, the workpiece-accumulating unit 5108 comprises a workpiece-taking out mechanism 5132 for taking out, one by one, the workpieces 10 acknowledged to be adequate of the workpieces 10 subjected to the appearance inspection by the appearance inspection unit 5106 and introducing the workpieces 10 into an accumulation-side linear transport mechanism 5130 as described later on, the accumulation-side linear transport mechanism 5130 for successively transporting, in a first direction, the workpieces 10 introduced by the workpiece-taking out mechanism 5132 in a state of being placed laterally, a tray transport mechanism 5136 for transporting the tray 3070 placed in the supply unit 5112 toward the accumulating unit 5134 at a stage at which the supply tray 3070 positioned in the supply unit 5112 (see FIG. 61) is empty, a tray buffer unit 5138 for temporarily accommodating, as a backup tray 3070, the tray 3070 transported by the tray transport mechanism 5136, a tray-taking out mechanism 5140 for taking out the tray 3070 accommodated in the tray buffer unit 5138 and positioning the tray 3070 in the accumulating unit 5134, a workpiece-accumulating mechanism 5142 for taking out the workpiece 10 transported by the accumulation-side linear transport mechanism 5130 and accommodating the workpiece 10 in the tray 3070 positioned in the accumulating unit 5134, an accumulation-side tray changer mechanism 5146 for transporting the tray 3070 to a tray discharge unit 5144 and accommodating the tray 3070 in a stacked state at a stage at which the tray 3070 positioned in the accumulating unit 5134 is filled with the workpieces 10, and a tray discharge mechanism 5148 for transporting the plurality of trays 3070 in a stacked state to the next step at a stage at which the trays 3070 are stacked in a predetermined number of layers.

Figure 71:
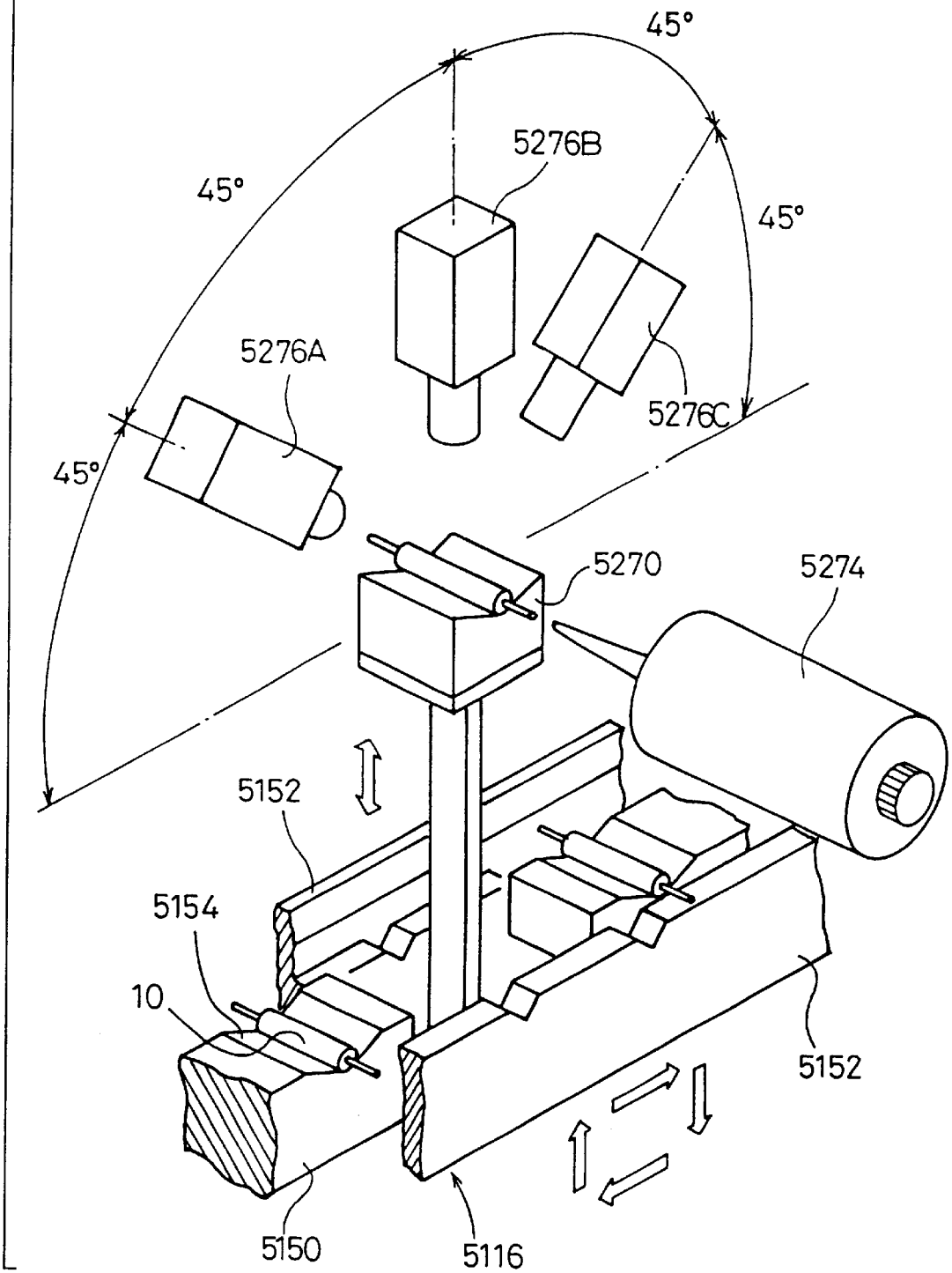
FIG. 71 shows a perspective view illustrating, with partial omission, an arrangement of the tesla inspection station.

As shown in FIG. 71, for example, any one of the supply-side linear transport mechanism 5116 and the accumulation-side linear transport mechanism 5130 comprises a fixed rail 5150 on which a large number of workpieces 10 are arranged laterally at equal pitches, and feed bars 5152 which are rotationally driven along the fixed rail 5150. The feed bars 5152 are rotated in a rectangular manner as shown by the arrows. Thus, the workpieces 10, which are placed on grooves 5154 formed at upper portions of the fixed rail 5150, are moved to the next grooves 5154 respectively. The feed bars 5152 may be constructed such that the workpieces 10 are moved to the next grooves 5154 by means of rotation effected by circular motion. In this embodiment, the workpieces 10 are arranged laterally by the aid of the supply-side linear transport mechanism 5116 and the accumulation-side linear transport mechanism 5130 as described above. However, there is no trouble if the workpieces 10 are arranged vertically, depending on the structure or arrangement of the machine.

Figure 62:
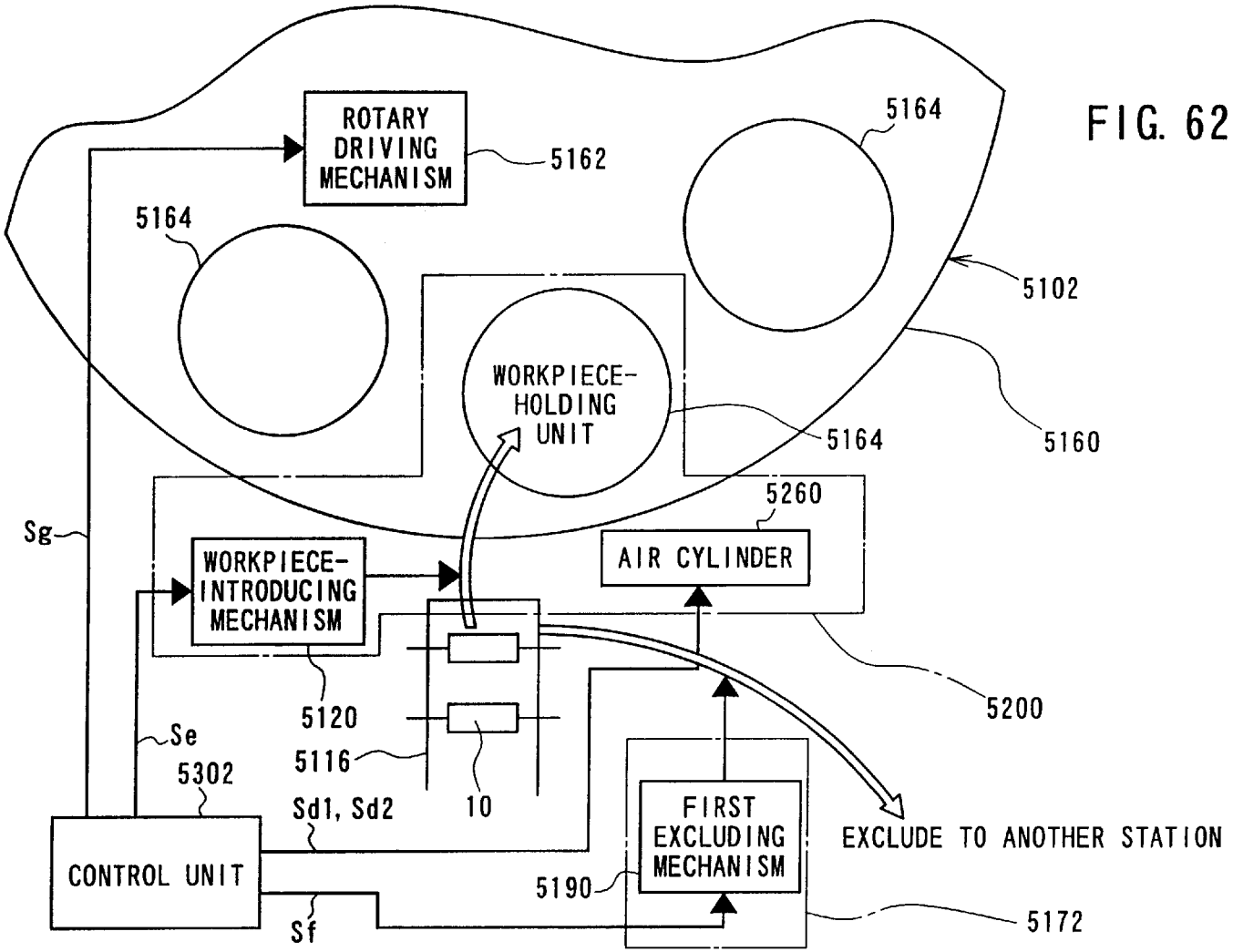
FIG. 62 shows a workpiece-holding station and a first excluding station of the appearance inspection system.

The rotary transport unit 5102 comprises a table 5160 having a substantially circular planar configuration, and a rotary driving mechanism 5162 for intermittently rotating the table 5160 in a first direction (see FIG. 62). A plurality of workpiece-holding units 5164 (indicated by circular frames) are arranged at equal pitches on a substantially identical circumference, at the outer circumferential portion of the table 5160. The workpiece-holding unit 5164 will be described in detail later on.

Figure 64:
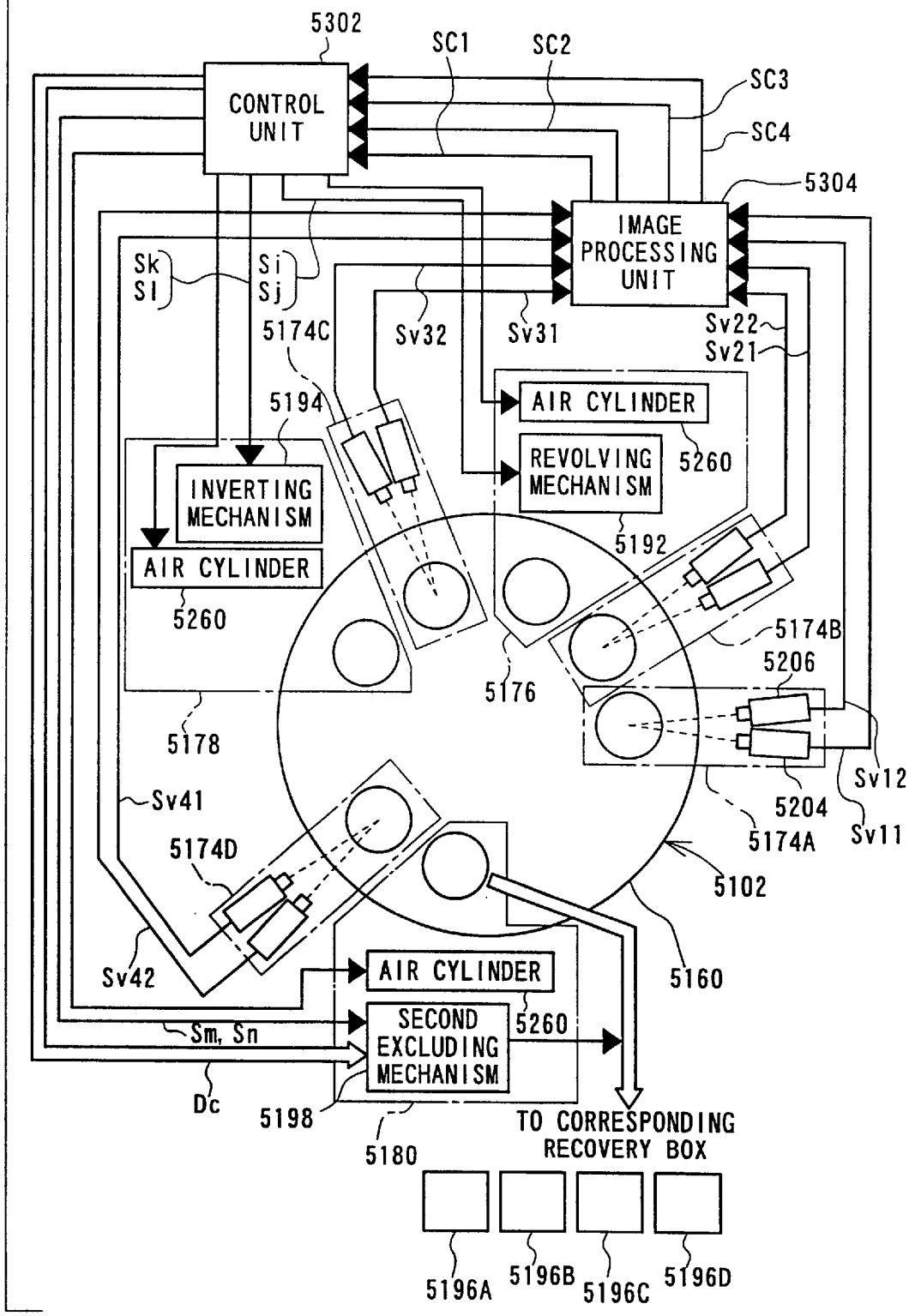
FIG. 64 shows an arrangement illustrating first to fourth appearance inspection station, a revolving station, an inverting station, and a second excluding station of the appearance inspection system.

The appearance inspection unit 5106 comprises a large number of stations in order to inspect the appearance of the workpiece 10. Specifically, a tesla inspection station 5170 for performing the light emission inspection by using a high voltage and a high frequency as shown in FIG. 61, and a first excluding station 5172 for excluding the workpiece 10 acknowledged to be defective as a result of the tesla inspection as shown in FIG. 62 are installed at the halfway of a transport passage of the supply-side linear transport mechanism 5116. As shown in FIG. 64, those installed around the rotary transport unit 5102 include four appearance inspection stations (first to fourth appearance inspection station 5174A to 5174D), a revolving station 5176 for revolving the workpiece 10 by about 180° about a center of its axis, an inverting station 5178 for inverting the workpiece by 180° about a center of an axis perpendicular to its axis, and a second excluding station 5180 for classifying the workpieces 10 acknowledged to be defective as a result of the inspection performed in the first to fourth appearance inspection stations 5174A to 5174D, into those belonging to different defective types so that they are excluded.

The first excluding station 5172 comprises a first excluding mechanism 5190 for taking out the concerning workpiece 10 during the transport process effected by the supply-side linear transport mechanism 5116 and transporting and excluding it to another station when the workpiece 10 is acknowledged to be defective in the tesla inspection.

The revolving station 5176 is installed with a revolving mechanism 5192 for once holding the workpiece 10 by the aid of the workpiece-holding unit 5164 and revolving the workpiece 10 by about 180° about the center of the axis of the workpiece 10. The inverting station 5178 is installed with an inverting mechanism 5194 for once taking the workpiece 10 out of the workpiece-holding unit 5164 and inverting the workpiece 10 by 180° about the center of the axis perpendicular to the axis of the workpiece 10.

The second excluding station 5180 comprises a plurality of recovery boxes 5196A to 5196D arranged corresponding to the types of defective products, and a second excluding mechanism 5198 for taking out the workpiece 10 held by the workpiece-holding unit 5164 so that the workpiece 10 is accommodated in any one of the recovery boxes 5196A to 5196D corresponding to the type of the defective product when the workpiece 10 is acknowledged to be defective.

As shown in FIG. 62, a workpiece-holding station 5200, which includes the workpiece-introducing mechanism 5120, is installed to hold the workpiece 10 by using the workpiece-holding unit 5164 of the rotary transport unit 5102. As shown in FIG. 63, a workpiece-taking out station 5202, which includes the workpiece-taking out mechanism 5132, is installed to take the workpiece 10 out of the workpiece-holding unit 5164 of the rotary transport unit 5102.

As shown in FIG. 64, two video cameras 5204, 5206 are installed in each of the first to fourth appearance inspection stations 5174A to 5174D. The workpiece 10 is photographed by using the two video cameras 5204, 5206 respectively in each of the appearance inspection stations 5174A to 5174D, followed by image processing to inspect, for example, the dirt on the inner and outer surfaces of the glass tube 12, the mechanical defect (for example, missing, breakage, crack) of the glass tube 12 and the functional parts, the sealed state (for example, the fused state of the sealed portion, the change in dimension in the vicinity of the sealed portion) of the glass tube 12, and the bending and the length of the lead wires 18, 22.

Of the four appearance inspection stations 5174A to 5174D, the first to third appearance inspection stations 5174A to 5174C are used to inspect the appearance of, for example, the portion of the glass tube 12 and the functional parts on the cathode-side, and the cathode-side lead 22. The fourth appearance inspection station 5174D is used to inspect the appearance of, for example, the portion of the glass tube 12 and the functional parts on the anode-side, and the anode-side lead 18.

Figure 65:
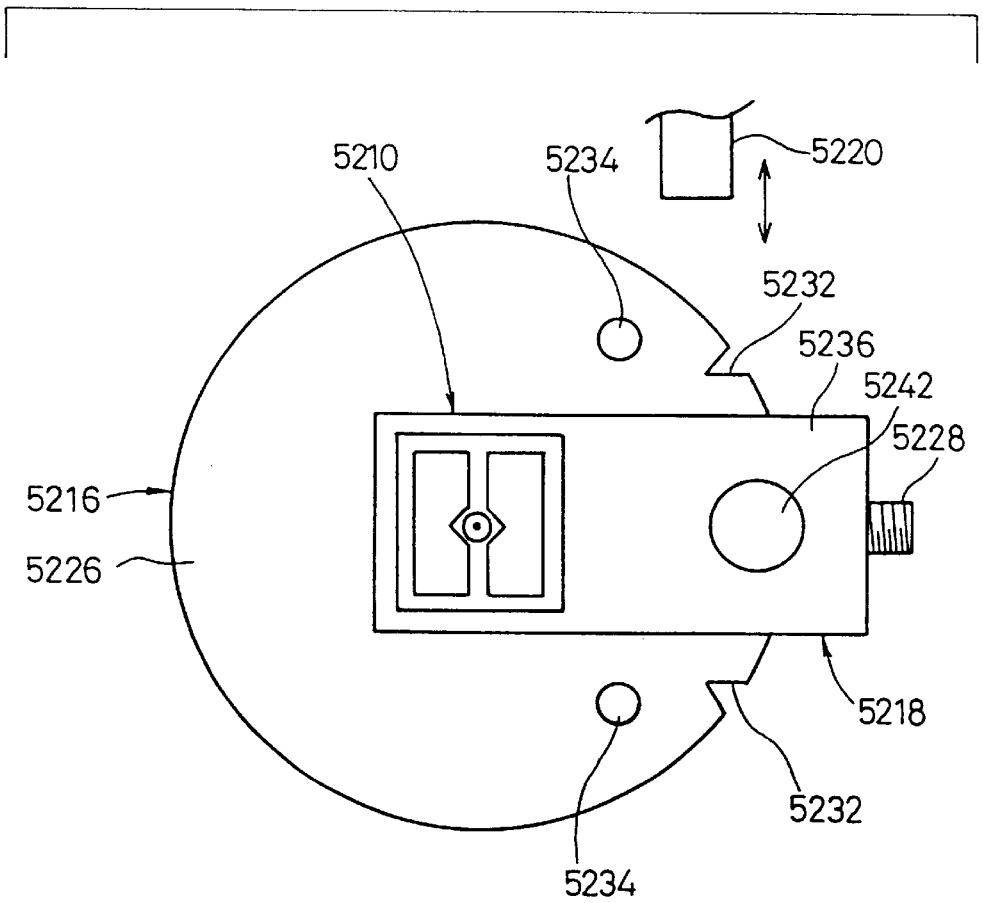
FIG. 65 shows a plan view illustrating an arrangement of a workpiece-holding unit.
Figure 66:
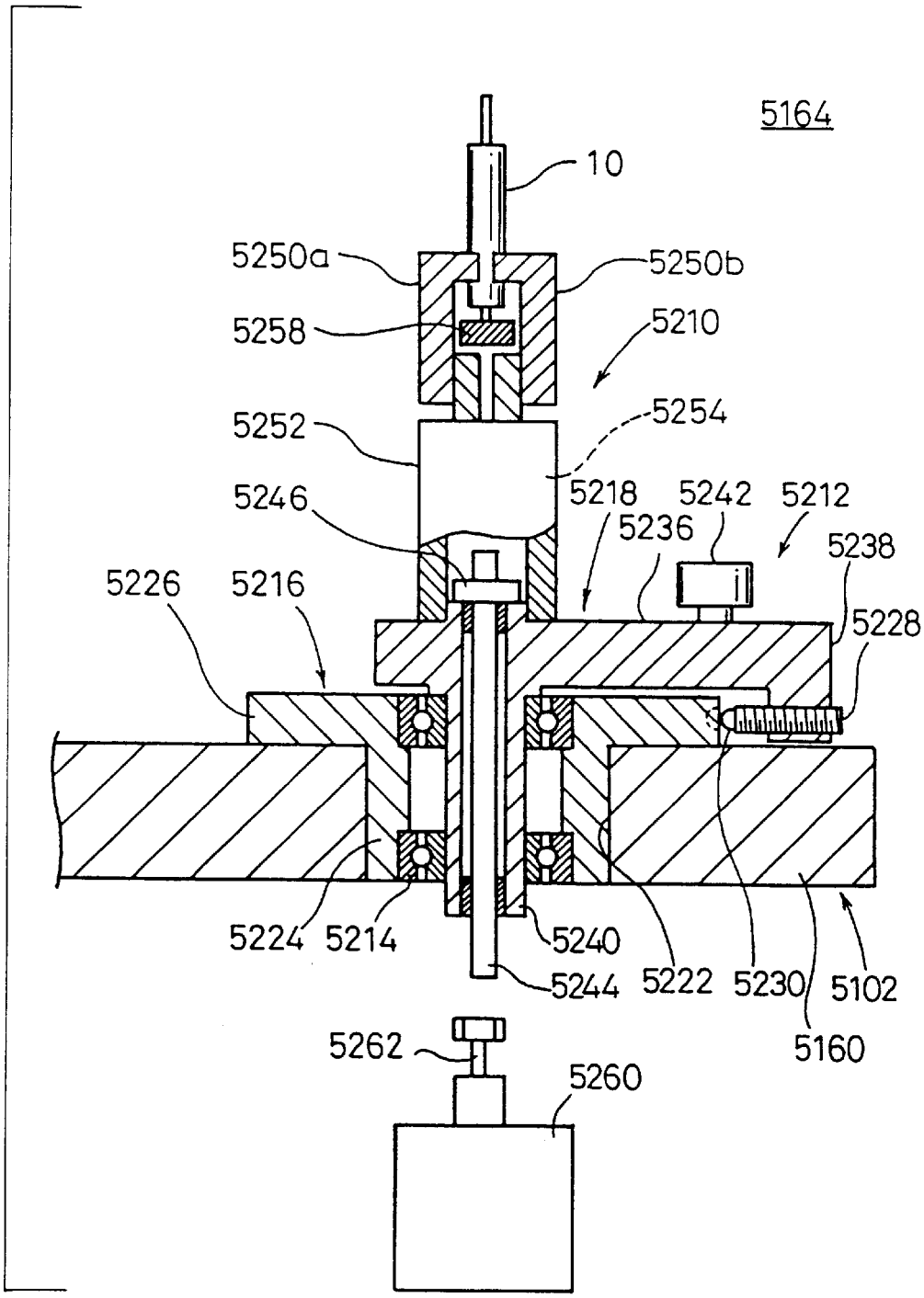
FIG. 66 shows a sectional view illustrating, with partial omission, the arrangement of the workpiece-holding unit.

On the other hand, as shown in FIGS. 65 and 66, the workpiece-holding unit 5164 comprises a clamp mechanism 5210 for positioning the workpiece 10 so that the axial direction of the workpiece 10 extends along the vertical direction to hold a part of the workpiece 10 of not more than a half of its entire length, and a clamp-revolving mechanism 5212 for revolving (swinging) the clamp mechanism 5120 about a center of its axis (or the central axis of the workpiece 10) within a range of angle of rotation of 90°.

The clamp-revolving mechanism 5212 comprises a fixed section 5216 fixed to the table 5160 and including a bearing 5214 attached inside, a revolving table 5218 attached rotatably to the fixed section 5216, and an actuator 5220 attached externally (see FIG. 65).

The fixed section 5216 comprises a cylinder 5224 inserted and secured to each of through-holes 5222 formed at equal pitches on the outer circumferential portion of the table 5160, and a circular flange 5226 formed integrally on the cylinder 5224. The flange 5226 functions as a guide member for guiding the rotation of the revolving table 5218. Meshing grooves 5232 (see FIG. 65), into which a ball 5230 of a ball plunger 5228 is inserted as described later on, are formed on the side wall of the flange 5226 (see FIG. 65). Two stopper pins 5234 for regulating the range of rotation of the revolving table 5218 are provided on the upper surface of the flange 5226.

The revolving table 5218 comprises a horizontal segment 5236 having a substantially rectangular planar configuration, a vertical segment 5238 formed integrally to hang vertically downwardly from one end of the horizontal segment 5236 (from one end disposed outer than the flange 5226 of the fixed section 5216), and a hollow shaft 5240 formed integrally to hang vertically downwardly at a position in the vicinity of the other end of the horizontal segment 5236 (at a position corresponding to the center of the fixed section 5216), for being inserted into the bearing 5214 of the fixed section 5216.

The vertical segment 5238 is provided at its central portion with the ball plunger 5228 which is attached to press the ball 5230 against the circumferential surface of the flange 5226. A cam follower 5242 for operating and rotating the revolving table 5218 is provided at an upper portion of the horizontal segment 5236 (at a position slightly inner than the position of the outer circumference of the flange 5226 of the fixed section 5216 as viewed in projection).

Therefore, the revolving table 5218 is rotated about the center the hollow shaft 5240 by linearly pushing or pulling the cam follower 5242 of the revolving table 5218 by using the actuator 5220. Accordingly, the ball 5230 of the ball plunger 5228 is inserted into the meshing groove 5232 provided on the flange 5226. Thus, the revolving table 5218 is prevented from further rotation.

Especially, in the appearance inspection system 5000, the two meshing grooves 5232 are provided at the positions to give a central angle of about 90° with reference to the center of rotation of the revolving table 5218. Therefore, the range of rotation of the revolving table 5218 is approximately a range of the central angle of 90°. Further, in the appearance inspection system 5000, the two stopper pins 5234 are provided on the upper surface of the flange 5226. Therefore, the ball plunger 5228 and the stopper pins 5234 can be used to reliably regulate the range of rotation of the revolving table 5218 to be within the range of the central angle of about 90°.

A rod 5244 is inserted along the hollow shaft 5240 into the hollow shaft 5240 of the revolving table 5218. A fastening ring 5246, which has its outer diameter larger than the inner diameter of the hollow shaft 5240, is integrally provided on the rod 5244 so that the rod 5244 is prevented from falling.

The clamp mechanism 5210 described above is attached over the center of rotation of the revolving table 5218. The clamp mechanism 5120 comprises a pair of chuck pawls 5250*a*, 5250*b* each having a substantially L-shaped longitudinal cross section, and a chuck mechanism 5254 contained in a housing 5252 and principally including a spring (not shown) for urging the pair of chuck pawls 5250*a*, 5250*b* in a direction to make approach to one another.

Figure 67:
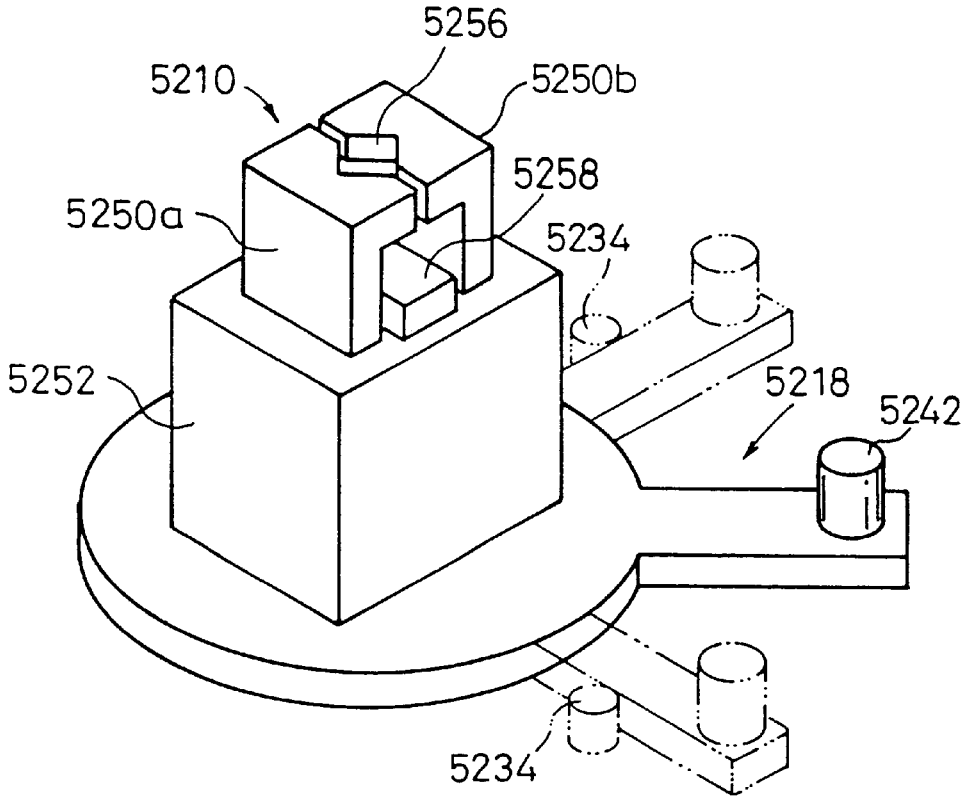
FIG. 67 shows a perspective view illustrating the revolving action of the workpiece-holding unit.

The structure of the pair of chuck pawls 5250*a*, 5250*b* will now be explained with reference to FIG. 67 depicting another illustrative structure of the revolving table. The pair of chuck pawls 5250*a*, 5250*b* are bent so that the respective forward ends are opposed to one another. Triangular cutouts 5256 are formed at the respective forward ends. Each of the cutouts 5256 has a size of a degree capable of holding the glass tube 12 of the workpiece 10 by using the bent portions of the pair of chuck pawls 5250*a*, 5250*b* when the pair of chuck pawls 5250*a*, 5250*b* make approach to one another.

Figure 68:
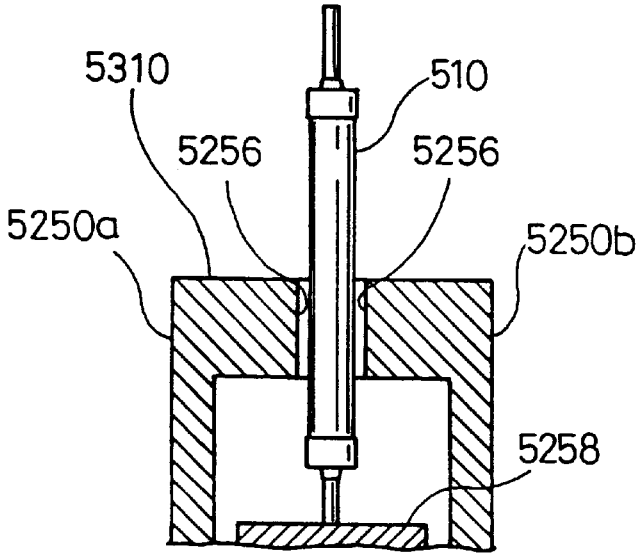
FIG. 68 shows a sectional view illustrating a pair of chuck pawls and a height fiducial plate of the workpiece-holding unit.

As also shown in FIG. 68, a height fiducial plate 5258 for prescribing the height of the workpiece 10 during the clamping operation is provided on the housing 5252 of the clamp mechanism 5210. In the appearance inspection system 5000, when the workpiece 10 is held by the clamp mechanism 5210, the portion of the workpiece 10 (the upper half+an upper portion of the lower half of the workpiece 10), which is larger than the half of the entire length of the workpiece 10, is exposed to the outside while being disposed upwardly from the upper ends of the pair of chuck pawls 5250*a*, 5250*b*. A portion of the lower half of the workpiece 10 except for the upper portion of the lower half is hidden by the pair of chuck pawls 5250*a*, 5250*b*.

As shown in FIG. 66, the holding action effected by the pair of chuck pawls 5250*a*, 5250*b* is released, i.e., the pair of chuck pawls 5250*a*, 5250*b* are opened by upwardly lifting the rod 5244 which extends through the inside of the hollow shaft 5240 of the revolving table 5218.

An air cylinder 5260 for the unclamping action is installed at a position corresponding to the station in which it is necessary to temporarily release the holding of the workpiece 10 effected by the workpiece-holding unit 5164 (for example, the workpiece-holding station 5200 (see FIG. 62), the revolving station 5176 (see FIG. 64), the inverting station 5178 (see FIG. 64), the second excluding station 5180 (see FIG. 64), and the workpiece-taking out station 5202 (see FIG. 63)) in a space under the table 5160. A piston rod 5262 is moved upwardly in accordance with the driving action of the air cylinder 5260. Thus, the rod 5244 of the revolving table 5218, which is positioned over the air cylinder 5260, is lifted upwardly. Accordingly, the holding of the workpiece 10 effected by the pair of chuck pawls 5250*a*, 5250*b* is released.

Figure 69B:
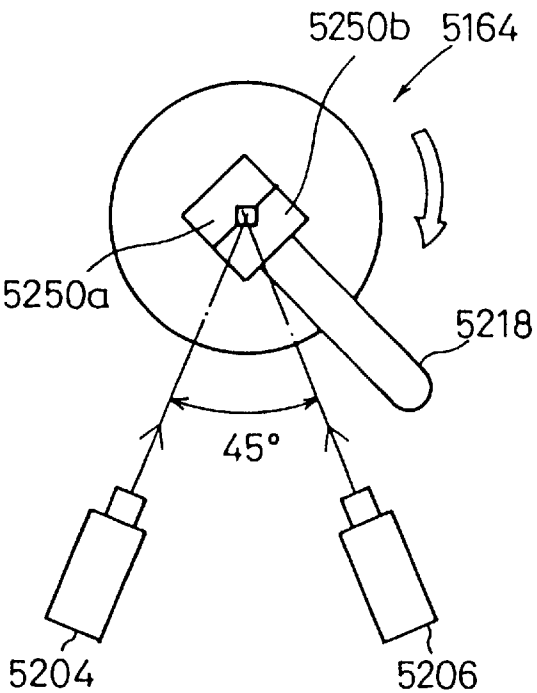
FIG. 69B shows a plan view illustrating a state in which the workpiece-holding unit is revolved (swung) by 90°.
Figure 69A:
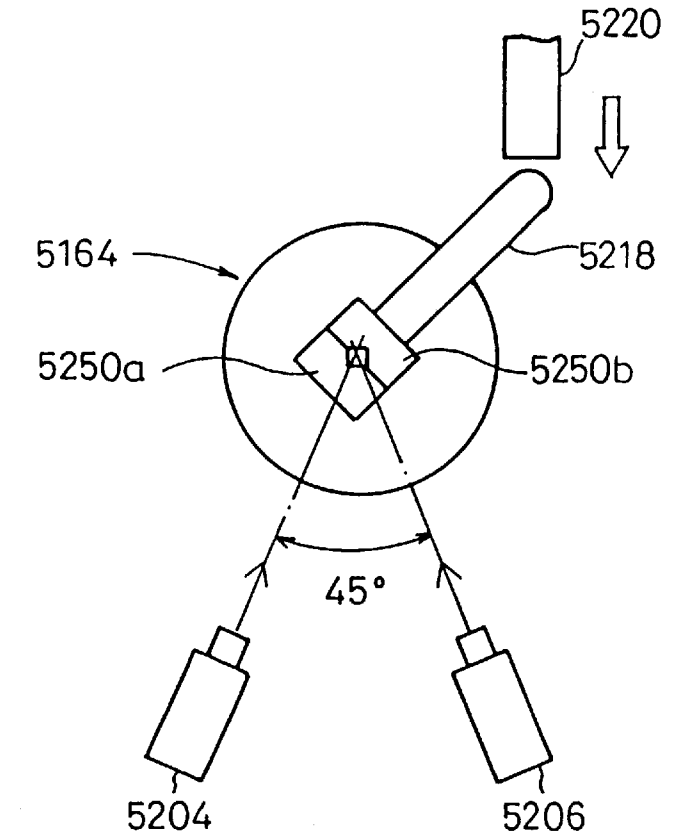
FIG. 69A shows an initial state of the workpiece-holding unit.

When the workpiece-holding unit 5164 arrives at any one of the first to fourth appearance inspection stations 5174A to 5174D in accordance with the rotation of the table 5160, the workpiece 10, which is held by the workpiece-holding unit 5164, is photographed by the two video cameras 5204, 5206. As shown in FIG. 69A, for example, the two video cameras 5204, 5206 have their respective image pickup planes which are directed toward the central axis of the workpiece-holding unit 5164, and they are arranged at positions at which the central angle is $\{(n\pi/2)+45°\}$ (n=0, 1, 2, 3) respectively provided that the central axis is the planar center. The embodiment shown in FIG. 69A is illustrative of a case of n=0 in which the central angle is 45°.

The entire circumference of the workpiece 10 can be inspected owing to the two video cameras 5204, 5206 arranged as described above, in combination with the rotation of the workpiece-holding unit 5164 by 90°. FIGS. 69A and 69B especially illustrate, in a simplified manner, the arrangement of the revolving table 5218 of the workpiece-holding unit 5164.

Figure 70B:
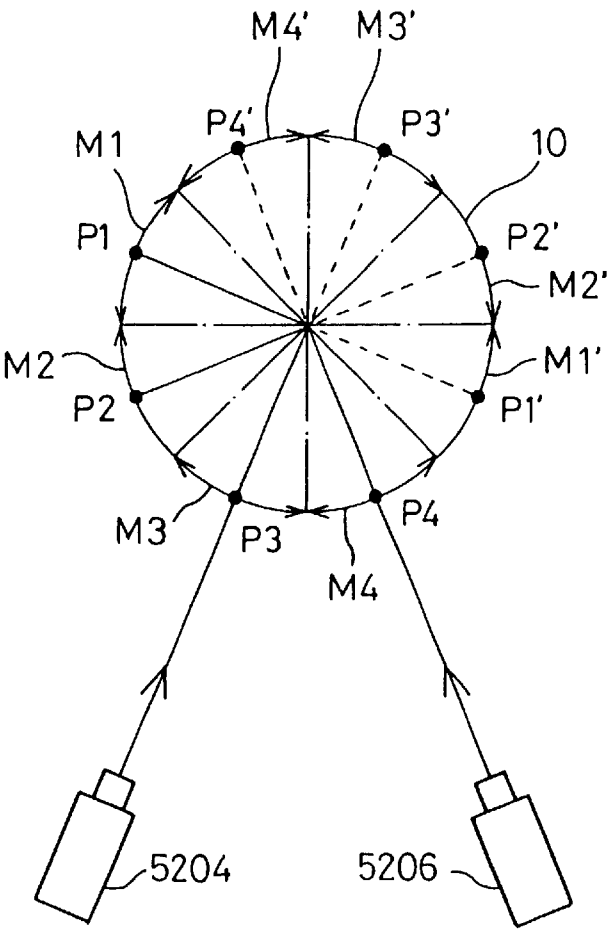
FIG. 70B illustrates an image pickup range for the workpiece when the workpiece-holding unit is revolved (swung) by 90°.
Figure 70A:
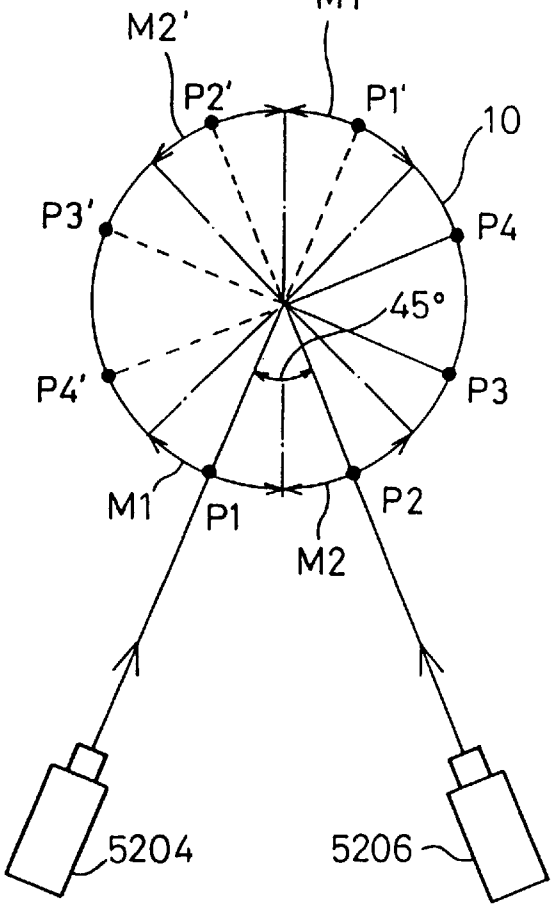
FIG. 70A illustrates an image pickup range for the workpiece when the workpiece-holding unit is in the initial state.

The arrangement described above will be specifically explained with reference to FIGS. 70A and 70B. In the initial state shown in FIG. 70A, the workpiece 10 is photographed over a range of 90° concerning planes (a plane M1 having a center of P1 and a plane M2 having a center of P2) opposing to the two video cameras 5204, 5206. Subsequently, the respective focal lengths of the two video cameras 5204, 5206 are adjusted so that the workpiece 10 is photographed over a range (range of a plane M1' having a center of P1' and a plane M2' having a center of P2') of point symmetry with respect to the range of 90° described above.

Subsequently, the actuator 5220 (see FIG. 69A) is operated to rotate the revolving table 5218 by 90° about the center of the hollow shaft, in accordance with which the workpiece 10 is also rotated by 90° about the center of its axis. As a result, as shown in FIG. 70B, the planes, which are opposed to the two video cameras 5204, 5206 concerning the workpiece 10 (the plane M1 having the center P1 and the plane M2 having the center P2), are moved by rotation by 90°. Thus, new planes (a plane M3 having a center P3 and a plane M4 having a center P4) appear in front of the two video cameras 5204, 5206.

The workpiece 10 is photographed over a range of 90° concerning the new planes (the plane M3 having the center P3 and the plane M4 having the center P4) opposing to the two video cameras 5204, 5206, in the same manner as described above. Subsequently, the respective focal lengths of the two video cameras 5204, 5206 are adjusted so that the workpiece 10 is photographed over a range (range of 90° concerning a plane M3' having a center of P3' and a plane M4' having a center of P4') of point symmetry with respect to the new range of 90° described above.

In other words, it is possible in the appearance inspection system 5000 to inspect the appearance over the entire circumference of the workpiece 10 by using the two video cameras 5204, 5206. In the foregoing explanation, the range of point symmetry is photographed by adjusting the respective focal lengths of the two video cameras 5204, 5206. However, it is also possible to photograph the range of point symmetry without adjusting the focal length depending on the setting of the camera (for example, the lens focal length and the diaphragm).

The actuators 5220 (comprising, for example, air cylinders as the driving sources) for revolving (swinging) the revolving table 5218 of the workpiece-holding unit 5164 by 90° are provided at the places corresponding to the first to fourth appearance inspection stations 5174A to 5174D over the table 5160. For example, the actuator 5220 is installed at the place corresponding to each of the appearance inspection stations 5174A and 5174C having an odd number so that the revolving table 5218 is rotated, for example, clockwise. The actuator 5220 is installed at the place corresponding to each of the appearance inspection stations 5174B and 5174D having an even number so that the revolving table 5218 is rotated, for example, counterclockwise.

That is, in one appearance inspection station, the rotation (swinging) of the workpiece-holding unit 5164 by 90° is performed only once, and the workpiece-holding unit 5164 is not restored to the original state. In the next appearance inspection station, the workpiece-holding unit 5164 is rotated (swung) by 90° in the opposite direction. Thus, it is possible to perform the inspection for the entire circumference of the workpiece 10 in the respective first to fourth appearance inspection stations 5174A to 5174D.

As shown in FIG. 71, the tesla inspection station 5170 comprises a vertical movement mechanism 5272 (see FIG. 61) for vertically moving a stand 5270 for placing one workpiece 10 thereon to be subjected to the tesla inspection, of the workpieces 10 during the transport process effected by the supply-side linear transport mechanism 5116, a tesla coil 5274 for applying a high voltage high frequency signal to the workpiece 10 placed on the stand 5270 moved upwardly by the vertical movement mechanism 5272, and three video cameras (first to third video cameras 5276A to 5276C) for photographing, in three directions, the workpiece 10 applied with the high voltage high frequency signal by the tesla coil 5274.

In the tesla inspection station 5170, the high voltage high frequency signal is applied from the tesla coil 5274 to the workpiece 10 to cause electric discharge so that the light emission generated by the workpiece 10 is inspected during this process. The stand 5270, which is moved vertically upwardly and downwardly by the vertical movement mechanism 5274, is electrically insulated from the main machine body (the vertical movement mechanism) so that no noise is superimposed on other signal transmission systems for the appearance inspection.

Figure 72:
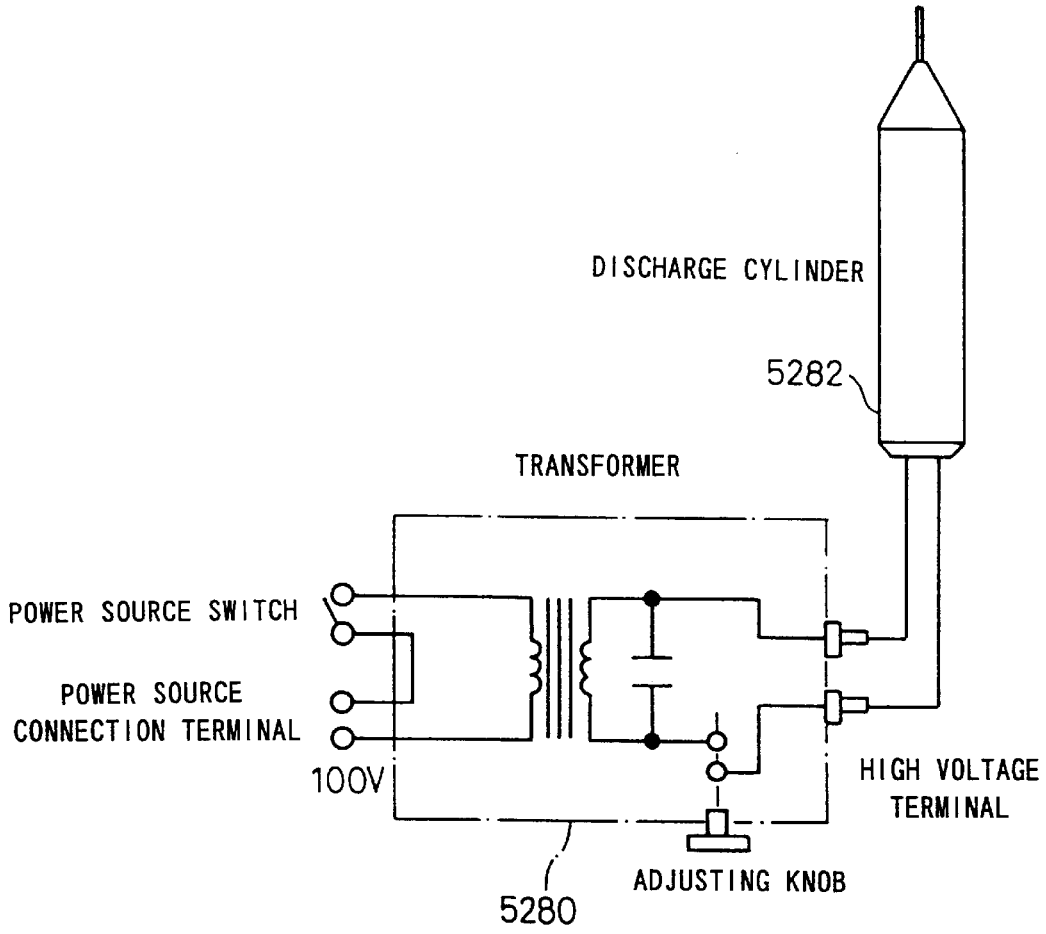
FIG. 72 shows a circuit for the tesla inspection to be ordinarily used.

The tesla coil 5274 is usually arranged as shown in FIG. 72. That is, the electric lamp line voltage (100 V) is raised by a transformer 5280. High frequency vibration is generated in the circuit by controlling the spark interval so that the high frequency voltage is generated by using a discharge cylinder (high frequency transformer) 5282. In such an arrangement, a problem arises in that the frequency is unstable because the high frequency is generated in accordance with the spark interval.

Figure 73:
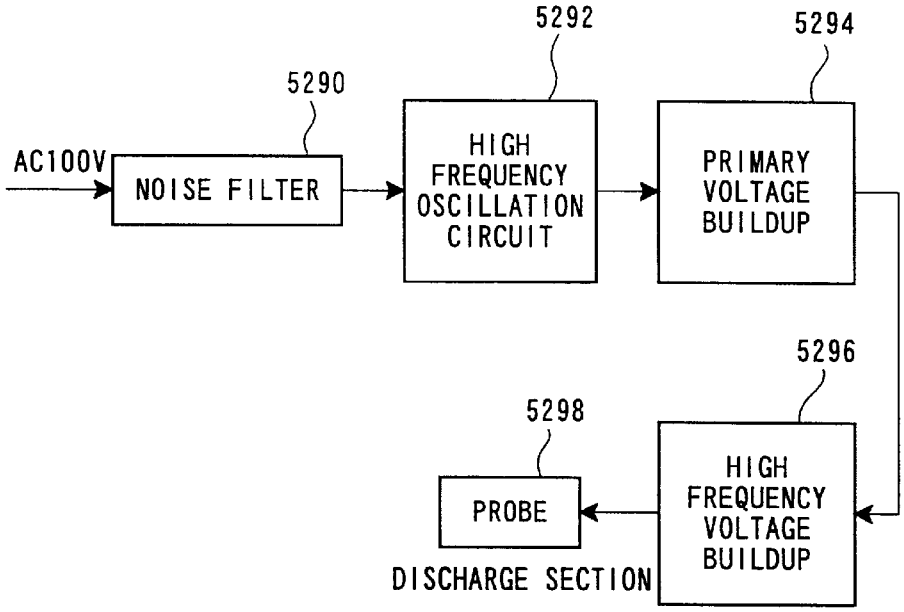
FIG. 73 shows a block diagram illustrating a circuit for the tesla inspection to be used in the tesla inspection station.

However, as shown in FIG. 73, the appearance inspection system 5000 is constructed as follows. That is, the electric lamp line voltage (100 V) is supplied to a high frequency oscillation circuit 5294 via a noise filter 5290. A signal, which is outputted from the high frequency oscillation circuit 5294, is subjected to voltage buildup by using a primary voltage buildup circuit 5294. The voltage is further raised by using a high frequency voltage buildup circuit 5296 disposed downstream so that a high voltage high frequency signal is applied to the workpiece 10 via a probe 5298. In this embodiment, the high frequency oscillation circuit 5294 is constructed by an electronic circuit. Therefore, an effect is obtained in that the frequency is stable as compared with the tesla coil 5274 shown in FIG. 72.

Of the first to third video cameras 5276A to 5264C, the second video camera (color CCD camera) 5276B for inspecting the light of color development is installed with its image pickup plane disposed downward so that the workpiece 10 may be photographed just thereover. The first and third video cameras (both are black-and-white CCD cameras) 5276A, 5276C for inspecting the discharge route of light emission are installed so that each of their optical axes is at an angle of 45° with respect to the optical axis of the second video camera 5276B.

Figure 74:
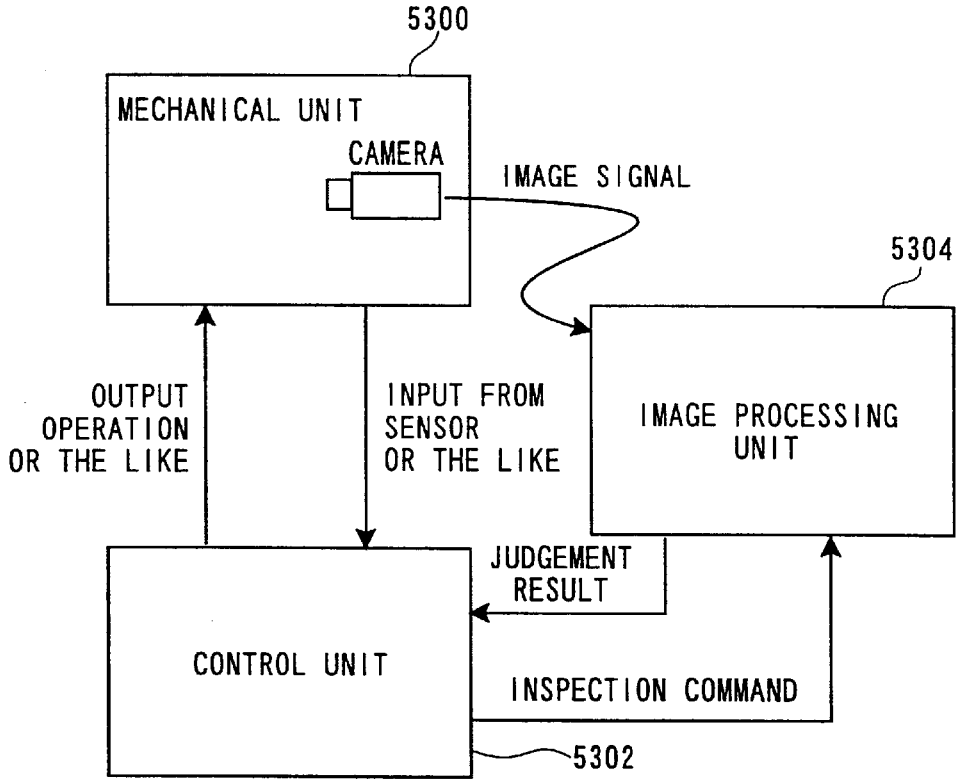
FIG. 74 shows a block diagram illustrating a control system of the appearance inspection system according to the embodiment of the present invention.

As shown in FIG. 74, the control system of the appearance inspection system 5000 comprises a mechanical unit 5300 (including the video cameras) constructed by the group of various mechanisms, a control unit 5302 for controlling the various mechanisms included in the mechanical unit 5300, and an image processing unit 5304 for receiving image signals fed from the various video cameras included in the mechanical unit 5300 so that image processing is performed for the appearance inspection to make judgement.

The control unit 5302 outputs a signal to instruct an inspection command to the image processing unit 5304. The control unit 5302 outputs control signals, for example, to operate the various mechanisms included in the mechanical unit 5300, on the basis of the input of signals from sensors or the like from the mechanical unit 5300 and the input of a signal indicating a result of judgement supplied from the image processing unit 5304.

The appearance inspection system 5000 is basically constructed as described above. Next, an example of the use of the appearance inspection system 5000 will be explained with reference to a block diagram depicting steps shown in FIG. 75 as well.

At first, as shown in FIG. 61, for example, an inspection start switch (not shown) of a control console (not shown) connected to the control unit 5302 is operated, and a start instruction for the appearance inspection is inputted into the control unit 5302. Accordingly, the control unit 5302 outputs a start signal Sa to the supply-side tray changer mechanism 5114. The supply-side tray changer mechanism 5114 separates, one by one, a large number of trays 3070 (trays in which a large number of workpieces 10 are accommodated before the appearance inspection) accommodated in the tray-receiving unit 5110, on the basis of the input of the start signal Sa so that the trays 5112 are positioned in the supply unit 5112 (step S1 in FIG. 75).

When a positioning completion signal is outputted from the sensor installed in the supply unit 5112, and the signal is inputted into the control unit 5302, then the control unit 5302 outputs a start signal Sb to the workpiece supply mechanism 5118. The workpiece supply mechanism 5118 takes a plurality of (for example, eight of) workpieces 10 at once out of one tray 3070 positioned in the supply unit 5112, on the basis of the input of the start signal Sb to introduce the workpieces 10 into the supply-side linear transport mechanism 5116 (step S2 in FIG. 75).

When an introduction completion signal is outputted from the sensor installed in the workpiece supply mechanism 5118, and the signal is inputted into the control unit 5302, then the control unit 5302 outputs a start signal Sc to the supply-side linear transport mechanism 5116. The supply-side linear transport mechanism 5116 successively transports, in the first direction, the plurality of workpieces 10 introduced by the workpiece supply mechanism 5118 while being placed laterally respectively (step S3 in FIG. 75), on the basis of the input of the start signal Sc. That is, the plurality of workpieces 10 are successively transported to the rotary transport unit 5102.

Figure 75:
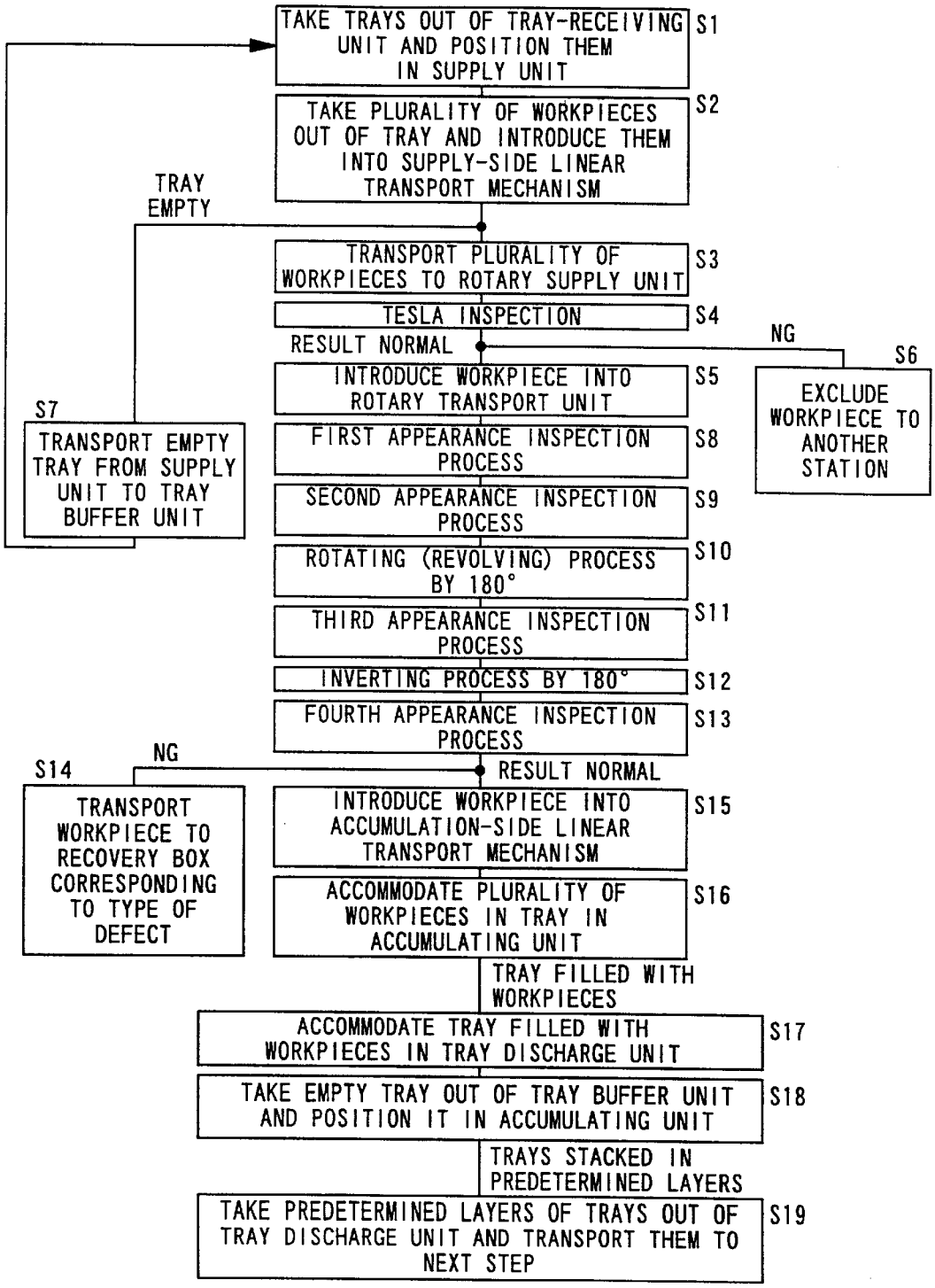
FIG. 75 shows a block diagram depicting steps of an appearance inspection method according to the embodiment of the present invention.

The tesla inspection is performed for the workpiece 10, for example, at the stage at which the first workpiece 10 arrives at the tesla inspection station 5170 installed at the halfway of the supply-side linear transport mechanism 5116 (step S4 in FIG. 75).

Specifically, a detection signal for the workpiece 10 is outputted from the sensor installed in the tesla inspection station 5170, and the signal is inputted into the control unit 5302. The control unit 5302 outputs a temporary stop signal S1 to the supply-side linear transport mechanism 5116, on the basis of the input of the detection signal, and it simultaneously outputs a start signal Sd to the vertical movement mechanism 5272. The supply-side linear transport mechanism 5116 temporarily stops the successive transport of the workpieces 10 on the basis of the input of the temporary stop signal S1.

On the other hand, the vertical movement mechanism 5272 moves upwardly the predetermined stand 5270 (see FIG. 71) in the tesla inspection station 5170 on the basis of the input of the start signal Sd so that the workpiece 10 placed on the stand 5170 is positioned at a prescribed tesla inspection point. A detection signal, which indicates the fact that the workpiece 10 is positioned at the tesla inspection point, is outputted from the sensor installed in the tesla inspection station 5170, and the signal is inputted into the control unit 5302. Accordingly, the control unit 5302 supplies the power source voltage to the tesla coil 5274.

Accordingly, the tesla inspection is carried out for the workpiece 10. The discharge route of the workpiece 10 is photographed by the first and third video cameras 5276A, 5276C. The color of light emission of the workpiece 10 is photographed by the second video camera 5276B. The image pickup signals Sv1 to Sv3 obtained thereby are inputted into the image processing unit 5304. The inputted image pickup signals Sv1 to Sv3 are subjected to image processing performed by the image processing unit 5304 to extract color components and vector components of the discharge route which are necessary for the tesla inspection to be compared with those of prescribed ranges so that the judgement is made. The result of judgement SC is inputted into the control unit 5302.

At this time, the image processing unit 5304 simultaneously performs processing such that the image pickup signals Sv1 to Sv3 are converted into picture signals to be outputted to a monitor (not shown) so that they are displayed as reproduced images on the monitor.

The control unit 5302 stops the supply of the power source voltage to the tesla coil 5274 at the point of time at which the judgement result SC is inputted from the image processing unit 5304. Simultaneously, the control unit 5302 outputs a restoration signal to the vertical movement mechanism 5274. The vertical movement mechanism 5272 moves the stand 5270 downwardly to restore it to the original position on the basis of the input of the restoration signal.

When a detection signal, which indicates the fact that the stand 5270 is restored, is outputted from the sensor installed in the tesla inspection station 5170, and the signal is inputted into the control unit 5302, then the control unit 5302 outputs a transport restart signal S2 to the supply-side linear transport mechanism 5116. The supply-side linear transport mechanism 1556 restarts the successive transport of the workpieces 10 on the basis of the input of the transport restart signal S2 so that the plurality of workpieces 10 are transported in the direction to the rotary transport unit 5102. When the second workpiece 10 arrives at the stand 5270, the processing is performed again in the same manner as described above so that the tesla inspection is carried out for the second workpiece 10.

During the period in which the tesla inspection is carried out for the second workpiece 10, for example, the first workpiece 10 is subjected to the introducing process into the rotary transport unit 5102 (step S5 in FIG. 75) or the excluding process to another step (step S6 in FIG. 75). That is, if the inputted judgement result SC of the tesla inspection carried out for the first workpiece 10 indicates "adequate", the control unit 5302 outputs a start signal Se to the workpiece-introducing unit 5120 as shown in FIG. 62. If the judgement result SC indicates "defective", the control unit 5302 outputs a start signal Sf to the first excluding mechanism 5190.

When the start signal Sf is inputted into the first excluding mechanism 5190, the first workpiece 10 is taken out of the supply-side linear transport mechanism 5116. The first workpiece 10 is excluded from the transport passage operated by the supply-side linear transport mechanism 5116.

On the other hand, when the start signal Se is introduced into the workpiece-introducing mechanism 5120, the workpiece-introducing mechanism 5120 starts operation at the point of time at which a detection signal from the sensor installed in the workpiece-holding station 5200 (the detection signal indicating the fact that one of the workpiece-holding units 5164 arranged on the table 5160 is positioned at the workpiece-holding station 5200) is inputted, in addition to the input of the start signal Se from the control unit 5302. The first workpiece 10 is taken out of the supply-side linear transport mechanism 5116, and the first workpiece 10 is introduced into the workpiece-holding unit 5164 positioned in the workpiece-holding station 5200.

The detection signal from the sensor is also inputted into the control unit 5302. The control unit 5302 inputs a driving signal Sd1 to the air cylinder 5260 installed under the workpiece-holding station 5200, on the basis of the input of the detection signal. The air cylinder 5260 drives and moves the piston rod 5262 upwardly on the basis of the input of the driving signal Sd1 (see FIG. 66). Accordingly, the pair of chuck pawls 5250*a*, 5250*b* of the workpiece-holding unit 5164 are opened.

In this state, the first workpiece 10 is introduced into the workpiece-holding unit 5164 by the aid of the workpiece-introducing mechanism 5120. The workpiece 10 is inserted into the space between the pair of chuck pawls 5250*a*, 5150*b* which are in the open state. In this case, the workpiece 10 is inserted so that the cathode-side lead 22 (see FIG. 1) is disposed upward. An ON signal is outputted, for example, from a proximity switch at the point of time at which the forward end of the anode-side lead 18 abuts against the height fiducial plate 5258 (see FIG. 68), and the signal is inputted into the control unit 5302.

The control unit 5302 outputs a restoration signal Sd2 to the air cylinder 5260 on the basis of the input of the ON signal. The air cylinder 5260 moves the piston rod 5262 downwardly on the basis of the input of the restoration signal Sd2. Accordingly, the pair of chuck pawls 5250*a*, 5250*b* are moved in the closing direction. Thus, the workpiece 10 is held by the pair of chuck pawls 5250*a*, 5250*b*. In this state, as shown in FIG. 68, the portion of the workpiece 10, which is disposed above the upper ends of the pair of chuck pawls 5250*a*, 5250*b*, is subjected to the inspection. In the respective appearance inspection stations 5174A to 5174D, the two video cameras 5204, 5206 photograph the portion disposed above the upper ends 5310.

When the first workpiece 10 is held by the workpiece-holding unit 5164 positioned in the workpiece-holding station 5200 as described above, the control unit 5302 outputs a driving signal Sg to the rotary driving mechanism 5162 of the rotary transport unit 5102. The rotary driving mechanism 5162 rotates the table 5160 by the predetermined angle on the basis of the input of the driving signal Sg.

As a result of the rotation, a workpiece-holding unit 5164, which is next to the workpiece-holding unit 5164 that holds the first workpiece 10, is positioned in the workpiece-holding station 5200. The workpiece 10, which is judged to be "adequate" in the tesla inspection and which is not necessarily the second workpiece 10, is held by the next workpiece-holding unit 5164.

The repetition of the series of operations described above allows the workpieces 10 judged to be "adequate" in the tesla inspection to be held by the individual workpiece-holding units 5164 respectively. When the plurality of (for example, eight of) workpieces 10 are processed, a plurality of workpieces 10 are introduced again into the supply-side linear transport mechanism 5116 by the aid of the workpiece supply mechanism 5118 from the tray 3070 positioned in the supply unit 5112. Thus, the foregoing operations are repeatedly performed.

When all of the workpieces 10 having been accommodated in the tray 3070 positioned in the supply unit 5112 are processed, as shown in FIG. 61, the control unit 5302 outputs a start signal Sh to the tray transport mechanism 5136. The tray transport mechanism 5136 transports the empty tray 3070 positioned in the supply unit 5122 toward the accumulating unit 5134, on the basis of the input of the start signal Sh so that the tray 3070 is positioned in the tray buffer unit 5138 (step S7 in FIG. 75).

The control unit 5302 outputs the start signal Sa to the supply-side tray changer mechanism 5114 simultaneously with the output of the start signal Sh to the tray transport mechanism 5136. Accordingly, one tray 3070 is taken out of the group of trays accommodated in the tray-receiving unit 5110, and the tray 3070 is transported to the supply unit 5112, simultaneously with the transport process for the empty tray 3070 to the tray buffer unit 5138 (step S1 in FIG. 75). The process described above is carried out for the workpieces 10 accommodated in the tray 3070 positioned in the supply unit 5112.

On the other hand, as shown in FIG. 64, the workpiece 10, which is held by the workpiece-holding unit 5164 in the workpiece-holding station 5200, is transported to the first appearance inspection station 5174A in accordance with the intermittent rotation of the table 5160 in the first direction, and the workpiece 10 is subjected to the first appearance inspection (step S8 in FIG. 75).

At the point of time at which the workpiece 10 is transported to the first appearance inspection station 5174A, a detection signal is outputted from the sensor installed in the first appearance inspection station 5174A, and the signal is inputted into the control unit 5302. The control unit 5302 drives the two video cameras 5204, 5206 installed in the first appearance inspection station 5174A, on the basis of the input of the detection signal to pickup images of the cathode 14 and the portions therearound (the glass tube 12 and the cathode-side lead 22).

The image pickup signals Sv11, Sv12 thus obtained are inputted into the image processing unit 5304. The image processing unit 5304 image-processes the inputted image pickup signals Sv11, Sv12 to extract brightness components and color components which are necessary for the items to be inspected in the first appearance inspection station 5174A. Obtained results are compared with those in the prescribed ranges to judge whether the product is adequate or defective. The judgement result SC1 is inputted into the control unit 5302.

The workpiece 10, which is completed for the first appearance inspection process effected in the first appearance inspection station 5174A, is transported to the next second appearance inspection station 5174B in accordance with the rotation of the table 5160. The workpiece 10 is subjected to the second appearance inspection process (step S9 in FIG. 75) in the second appearance inspection station 5174B in the same manner as performed in the first appearance inspection station 5174A.

That is, the image processing unit 5304 image-processes the image pickup signals Sv21, Sv22 supplied from the two video cameras 5204, 5206 to extract brightness components and color components which are necessary for the items to be inspected in the second appearance inspection station 5174B. Obtained results are compared with those in the prescribed ranges to judge whether the product is adequate or defective. The judgement result SC2 is inputted into the control unit 5302.

The workpiece 10, which is completed for the second appearance inspection process effected in the second appearance inspection station 5174B, is transported to the next revolving station 5176 in accordance with the rotation of the table 5160, and the rotating (revolting) process by about 180° is performed (step S10 in FIG. 75).

When the workpiece-holding unit 5164 is transported to the revolving station 5176, and it is positioned therein, then the control unit 5302 firstly outputs a gripping command signal Si to the revolving mechanism 5192. The revolving mechanism 5192 grips the workpiece 10 held by the workpiece-holding unit 5164, on the basis of the input of the gripping command signal Si. After that, the control unit 5302 drives the air cylinder 5260 (see FIG. 71) in the same manner as in the workpiece-holding station 5200 so that the holding action on the workpiece 10 effected by the workpiece-holding unit 5164 is once canceled. Subsequently, the control unit 5302 outputs a revolving command signal Sj to the revolving mechanism 5192.

The revolving mechanism 5192 rotates the workpiece 10 in the gripped state by about 180° about its axis, on the basis of the input of the revolving command signal Sj. The air cylinder 5260 is restored on the basis of the input of a rotation completion signal so that the workpiece 10 is held by the pair of chuck pawls 5250*a*, 5250*b* again, and the gripping action on the workpiece 10 is canceled. The angle of revolution effected by the revolving mechanism 5192 for the workpiece 10 is 180°±(45°/2) in the appearance inspection system 5000.

After completion of the rotating (revolving) process by about 180° in the revolving station 5176, the workpiece 10 is transported to the next third appearance inspection station 5174C in accordance with the rotation of the table 5160. In the third appearance inspection station 5174C, the third appearance inspection process is performed in the same manner as in the first appearance inspection station 5174A described above (step S11 in FIG. 75).

That is, the image processing unit 5304 image-processes the image pickup signals Sv31, Sv32 supplied from the two video cameras 5204, 5206 to extract brightness components and color components which are necessary for the items to be inspected in the third appearance inspection station 5174C. Obtained results are compared with those in the prescribed ranges to judge whether the product is adequate or defective. The judgement result SC3 is inputted into the control unit 5302.

The inspection process performed in the third appearance inspection station 5174C will be described. For example, as shown in FIG. 70A, the workpiece 10 is firstly photographed for the ranges of those included in 90° of the planes opposing to the two video cameras 5204, 5206, and then the respective focal lengths of the two video cameras 5204, 5206 are adjusted so that the workpiece 10 is photographed for the ranges of those included in point symmetry of the ranges of 90° described above. In such a procedure, it is feared to cause a problem that a part of the point symmetry range may be hidden by the cathode 14 enclosed in the glass tube 12 of the workpiece 10, and such a part cannot be photographed. The inspection process is performed in the third appearance inspection station 5174C in order to solve such a problem.

In the revolving station 5176, the workpiece 10 is revolved by about 180°±(45°/2). Therefore, for example, the appearance inspection for the cathode 14 of the appearance inspection items to be performed in the third appearance inspection station 5174C makes it possible to simultaneously inspect the appearance of expanded portions on both sides (based on the ring-shaped cathode 14) as well, in addition to the position of point symmetry of the inspection point for the cathode 14 before the revolving operation. Thus, it is possible to inspect the appearance concerning the entire circumference of the cathode 14.

After completion of the third appearance inspection process in the third appearance inspection station 5174C, the workpiece 10 is transported to the next inverting station 5178 in accordance with the rotation of the table 5160, and workpiece 10 is subjected to the inverting process by 180° (step S12 in FIG. 75).

When the workpiece-holding unit 5164 is transported to the inverting station 1578, and it is positioned therein, then the control unit 5302 firstly outputs a gripping command signal Sk to the inverting mechanism 5194. The inverting mechanism 5194 grips the workpiece 10 held by the workpiece-holding unit 5164, on the basis of the input of the gripping command signal Sk. After that, the control unit 5302 drives the air cylinder 5260 in the same manner as in the workpiece-holding station 5200 described above so that the holding action on the workpiece 10 effected by the workpiece-holding unit 5164 is once canceled.

Subsequently, the control unit 5302 outputs an inverting command signal S1 to the inverting mechanism 5194. The inverting mechanism 5194 rotates the workpiece 10 in the held state by 180° about the center of the axis perpendicular to its axis, on the basis of the input of the inverting command signal S1. Subsequently, the workpiece 10 is inserted into the space between the pair of chuck pawls 5250*a*, 5250*b* of the workpiece-holding unit 5164 in the open state. During this process, the workpiece 10 is inserted into the space between the pair of chuck pawls 5250*a*, 5250*b*, with the cathode-side lead 22 being disposed downward.

The control unit 5302 restores the air cylinder 5260 so that the workpiece 10 is held again between the pair of chuck pawls 5250*a*, 5250*b*, on the basis of the input of the ON signal from the proximity switch indicating that the cathode-side lead 22 abuts against the height fiducial plate 5258 of the workpiece-holding unit 5164.

After completion of the inverting process by 180° in the inverting station 5178 as described above, the workpiece 10 is transported to the next fourth appearance inspection station 5174D in accordance with the rotation of the table 5160. In the fourth appearance inspection station 5174D, the fourth appearance inspection process is performed in the same manner as in the first appearance inspection station 5174A described above (step S13 in FIG. 75).

That is, the image processing unit 5304 image-processes the image pickup signals Sv41, Sv42 supplied from the two video cameras 5204, 5206 to extract brightness components and color components which are necessary for the items to be inspected in the fourth appearance inspection station 5174D. Obtained results are compared with those in the prescribed ranges to judge whether the product is adequate or defective. The judgement result SC4 is inputted into the control unit 5302.

After completion of the fourth appearance inspection process in the fourth appearance inspection station 5174D, the workpiece 10 is transported to the next second excluding station 5180 in accordance with the rotation of the table 5160. The control unit 5302 judges whether the workpiece 10 is adequate or defective according to the results of appearance inspection performed in the first to fourth appearance inspection stations 5174A to 5174D (the first to fourth judgement results SC1 to SC4). If it is judged that the workpiece 10 is "adequate", the control unit 5302 outputs a normal signal Sm to the second excluding station 5180.

On the other hand, if it is judged that the workpiece 10 is "defective", the control unit 5302 deduces the type of defect according to the first to fourth judgement results SC1 to SC4, and it outputs a defective signal Sn and code data indicating the type of defect to the second excluding station 5180. At this time, the control unit 5302 outputs a driving signal to the air cylinder 5260 installed under the second excluding station 5180 to cancel the holding action for the workpiece 10 effected by the workpiece-holding unit 5164.

When the defective signal Sn is inputted from the control unit 5302, the second excluding station 5180 operates the second excluding mechanism 5198 to exclude the workpiece 10 (step S14 in FIG. 75). The second excluding mechanism 5198 takes the workpiece 10 out of the workpiece-holding unit 5164, and it transports the workpiece 10 to any one of the recovery boxes 5196A to 5196D corresponding to the type of defect indicated by the code data Dc inputted from the control unit 5302 so that the workpiece 10 is accommodated therein. In this embodiment, the appearance inspection stations 5174A to 5174D correspond to the recovery boxes 5196A to 5196D by 1 to 1. However, it is allowable that the number of the inspection stations is larger than the number of the recovery boxes. In such a case, the classification into the recovery boxes may be controlled depending on the property of the defect.

On the contrary, when the normal signal Sm is inputted from the control unit 5302, then the second excluding station 5180 takes the transported workpiece 10 out of the workpiece-holding unit 5164, and it introduces the workpiece 10 into the accumulation-side linear transport mechanism 5130 (step S15 in FIG. 75).

That is, as shown in FIG. 63, the workpiece 10, which is acknowledged to be "adequate", is transported to the next workpiece-taking out station 5202 in the state of being held by the workpiece-holding unit 5164 in accordance with the rotation of the table 5160. When the workpiece-holding unit 5164 is transported to the workpiece-taking out station 5202, and it is positioned therein, then the control unit 5302 outputs a start signal So to the workpiece-taking out mechanism 5132.

The workpiece-taking out mechanism 5132 firstly grips the workpiece 10 held by the workpiece-holding unit 5164, on the basis of the input of the start signal So. The air cylinder 5260, which is installed under the workpiece-taking out station 5202, is driven by the control unit 5302 so that the workpiece-holding action effected by the workpiece-holding unit 5164 is canceled. At this stage, the workpiece 10 is taken out of the workpiece-holding unit 5164, and it is introduced into the accumulation-side linear transport mechanism 5130.

When an introduction completion signal is outputted from the sensor installed in the workpiece-taking out mechanism 5132, and the signal is inputted into the control unit 5302, then the control unit 5302 outputs a start signal Sp to the accumulation-side linear transport mechanism 5130. The accumulation-side linear transport mechanism 5130 transports one workpiece 10 introduced by the workpiece-taking out mechanism 5132 in a state of being placed laterally, in an amount of one pitch toward the accumulating unit, on the basis of the input of the start signal Sp.

The successive repetition of the series of operations described above allows only the workpieces 10 acknowledged to be "adequate" to be successively introduced into the accumulation-side linear transport mechanism 5130.

At the stage at which a plurality of (for example, eight of) workpieces 10 are transported to the downstream portion of the accumulation-side linear transport mechanism 5130, the control unit 5302 outputs a start signal Sq to the workpiece-accumulating mechanism 5142. The workpiece-accumulating mechanism 5142 takes out at once the plurality of workpieces 10 transported to the downstream portion of the accumulation-side linear transport mechanism 5130, on the basis of the input of the start signal Sq. The workpieces 10 are transported to vacant places on the tray 3070 positioned in the accumulating unit 5134, and they are accommodated therein (step S16 in FIG. 75).

When a plurality of workpieces 10 are newly transported to the downstream portion again after the plurality of former workpieces 10 are accommodated in the tray 3070, then the plurality of newly transported workpieces 10 are transported to vacant places on the tray 3070, and they are accommodated therein, by the aid of the workpiece-accumulating mechanism 5142.

At the stage at which the tray 3070 positioned in the accumulating unit 5134 is filled with the workpieces 10, the control unit 5302 outputs a start signal Sr to the accumulation-side tray changer mechanism 5146. The accumulation-side tray changer mechanism 5146 transports the tray 3070 filled with the workpieces 10 from the accumulating unit 5134 to the tray discharge unit 5144, on the basis of the input of the start signal Sr. The transported tray 3070 is accommodated therein in the stacked state together with other groups of trays (step S17 in FIG. 75).

After that, the control unit 5302 outputs a start signal Ss to the tray-taking out mechanism 5140. The tray-taking out mechanism 5140 performs the processing on the basis of the input of the start signal Ss such that the backup tray 3070, which is positioned in the tray buffer unit 5138 at present, is transported to the accumulating unit 5134, and the tray 3070 is positioned in the accumulating unit 5134 (step S18 in FIG. 75).

At the stage at which the group of trays accommodated in the tray discharge unit 5144 are stacked in the predetermined number of layers, the control unit 5302 outputs a start signal St to the tray discharge mechanism 5148. The tray discharge mechanism 5148 takes a plurality of trays 3070 in the stacked state out of the tray discharge unit 5144 on the basis of the input of the start signal St, and the trays 3070 are transported to the next step (step S19 in FIG. 75).

The appearance inspection system 5000 makes it possible to realize the fully automatic production steps for the xenon discharge tube 10, especially the series of automatic steps for inspecting the appearance of the xenon discharge tube (workpiece) 10 before obtaining the final product. Thus, it is possible to achieve the improvement in production efficiency of the xenon discharge tube 10.

As described above, in the production method according to the embodiment of the present invention, the anode-side sealing jig 40 functions as the transport member for collectively transporting the large number of anode-side leads 18 (workpieces) to the next glass tube-inserting step S18, and as the transport member for collectively transporting the large number of primary sealed products 72 (workpieces) to the next assembling process S3. Further, the anode-side sealing jig 40 also functions as the support member for fusing the first ends 12*a* of the glass tubes 12 corresponding to the large number of anode-side leads 18 respectively.

Similarly, the cathode-side sealing jig 42 functions as the transport member for collectively transporting the large number of cathode members 74 (workpieces) to the secondary sealing step S32 in the assembling process S3, and as the support member for fusing the second ends 12*b* of the glass tubes 12 corresponding to the large number of cathode members 74 respectively.

That is, all of the transport of the workpieces (the large number of anode-side leads 18 and the large number of primary sealed products 72) in the anode-side assembling process S1 can be carried out by using the anode-side sealing jig 40. All of the transport of the workpieces (the large number of cathode-side leads 22 and the large number of cathode members 74) in the cathode-side assembling process S2 can be carried out by using the cathode-side sealing jig 42. Therefore, the workpieces are sufficiently delivered to the respective steps of the production steps for the xenon discharge tubes 10 merely by moving the jigs (the anode-side sealing jig 40 and the cathode-side sealing jig 42). Thus, it is possible to simplify the working operation performed by the operator.

The glass tube 12 is fused to the respective leads 18, 22 by applying the electric power to heat the anode-side sealing jig 40 and the cathode-side sealing jig 42. Therefore, it is possible to establish the equipment which can be commonly used for the primary sealing and the secondary sealing. Accordingly, it is possible to improve the production efficiency and the operating efficiency of the production equipment.

As a result, in the method for producing the xenon discharge tube according to the embodiment of the present invention, the operations for transporting the various workpieces and the glass-fusing operations can be consistently carried out by the aid of the jigs. Therefore, it is possible to realize the fully automatic production line, and it is possible to achieve the improvement in production efficiency of the xenon discharge tube 10.

In the production method according to the embodiment of the present invention, the glass bead 70 is inserted into the anode-side lead 18 after the anode-side shooting step S11 so that the glass bead 70 is fused to the electrode bar 20. Therefore, when the first end 12*a* of the glass tube 12 is fused to the anode-side lead 18 in the following primary sealing step S14, the glass bead 70 intervenes therebetween. As a result, the first end 12*a* of the glass tube 12 is fused to the anode-side lead 18 rapidly and reliably.

In the cathode-side shooting step S21, the glass bead 70 is attached to the cathode-side lead 22 before the cathode 14 is fixed by caulking to the cathode-side lead 22. Therefore, when the second end 12*b* of the glass tube 12 is fused to the cathode-side lead 22 in the following secondary sealing step S32, the glass bead 70 intervenes therebetween. As a result, the second end 12*b* of the glass tube 12 is fused to the cathode-side lead 22 rapidly and reliably.

In the production method according to the embodiment of the present invention, the glass bead 70 is thermally fused to the electrode bar 20 after the glass bead 70 is inserted into the anode-side lead 18 so that the glass bead 70 is temporarily fastened to the anode-side lead 18. Therefore, the glass bead 70 is effectively prevented from unexpected falling, and the glass bead 70 is effectively prevented from disengagement from the anode-side lead 18. Thus, it is possible to improve the reliability of the xenon discharge tube 10 based on the use of the glass bead 70.

In the production method according to the embodiment of the present invention, the cleaning process is carried out at the initial stage of the secondary sealing step S32. Therefore, the finished xenon discharge tube 10 hardly contains unnecessary impurities in the glass tube 12. Accordingly, it is possible to obtain the xenon discharge tube 10 having high brightness and high quality. Further, the electric power is applied under the negative pressure atmosphere to heat the cathode-side sealing jig 42. Accordingly, the heat divergence distribution from the cathode-side sealing jig 42 is substantially uniform for the large number of primary sealed products set in the cathode-side sealing jig 42. Therefore, it is possible to decrease the dispersion which would be otherwise caused for the unit of discharge tube concerning the glass fusion. Thus, it is possible to efficiently realize the improvement in yield of the xenon discharge tube 10.

In the next cooling step S303, the xenon discharge tube 10 is cooled in the negative pressure atmosphere. Therefore, almost all of the dispersion concerning the degree of cooling for the large number of xenon discharge tubes 10 disappears. Thus, it is possible to effectively avoid any local excessive cooling state and any insufficient cooling state. This results in achievement of high quality and high reliability of the xenon discharge tube 10.

Figure 76:
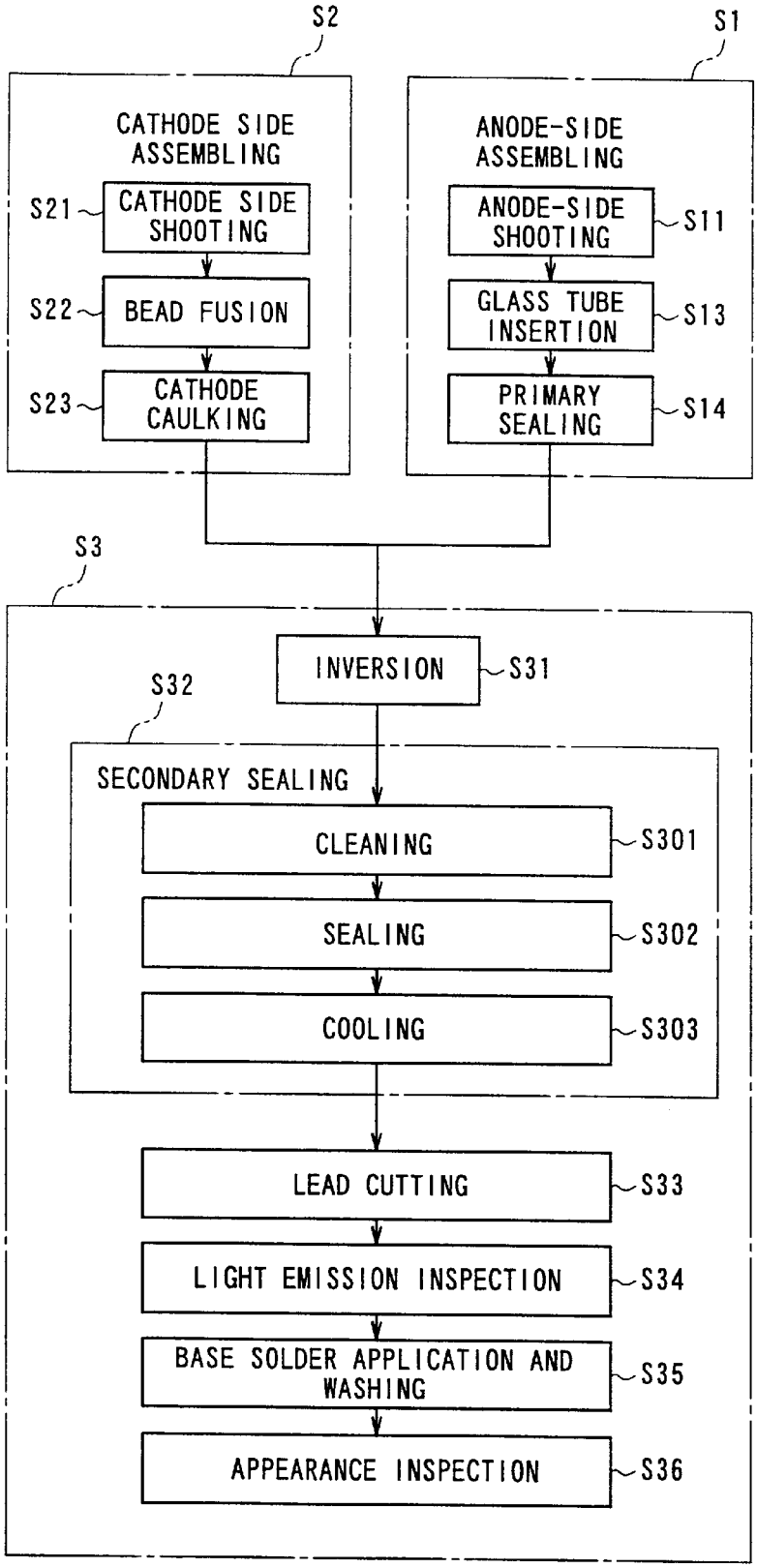
FIG. 76 shows a block diagram depicting steps of a modified embodiment of the method for producing the xenon discharge tube according to the embodiment of the present invention.

Next, a modified embodiment of the production method according to the embodiment of the present invention will be explained with reference to FIG. 76.

The production method according to the modified embodiment includes approximately the same steps as those of the production method according to the foregoing embodiment. However, as shown in FIG. 76, the former is different from the latter in that the bead-fusing step S12 in the anode-side assembling process S1 is omitted, based on the following reason. That is, the first end 12*a* of the glass tube 12 is sealed to the electrode bar 20 of the anode-side lead 18 before entering the inverting step S31 in the assembling process S3. Therefore, it is not necessarily indispensable that the glass bead 70 inserted into the electrode bar 20 is thermally sealed to the electrode bar 20 before the glass tube-inserting step S13.

The embodiments described above (including the modified embodiment) are illustrative of the example in which the method for producing the xenon discharge tube according to the present invention is applied to the sealing processing step for the glass tube 12 of the xenon discharge tube 10. Besides, the present invention is also applicable to production steps for various products which are constructed by sealing the glass tube.

It is a matter of course that the present invention is not limited to the embodiments described above, which may be embodied in other various forms without deviating from the gist or essential characteristics of the present invention.

As explained above, the method for producing the xenon discharge tube according to the present invention comprises an anode-side shooting step of inserting a large number of anode-side leads into a large number of holes of an anode-side jig provided with the large number of holes respectively, an anode-side glass tube-inserting step of inserting first ends of the large number of glass tubes into the anode-side jig so that anodes of the corresponding anode-side leads are respectively surrounded thereby, a primary sealing step of producing primary sealed products by applying electric power to heat the anode-side jig so that the large number of glass tubes are fused to the corresponding anode-side leads respectively, a cathode-side shooting step of inserting a large number of cathode-side leads into a large number of holes of a cathode-side jig provided with the large number of holes respectively, a cathode-side glass tube-inserting step of inserting second ends of the glass tubes of the primary sealed products into the cathode-side jig so that cathodes of the corresponding cathode-side leads are respectively surrounded thereby, and a secondary sealing step of applying electric power to heat the cathode-side jig in a xenon gas atmosphere so that the glass tubes of the primary sealed products are fused to the corresponding cathode-side leads respectively.

Accordingly, the following effect is obtained. That is, it is possible to realize the fully automatic production steps for the xenon discharge tube, and it is possible to achieve the improvement in production efficiency of the xenon discharge tube.

What is claimed is:

1. A method for producing a flash discharge tube comprising a trigger electrode composed of a transparent conductive film formed on a surface of a light-transmissive sealed tube, said method comprising the steps of:

coating said surface of said light-transmissive sealed tube in accordance with an immersion method with a solution of an organic metal compound containing a major component metal of indium or tin as a transparent conductive material;

drying said surface followed by allowing hot air to blow against only a portion for forming said transparent conductive film, of a coating layer of said transparent conductive material to perform local calcination by oxidizing indium or tin contained in said transparent conductive material; and then removing a non-calcinated portion of said transparent conductive material by means of etching with an acidic solution to form said transparent conductive film in a band-shaped configuration on said surface of said light-transmissive sealed tube.

2. The method for producing said flash discharge tube according to claim 1, wherein at least one of film-forming positions for said transparent conductive film is decided when said light-transmissive sealed tube is immersed.

3. The method for producing said flash discharge tube according to claim 1, further comprising:

an anode-side shooting step of inserting a large number of anode-side leads into a large number of holes of an anode-side jig provided with said large number of holes respectively;

an anode-side glass tube-inserting step of inserting first ends of said large number of glass tubes into said anode-side jig so that anodes of said corresponding anode-side leads are respectively surrounded thereby;

a primary sealing step of producing primary sealed products by applying electric power to heat said anode-side jig so that said large number of glass tubes are fused to said corresponding anode-side leads respectively;

a cathode-side shooting step of inserting a large number of cathode-side leads into a large number of holes of a cathode-side jig provided with said large number of holes respectively;

a cathode-side glass tube-inserting step of inserting second ends of said glass tubes of said primary sealed products into said cathode-side jig so that cathodes of said corresponding cathode-side leads are respectively surrounded thereby; and a secondary sealing step of applying electric power to heat said cathode-side jig in a xenon gas atmosphere so that said glass tubes of said primary sealed products are fused to said corresponding cathode-side leads respectively.

4. The method for producing said flash discharge tube according to claim 3, further comprising a lead-cutting step of cutting said anode-side lead and said cathode-side lead of a secondary sealed product discharged from said secondary sealing step, to have predetermined lengths respectively.

5. The method for producing said flash discharge tube according to claim 3, wherein said anode-side jig to be used is a jig in which a large number of recesses, which are capable of inserting said first ends of said glass tubes thereinto, are formed through a first principal surface thereof, and anode-side lead insertion holes, which penetrate up to a second principal surface of said anode-side jig and which are capable of inserting said anode-side leads thereinto, are provided through central portions of bottoms of said respective recesses.

6. The method for producing said flash discharge tube according to claim 3, wherein said cathode-side jig to be used is a jig in which a large number of recesses, which are capable of inserting said second ends of said glass tubes thereinto, are formed through a first principal surface thereof, and cathode-side lead insertion holes, which penetrate up to a second principal surface of said cathode-side jig and which are capable of inserting said cathode-side leads thereinto, are provided through central portions of bottoms of said respective recesses.

7. The method for producing said flash discharge tube according to claim 3, wherein said anode-side shooting step includes insertion of a glass bead into said anode-side lead.

8. The method for producing said flash discharge tube according to claim 3, wherein a glass bead is attached to said cathode-side lead to be inserted into said cathode-side jig in said cathode-side shooting step, before being inserted.

9. The method for producing said flash discharge tube according to claim 7, further comprising a bead-applying step of applying electric power to head said anode-side jig so that said glass bead is fused to said anode-side lead.

10. The method for producing said flash discharge tube according to claim 3, further comprising a cathode-caulking step of inserting said cathode into a forward end portion of said cathode-side lead so that said cathode is fixed by caulking.

11. The method for producing said flash discharge tube according to claim 10, wherein said cathode-caulking step is carried out to fix, by caulking, said cathode to said forward end portion of said cathode-side lead in which a glass bead is previously attached to said forward end portion.

12. The method for producing said flash discharge tube according to claim 3, wherein said secondary sealing step comprises:

a cleaning step of removing impurities from at least the inside of said glass tube by means of exposure to a negative pressure atmosphere prior to said application of electric power to heat said cathode-side jig;

a sealing step of applying electric power to heat said cathode-side jig in a negative pressure atmosphere and in a xenon gas atmosphere; and a cooling step of cooling at least said cathode-side jig in a negative pressure atmosphere.

* * * * *